US007891307B2

(12) United States Patent
Sakuma et al.

(10) Patent No.: US 7,891,307 B2
(45) Date of Patent: Feb. 22, 2011

(54) METHOD AND SEWING MACHINE FOR FORMING SINGLE-THREAD LOCKED HANDSTITCHES

(75) Inventors: Kouichi Sakuma, Yamagata (JP); Tohru Sakuma, Yamagata (JP)

(73) Assignee: Suzuki Manufacturing, Ltd. (JP)

( * ) Notice: Subject to any disclaimer, the term of this patent is extended or adjusted under 35 U.S.C. 154(b) by 450 days.

(21) Appl. No.: 12/087,795

(22) PCT Filed: Jan. 31, 2007

(86) PCT No.: PCT/JP2007/000044

§ 371 (c)(1),
(2), (4) Date: Jul. 15, 2008

(87) PCT Pub. No.: WO2007/088708

PCT Pub. Date: Aug. 9, 2007

(65) Prior Publication Data

US 2009/0007830 A1 Jan. 8, 2009

(30) Foreign Application Priority Data

Feb. 3, 2006 (JP) ..... 2006-026678
Dec. 28, 2006 (JP) ..... 2006-356152

(51) Int. Cl.
*D05B 57/14* (2006.01)
*D05B 57/02* (2006.01)
*D05B 93/00* (2006.01)

(52) U.S. Cl. ..... 112/475.17; 112/189; 112/197

(58) Field of Classification Search ..... 112/475.17, 112/181–185, 189–201
See application file for complete search history.

(56) References Cited

U.S. PATENT DOCUMENTS

| | | | | |
|---|---|---|---|---|
| 3,224,399 | A * | 12/1965 | Lightner et al. | 112/410 |
| 3,447,498 | A * | 6/1969 | Yasukata | 112/197 |
| 4,366,765 | A * | 1/1983 | Hoekstra | 112/429 |
| 4,580,514 | A * | 4/1986 | Hanyu et al. | 112/162 |
| 4,590,878 | A | 5/1986 | Conti | 112/266 |
| 5,881,658 | A * | 3/1999 | Nozaki et al. | 112/192 |
| 2010/0199899 | A1 * | 8/2010 | Sakuma et al. | 112/170 |

FOREIGN PATENT DOCUMENTS

| | | |
|---|---|---|
| DE | 603983 | 10/1934 |
| GB | 959688 A | 5/1961 |
| JP | 41-21544 | 12/1966 |
| JP | 55-99473 | 7/1980 |
| JP | 55-35481 | 9/1980 |
| JP | 4-3234 | 1/1992 |
| JP | 2687950 | 12/1997 |
| JP | 11-047472 | 2/1999 |

* cited by examiner

*Primary Examiner*—Ismael Izaguirre
(74) *Attorney, Agent, or Firm*—Bacon & Thomas PLLC

(57) ABSTRACT

A sewing thread (20) can be captured certainly with a thread capturing open eye (13*a*) of an open eye needle (13) and the stitches are formed in the inner space of a sewing machine bed (3). A handstitch and a locked stitch are formed, respectively, on the front surface and the back surface of a fabric workpiece (21) as a skip stitch set through cooperation of the open eye needle (13), a shuttle hook (200) and a thread draw out actuator (401). A feed dog (601) feeds the fabric workpiece by a stitch length (P1) for handstitch during a first stroke of the open eye needle (13), and feeds the fabric workpiece by an inter-stitch pitch (P2) between the handstitches during a second stroke of the open eye needle (13).

28 Claims, 87 Drawing Sheets

(A)

(B)

METHOD AND SEWING MACHINE FOR FORMING SINGLE-THREAD LOCKED HANDSTITCHES

FIELD OF THE ART

The present invention relates to a method and sewing machine for forming single-thread locked handstitches. Particularly, the present invention relates to the method and sewing machine for forming single-thread locked handstitches that a sewing thread is captured to a thread capturing open eye of a needle certainly, a formation of the stitch can be performed in an inner space of a sewing machine bed and it is suitable to a quasi-handstitch called pinpoint/saddle stitch.

BACKGROUND OF THE ART

The stitches which form the pinpoint stitch appearing and disappearing on one side of a fabric workpiece alternately by one sewing thread and project an atmosphere of the handstitch is standardized as ISO 4915 Stitch Type 104 (chain stitch) and ISO 4915 Stitch Type 209 (saddle stitch/handstitch) of the international standard.

Heretofore, a pinpoint stitch sewing machine which forms "104" stitch as the pinpoint stitch (quasi-handstitch) and prevents a cloth misalignment of such a pinpoint stitch sewing by using the sewing needle that one sewing thread which is pierced to the needle is pierced, an open eye needle that the thread capturing open eye is equipped laterally, a looper and a spreader is known (for example, refer to Patent document No. 1).

Because this pinpoint stitch sewing machine uses the sewing needle that one sewing thread is pierced and the open eye needle that the thread capturing open eye is equipped laterally, there is a disadvantage that a stitch length is limited to a distance between the sewing needle and the open eye needle. And, in this pinpoint stitch sewing machine, when sewing, a balloon stitch is formed on the upper side of the cloth. However, because the pinpoint stitch to be stitched intrinsically is formed in the lower side of the cloth, sewing work is forced to in the state that it cannot watch for a worker. Therefore, it is difficult to confirm the position of the pinpoint stitch and there is also a disadvantage that an exact sewing is not possible. Besides, in the "104" stitch of this pinpoint stitch sewing machine, because the stitch comes loose easily by pulling the sewing thread which forms the stitch, there is also a disadvantage that a function to prevent the above described cloth misalignment of such the pinpoint stitch sewing is lost.

In order to solve these disadvantages, the quasi-handstitch sewing machine which forms a quasi-pinpoint stitch similar to the "104" stitch by using the open eye needle that one thread capturing open eye is equipped laterally, a thread grapple hook, a guide spreader of the sewing thread to the thread capturing open eye and a thread take-up lever by one thread which is wound around a bobbin arranged in an inside of a rotary hook is proposed (for example, refer to Patent document No. 2).

Patent document No. 1: Toku-Kou-Shou 55-35481 (FIG. 5, FIG. 6, FIG. 7)

Patent document No. 2: Toku-Kou-Hei 4-3234 (=U.S. Pat. No. 4,590,878) (FIG. 11, FIG. 13, FIG. 14)

DISCLOSURE OF THE INVENTION

Problem to be Solved by the Invention

In this quasi-handstitch sewing machine, when sewing, the sewing thread which became double is formed like handstitch on the upper side of the cloth, and the locked stitch is formed in the lower side of the cloth. However, in this quasi-handstitch sewing machine, though the sewing thread guide spreader to the thread capturing open eye of the needle is necessary to be arranged between a throat plate which supports the cloth and the rotary hook, functionally, the thread take-up lever must be installed just beneath the throat plate and arranged between the throat plate and the rotary hook, and a drive mechanism to drive the sewing thread guide spreader must be arranged. Therefore, in the limited space of the inside of the machine bed, such arrangement was not able to be actualized concretely.

Besides, in this quasi-handstitch sewing machine, because the sewing thread which was guided into the inside of the rotary hook has to pull up the sewing thread which was guided out from the rotary hook to the upper direction of the cloth by the thread grapple hook, it is extremely dangerous that the worker takes his hand to such a position on the cloth, and there was a difficult point that an obstacle occurs in the sewing work which moves the cloth. Therefore, it is impossible to perform this quasi-handstitch sewing machine.

In addition, in making a quilt, a quilting or a patchwork, the sewing work is performed by hand since ancient times. This needs extremely great labor hour, and this is the work that hard labor is forced to. Therefore, by using the sewing machine which perform the sewing with a lockstitch (ISO 4915 Stitch Type 301) and using transparent thread for one of two threads which are used, the technique which projects the handstitch sewing at first glance is also adopted. However, in the stitch which was sewn by this technique, because the thread is sewn continuously by using lockstitch sewing machine basically, there is a difficult point that the atmosphere of original handstitch sewing by pursuing the softness accompanied by the convexo-concave which is produced on the surface of the fabric workpiece after sewing which is needed in the quilt, the quilting or the patchwork is not obtained.

This invention was conducted to solve these hitherto known difficult points. And this invention aims to provide the method and sewing machine for forming single-thread locked handstitches which are suitable to the quasi-handstitch which is called pinpoint/saddle stitch that the sewing thread is certainly captured to the thread capturing open eye of the needle, and that the formation of the stitch is performed in the inner space of the sewing machine bed.

And, this invention aims to provide the method and sewing machine for forming single-thread locked handstitches that the sewing thread is captured certainly to the thread capturing open eye of the needle, and the formation of the stitch is performed in the inner space of the sewing machine bed, and the stitch length and the inter-stitch pitch can be set freely.

Besides, this invention aims to provide the method and sewing machine for forming single-thread locked handstitches which are suitable to the quilt, the quilting or the patchwork by forming the handstitch on the front surface and the locked stitch on the back surface of the fabric workpiece as a skip stitch set, and by varying the feed direction, namely, the sewing direction of the fabric workpiece every one skip stitch set.

Means for Solving the Problems

The principle of this invention is to form the handstitch on the front surface and the locked stitch on the back surface of the fabric workpiece respectively by letting the open eye needle that the thread capturing open eye is equipped laterally and which performs the linear reciprocating motion vertically, the shuttle hook which performs the half-turn normal rotation and the half-turn reverse rotation, the thread draw out actuator which performs the reciprocating motion like the thread take-up lever, and the feed dog which performs the elliptical motion collaborate, and by capturing the sewing thread to the thread capturing open eye of the needle certainly, and by performing the formation of the stitch in the inside of the sewing machine bed. Besides, the principle of this invention is that the stitch length and the inter-stitch pitch can be set freely by letting the feed quantity of the fabric workpiece by the feed dog change depending on the stitch length feed and the inter-stitch pitch feed when forming the handstitch on the front surface and the locked stitch on the back surface of the fabric workpiece as the skip stitch set by cooperation of the open eye needle, the shuttle hook and the thread draw out actuator.

The method for forming single-thread locked handstitches of this invention in order to achieve this purpose comprises the steps of (a) capturing a thread which is drawn out from a thread exit of a shuttle hook positioned under a throat plate, winding the thread and performing a half-turn reverse rotation, and which abuts circumferentially on an open eye needle and is tightened by a thread capturing open eye when the open eye needle which equips the thread capturing open eye laterally and performs a linear reciprocating motion vertically comes down from an upper dead center, pierces a fabric workpiece which is placed on the throat plate, and goes up from a lower dead center during a first stroke, (b) feeding one stitch length of the fabric workpiece, and tightening a thread by a rise of the open eye needle which captures the thread, and by performing a further reverse rotation of the shuttle hook while the open eye needle slips out from the fabric workpiece, goes up, and passes through the upper dead center during the first stroke, (c) scooping the thread which is captured by the thread capturing open eye by a loop-taker point of the shuttle hook which performs the half-turn normal rotation, and releasing the captured thread by the rotation of the shuttle hook from the thread capturing open eye when the open eye needle comes down from the upper dead center, pierces said fabric workpiece, and goes up from the lower dead center during a second stroke, (d) guiding in the thread which is scooped by the loop-taker point of the shuttle hook and released by the further rotation of the shuttle hook into the shuttle hook, interlacing the thread to the thread which is wound in the shuttle hook, and tightening the thread which guides out from the shuttle hook, (e) feeding one inter-stitch pitch of the fabric workpiece while the open eye needle slips out from the fabric workpiece, goes up, and passes through the upper dead center during the second stroke, and (f) forming a handstitch on a front surface and a locked stitch on a back surface of the fabric workpiece by repeating the steps from (a) to (e).

In this method for forming single-thread locked handstitches, the shuttle hook incorporates a bobbin case which houses a bobbin that the thread is wound in an inner shuttle hook, the bobbin case is rotatably loaded together with the inner shuttle hook in an shuttle race body, and the thread exit is equipped in the bobbin case in the direction and the position which depart from the throat plate by reverse rotation of the shuttle hook when the open eye needle goes up from the throat plate.

In this method for forming single-thread locked handstitches, the shuttle hook stops the rotation when the open eye needle moves from the upper dead center to the lower dead center.

In this method for forming single-thread locked handstitches, the thread which is drawn out from the thread exit of the shuttle hook is hooked, and is tightened by being drawn out from the shuttle hook after the thread captured by the thread capturing open eye is scooped by the look-taker point of the shuttle hook, and the thread which is hooked is released after the thread is captured by the thread capturing open eye.

In this method for forming single-thread locked handstitches, the thread captured by the thread capturing open eye is shifted to the unopened direction of the thread capturing open eye between the tip of the open eye needle and the fabric workpiece when the open eye needle comes down from the upper dead center during the second stroke.

In this method for forming single-thread locked handstitches, the thread tightness quantity is adjusted depending on the stitch length when tightening the thread which guides out from the shuttle hook.

In this method for forming single-thread locked handstitches, before the open eye needle comes down from the upper dead center, pierces the fabric workpiece, goes up from the lower dead center and slips out from the fabric workpiece, a pressing force which performs the pressing force of the fabric workpiece on the throat plate is released, and a rotating operation by hand of the feed direction of the fabric workpiece is performed by making the open eye needle the rotating shaft.

In this method for forming single-thread locked handstitches, the thread which is scooped by the loop-taker point of the shuttle hook and released interlaces to the thread which is wound in the shuttle hook by guiding in the shuttle hook by the further rotation of the shuttle hook, and the thread which is guided in the shuttle hook is accumulated temporarily in the circumference of the shuttle hook after interlacing and before the thread which guides out from the shuttle hook is tightened, and the temporary accumulation is released by tightening the thread which guides out from the shuttle hook.

And, the method for forming single-thread locked handstitches of this invention in order to achieve this purpose comprises the steps of forming a handstitch on a front surface and a locked stitch on a back surface of a fabric workpiece as a skip stitch set by cooperation of an open eye needle, a shuttle hook and a thread draw out actuator, setting up a stitch length feed quantity of a stitch length feed and an inter-stitch pitch feed quantity of an inter-stitch pitch feed respectively, when the stitch length feed of the fabric workpiece for the handstitch is performed by a feed dog during a first stroke of the open eye needle, and the inter-stitch pitch feed of the fabric workpiece for the inter-handstitch is performed by the feed dog during a second stroke of the open eye needle, changing over to each fabric workpiece feed mode corresponding to the stitch length feed and the inter-stitch pitch feed respectively every one skip stitch set in sequence, transmitting the set stitch length feed quantity and inter-stitch pitch feed quantity to a feed drive mechanism in each fabric workpiece feed mode respectively, and feeding the fabric workpiece by the feed dog.

In this method for forming single-thread locked handstitches, a hand feed of the fabric workpiece is performed while giving the stitch length feed quantity and the inter-stitch pitch feed quantity arbitrarily by releasing a pressing force that the pressing force of the fabric workpiece is kept on the throat plate when the open eye needle is slipping out from the fabric workpiece.

In this method for forming single-thread locked handstitches, a hand feed of the fabric workpiece is performed while giving the stitch length feed quantity and the inter-stitch pitch feed quantity arbitrarily by evacuating the feed dog which feeds the fabric workpiece when the open eye needle is slipping out from the fabric workpiece.

Besides, the single-thread locked handstitch sewing machine of this invention in order to achieve this purpose comprises an open eye needle, which captures a thread when coming down from an upper dead center, piercing a fabric workpiece, and going up from a lower dead center during a first stroke of coming down from the upper dead center, piercing the fabric workpiece which is placed on a throat plate, slipping out from the fabric workpiece from the lower dead center, going up, and performing a linear reciprocating motion vertically, and equips laterally a thread capturing open eye which releases the captured thread when coming down from an upper dead center, piercing a fabric workpiece, and going up from a lower dead center during a second stroke, a shuttle hook, which is a shuttle hook positioned in a lower direction of the throat plate, and that a thread is wound, and the thread is drawn out from a thread exit, and the shuttle hook performs a half-turn reverse rotation when the open eye needle comes down from the upper dead center, piercing the fabric workpiece, and going up from the lower dead center during a first stroke, and that the thread is tightened by a further reverse rotation along with a rising of the open eye needle which captured the thread by the thread capturing open eye, and which has a loop-taker point for scooping the thread which is captured by the thread capturing open eye by a half-turn normal rotation of the shuttle hook, and that the captured thread is released from the thread capturing open eye by scooping by the loop-taker point of the shuttle hook by the rotation of the shuttle hook, and the released thread is guided in the shuttle hook by the further rotation of the shuttle hook and is interlaced to the thread which is wound in the shuttle hook when the open eye needle comes down from the upper dead center, pierces said fabric workpiece, and goes up from the lower dead center during the second stroke, a thread draw out actuator, which tightens the thread which is drawn out from the thread exit by abutting circumferentially on the open eye needle by rotation of the shuttle hook when the thread capturing open eye captures the thread, and tightens the thread which guides out from the shuttle hook, and a feed dog, which feeds the fabric workpiece with one stitch length while the open eye needle slips out from the fabric workpiece, goes up, and passes through the upper dead center during the first stroke, and feeds the fabric workpiece with one inter-stitch pitch while the open eye needle slips out from the fabric workpiece, goes up, and passes through the upper dead center during the second stroke, wherein a handstitch on a front surface and a locked stitch on a back surface of the fabric workpiece are formed respectively.

In this single-thread locked handstitch sewing machine, the shuttle hook incorporates a bobbin case which houses a bobbin that the thread is wound in an inner shuttle hook, and the bobbin case is rotatably loaded together with the inner shuttle hook in an shuttle race body, and the thread exit is equipped in the bobbin case in the direction and the position which depart from the throat plate by reverse rotation of the shuttle hook when the open eye needle goes up from the throat plate.

In this single-thread locked handstitch sewing machine, the shuttle hook has a period of a stop of a rotation when the open eye needle moves from the upper dead center to the lower dead center.

In this single-thread locked handstitch sewing machine, the thread draw out actuator has functions for hooking the thread drawn out from the thread exit of the shuttle hook, tightening the thread by drawing out the thread from the shuttle hook after scooping the thread captured by the capturing open eye by the loop-taker point of the shuttle hook, and releasing the thread which is hooked after capturing the thread by the thread capturing open eye.

In this single-thread locked handstitch sewing machine, a thread shifting mechanism which shifts the thread captured by the thread capturing open eye between a needlepoint of the open eye needle and the fabric workpiece when the open eye needle comes down from the upper dead center during the second stroke is equipped.

In this single-thread locked handstitch sewing machine, a thread tightness adjusting mechanism which adjusts a thread tightness quantity of the thread draw out actuator depending on the stitch length which is set by a feed quantity setting mechanism is equipped.

In this single-thread locked handstitch sewing machine, a presser foot which performs the pressing force of the fabric workpiece on the throat plate is equipped, and a pressing force release mechanism that the hand feed of the fabric workpiece is performed while giving the stitch length feed quantity and the inter-stitch pitch feed quantity arbitrarily by releasing the pressing force of the presser foot when the open eye needle is slipping out from the fabric workpiece is equipped.

In this single-thread locked handstitch sewing machine, a feed dog evacuate mechanism that the hand feed of the fabric workpiece is performed while giving the stitch length feed quantity and the inter-stitch pitch feed quantity arbitrarily by evacuating the feed dog which feeds the fabric workpiece when the open eye needle is slipping out from the fabric workpiece is equipped.

In this single-thread locked handstitch sewing machine, before the open eye needle comes down from the upper dead center, pierces the fabric workpiece, goes up from the lower dead center and slips out from the fabric workpiece, a rotating operation/linear feed changeover mechanism for performing a rotating operation by hand of the feed direction of the fabric workpiece by making the open eye needle the rotating shaft by releasing a pressing force which performs the pressing force of the fabric workpiece on the throat plate is equipped.

In this single-thread locked handstitch sewing machine, a needle guard for correcting an irregular motion which occurs by piercing the fabric workpiece by the open eye needle to the needle dropping position after the open eye needle pierced the fabric workpiece is equipped in a driver which drives the inner shuttle hook so as to perform the half-turn normal rotation and the half-turn reverse rotation.

In this single-thread locked handstitch sewing machine, a thread insert actuator which inserts forcibly the thread, which is drawn out from the thread exit and decided the position at the thread capturing open eye by the thread draw out actuator and tightened by abutting circumferentially on the open eye needle, into the thread capturing open eye is equipped.

In this single-thread locked handstitch sewing machine, an open eye needle-latch wire drive mechanism for driving a latch wire which closes the thread capturing open eye is equipped in the period that the thread capturing open eye of the open eye needle comes down from the upper dead center, pierces the fabric workpiece, and passes through the throat plate, and in the period that the thread capturing open eye passes through the throat plate, slips out from the fabric workpiece, and reaches the upper dead center after the thread capturing open eye goes up from the lower dead center and captures the thread.

In this single-thread locked handstitch sewing machine, the thread which is scooped by the loop-taker point of the shuttle hook and released interlaces to the thread which is wound in the shuttle hook by guiding in the shuttle hook by the further rotation of the shuttle hook, and a thread accumulating portion that the thread which is guided in the shuttle hook is accumulated temporarily after interlacing and before the thread which guides out from the shuttle hook is tightened, and the temporary accumulation is released by tightening the thread which guides out from the shuttle hook is equipped in the part of the circumference of the shuttle hook.

Further, in the single-thread locked handstitch sewing machine of this invention in order to achieve this purpose, the sewing machine forms a handstitch on a front surface and a locked stitch on a back surface of a fabric workpiece as a skip stitch set by cooperation of an open eye needle, a shuttle hook and a thread draw out actuator, and performs a stitch length feed of the fabric workpiece for the handstitch by a feed dog during a first stroke of the open eye needle and performs an inter-stitch pitch feed of the fabric workpiece for the inter-handstitch by the feed dog during a second stroke, and the sewing machine comprises a feed quantity setting mechanism which sets up a stitch length feed quantity of the stitch length feed and an inter-stitch pitch feed quantity of an inter-stitch pitch feed respectively, a feed mode changeover mechanism which changes over to each fabric workpiece feed mode corresponding to the stitch length feed and the inter-stitch pitch feed respectively every one skip stitch set in sequence, and a feed drive mechanism which transmits the set stitch length feed quantity and inter-stitch pitch feed quantity in each fabric workpiece feed mode respectively, and feeds the fabric workpiece by the feed dog.

In this single-thread locked handstitch sewing machine, the feed quantity setting mechanism consists of a reverse T-shaped feed adjuster which is pivotally attached to a supporting arm which is pivotally supported to an intermediate shaft that one-half is decelerated from an upper shaft which drives the open eye needle, and a stitch length feed quantity operating member and an inter-stitch pitch feed quantity operating member are pivotally attached to both arms of the reverse T-shaped feed adjuster respectively.

In this single-thread locked handstitch sewing machine, the feed mode changeover mechanism consists of a feed changeover triangular cam which is firmly fixed to the intermediate shaft and has two even-numbered deviating points and a feed changeover rod which contacts to the outside of the feed changeover triangular cam, and a connecting end of the feed changeover rod is pivotally attached to one end of a stitch length changeover link, and another end is pivotally attached to a vertical arm end of the reverse T-shaped feed adjuster.

In this single-thread locked handstitch sewing machine, the feed drive mechanism consists of a horizontal feed connection link whose one end is pivotally attached to the connecting end of the feed changeover rod, a horizontal feed connection crank whose first arm is pivotally attached to another end of the horizontal feed connection link, a horizontal feed rod link whose one end is pivotally attached to a second arm of the horizontal feed connection crank and another end is pivotally attached to a horizontal feed vertical rod, a horizontal feed eccentric cam which is firmly fixed to the upper shaft, and a horizontal feed drive rod which is pivotally attached to another end of the horizontal feed rod link and contacts to the outside of the horizontal feed eccentric cam.

Effect of the Invention

According to the method and sewing machine for forming single-thread locked handstitches of this invention, the sewing thread is certainly captured to the thread capturing open eye of the needle, and the formation of the single-thread locked stitch is performed in the inner space of the sewing machine bed, and the sewing which is suitable to the quasi-handstitch called pinpoint/saddle stitch is possible.

In addition, According to the method and sewing machine for forming single-thread locked handstitches of this invention, because the handstitch on the front surface and the locked stitch on the back surface of the fabric workpiece are formed respectively, the sewing work is performed in the state that the handstitch can be seen on the surface for the worker, and it is possible to confirm the position of the handstitch. Therefore, the accurate sewing is possible.

And, According to the method and sewing machine for forming single-thread locked handstitches of this invention, because the handstitch on the front surface and the locked stitch on the back surface of the fabric workpiece are formed respectively, it does not come loose easily by pulling the sewing thread which forms single-thread locked stitch. Therefore, the firm sewing can be obtained.

Besides, According to the method and sewing machine for forming single-thread locked handstitches of this invention, because the single-thread locked stitch is formed by cooperation of the open eye needle, the shuttle hook and the thread draw out actuator, the stitch length and the inter-stitch pitch can be set freely.

BRIEF DESCRIPTION OF THE DRAWINGS

FIG. 3 (B) A perspective view showing the open eye needle-latch wire drive mechanism in the single-thread locked handstitch sewing machine of this invention, wherein (B) is a view that the open eye needle is in the lower dead center.

FIG. 18 (B) A movement explanatory view showing the method for forming single-thread locked handstitches about the movement of the single-thread locked handstitch sewing machine by this invention.

FIG. 18 (C) A movement explanatory view showing the method for forming single-thread locked handstitches about the movement of the single-thread locked handstitch sewing machine by this invention.

FIG. 18 (D) A movement explanatory view showing the method for forming single-thread locked handstitches about the movement of the single-thread locked handstitch sewing machine by this invention.

FIG. 18 (E) A movement explanatory view showing the method for forming single-thread locked handstitches about the movement of the single-thread locked handstitch sewing machine by this invention.

FIG. 18 (F) A movement explanatory view showing the method for forming single-thread locked handstitches about the movement of the single-thread locked handstitch sewing machine by this invention.

FIG. 18 (G) A movement explanatory view showing the method for forming single-thread locked handstitches about the movement of the single-thread locked handstitch sewing machine by this invention.

FIG. 18 (H) A movement explanatory view showing the method for forming single-thread locked handstitches about the movement of the single-thread locked handstitch sewing machine by this invention.

FIG. 18 (I) A movement explanatory view showing the method for forming single-thread locked handstitches about the movement of the single-thread locked handstitch sewing machine by this invention.

FIG. 18 (J) A movement explanatory view showing the method for forming single-thread locked handstitches about the movement of the single-thread locked handstitch sewing machine by this invention.

FIG. 18 (K) A movement explanatory view showing the method for forming single-thread locked handstitches about the movement of the single-thread locked handstitch sewing machine by this invention.

FIG. 18 (L) A movement explanatory view showing the method for forming single-thread locked handstitches about the movement of the single-thread locked handstitch sewing machine by this invention.

FIG. 18 (M) A movement explanatory view showing the method for forming single-thread locked handstitches about the movement of the single-thread locked handstitch sewing machine by this invention.

FIG. 18 (N) A movement explanatory view showing the method for forming single-thread locked handstitches about the movement of the single-thread locked handstitch sewing machine by this invention.

FIG. 18 (O) A movement explanatory view showing the method for forming single-thread locked handstitches about the movement of the single-thread locked handstitch sewing machine by this invention.

FIG. 18 (P) A movement explanatory view showing the method for forming single-thread locked handstitches about the movement of the single-thread locked handstitch sewing machine by this invention.

FIG. 18 (Q) A movement explanatory view showing the method for forming single-thread locked handstitches about the movement of the single-thread locked handstitch sewing machine by this invention.

FIG. 18 (R) A movement explanatory view showing the method for forming single-thread locked handstitches about the movement of the single-thread locked handstitch sewing machine by this invention.

FIG. 18 (S) A movement explanatory view showing the method for forming single-thread locked handstitches about the movement of the single-thread locked handstitch sewing machine by this invention.

FIG. 18 (T) A movement explanatory view showing the method for forming single-thread locked handstitches about the movement of the single-thread locked handstitch sewing machine by this invention.

FIG. 18 (U) A movement explanatory view showing the method for forming single-thread locked handstitches about the movement of the single-thread locked handstitch sewing machine by this invention.

FIG. 18 (V) A movement explanatory view showing the method for forming single-thread locked handstitches about the movement of the single-thread locked handstitch sewing machine by this invention.

FIG. 18 (W) A movement explanatory view showing the method for forming single-thread locked handstitches about the movement of the single-thread locked handstitch sewing machine by this invention.

FIG. 23 (B) A view showing the feed quantity setting mechanism, the mode changeover mechanism, the cloth feed mechanism and the cloth feed drive mechanism schematically in the single-thread locked handstitch sewing machine of this invention.

FIG. 24 (B) A view showing the feed quantity setting mechanism, the mode changeover mechanism, the cloth feed mechanism and the cloth feed drive mechanism schematically in the single-thread locked handstitch sewing machine of this invention.

FIG. 25 (B) A perspective view showing the open eye needle-latch wire drive mechanism of another mode of embodiment in the single-thread locked handstitch sewing machine of this invention, wherein (B) is the view that the open eye needle is in the lower dead center.

FIG. 27 (B) An exploded perspective view showing the thread shifting mechanism in the single-thread locked handstitch sewing machine of this invention.

FIG. 28 (B) An exploded perspective view showing the thread shifting mechanism of another mode of embodiment in the single-thread locked handstitch sewing machine of this invention.

FIG. 34 (B) A schematic view showing the movement state when viewing the thread tightness adjusting mechanism of FIG. 32 and FIG. 33 from the lower side of the sewing machine.

FIG. 35 (B) A rotating operation/linear feed changeover mechanism in the single-thread locked handstitch sewing machine of this invention is shown; wherein this view is a perspective view showing the state that the changeover lever is changed over to the rotating operation.

FIG. 40 (B) A hand feed/linear feed changeover mechanism in the single-thread locked handstitch sewing machine of this invention is shown; wherein this view is a perspective view showing the state that the changeover lever is changed over to the hand feed.

FIG. 52 (B) A movement explanatory view showing the movement state of the open eye needle, the shuttle hook, the thread shifter, the presser foot and the thread insert actuator of the single-thread locked handstitch sewing machine of FIG. 48, FIG. 49.

FIG. 52 (C) A movement explanatory view showing the movement state of the open eye needle, the shuttle hook, the thread shifter, the presser foot and the thread insert actuator of the single-thread locked handstitch sewing machine of FIG. 53, FIG. 54.

BEST MODE FOR CARRYING OUT THE INVENTION

Hereinafter, the example of the best mode of embodiment of the method and sewing machine for forming single-thread locked handstitches of this invention is explained based on the drawings.

Figure 1:
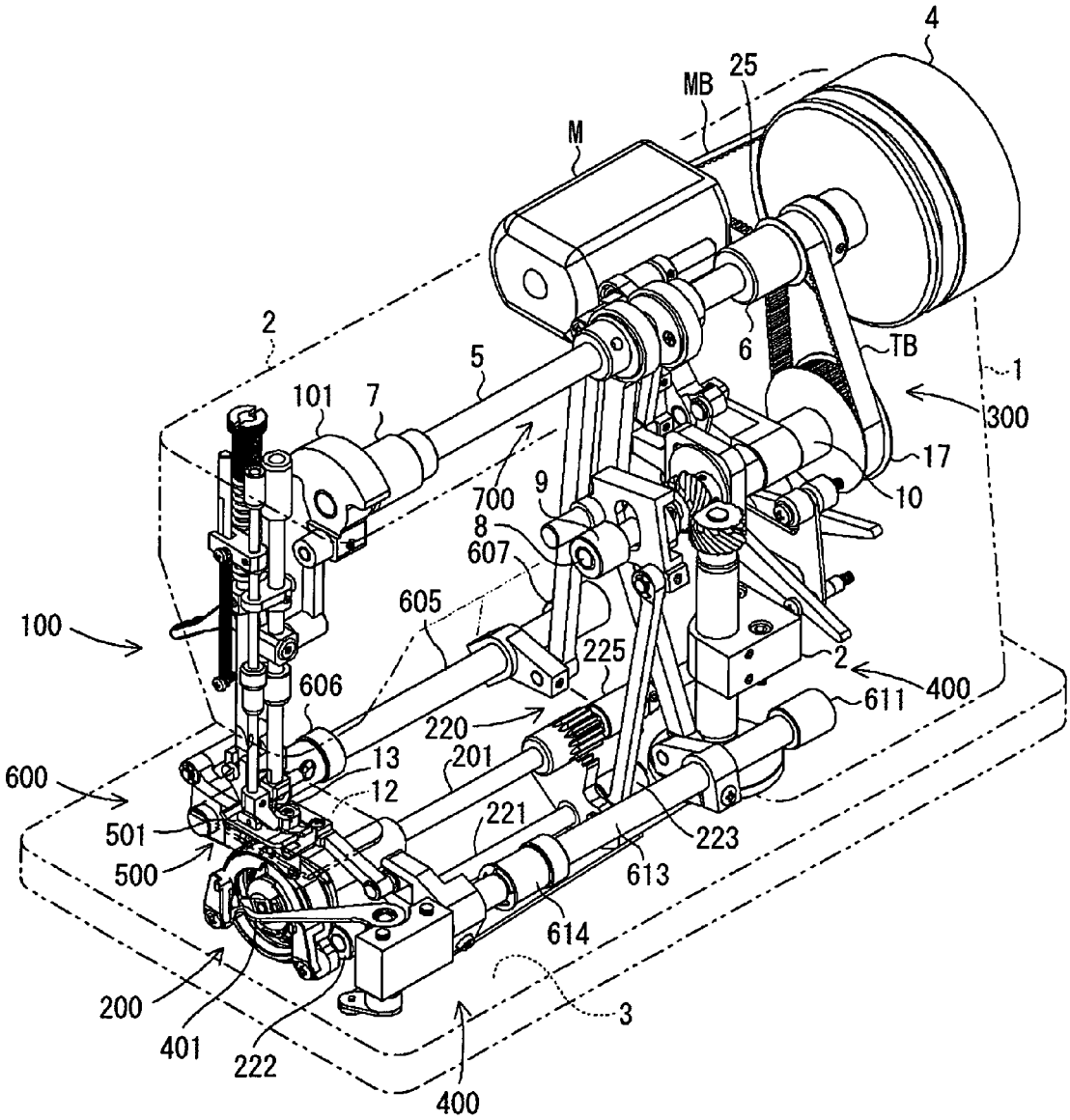
FIG. 1 An overall perspective view showing the example of the preferable mode of embodiment by the single-thread locked handstitch sewing machine of this invention.
Figure 2:
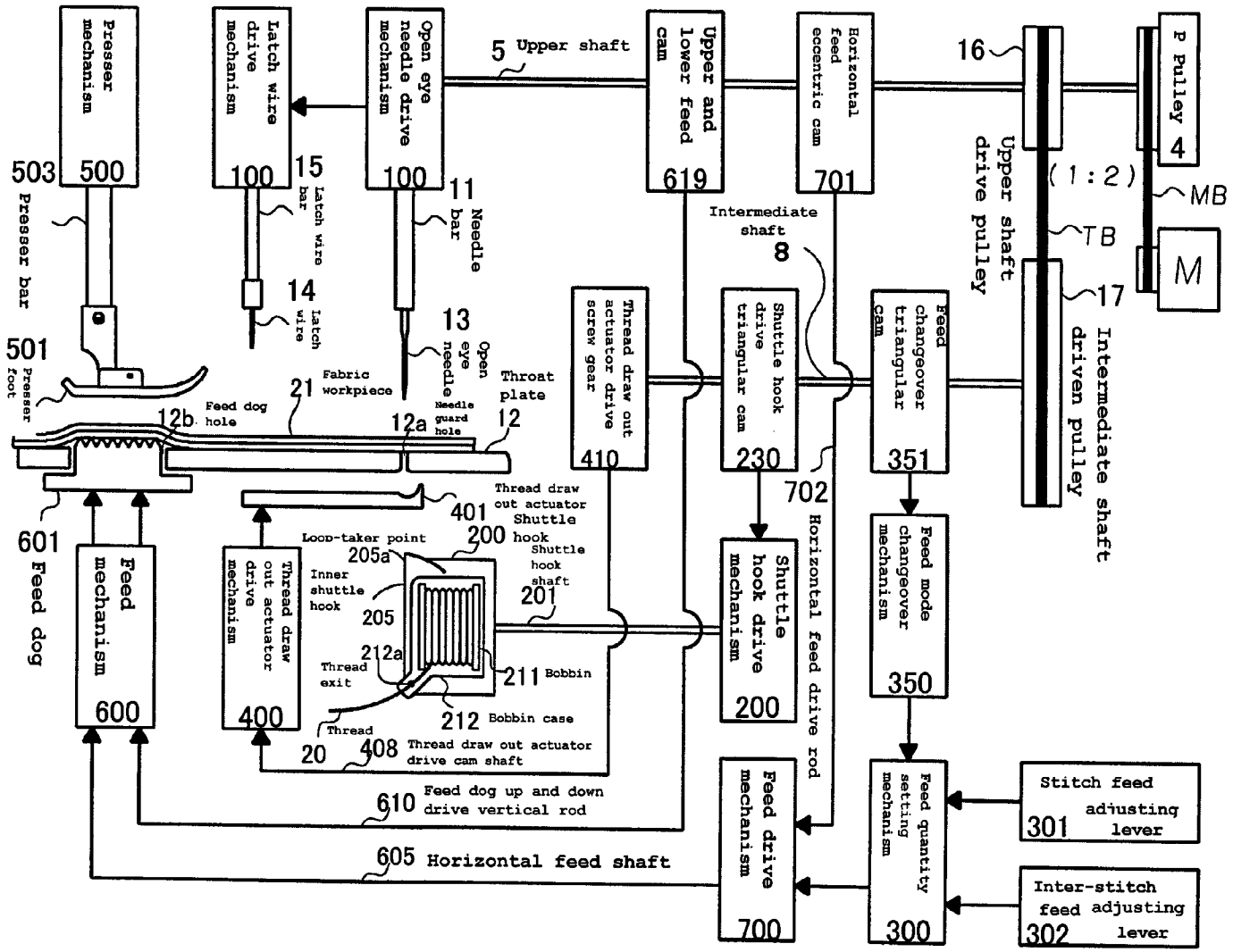
FIG. 2 A block diagram showing the drive system of the single-thread locked handstitch sewing machine of this invention.

As shown in FIG. 1 and FIG. 2, the single-thread locked handstitch sewing machine of this invention is equipped with a open eye needle 13 which pierces a sewing thread 20 to a fabric workpiece 21 by providing a thread capturing open eye 13*a* laterally and by performing the linear reciprocating motion vertically, a shuttle hook 200 which forms the stitch by letting the sewing thread 20 intersect by the half-turn normal rotation and by the half-turn reverse rotation, a thread draw out actuator 401 which gives the slack to the sewing thread 20 and tightens the stitch by performing the reciprocating motion like a thread take-up lever, and a feed dog 601 which feeds the fabric workpiece 21 by the elliptical motion or the like in a frame 1 consisting of an arm 2 and a bed 3. And the single-thread locked handstitch sewing machine of this invention is the sewing machine for forming a handstitch on the front surface of the fabric workpiece 21 and for forming a locked stitch on the back surface of the fabric workpiece 21 by using the single thread 20 which was wound in the shuttle hook 200. In this description, "winding" means being equipped in the state where it was wound.

The arm 2 is equipped with a upper shaft 5 and an intermediate shaft 8, and the bed 3 is equipped with a horizontal feed shaft 605, an upper and lower feed shaft 613 and a shuttle hook shaft 201, and as for these, the direction of the shafts are set up in horizontal direction respectively. The upper shaft 5 is rotatably set up by an upper shaft former bushing 7 and an upper shaft rear bushing 6 in the arm 2, and the intermediate shaft 8 is rotatably set up by an intermediate shaft front bushing 9 and an intermediate shaft rear bushing 10 in the arm 2, respectively. The horizontal feed shaft 605 is rotatably set up by a horizontal feed shaft former bushing 606 and a horizontal feed shaft rear bushing 607 in the arm 2, and the upper and lower feed shaft 613 is rotatably set up by an upper and lower feed shaft former bushing 614 and an upper and lower feed shaft rear bushing 611 in the arm 2, respectively. The shuttle hook shaft 201 is fixed to an after-mentioned inner shuttle hook driver 203 of the shuttle hook 200 while it is rotatably set up by a shuttle hook shaft rear bushing 225 and a bushing of an shuttle race body attaching portion 202*c* (refer to FIG. 13) in the arm 2.

A driven pulley 4 is equipped at one end of the upper shaft 5, and the driven pulley 4 is driven by a motor M through a drive belt MB which is an endless belt. And, a needle bar crank 101 of the open eye needle-latch wire drive mechanism 100 for driving the open eye needle 13 is equipped to another end of the upper shaft 5. The cloth feed drive mechanism 700 for driving the cloth feed mechanism 600 by letting the elliptical motion perform to the feed dog 601 is connected with the intermediate portion of the upper shaft 5. An upper shaft drive pulley 25 for driving the feed quantity setting mechanism 300 of the stitch length—the inter-stitch pitch is equipped to the neighborhood of the driven pulley 4 of the upper shaft 5. A shuttle hook drive mechanism 220 for driving the shuttle hook 200 and a thread draw out drive mechanism 400 for driving the thread draw out actuator 401 are connected with the intermediate shaft 8.

The open eye needle-latch wire drive mechanism 100 has the composition that the following things are possible. The open eye needle 13 comes down from the upper dead center, and it pierces to the fabric workpiece 21 which is placed on a throat plate 12, and it slips out from the fabric workpiece 21 from the lower dead center and goes up, and it comes down from the upper dead center during the first stroke which performs the linear reciprocating motion vertically and pierces to the fabric workpiece 21, and it captures the sewing thread 20 by the thread capturing open eye 13*a* when it goes up from the lower dead center, and it pierces to the fabric workpiece 21 by coming down from the upper dead center during the second stroke, and it releases the fabric workpiece 21 which was captured by the thread capturing open eye 13*a* when it goes up from the lower dead center. In this description, "the first stroke of the open eye needle 13" means the first stitch that the open eye needle 13 reaches the upper dead center of needle→the lower dead center of needle→the upper dead center of needle, and "the second stroke of the open eye needle 13" means the second stitch that the open eye needle 13 reaches the upper dead center of needle→the lower dead center of needle→the upper dead center of needle.

Figure 3A:
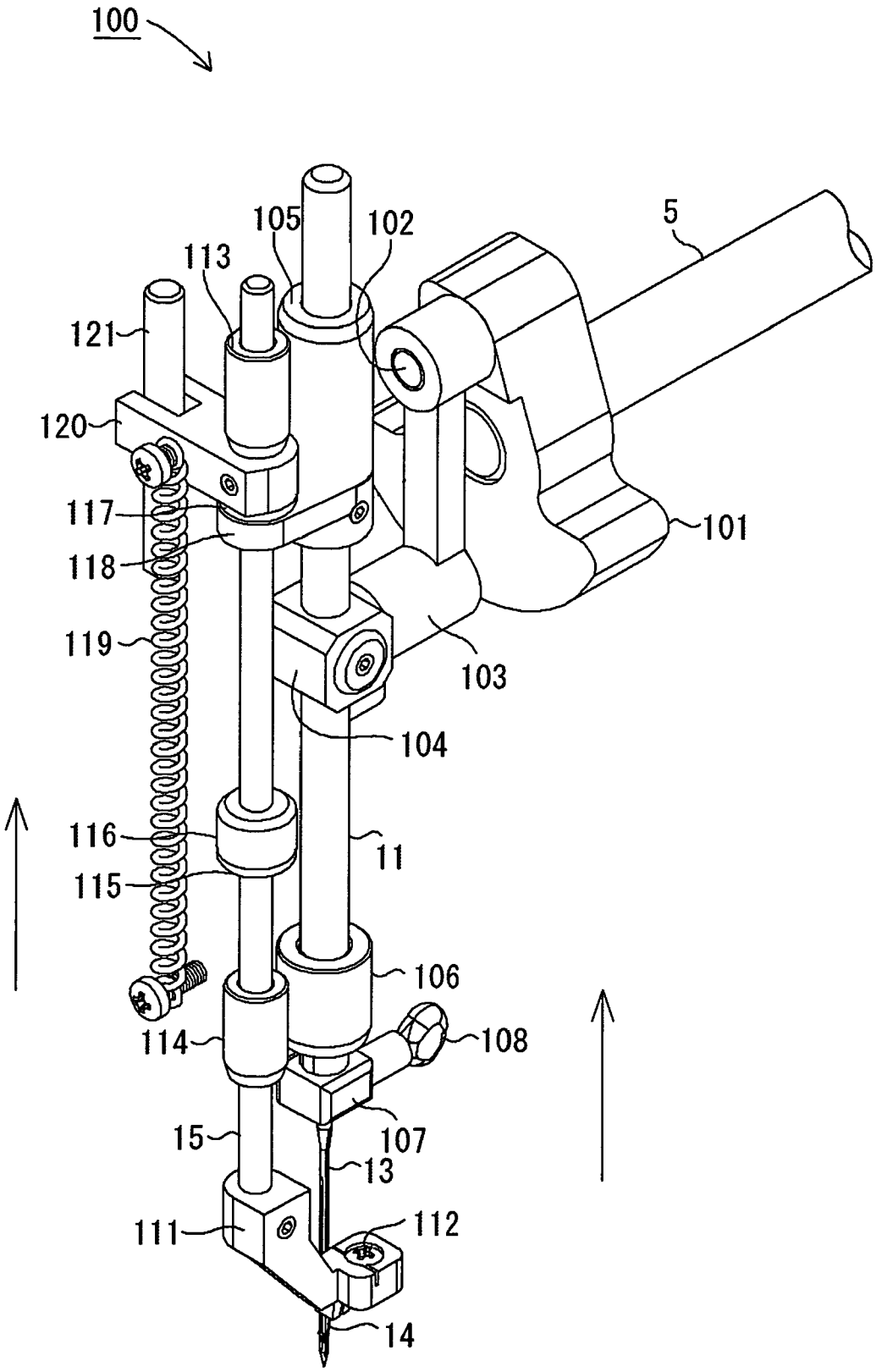
FIG. 3 (A) A perspective view showing the open eye needle-latch wire drive mechanism in the single-thread locked handstitch sewing machine of this invention, wherein (A) is a view that the open eye needle is in the upper dead center.
Figure 3B:
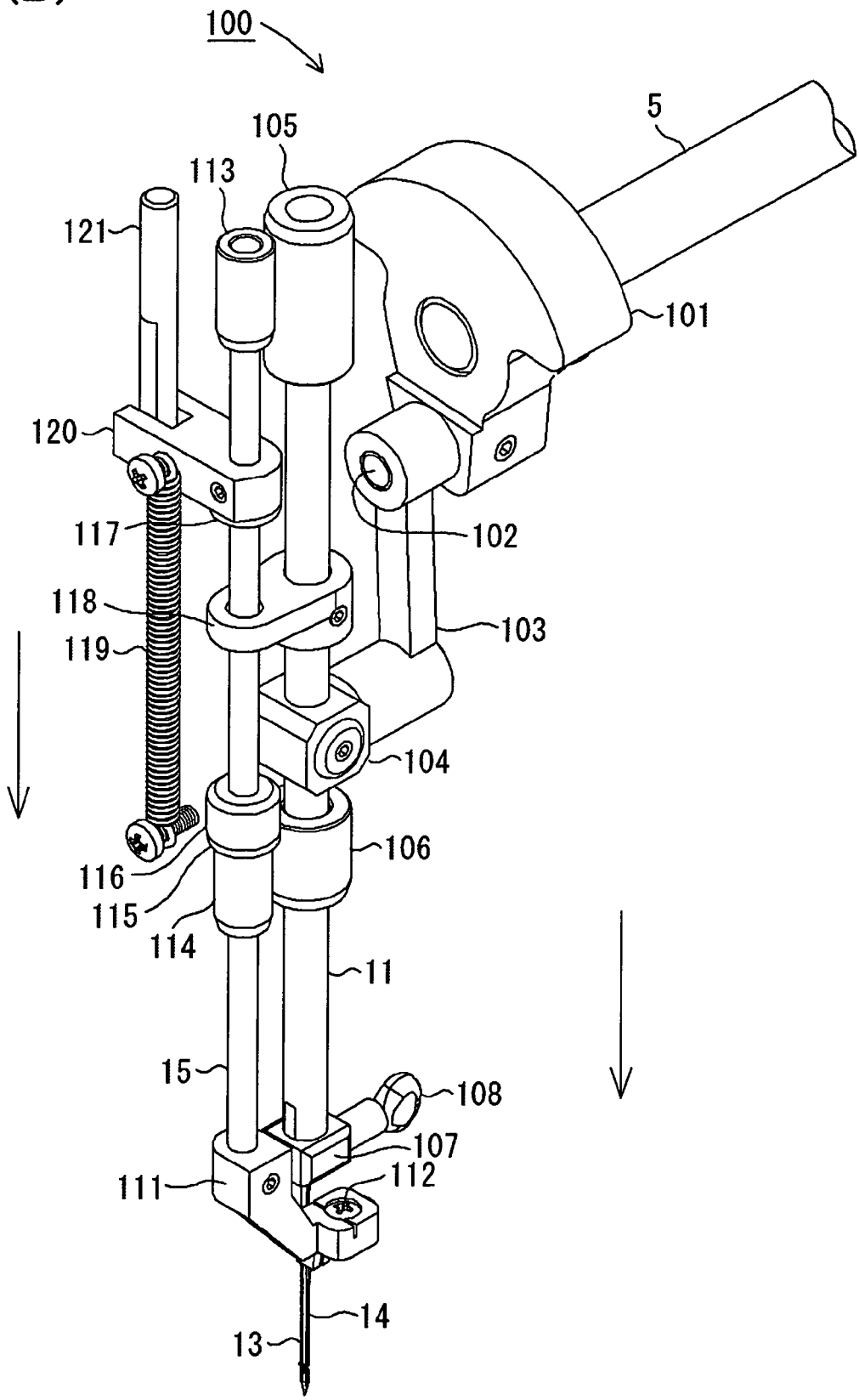
Figure 4:
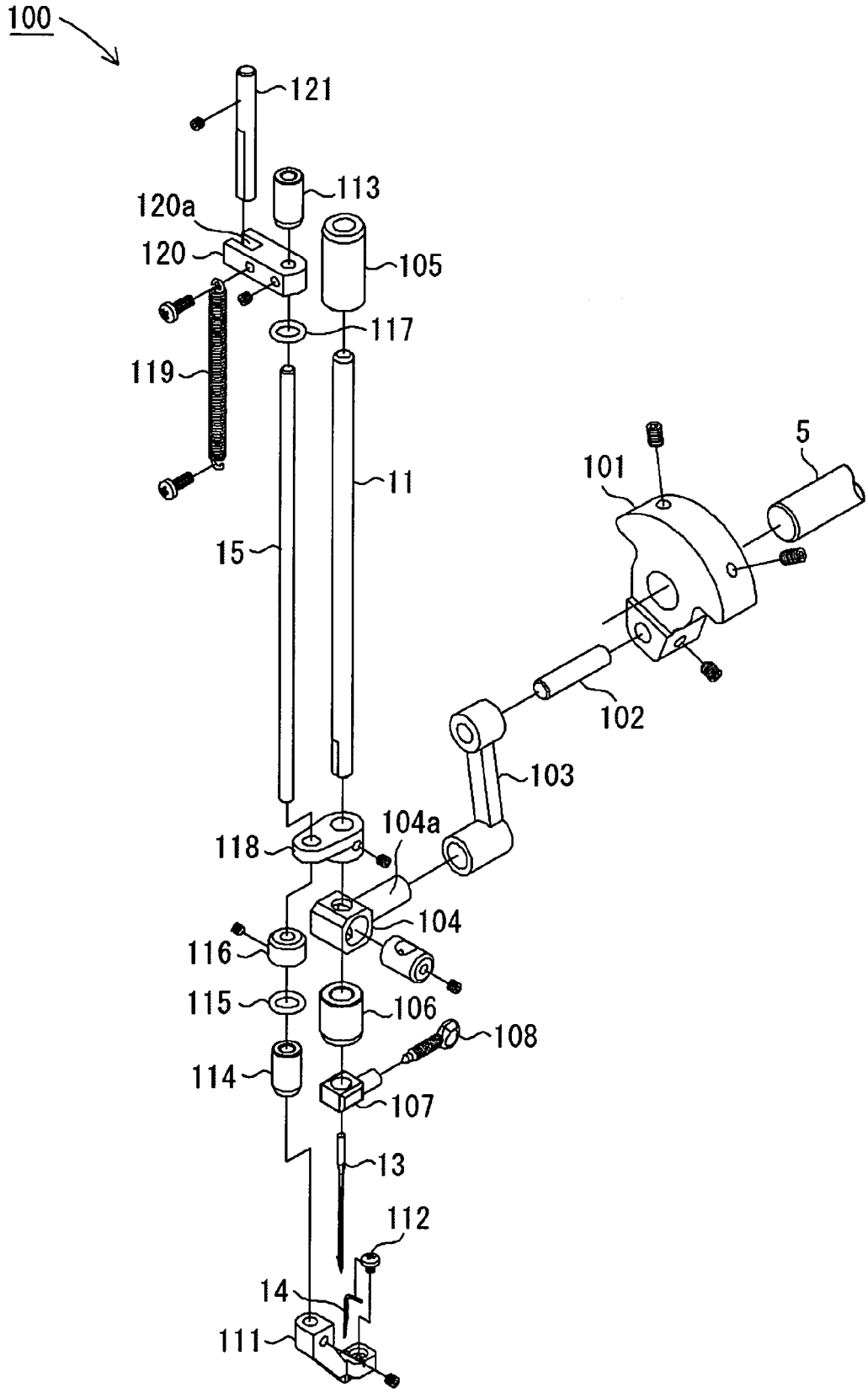
FIG. 4 An exploded perspective view showing the open eye needle-latch wire drive mechanism in the single-thread locked handstitch sewing machine of this invention.

As shown in FIG. 3 (A), (B) and FIG. 4, this open eye needle 13 is fixed to a needle clamp 107, and the needle clamp 107 is fixed to the lower end portion of a needle bar 11 which was set up at the arm 2 by a needle clamp screw 108 in the state that the reciprocating motion can perform linearly and vertically by a needle bar upper bushing 105 and a needle bar lower bushing 106. And, a needle bar holder 104 is fixed to the needle bar 11 between the needle bar upper bushing 105 and the needle bar lower bushing 106. A crank rod pin 104*a* which is formed in the needle bar holder 104 is rotatably connected with one end of a needle bar crank rod 103, and another end of the needle bar crank rod 103 is rotatably connected with the needle bar crank 101 which is fastened to another end of the upper shaft 5. Therefore, because the needle bar crank rod 103 cranks by the rotation of the upper shaft 5 through the needle bar crank 101, the needle bar 11 that the open eye needle is fixed by the needle clamp 107 performs the linear reciprocating motion vertically by the needle bar holder 104.

Besides, the thread capturing open eye 13*a* of the open eye needle 13 is opened and closed by the latch wire 14. This latch wire 14 is fixed to a latch wire clamp 111 by a latch wire clamp screw 112, and the latch wire clamp 111 is fixed to the lower end portion of a latch wire bar 15 which was set up in the arm 2 in the state that the linear reciprocating motion can perform vertically by a latch wire bar upper bushing 113 and a latch wire bar lower bushing 114. And, a latch wire bar receiver 116 is fixed to the latch wire bar 15 between the latch wire bar upper bushing 113 and the latch wire bar lower bushing 114. To the latch wire bar 15 between the latch wire bar receiver 116 and the latch wire bar upper bushing 113, a latch wire bar supporting upper arm 118 which was fixed to the needle bar 11 between the needle bar upper bushing 105 and the needle bar holder 104 has a gap to be able to move and is fitted in. A latch wire bar rotation stopper 120 is fixed to the latch wire bar 15 between the latch wire bar supporting upper arm 118 and the latch wire bar upper bushing 113, and a latch wire bar guide 121 which was fixed so that it projects to the arm 2 is slidably fitted into a notch 120*a* which is formed in this latch wire bar rotation stopper 120. Therefore, the latch wire bar 15 that the latch wire bar rotation stopper 120 is fixed does not rotate. And, the latch wire bar rotation stopper 120 is pulled downward always by fixing another end of a latch wire bar spring 119 which is fixed to one end of the arm 2. An O-ring 117 is fitted into the latch wire bar 15 in the lower side of the latch wire bar rotation stopper 120 and an O-ring 115 is fitted into the latch wire bar 15 in the upper side of the latch wire bar lower bushing 114. The O-ring 117 functions as the buffer material when the latch wire bar rotation stopper 120 abuts on the latch wire bar supporting upper arm 118, and the O-ring 115 functions as the buffer material when the latch wire bar lower bushing 114 abuts on the latch wire bar receiver 116.

Figure 5:
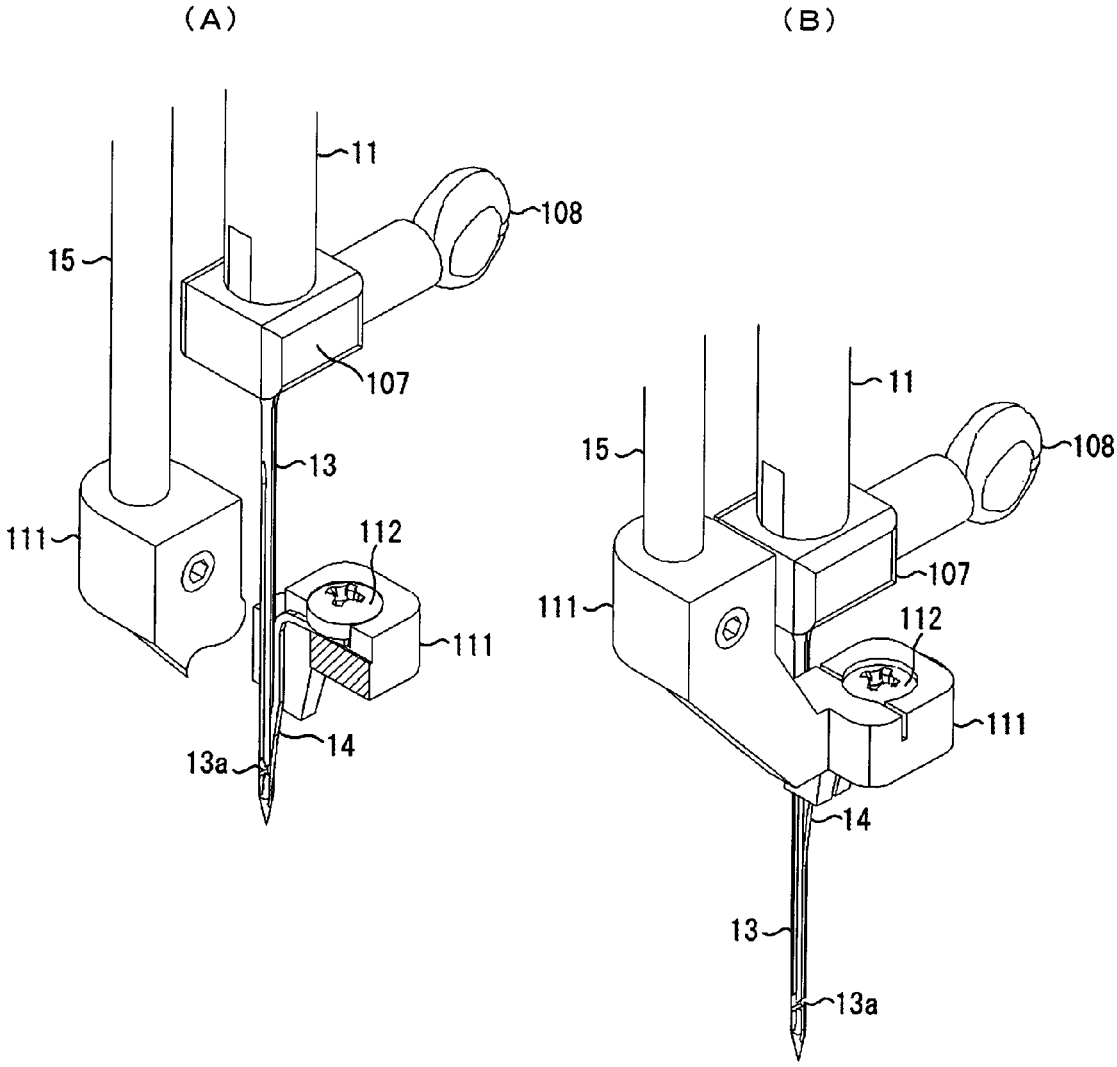
FIG. 5 A perspective view showing the relation between the open eye needle and the latch wire, wherein (A) is a view that the thread capturing open eye of the open eye needle is closed state by the latch wire, (B) is a view that the thread capturing open eye of the open eye needle is open state.
Figure 6:
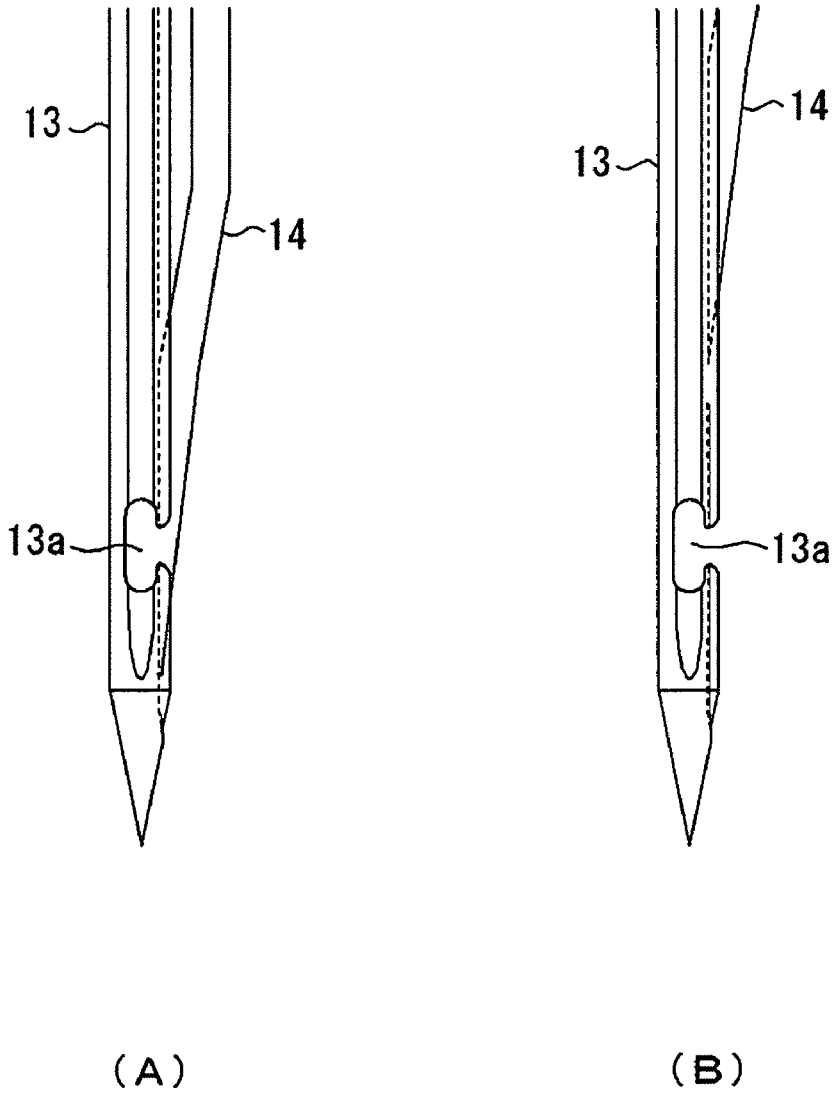
FIG. 6 A partial perspective view showing the relation between the open eye needle and the latch wire, wherein (A) is a view that the thread capturing open eye of the open eye needle is closed state by the latch wire, (B) is a view that the thread capturing open eye of the open eye needle is open state.

In the open eye needle-latch wire drive mechanism 100 constituted as described above, when the needle bar 11 goes up by rotation of the upper shaft 5 as shown in FIG. 3 (A), the latch wire bar supporting upper arm 118 lets the latch wire bar rotation stopper 120 go up against the elastic force of the latch wire bar spring 119. In this case, because the latch wire 14 also goes up while the open eye needle 13 goes up, as shown in FIG. 5 (A) and FIG. 6 (A), the thread capturing open eye 13*a* of the open eye needle 13 becomes closed state by the latch wire 14. That is, when the open eye needle 13 goes toward the upper dead center from the lower dead center, the thread capturing open eye 13*a* is closed by the latch wire 14. And, when the needle bar 11 comes down by the rotation of the upper shaft 5 as shown in FIG. 3 (B), because the latch wire bar supporting upper arm 118 also comes down, the latch wire bar rotation stopper 120 comes down by the elastic force of the latch wire bar spring 119. In this case, relating to the latch wire 14, because the latch wire bar receiver 116 which was fixed to the latch wire bar 15 abuts on the latch wire bar lower bushing 114, as shown in FIG. 5 (B) and FIG. 6 (B), the thread capturing open eye 13*a* of the open eye needle 13 becomes open state. That is, after the open eye needle 13 passed through the fabric workpiece 21, the thread capturing open eye 13*a* is released from the latch wire 14 in the lower side of the throat plate 12.

Figure 7:
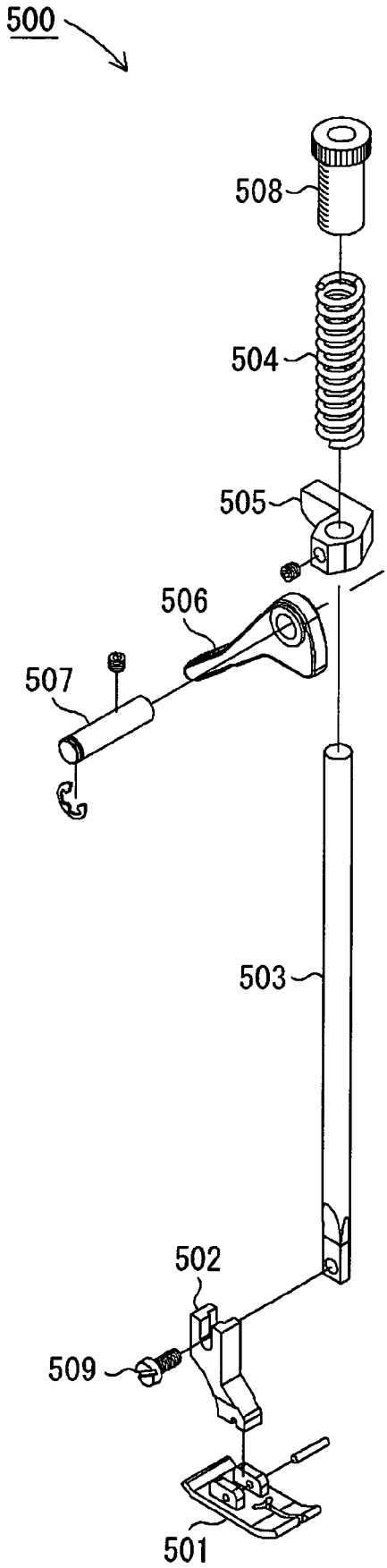
FIG. 7 An exploded perspective view showing the presser mechanism in the single-thread locked handstitch sewing machine of this invention.

In the neighborhood of this open eye needle-latch wire drive mechanism 100, as shown in FIG. 1 and FIG. 2, a presser mechanism 500 for letting the presser foot 501 to press the fabric workpiece 21 to the throat plate 12 operate is equipped. As shown in FIG. 7, the presser mechanism 500 is set up to the arm 2 in the state that a presser bar 503 can perform the linear reciprocating motion vertically, a presser foot leg 502 that the presser foot 501 was swingably assembled at the lower end portion of the presser bar 503 is fixed by a presser stopper screw 509. And, a presser bar pressure adjusting screw 508 is fixed at the upper portion of the presser bar 503, and the presser bar pressure adjusting screw 508 is threadably mounted on the upper portion of the arm 2. A presser bar holder 505 is fixed to the presser bar 503, and a presser bar pressure adjusting spring 504 is fitted into the presser bar 503 between the presser bar holder 505 and the lower surface of the arm 2. The suppress strength to the fabric workpiece 21 of the presser foot 501 by this presser bar pressure adjusting spring 504 can be adjusted by turning the presser bar pressure adjusting screw 508. In addition, in order to let the presser foot 501 go up and down, a presser upholding lever 506 which engages to the presser bar holder 505 is rotatably equipped to a presser upholding lever shaft 507 which is fixed to the arm 2. The presser bar holder 505 goes up when the presser upholding lever 506 goes up, and the presser bar holder 505 comes down when the presser upholding lever 506 comes down. Therefore, the space between the presser foot 501 and the throat plate 12 is made when the presser upholding lever 506 goes up, and the fabric workpiece 21 is pressed to the throat plate 12 when the presser upholding lever 506 comes down after placing the fabric workpiece 21 onto the throat plate 12, thereby, the fabric workpiece 21 can be set onto the throat plate 12.

As shown in FIG. 1 and FIG. 2, in order to feed the fabric workpiece 21 with one stitch length while the open eye needle 13 slips out from the fabric workpiece 21, goes up and passes through the upper dead center during the first stroke, and in order to feed the fabric workpiece 21 with one inter-stitch pitch while the open eye needle 13 slips out from the fabric workpiece 21, goes up and passes through the upper dead center during the second stroke, the cloth feed mechanism 600 is equipped with the feed dog 601.

Figure 8:
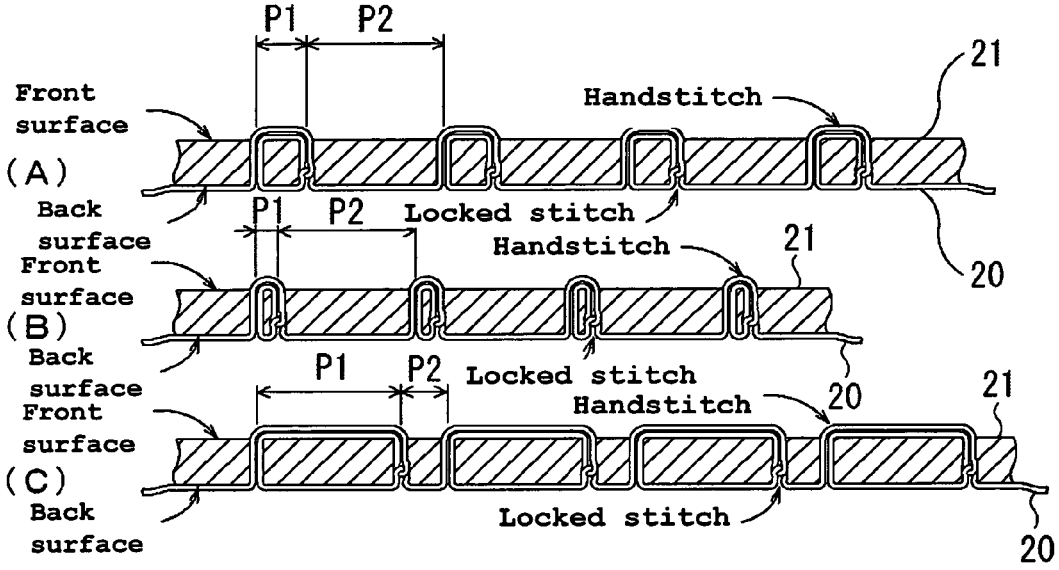
FIG. 8 An explanatory view showing the structure of the quasi-handstitch which is obtained by the method and sewing machine for forming single-thread locked handstitches of this invention.
Figure 9:
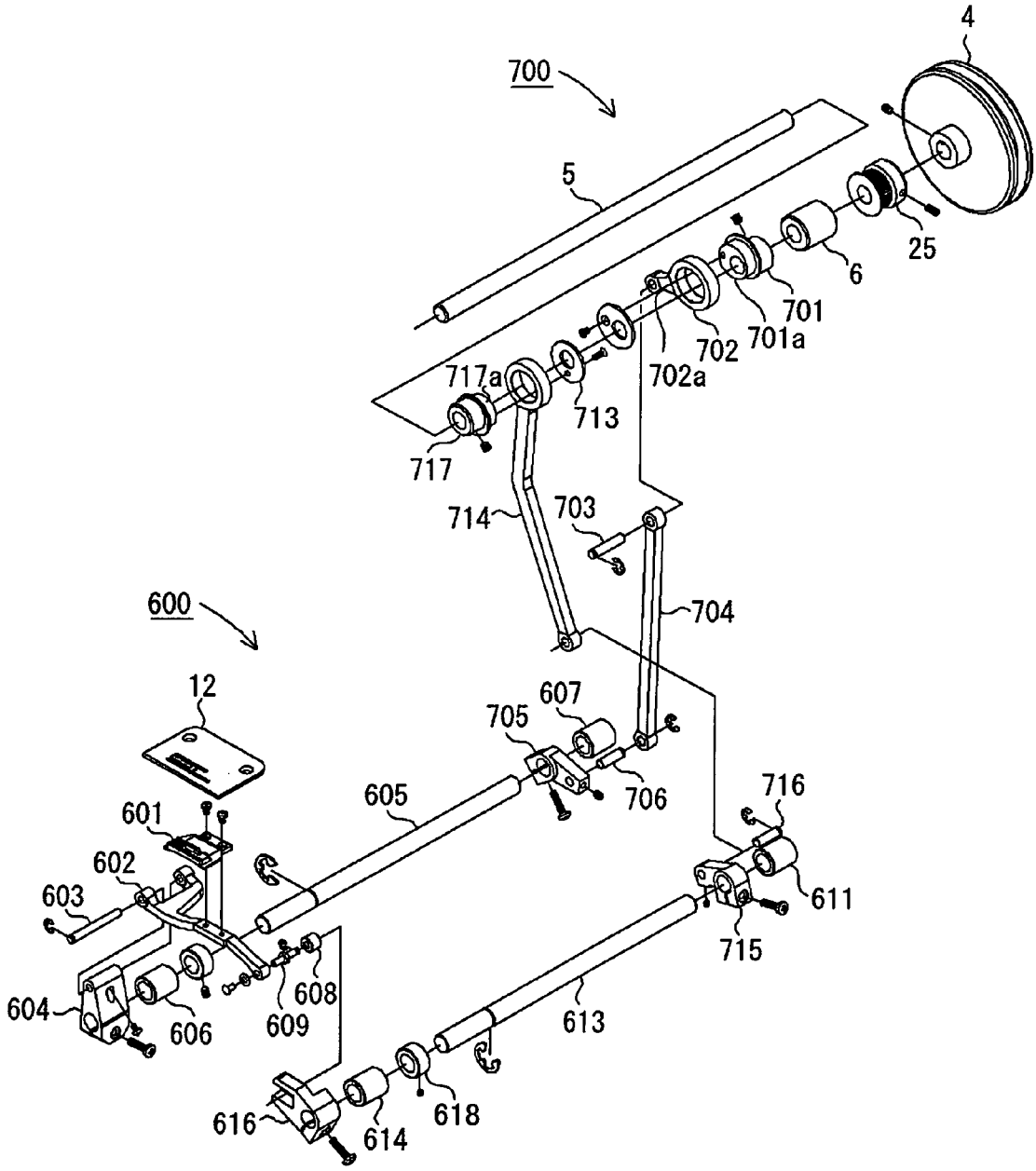
FIG. 9 An exploded perspective view showing the cloth feed mechanism and the cloth feed drive mechanism in the single-thread locked handstitch sewing machine of this invention.
Figure 10:
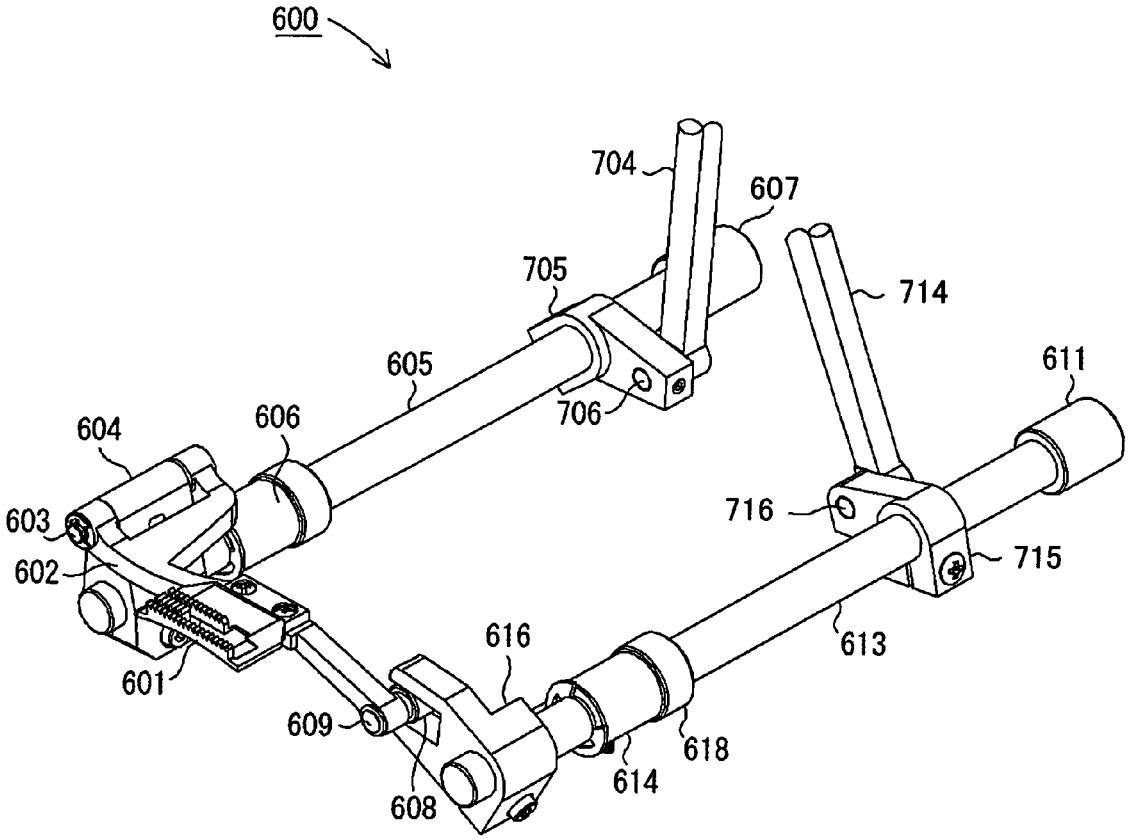
FIG. 10 A perspective view showing the cloth feed mechanism in the single-thread locked handstitch sewing machine of this invention.

As shown in FIG. 2, FIG. 9 and FIG. 10, this cloth feed mechanism 600 is equipped to the lower side of the throat plate 12, and the feed dog 601 is fixed to the almost center portion of a feed base 602. The one end of the feed base 602 is rotatably connected with a horizontal feed arm 604 which is fixed to another end of the horizontal feed shaft 605 by a horizontal feed arm shaft 603. Therefore, because the horizontal feed arm 604 performs the reciprocating rocking by reciprocating and rotating the horizontal feed shaft 605, the feed dog 601 can perform the reciprocating motion horizontally. And, a upper and lower feed roller shaft 609 is fixed to another end of the feed base 602, and a upper and lower feed roller 608 is rotatably equipped to the upper and lower feed roller shaft 609. This upper and lower feed roller 608 is inserted slidably to a forked portion 616*a* of a feed dog up and down drive fork 616 which is fixed to one end of the upper and lower feed shaft 613. Therefore, because the feed dog up and down drive fork 616 performs the reciprocating rocking by reciprocating and rotating the upper and lower feed shaft 613, the upper and lower feed roller 608 which fits into the feed dog up and down drive fork 616 can let another end of the feed base 602 reciprocate up and down. Here, as shown in FIGS. 8 (A), (B) and (C), one stitch length P1 of the stitch feed is the stitch length of the handstitch which is formed on the front surface of the fabric workpiece 21, and one inter-stitch pitch P2 of the inter-stitch feed is the space length between the continuous two handstitches.

As shown in FIG. 9, the cloth feed drive mechanism 700 transmits a stitch length feed quantity and a inter-stitch pitch feed quantity which are set up in the feed quantity setting mechanism 300 in each fabric workpiece feed mode respectively, and it feeds the fabric workpiece 21 by the feed dog 601. And, in the cloth feed drive mechanism 700, a horizontal feed cam 701 which reciprocates and rotates the horizontal feed shaft 605 and an upper and lower feed cam 717 which is fixed to the upper shaft 5 and which reciprocates and rotates the upper and lower feed shaft 613 are fixed to the upper shaft 5. In this description, "each fabric workpiece feed mode" means the stitch length feed and the inter-stitch pitch feed.

The horizontal feed cam 701 is an eccentric cam. A horizontal feed drive rod 702 is rotatably fitted into a cam portion 701*a*, and the one end of a horizontal feed vertical rod 704 is rotatably connected with an end of arm 702*a* of the horizontal feed drive rod 702 by a linking pin 703. Another end of the horizontal feed vertical rod 704 is rotatably connected with a horizontal feed shaft drive arm 705 which is fixed to another portion of the horizontal feed shaft 605 by a linking pin 706. Therefore, because the horizontal feed cam 701 lets the horizontal feed drive rod 702 perform the eccentric motion when the upper shaft 5 rotates, the horizontal feed vertical rod 704 performs the up-and-down motion and the horizontal feed shaft drive arm 705 can let the horizontal feed shaft 605 perform the reciprocating rotation.

The upper and lower feed cam 717 is the eccentric cam. The one end of a feed dog up and down drive vertical rod 714 is rotatably fitted into a cam portion 717*a*, and another end of the feed dog up and down drive vertical rod 714 is rotatably connected with a feed dog up and down shaft drive arm 715 which is fixed to another portion of the upper and lower feed shaft 613 by a linking pin 716. Therefore, because the horizontal feed cam 701 lets the one end of the feed dog up and down drive vertical rod 714 perform the eccentric motion when the upper shaft 5 rotates, the feed dog up and down drive vertical rod 714 itself performs the up-and-down motion and the feed dog up and down shaft drive arm 715 can let the upper and lower feed shaft 613 perform the reciprocating rotation.

As just described, by reciprocating and rotating the horizontal feed shaft 605, the horizontal feed arm 604 performs the reciprocating rocking and it lets the feed base 602 reciprocate horizontally. And, by reciprocating and rotating the upper and lower feed shaft 613, the feed dog up and down drive fork 616 performs the reciprocating rocking and the upper and lower feed roller 608 which fits into the feed dog up and down drive fork 616 lets another end of the feed base 602 reciprocate in the upper and lower direction. Therefore, the feed dog 601 which is fixed to the feed base 602 can perform so-called four feed process movements which is rise→advance→descend→retreat.

Figure 11:
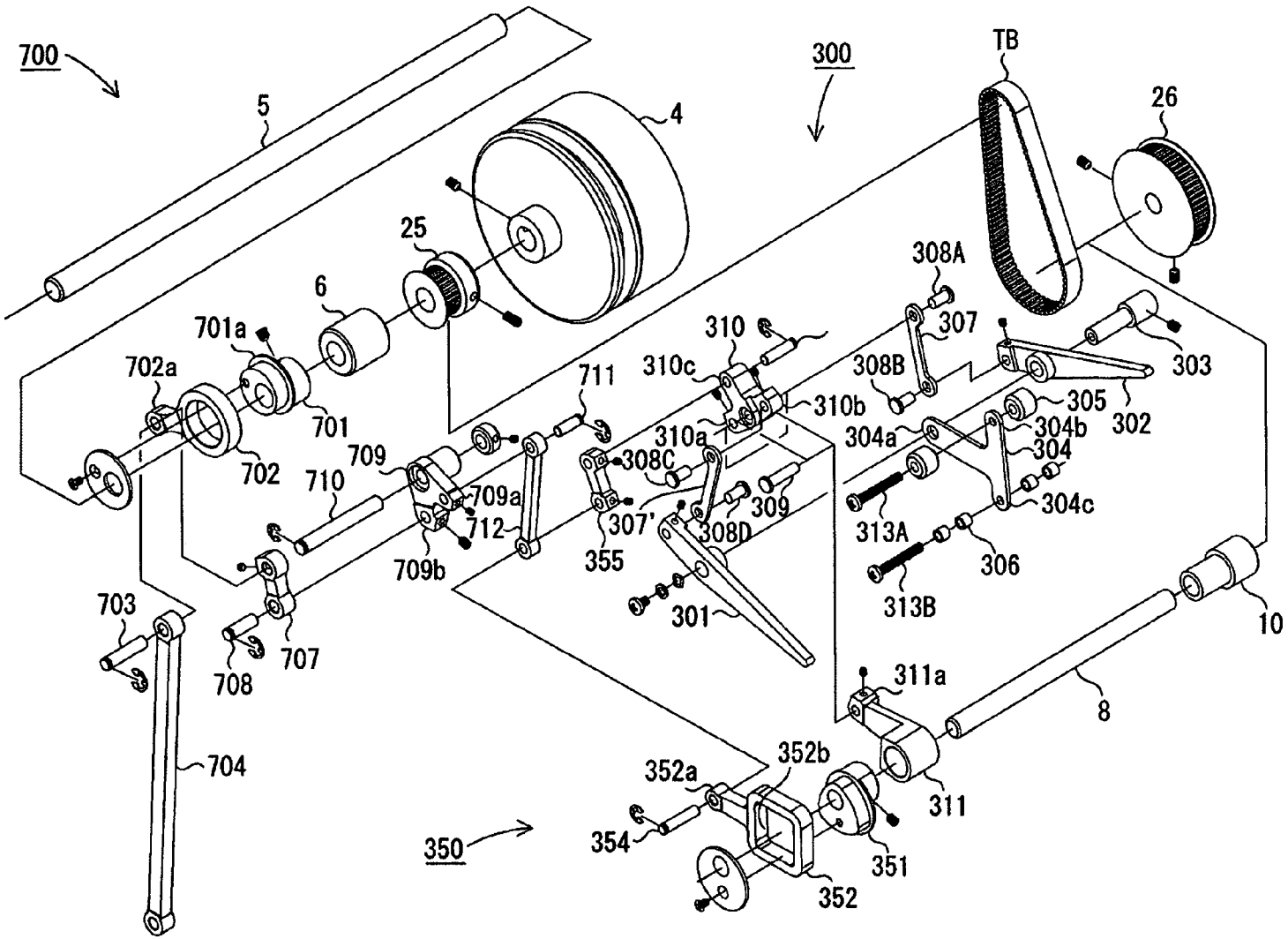
FIG. 11 An exploded perspective view showing the cloth feed drive mechanism, the feed quantity setting mechanism, and the mode changeover mechanism in the single-thread locked handstitch sewing machine of this invention.

As shown in FIG. 11, the feed quantity setting mechanism 300 sets up a stitch length feed quantity of a stitch length feed and a inter-stitch pitch feed quantity of a inter-stitch pitch feed respectively. And the feed quantity setting mechanism 300 consists of a reverse T-shaped feed adjuster 310 which is pivotally attached to a supporting arm 311 which is pivotally supported to the intermediate shaft 8 that one-half is decelerated from the upper shaft 5 which drives the open eye needle 13. A stitch feed adjusting lever 301 which is a stitch length feed quantity operating member and a inter-stitch feed adjusting lever 302 which is an inter-stitch pitch feed quantity operating member are pivotally attached to both arms which become a horizontal arm of the reverse T-shaped feed adjuster 310.

Concretely, an end of arm 311*a* of the supporting arm 311 is rotatably fitted into the intermediate shaft 8 while it connects with the portion which crosses the horizontal arm and the vertical arm of the reverse T-shaped feed adjuster 310 by a feed adjuster pin 309 rotatable. One end of a first adjusting lever link 307 is rotatably connected with one end of horizontal arm 310*a* of the reverse T-shaped feed adjuster 310 by a linking pin 308A, and the portion which becomes the operating point of the inter-stitch feed adjusting lever 302 is rotatably connected with another end of the first adjusting lever link 307 by a linking pin 308B. One end of a second adjusting lever link 307' is rotatably connected with another end of horizontal arm 310*b* of the reverse T-shaped feed adjuster 310 by a linking pin 308C, and the portion which becomes the operating point of the stitch feed adjusting lever 301 is rotatably connected with another end of the second adjusting lever link 307' by a linking pin 308D. In the stitch feed adjusting lever 301 and the inter-stitch feed adjusting lever 302, the portions which become the fulcrums respectively are rotatably equipped to an adjusting lever shaft 303 which is fixed to the arm 2. Besides, between the inter-stitch feed adjusting lever 302 and the stitch feed adjusting lever 301 which are rotatably equipped to a adjusting lever shaft 303, a vertical arm end 304*a* of a T-shaped adjusting lever partition plate 304 is equipped to the adjusting lever shaft 303, and it is fixed to the arm 2 by a setscrew 313A and 313B so that one end of the horizontal arm 304*b* which becomes the horizontal arm is positioned upward and another end of the horizontal arm 304*c* is positioned downward. Further, a partition plate upper spacer 305 is fixed to one end of horizontal arm 304*b* which becomes the horizontal arm by the setscrew 313A, and a partition plate lower spacer 306 is fixed to another end of horizontal arm 304*c* by the setscrew 313B. The partition plate upper spacer 305 is the limiter of the upward position of the portion which becomes the point of force of the inter-stitch feed adjusting lever 302 and the stitch feed adjusting lever 301, and the partition plate lower spacer 306 is the limiter of the downward position of the portion which becomes the point of force of the inter-stitch feed adjusting lever 302 and the stitch feed adjusting lever 301. The inter-stitch feed adjusting lever 302 and the stitch feed adjusting lever 301 are pivotally supported to the adjusting lever shaft 303 that the portion which becomes the fulcrum is firmly fixed to the arm 2, and it is fixed to the position which is set up by the operation of the portion of the point of force which becomes the operating finger grip in the state pressed by the elastic member such as the wavelike washer. Hereinafter, this fixing state is called semi-fixing.

Besides, as shown in FIG. 1 and FIG. 2, a feed mode changeover mechanism 350 which is changed over in sequence to each fabric workpiece feed mode corresponding to the stitch length feed and the inter-stitch pitch feed respectively every one skip stitch set is equipped. In this description, "skip stitch set" means a set of the handstitch and the locked stitch.

As shown in FIG. 11, the feed mode changeover mechanism 350 is equipped with a feed changeover triangular cam 351 which is firmly fixed to the intermediate shaft 8 and has two deviating points and a feed changeover rod 352 which contacts to the outside of the feed changeover triangular cam 351. A connecting end 352*a* of the feed changeover rod 352 is pivotally attached to one end of a stitch length changeover link 355, and another end of the stitch length changeover link 355 is pivotally attached to a vertical arm end 310*c* of the reverse T-shaped feed adjuster 310. Concretely, the feed changeover triangular cam 351 is in contact with the outside of an almost quadrangular cam hole 352*b* which is formed in the feed changeover rod 352, and the connecting end 352*a* of the feed changeover rod 352 is rotatably connected to one end of the stitch length changeover link 355 by a linking pin 354, and another end of the stitch length changeover link 355 is rotatably connected to the vertical arm end 310*c* of the reverse T-shaped feed adjuster 310 by a linking pin 312.

In the feed changeover triangular cam 351, although one skip stitch set having two even-numbered deviating points is formed, not only this, as a feed changeover cam having four or more even-numbered deviating points, the forming of the multiple skip stitch sets is also possible.

Besides, as shown in FIG. 11, the cloth feed drive mechanism 700 is equipped with a horizontal feed connection link 712 whose one end is pivotally attached to the connecting end 352*a* of the feed changeover rod 352, a horizontal feed connection crank 709 whose first arm 709*a* is pivotally attached to another end of the horizontal feed connection link 712, and a horizontal feed rod link 707 whose one end is pivotally attached to a second arm 709*b* of the horizontal feed connection crank 709 and another end is pivotally attached to the horizontal feed vertical rod 704. Concretely, one end of the horizontal feed connection link 712 is rotatably connected with the connecting end 352*a* of the feed changeover rod 352 by the linking pin 354, and another end of the horizontal feed connection link 712 is rotatably connected with the first arm 709*a* of the horizontal feed connection crank 709 by a linking pin 711, and the second arm 709*b* of the horizontal feed connection crank 709 rotatably connects with one end of the horizontal feed rod link 707 by a linking pin 708. Another end of the horizontal feed rod link 707 rotatably connects with the horizontal feed vertical rod 704 and an arm end 702*a* of the horizontal feed drive rod 702 by the linking pin 703.

In addition, an intermediate shaft driven pulley 26 is fixed to one end of the intermediate shaft 8, and a timing belt TB which is the endless belt is wound between this intermediate shaft driven pulley 26 and the upper shaft drive pulley 25 which is fixed to the upper shaft 5. In this intermediate shaft driven pulley 26 and the upper shaft drive pulley 25, a rotational motion is transmitted to the intermediate shaft 8 by decelerating one-half from the upper shaft 5.

The operations of the feed quantity setting mechanism 300 and the feed mode changeover mechanism 350 are explained in detail in the after-mentioned explanation of operation.

As shown in FIG. 1 and FIG. 2, the shuttle hook 200 and the shuttle hook drive mechanism 220 are located under the throat plate 12, and these are the shuttle hooks that the sewing thread 20 is wound and the sewing thread 20 is drawn out of a thread exit 212*a*. These have following mechanism composition. That is, during the first stroke, When the open eye needle 13 comes down from the upper dead center, pierces the fabric workpiece 21 and goes up from the lower dead center, the shuttle hook 200 performs the half-turn reverse rotation, and the sewing thread 20 is tightened by further reverse rotation along with the rising of the open eye needle 13 which captures the sewing thread 20 by the thread capturing open eye 13*a*. And, during the second stroke, when the open eye needle 13 comes down from the upper dead center, pierces the fabric workpiece 21 and goes up from the lower dead center, the open eye needle 13 has a loop-taker point 205*a* which scoops the captured sewing thread 20 by the thread capturing open eye 13*a* according to the half-turn normal rotation of the shuttle hook, and the shuttle hook 200 scoops the captured sewing thread 20 by the loop-taker point 205*a* of the shuttle hook by the rotation of the shuttle hook and releases it from the thread capturing open eye 13*a*. And the shuttle hook 200 guides the released sewing thread 20 into the shuttle hook by the further rotation of the shuttle hook, thereby the sewing thread 20 can be interlaced to the sewing thread 20 which is wound in the shuttle hook.

Figure 12:
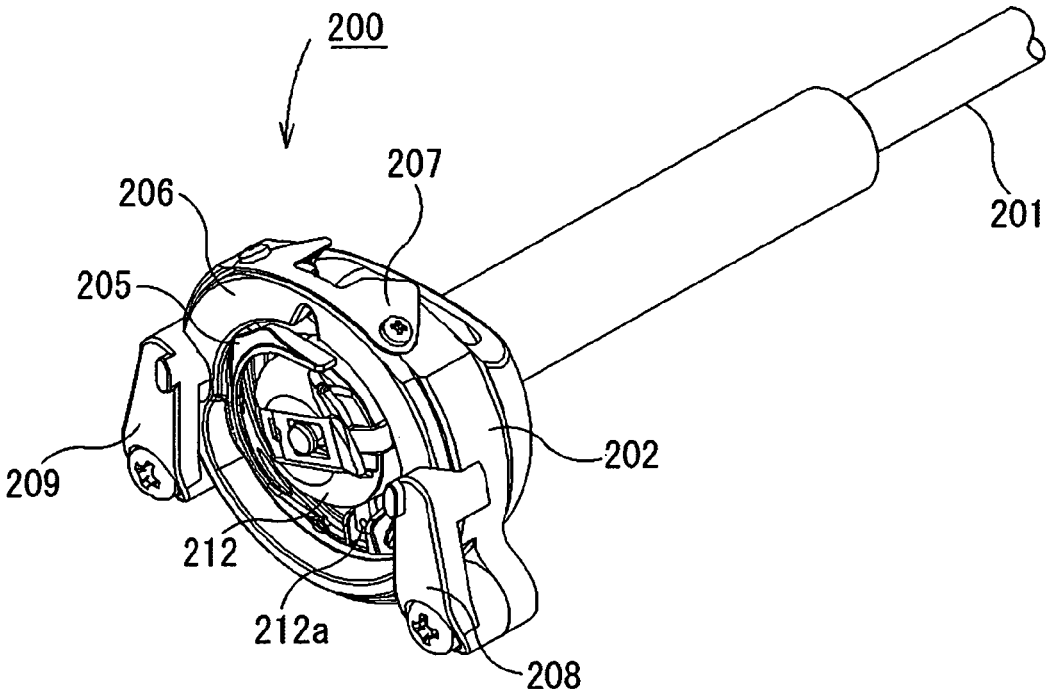
FIG. 12 A perspective view showing the shuttle hook in the single-thread locked handstitch sewing machine of this invention.
Figure 13:
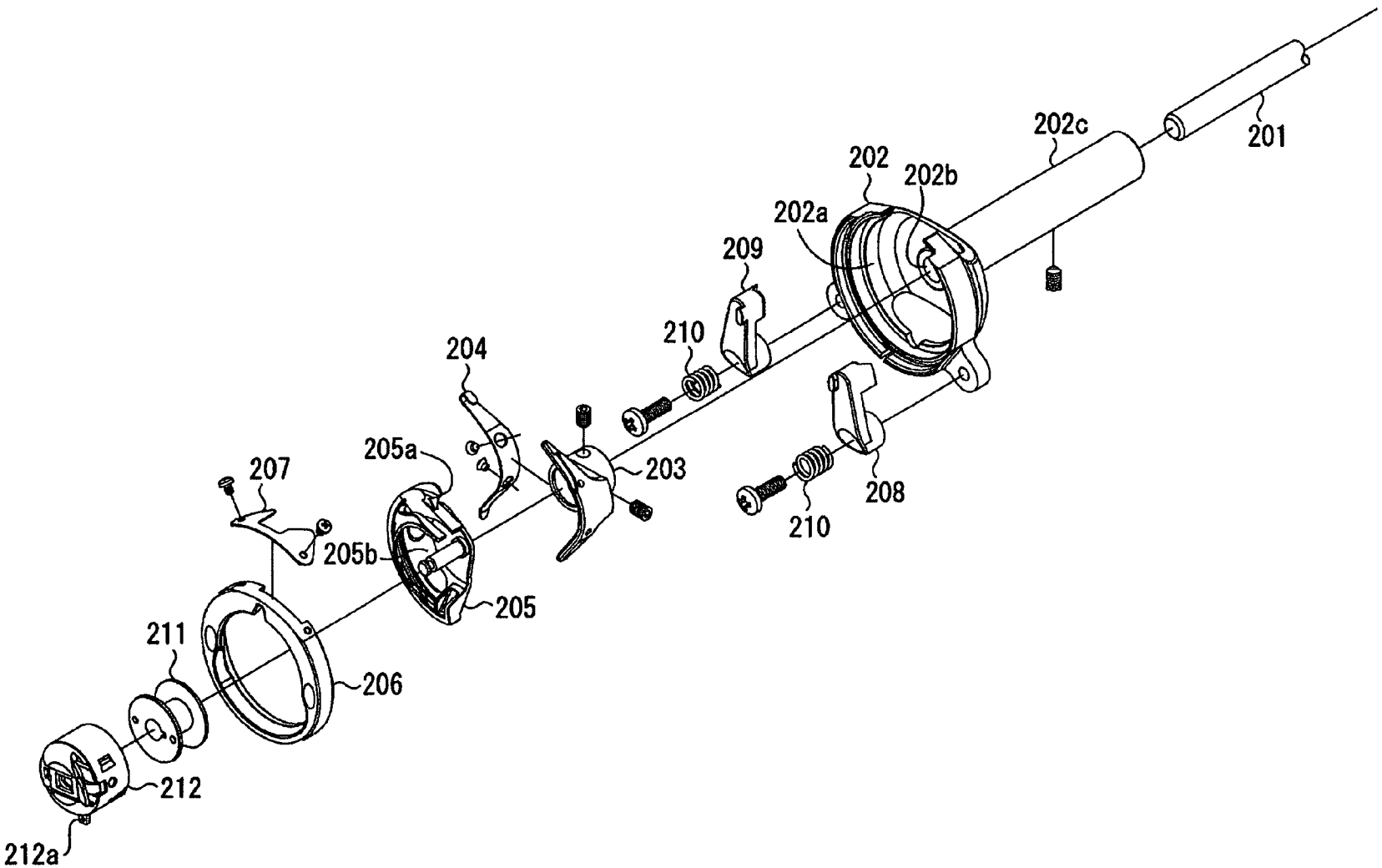
FIG. 13 An exploded perspective view showing the shuttle hook in the single-thread locked handstitch sewing machine of this invention.

In such the shuttle hook 200, as shown in FIG. 12 and FIG. 13, a bobbin case 212 which houses a bobbin 211 that the sewing thread 20 is wound is incorporated in the inner shuttle hook 205, and the bobbin case 212 is rotatably loaded together with the inner shuttle hook 205 in the shuttle race body 202. In this description, the "loading" means spanning and equipping. Concretely, the shuttle hook 200 is equipped with the bobbin case 212 which houses a bobbin 211 that the sewing thread 20 is wound, the inner shuttle hook 205 which has the loop-taker point 205*a* along with removably housing the bobbin case 212, and the shuttle race body 202 that the inner shuttle hook is rotatably housed and that the rotation stop is performed to the bed 3. The inner shuttle hook 205 has a bobbin case housing 205*b* which houses the bobbin case 212, and the bobbin case 212 is removably housed in the bobbin case housing 205*b*. The shuttle race body 202 has an inner shuttle hook driver 203 that an inner shuttle hook driver spring 204 is fixed and has an inner shuttle hook housing 202*a* which houses the inner shuttle hook 205. Besides, the shuttle race body 202 has a shuttle race body attaching portion 202*c* that a shuttle hook shaft hole 202*b* to insert rotatably to one end of the shuttle hook shaft 201 is equipped, and the rotation center of this shuttle hook shaft hole 202*b* and the inner shuttle hook housing 202*a* is concentric with the rotation center of the shuttle hook shaft 201.

The inner shuttle hook driver 203 is housed in the inner shuttle hook housing 202*a* of the shuttle race body 202 and is fixed to the shuttle hook shaft 201 which is inserted in the shuttle hook shaft hole 202*b*. In addition, the inner shuttle hook 205 and an inner shuttle hook holder 206 are housed in the inner shuttle hook housing 202*a*, and the inner shuttle hook holder 206 is fixed by a right inner shuttle hook holder pawl 208 and a left inner shuttle hook holder pawl 209 in the state that the spring force is given by an inner shuttle hook holder pawl spring 210. The predetermined gap exists between the inner shuttle hook 205 and the inner shuttle hook driver 203 in which the inner shuttle hook driver spring 204 is fixed. Besides, because the relation between the inner shuttle hook driver spring 204 of the inner shuttle hook driver 203 and the inner shuttle hook 205 can regulate the free rotation of the inner shuttle hook 205 at both ends of the inner shuttle hook driver spring 204. Therefore, when the inner shuttle hook driver 203 performs the half-turn normal rotation around the shuttle hook shaft 201, one end of the inner shuttle hook driver spring 204 abuts on the inner shuttle hook 205 and another end of the inner shuttle hook driver spring 204 has the gap $O_2$ between the inner shuttle hook 205 (refer to FIG. 18 (O)). In addition, when the inner shuttle hook driver 203 performs the half-turn reverse rotation around the shuttle hook shaft 201, another end of the inner shuttle hook driver spring 204 abuts on the inner shuttle hook 205 and one end of the inner shuttle hook driver spring 204 has the gap $O_1$ between the inner shuttle hook 205 (refer to FIG. 18 (E)). And, in the needle dropping direction of the inner shuttle hook holder 206, an upper spring 207 for adjusting the slack of the sewing thread 20 is fixed by the screw. Besides, in the bobbin case 212, the thread exit 212*a* is equipped in the direction and the position which depart from the throat plate by reverse rotation of the shuttle hook 200 when the open eye needle 13 goes up from the throat plate 12.

Figure 14:
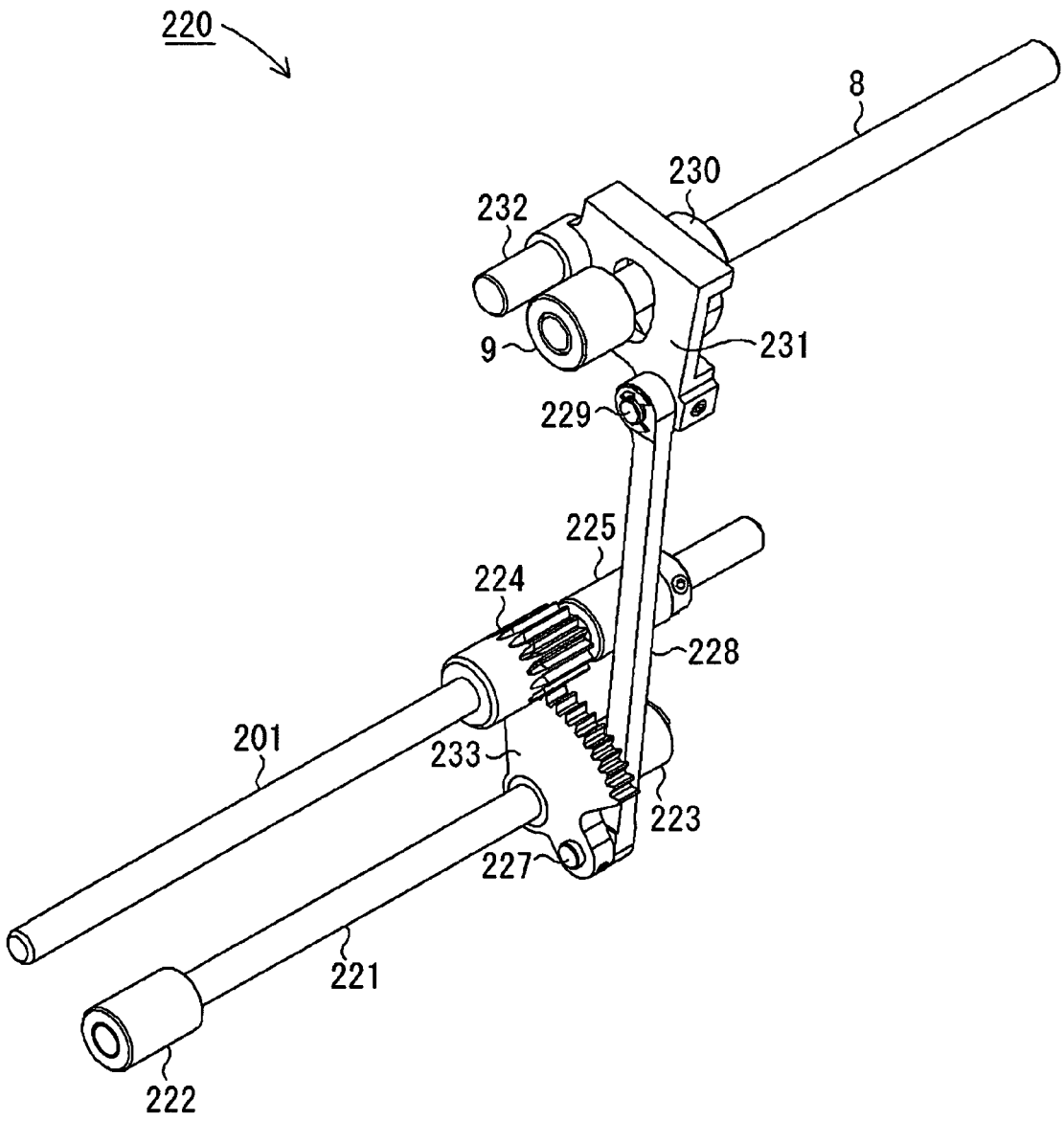
FIG. 14 A perspective view showing the shuttle hook drive mechanism in the single-thread locked handstitch sewing machine of this invention.
Figure 15:
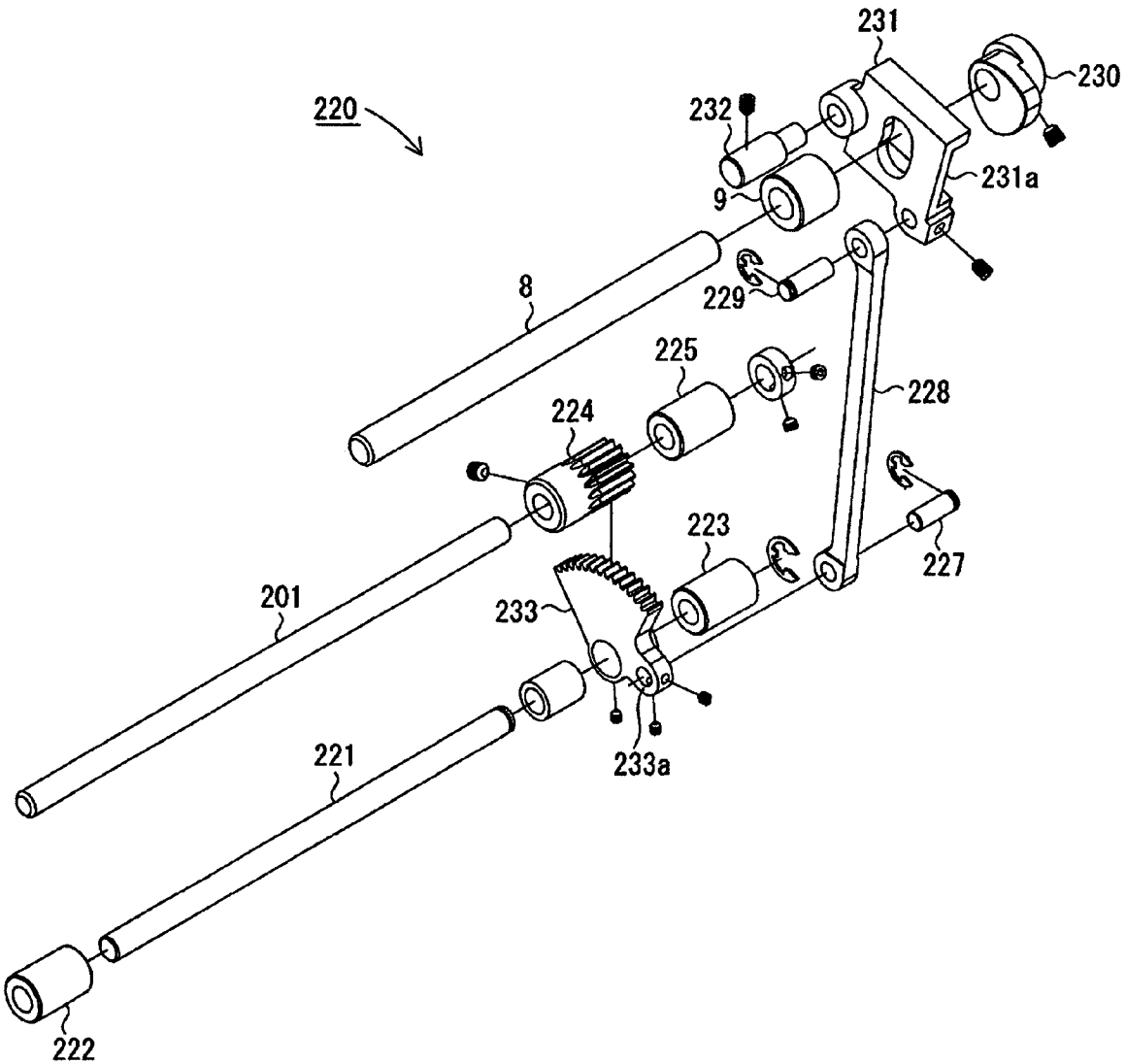
FIG. 15 An exploded perspective view showing the shuttle hook drive mechanism in the single-thread locked handstitch sewing machine of this invention.

As shown in FIG. 14 and FIG. 15, the shuttle hook drive mechanism 220 consists of a shuttle hook drive triangular cam 230 which is fixed to another end of the intermediate shaft 8 and is the eccentric cam, a shuttle hook drive fork 231 which contacts to the outside of the shuttle hook drive triangular cam 230, a shuttle hook drive vertical rod 228 which is connected with the portion that one end becomes the point of force of the shuttle hook drive fork 231, a shuttle hook drive fan-shaped gear 233 that an arm 233*a* is connected with another end of the shuttle hook drive vertical rod 228 and is fixed to a fan-shaped gear shaft 221, and a shuttle hook shaft gear 224 which is meshed to the shuttle hook drive fan-shaped gear 233 and is fixed to the shuttle hook shaft 201. Concretely, the shuttle hook drive triangular cam 230 contacts to the outside of an almost square-shaped cam groove 231*a* which is formed in the shuttle hook drive fork 231, and one end of the shuttle hook drive vertical rod 228 is rotatably connected with the portion which becomes the point of force of the shuttle hook drive fork 231 by a linking pin 229, besides another end of the shuttle hook drive vertical rod 228 is rotatably connected with the arm 233*a* of the shuttle hook drive fan-shaped gear 233 by a linking pin 227. In addition, the portion which becomes the fulcrum of the shuttle hook drive fork 231 is pivotally supported by a shuttle hook drive fork shaft 232, and this shuttle hook drive fork shaft 232 is fixed to the arm 2. The fan-shaped gear shaft 221 is arranged on the bed 3 so that the axial direction becomes horizontal, and is rotatably set up by a fan-shaped gear shaft former bushing 222 and a fan-shaped gear shaft rear bushing 223.

In the shuttle hook drive mechanism 220 of such a composition, when the intermediate shaft 8 rotates, because the shuttle hook drive fork 231 lets the shuttle hook drive vertical rod 228 perform up-and-down motion by making the shuttle hook drive fork shaft 232 the fulcrum by eccentric motion of the shuttle hook drive triangular cam 230, the shuttle hook drive fan-shaped gear 233 performs the reciprocating rocking. Based on this reciprocating rocking of the shuttle hook drive fan-shaped gear 233, because also the shuttle hook shaft 201 that the shuttle hook shaft gear 224 is fixed performs the reciprocating rotating movement with the constant rotating angle, the inner shuttle hook 205 of the shuttle hook 200 can perform the half-turn normal rotation and the half-turn reverse rotation.

As shown in FIG. 1 and FIG. 2, the thread draw out drive mechanism 400 has following mechanism composition. That is, when the thread capturing open eye 13*a* of the open eye needle 13 captures the sewing thread 20, the thread draw out actuator 401 gives the tension to the sewing thread 20 which is drawn out from the thread exit 212*a* by rotation of the shuttle hook 200 by abutting circumferentially on the open eye needle 13, and thread draw out actuator 401 can tighten the sewing thread 20 which guides out from the shuttle hook 200. In this description, "abut circumferentially on" means abutting circumferentially on the certain portion. This thread draw out actuator 401 has following function. That is, after the sewing thread 20 which is captured by the thread capturing open eye 13*a* is scooped by the loop-taker point 205*a* of the shuttle hook 200, the thread draw out actuator 401 hooks the sewing thread 20 which is drawn out from the thread exit 212*a* of the shuttle hook 200, and tightens the thread by drawing out the thread from the shuttle hook 200. And after the thread draw out actuator 401 captures the sewing thread 20 by the thread capturing open eye 13*a*, it releases the sewing thread 20 which is hooked.

Figure 16:
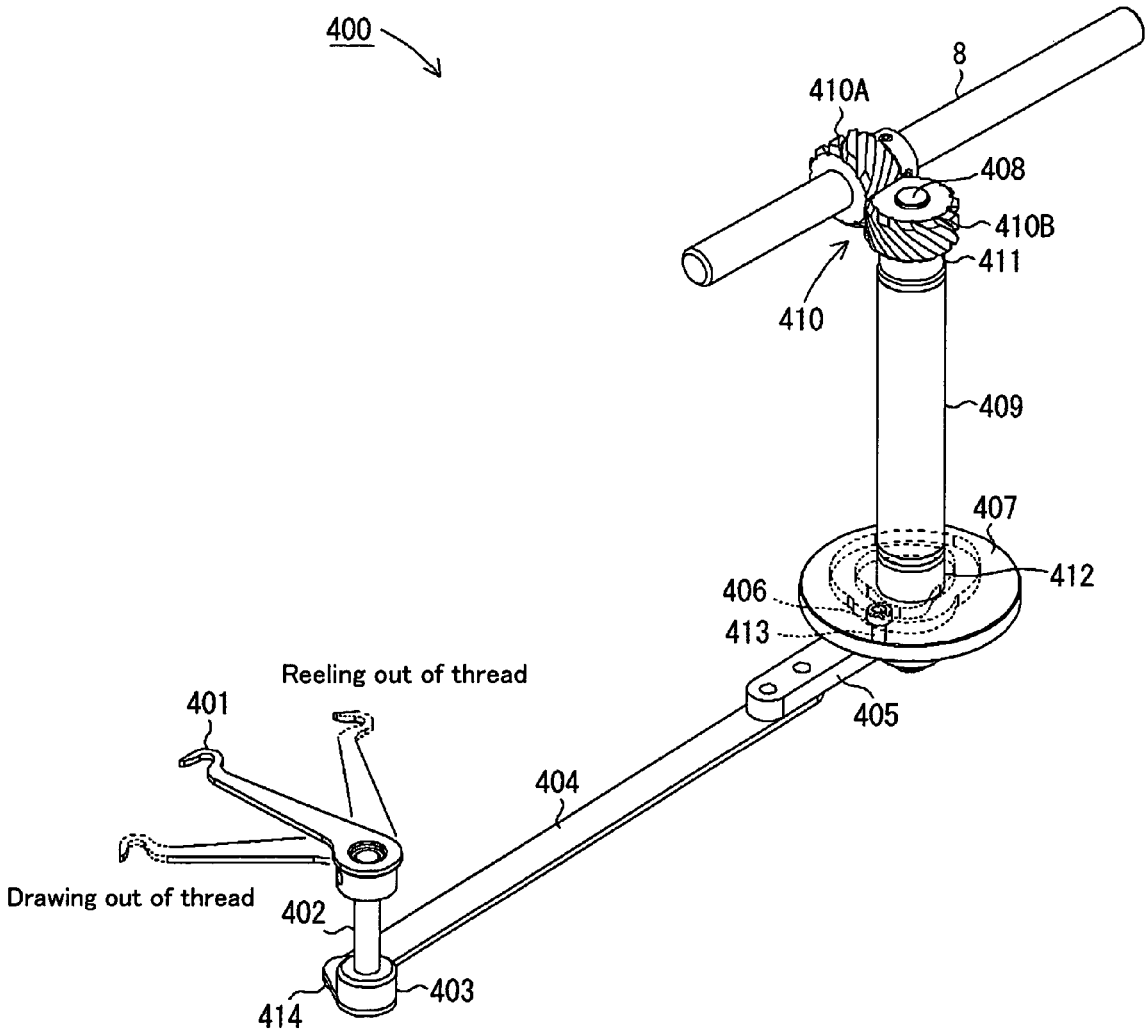
FIG. 16 A perspective view showing the thread draw out mechanism in the single-thread locked handstitch sewing machine of this invention.
Figure 17:
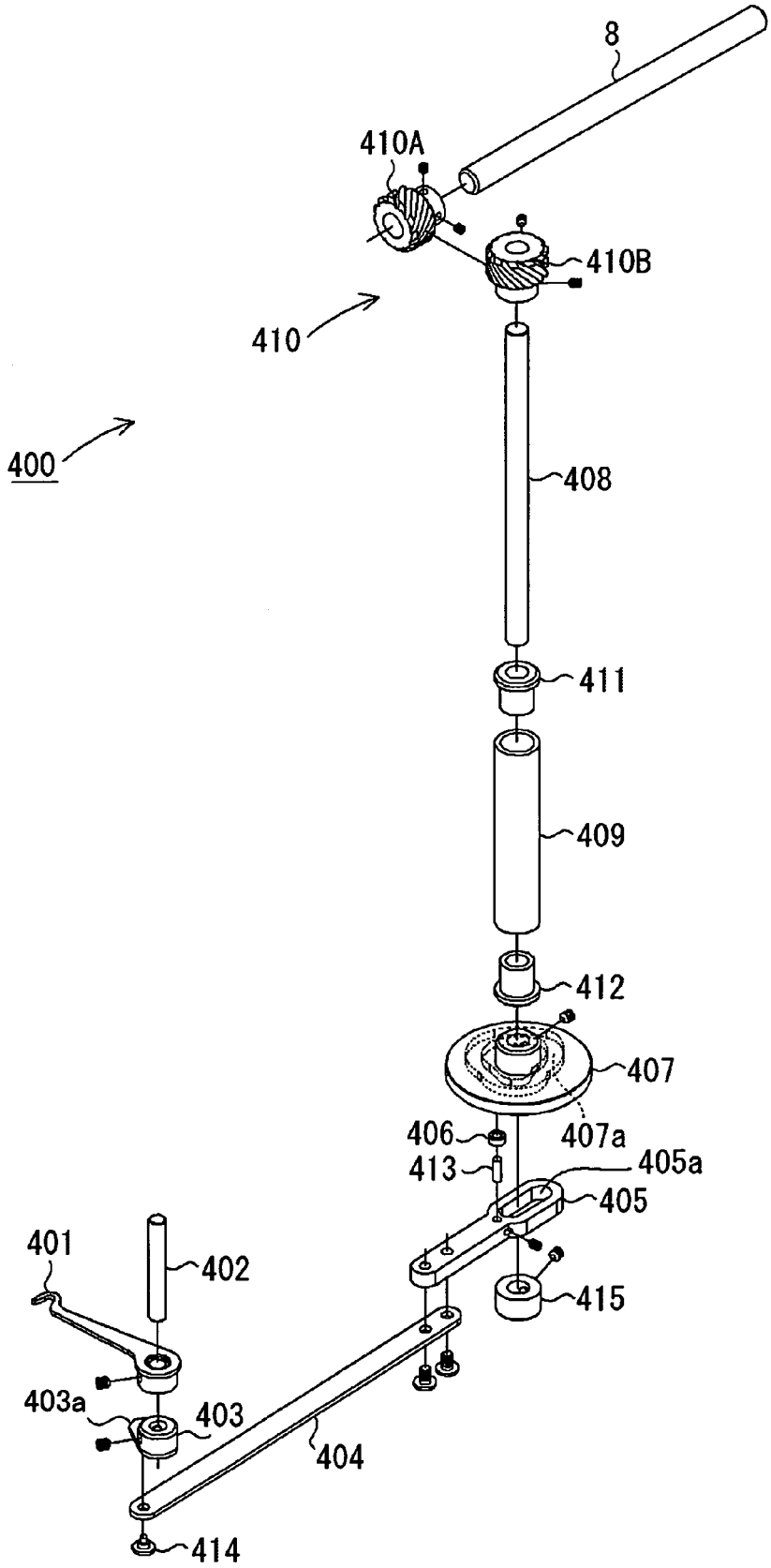
FIG. 17 An exploded perspective view showing the thread draw out mechanism in the single-thread locked handstitch sewing machine of this invention.
Figure 18A:
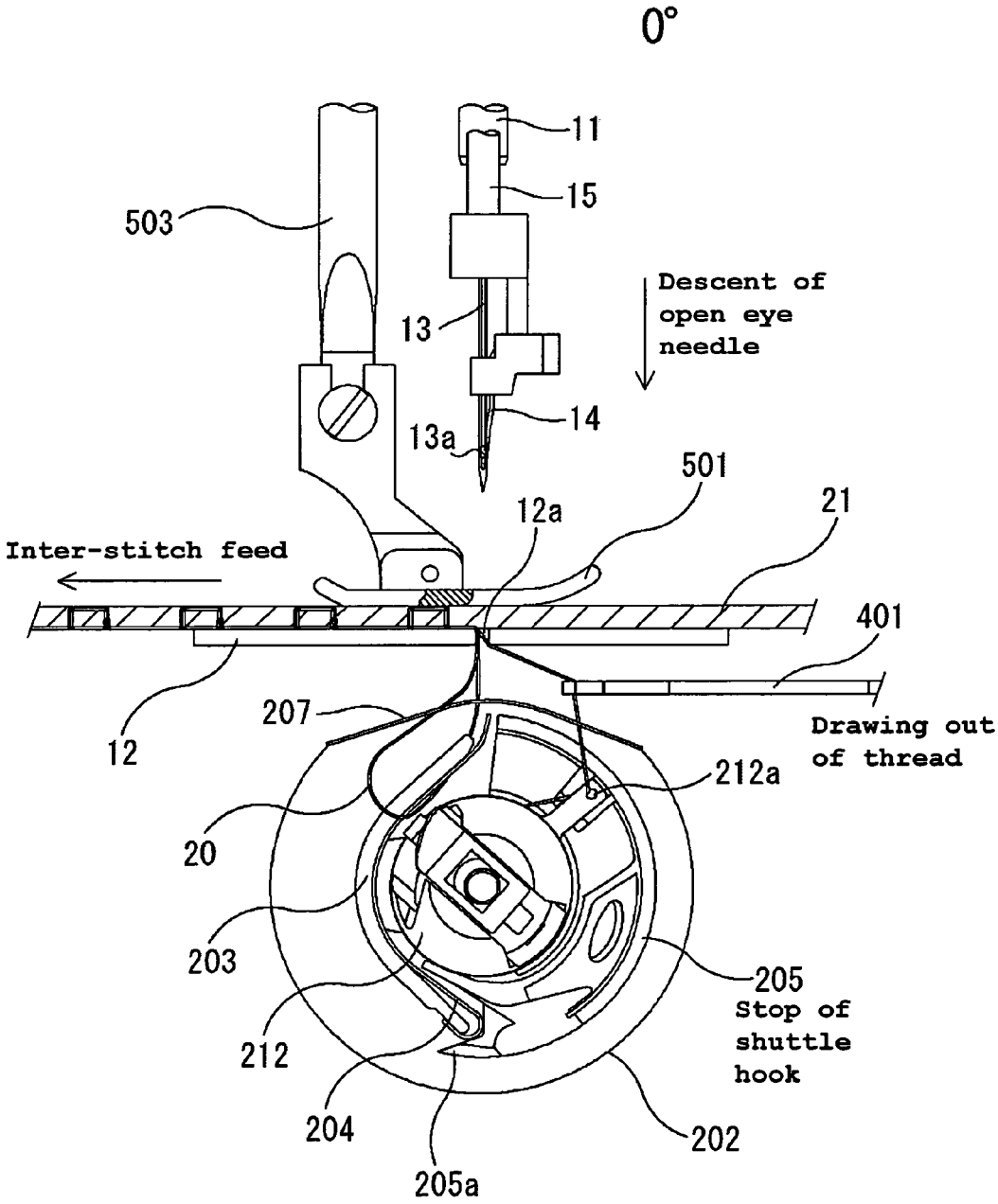
FIG. 18 (A) A movement explanatory view showing the method for forming single-thread locked handstitches about the movement of the single-thread locked handstitch sewing machine by this invention.
Figure 18B:
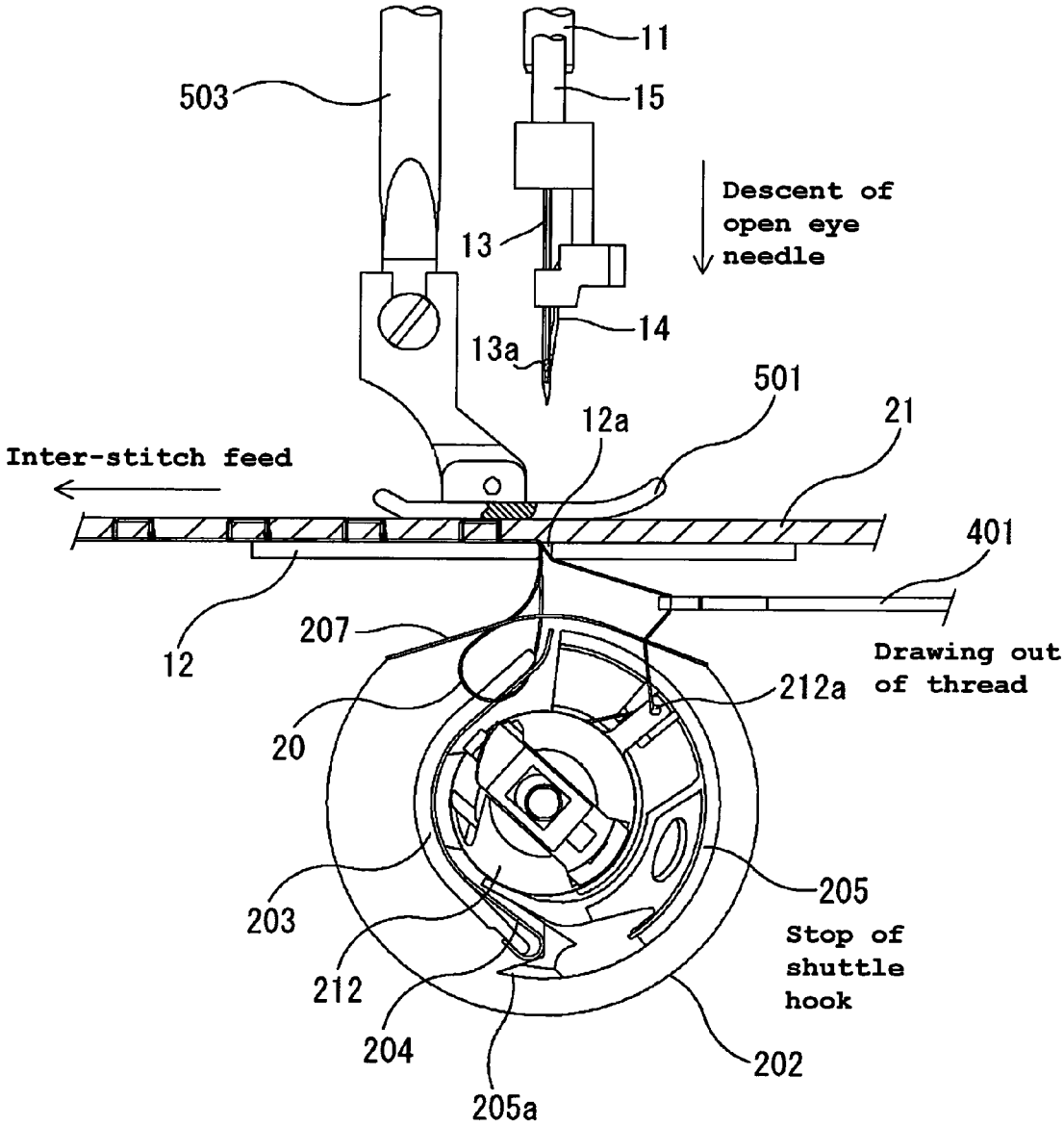
Figure 18C:
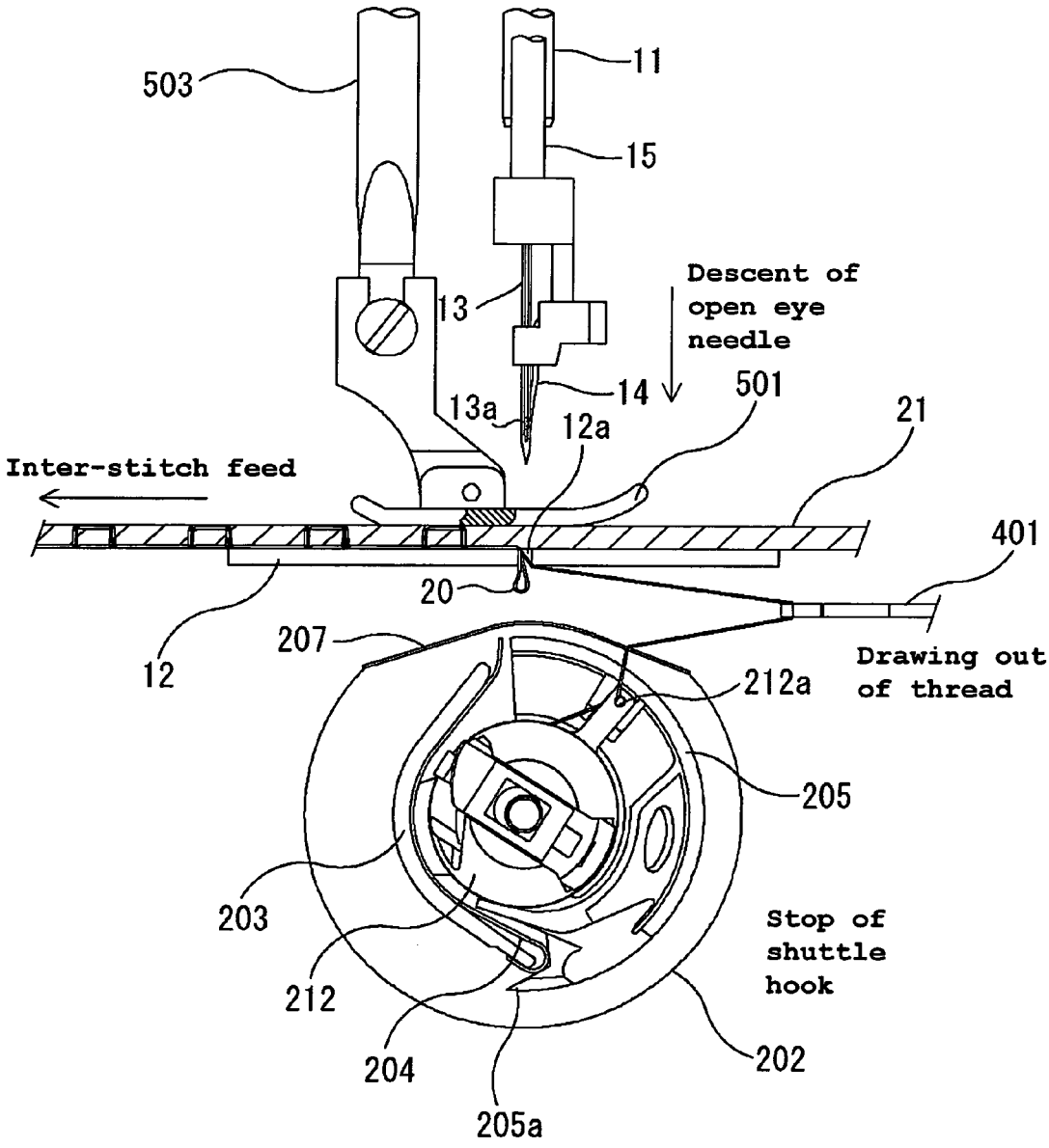
Figure 18D:
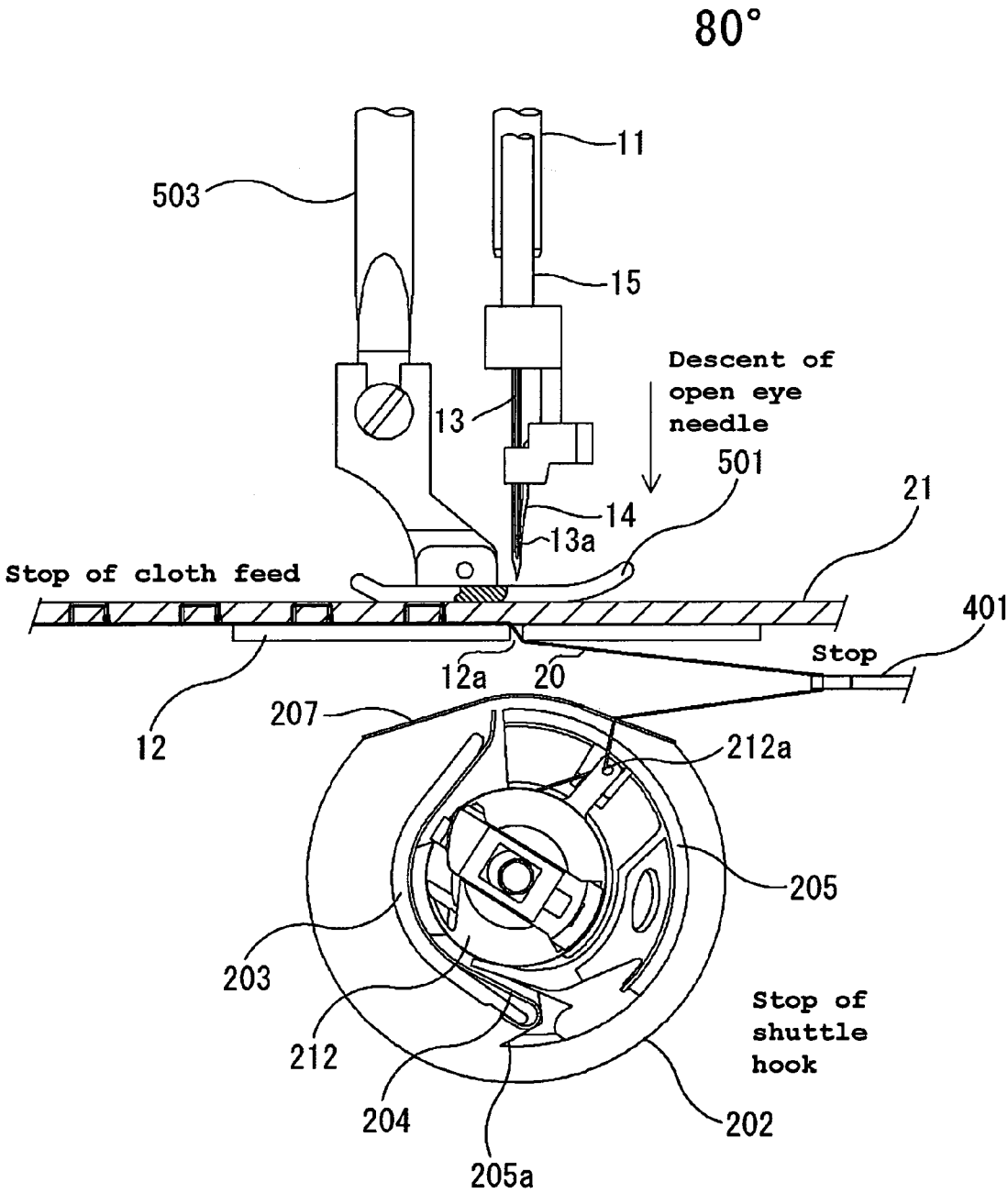
Figure 18E:
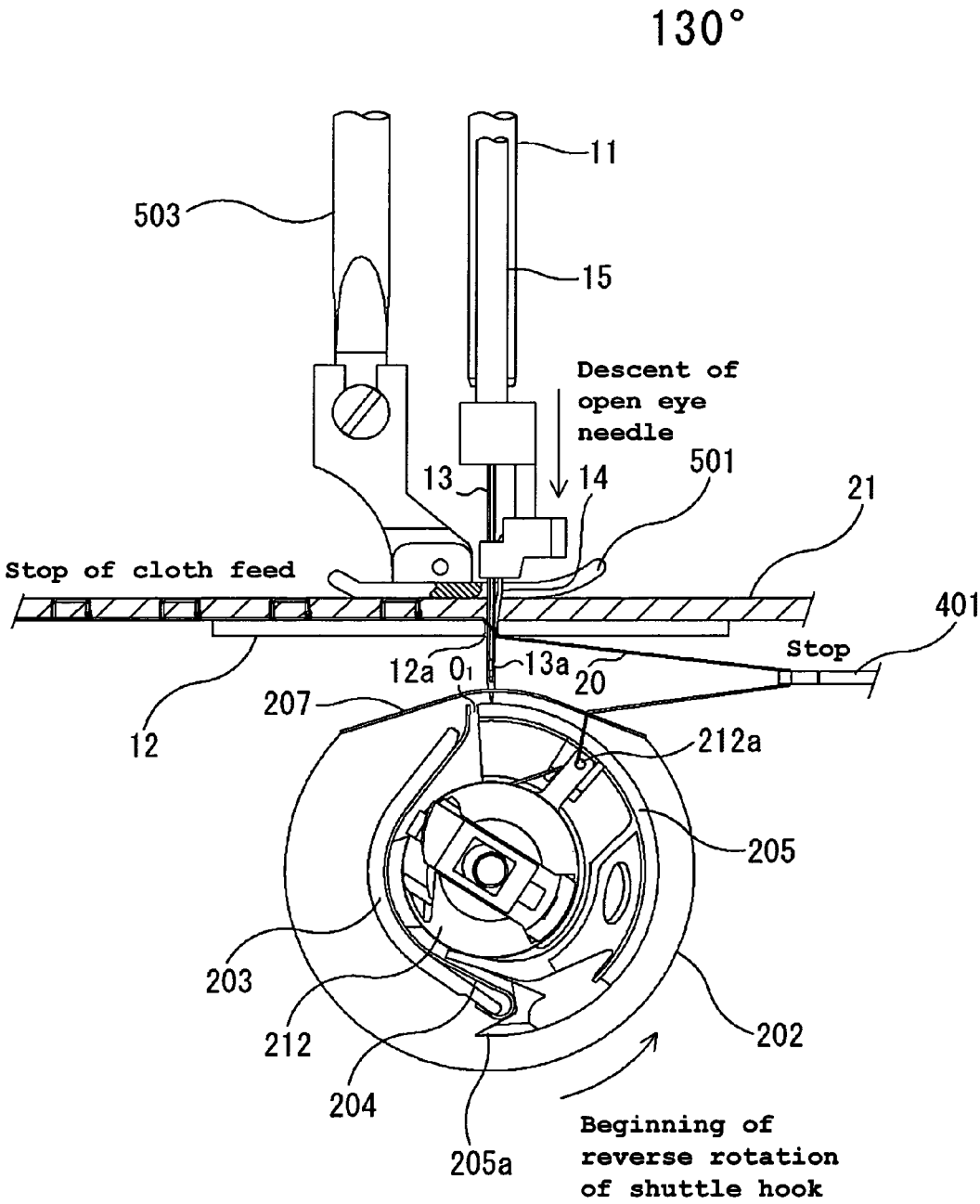
Figure 18F:
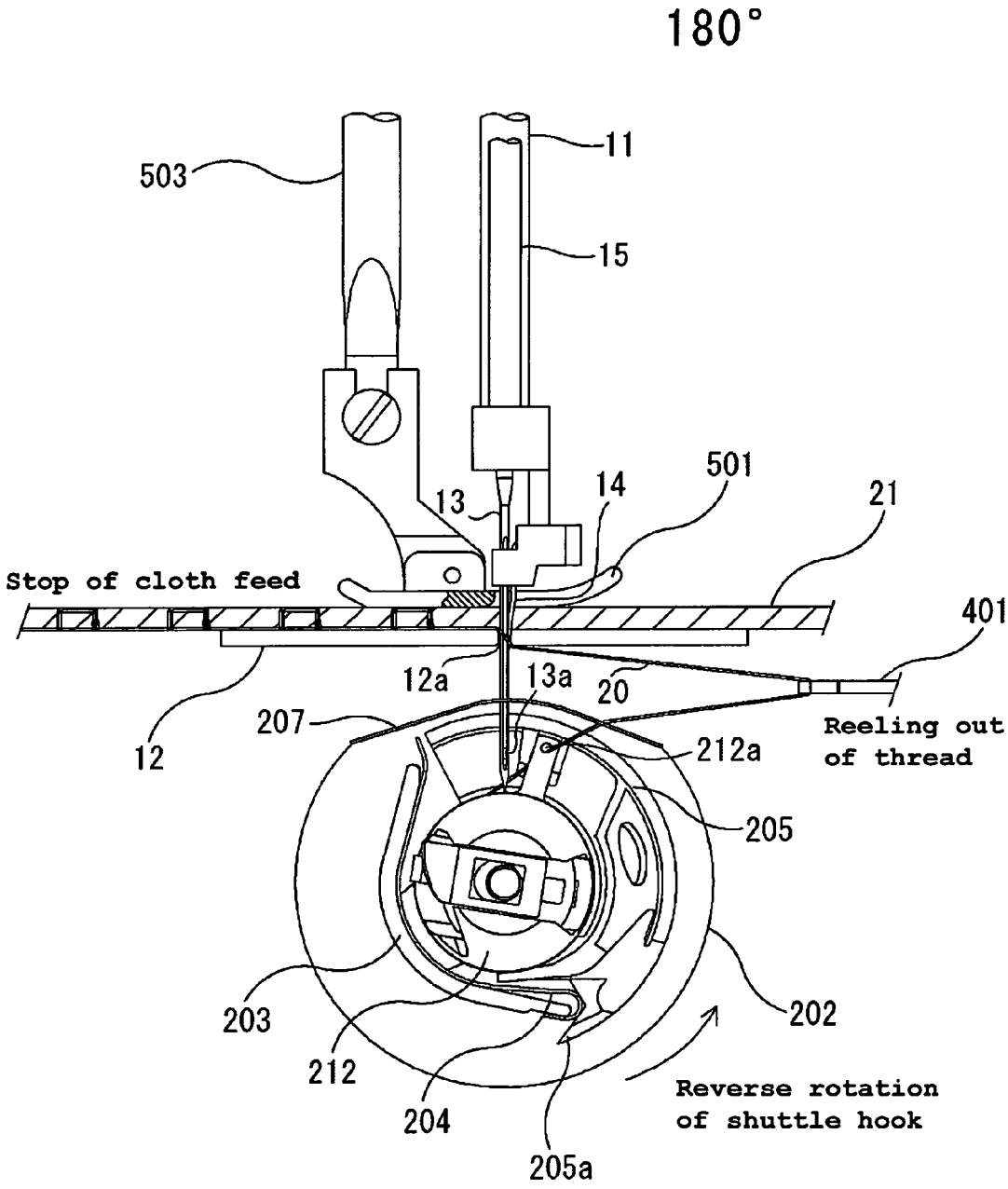
Figure 18G:
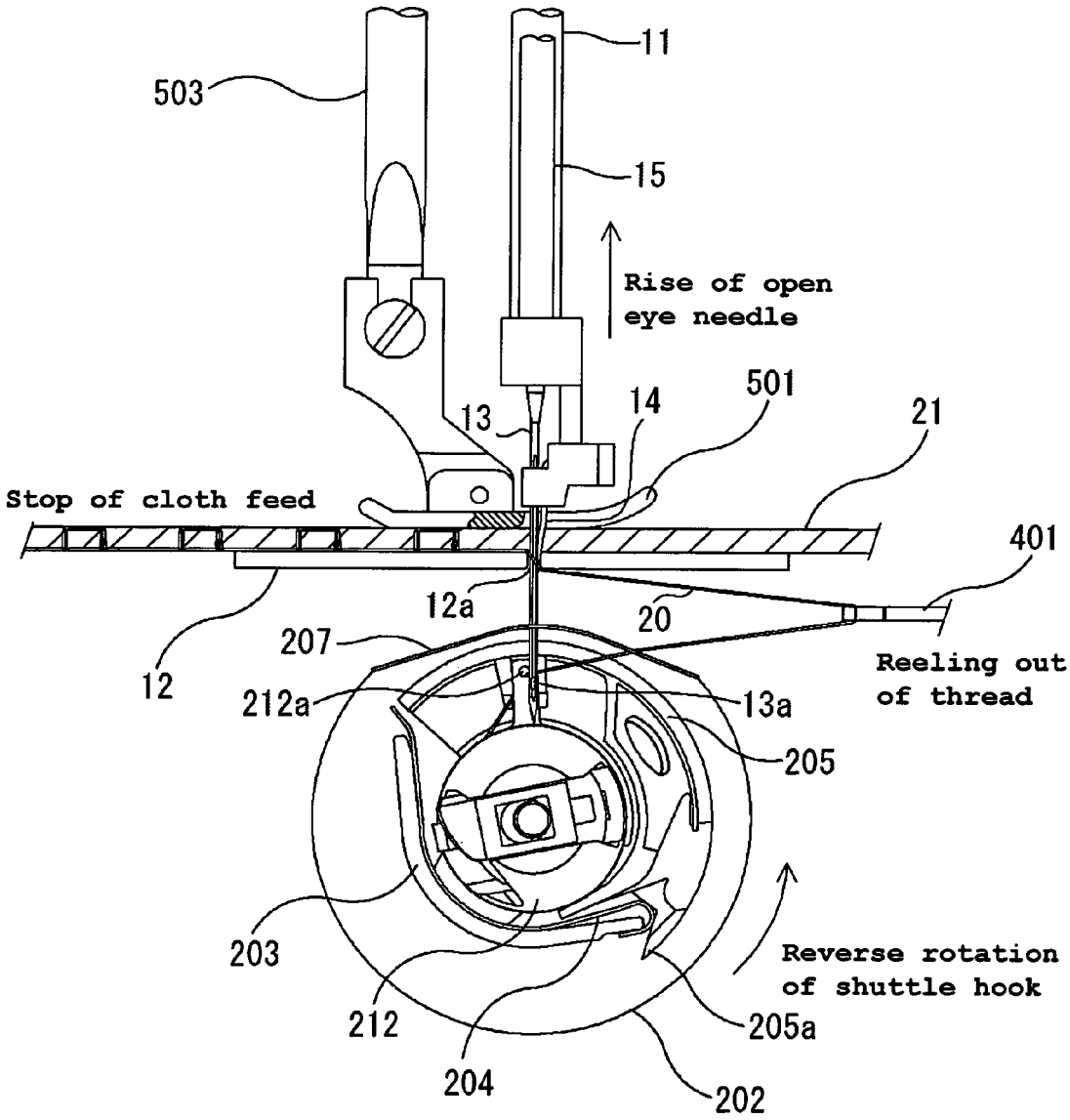
Figure 18H:
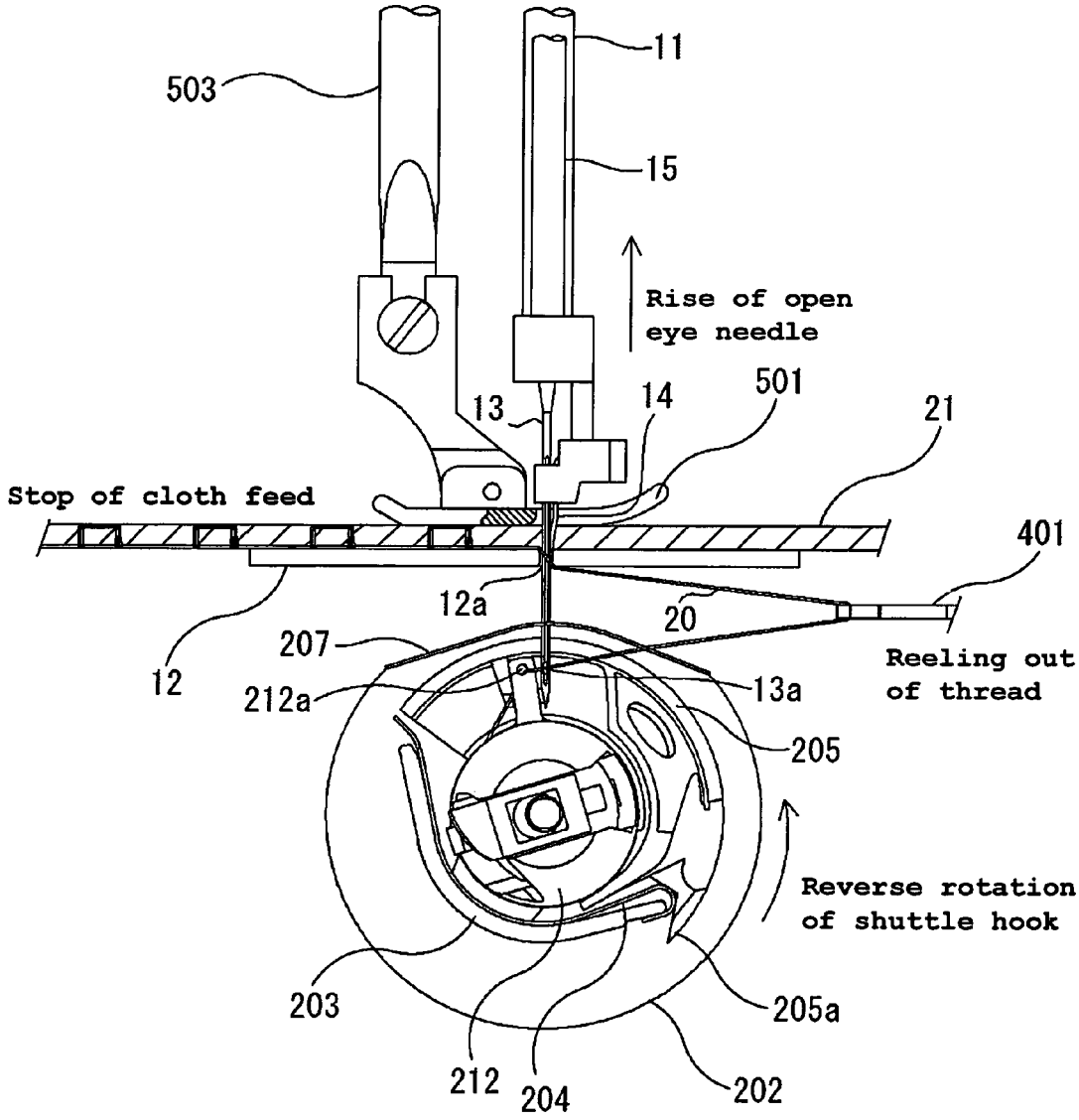
Figure 18I:
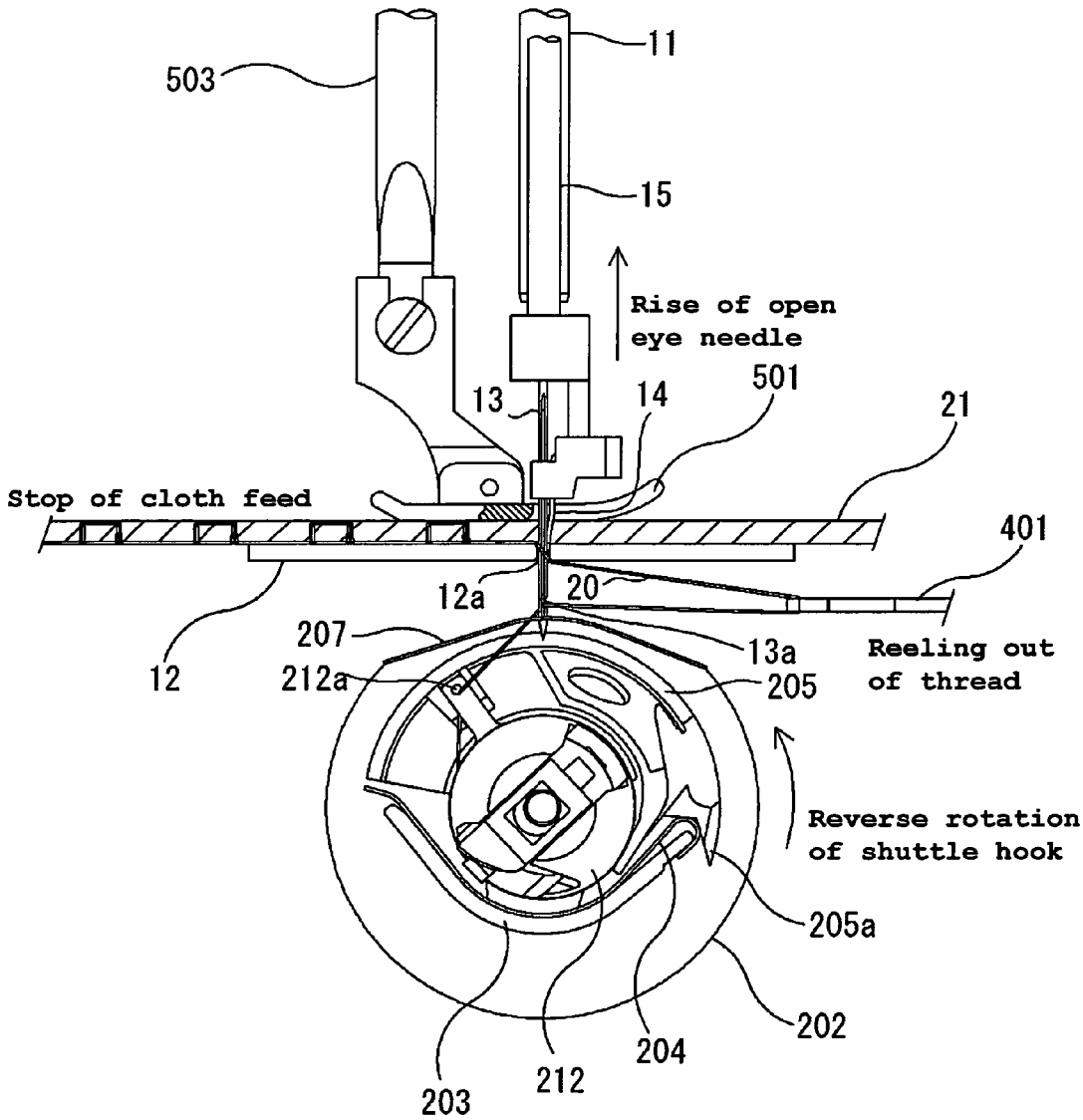
Figure 18J:
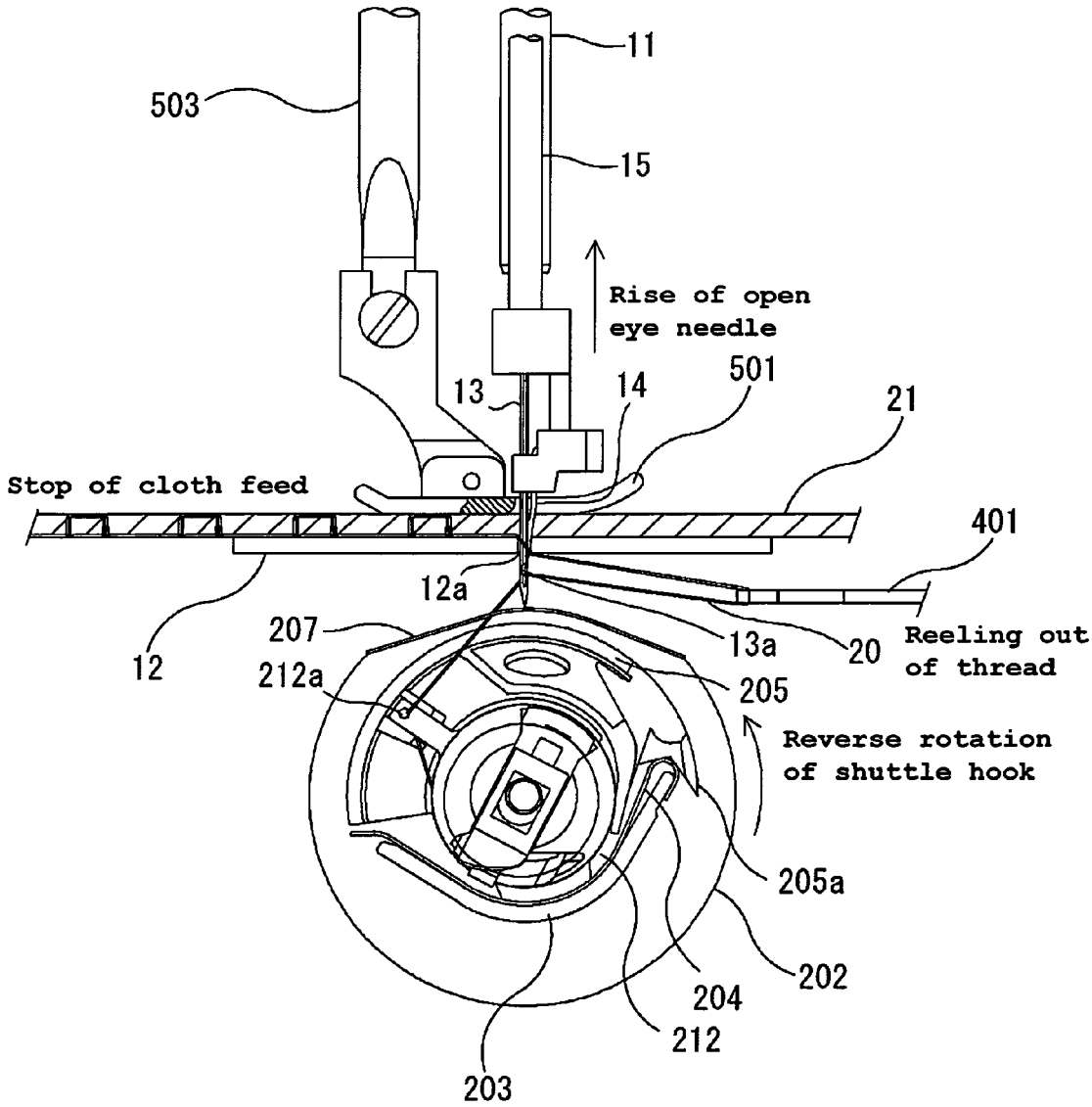
Figure 18K:
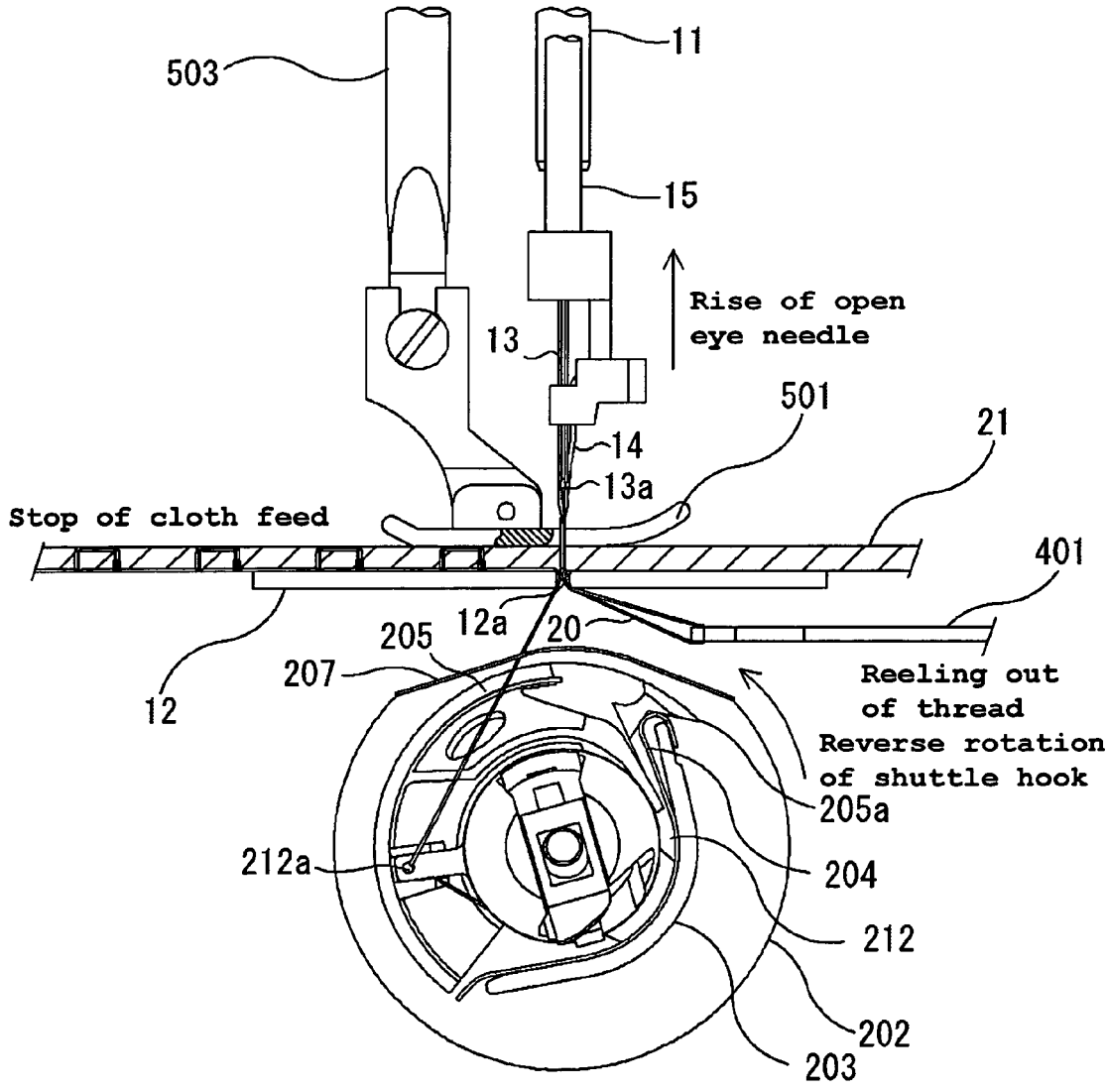
Figure 18L:
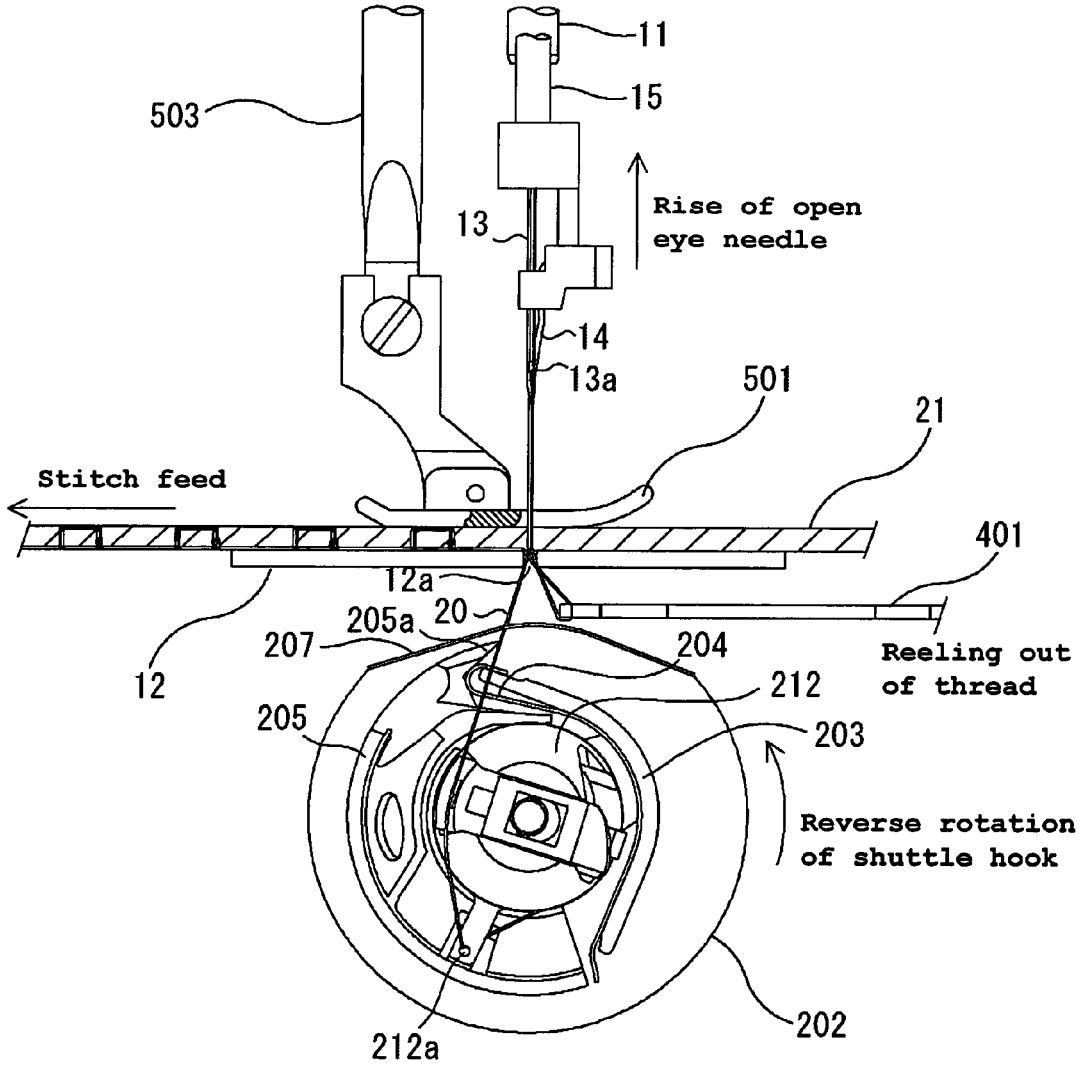
Figure 18M:
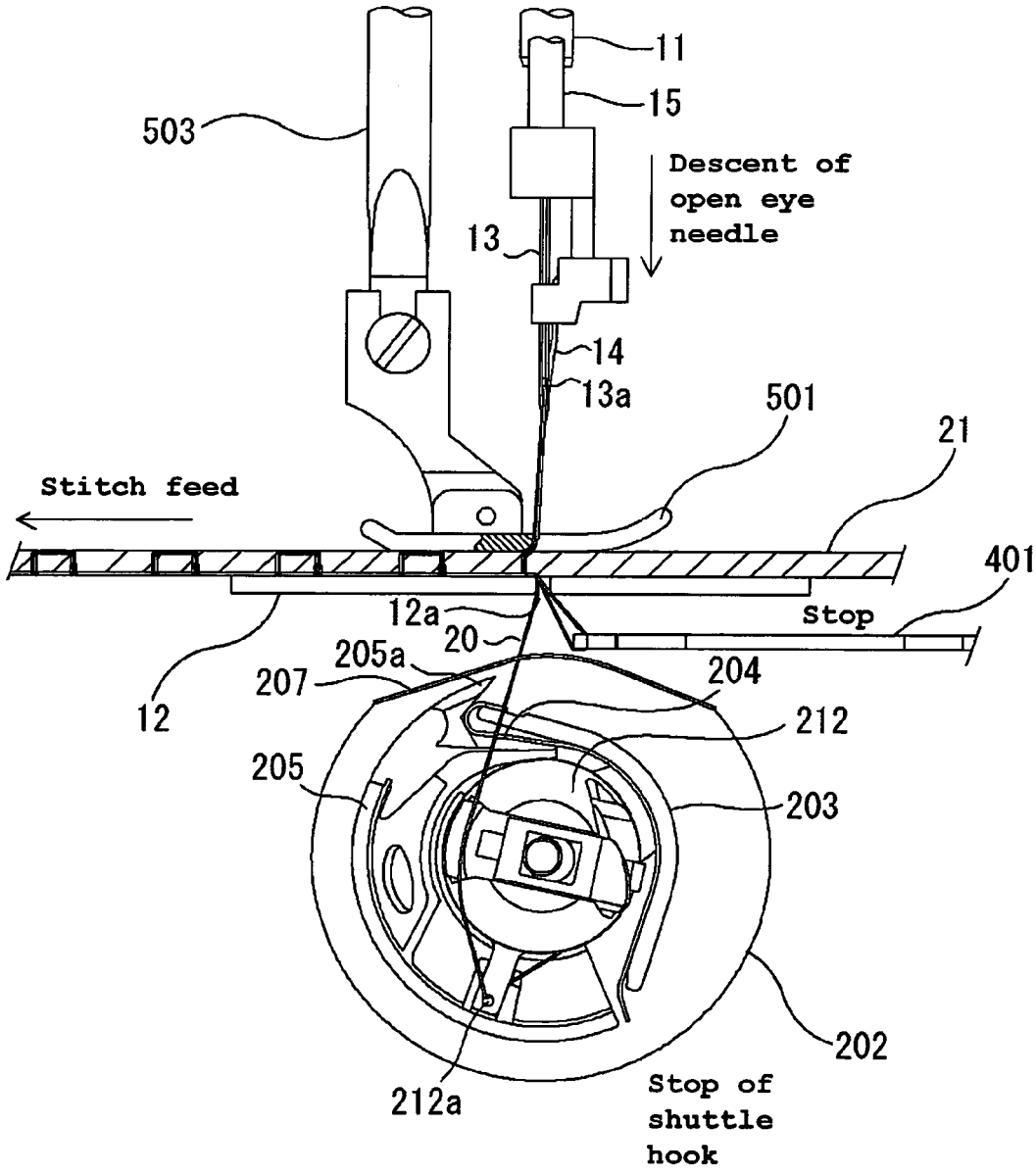
Figure 18N:
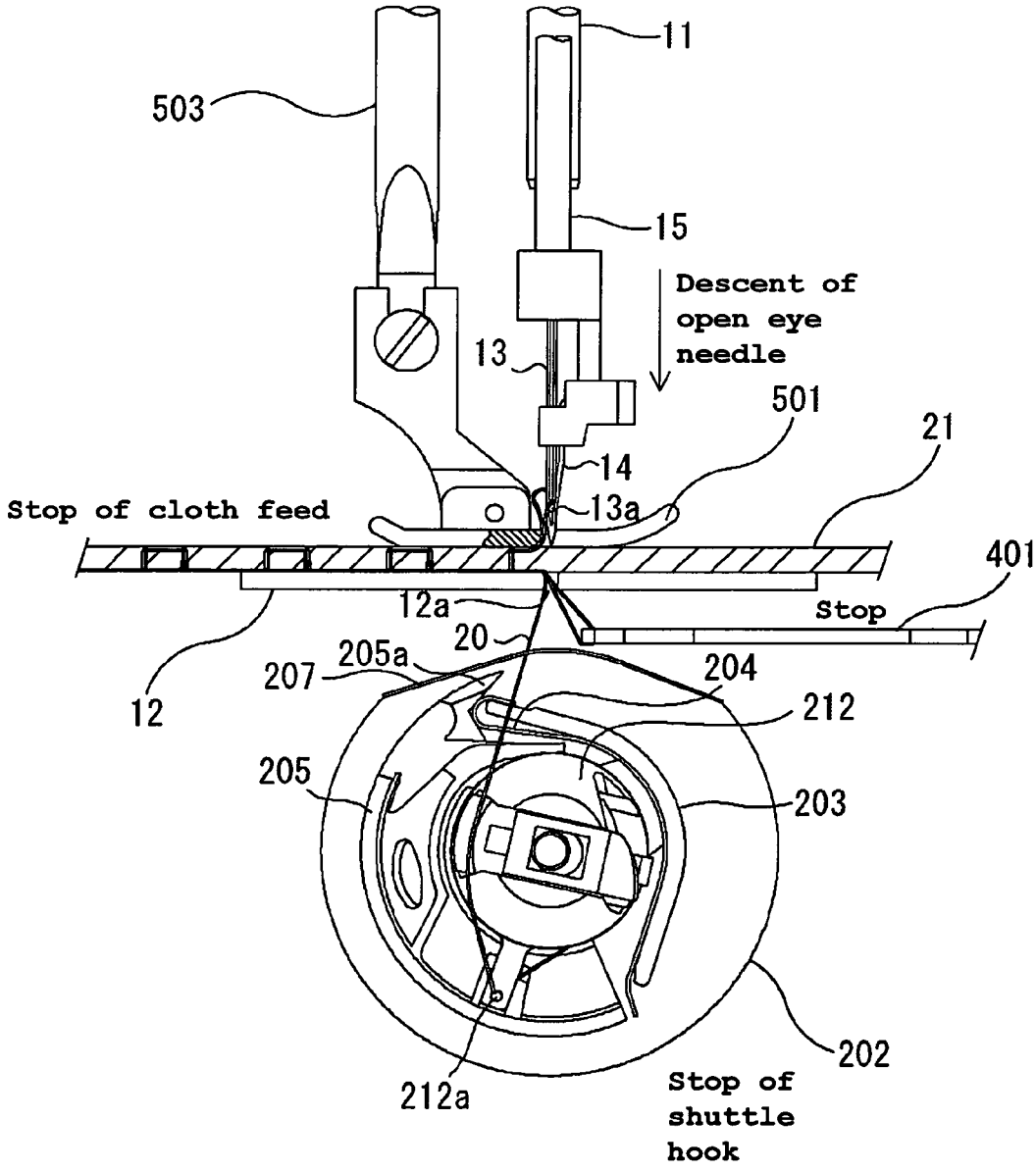
Figure 18O:
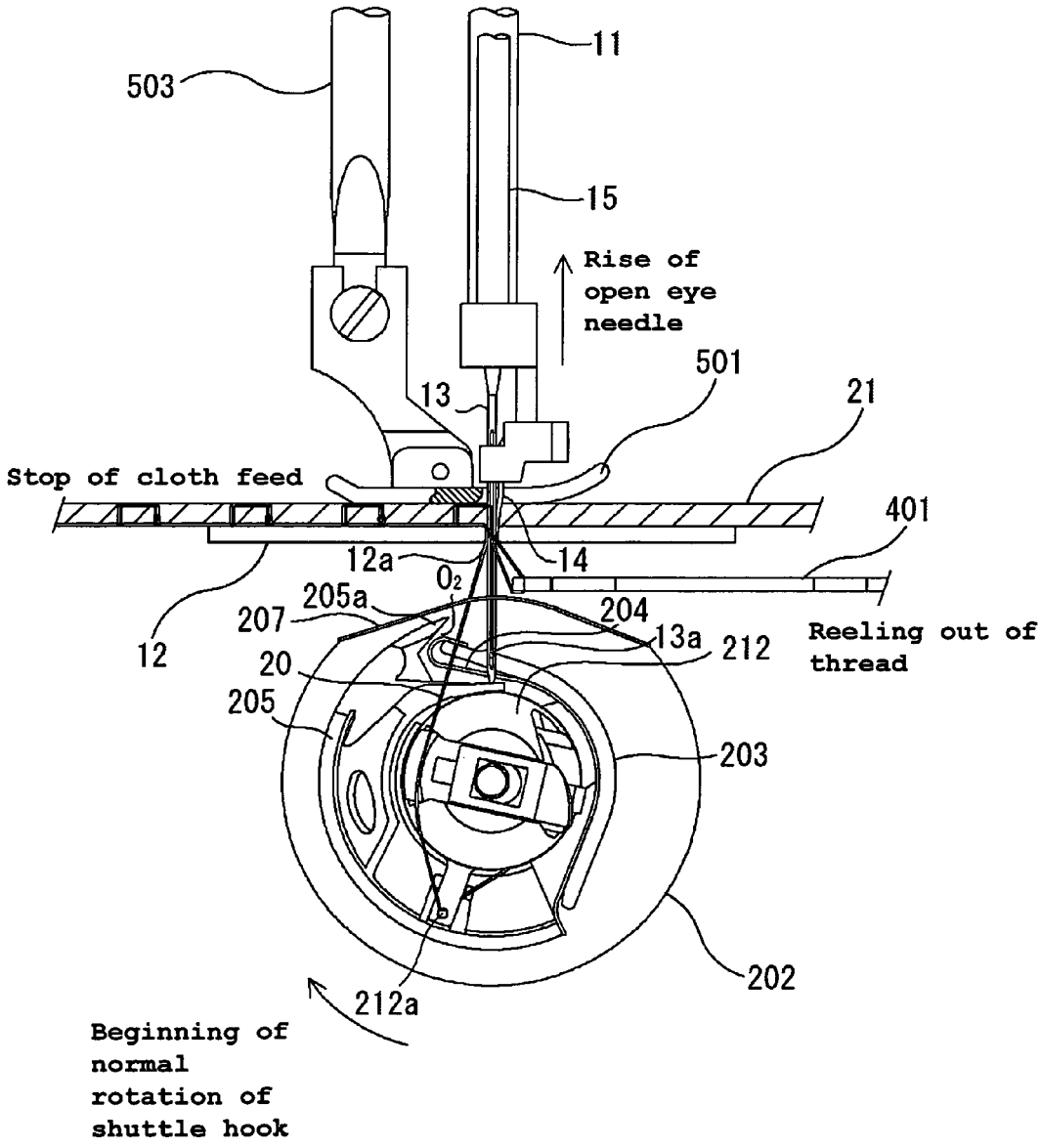
Figure 18P:
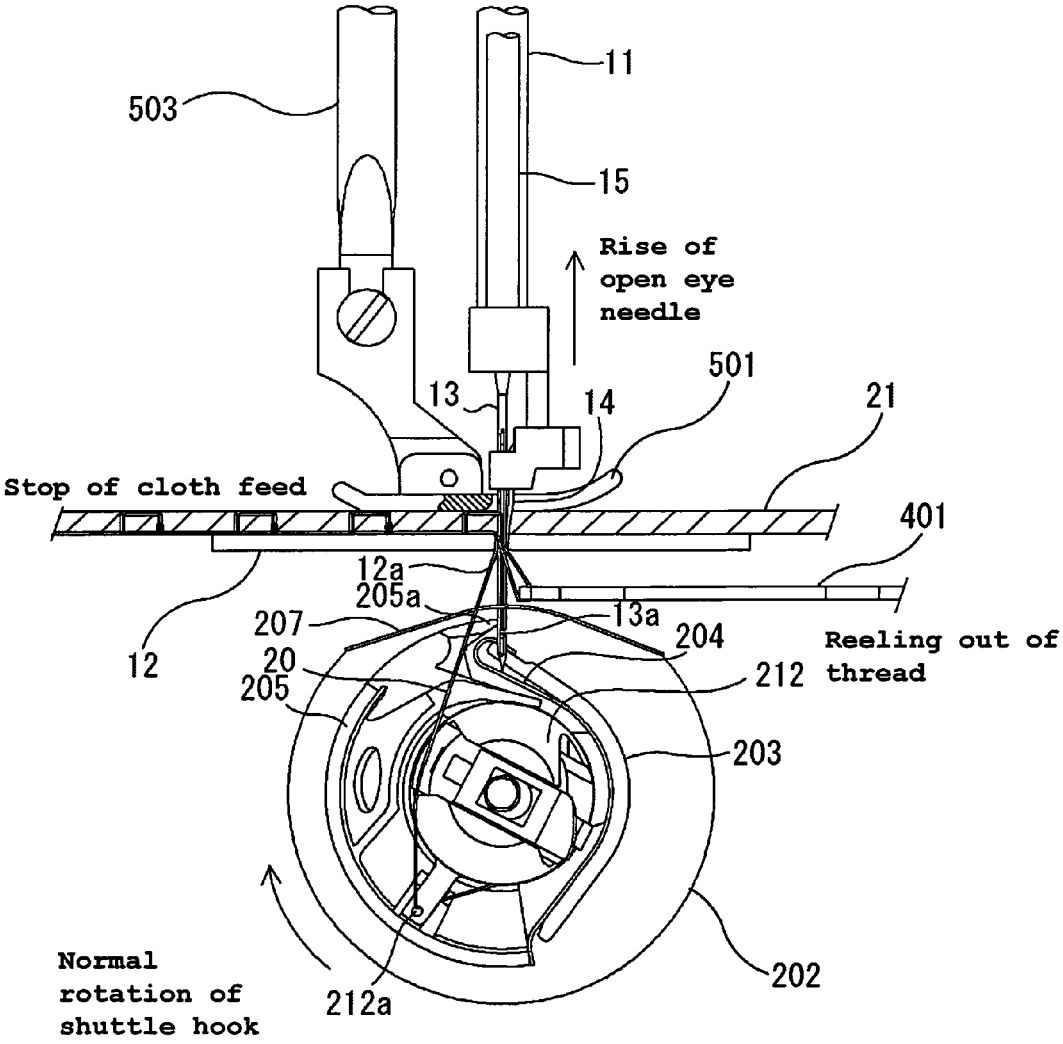
Figure 18Q:
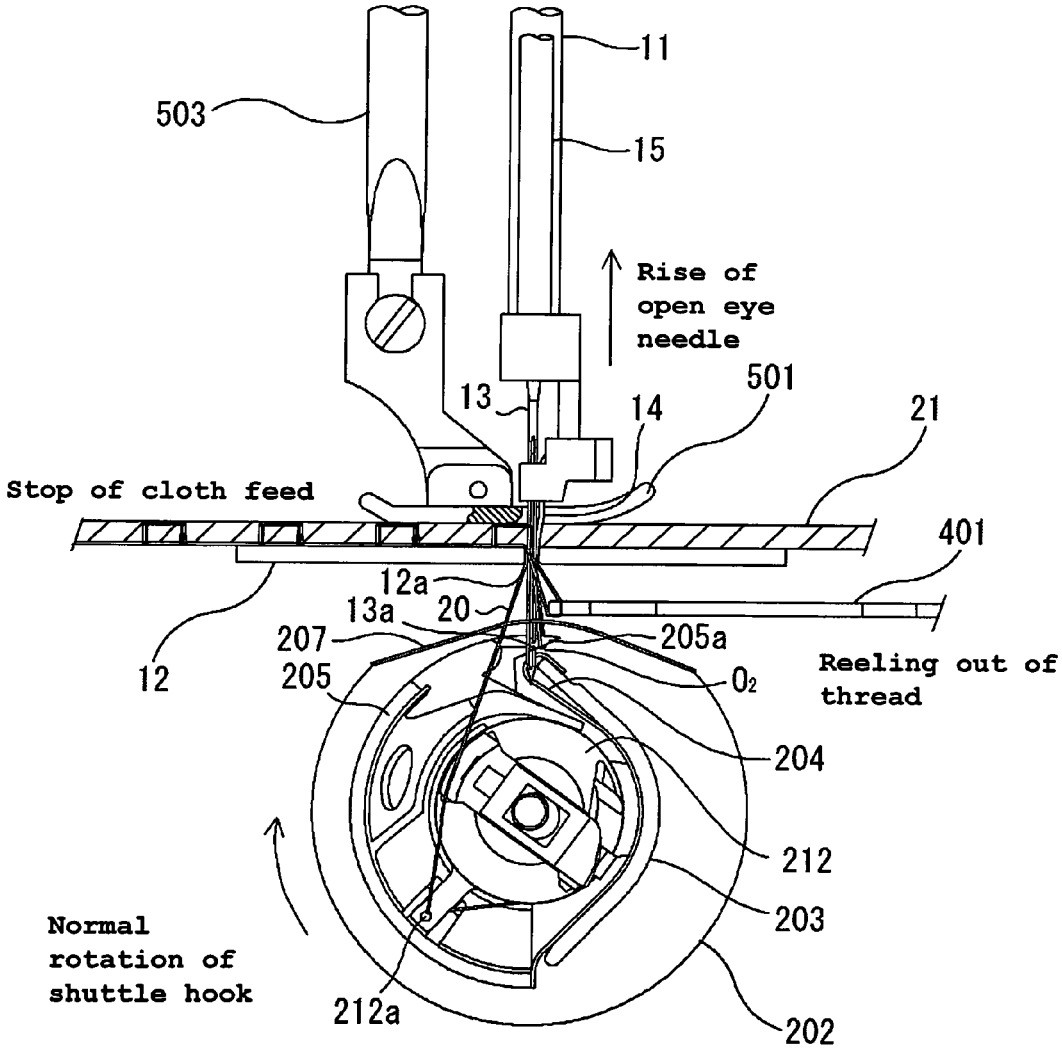
Figure 18R:
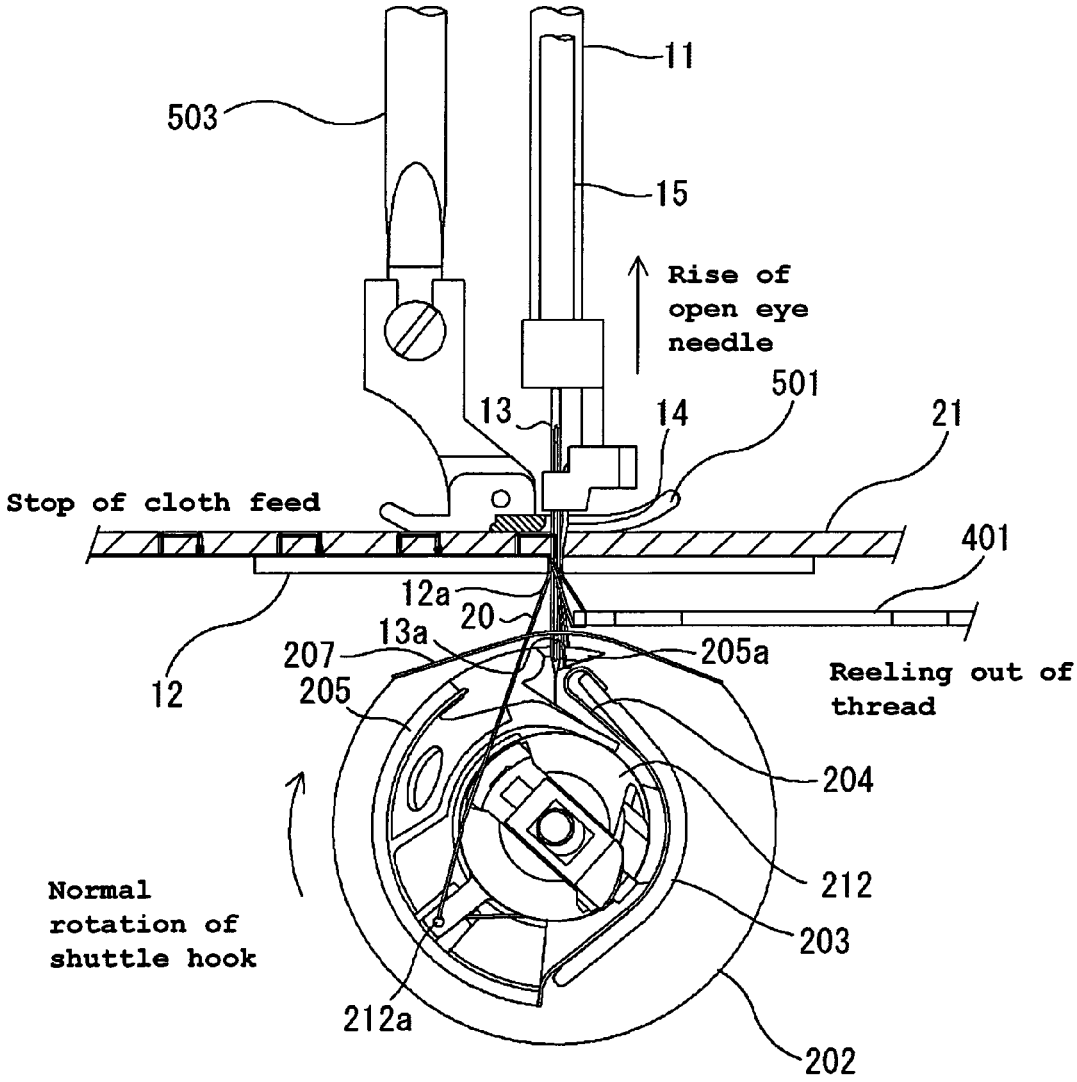
Figure 18S:
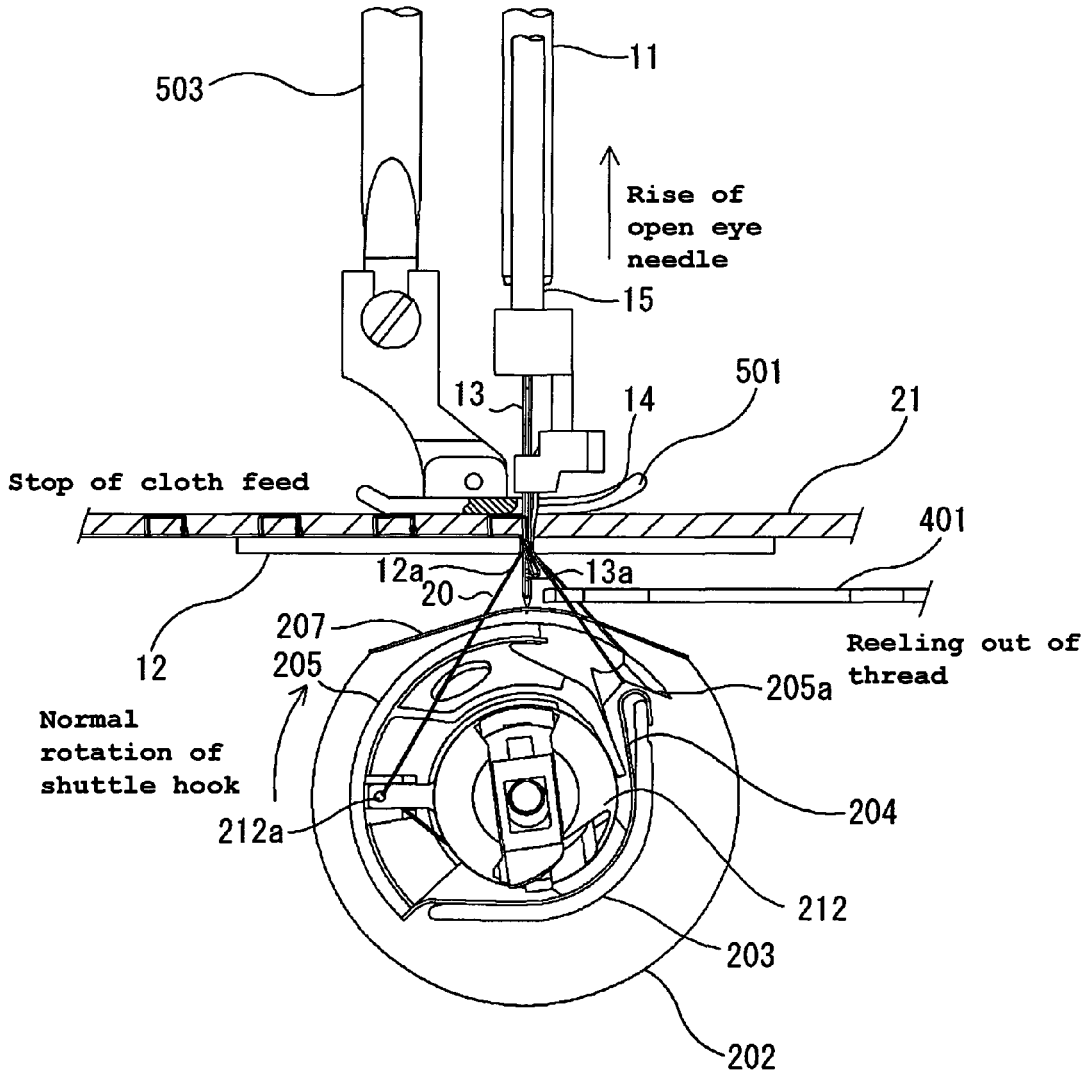
Figure 18T:
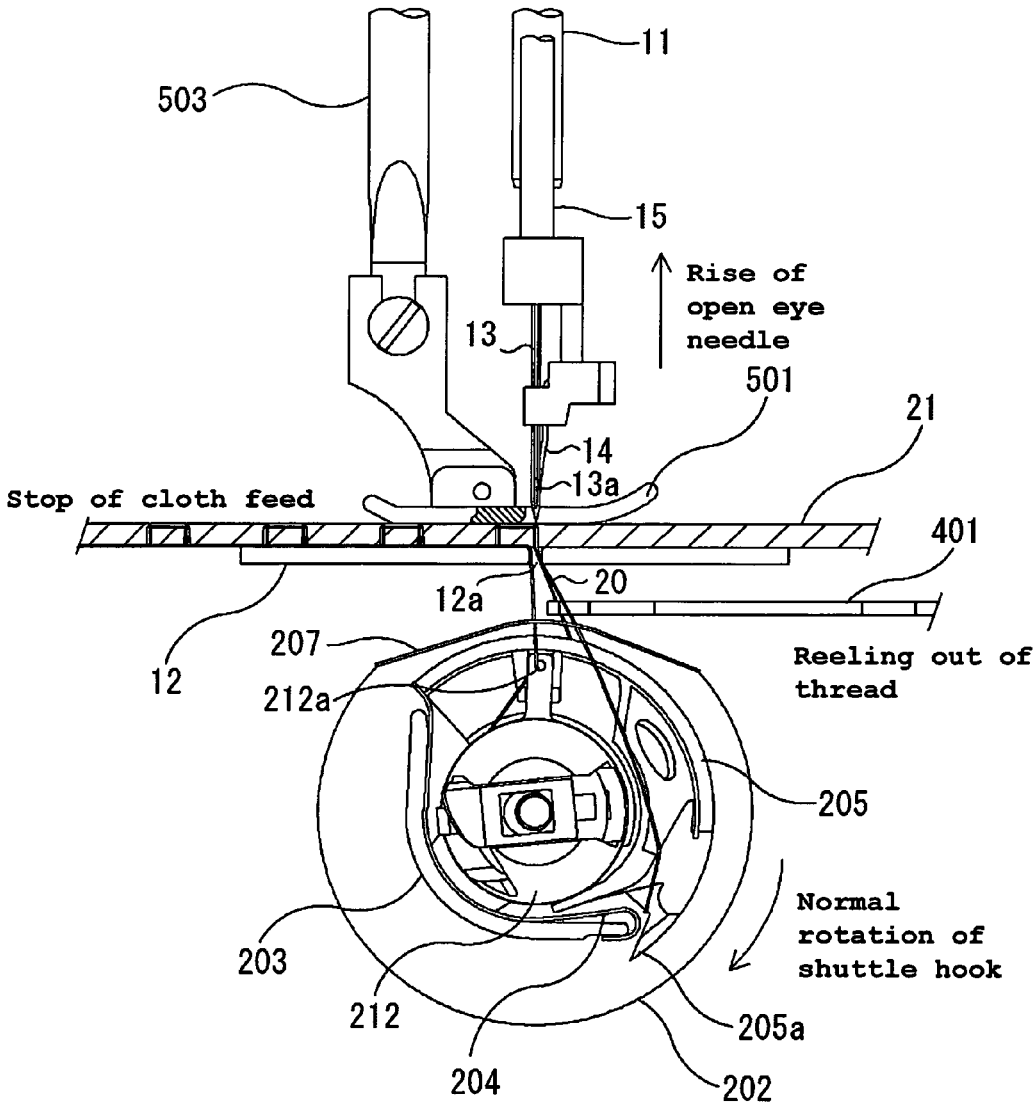
Figure 18U:
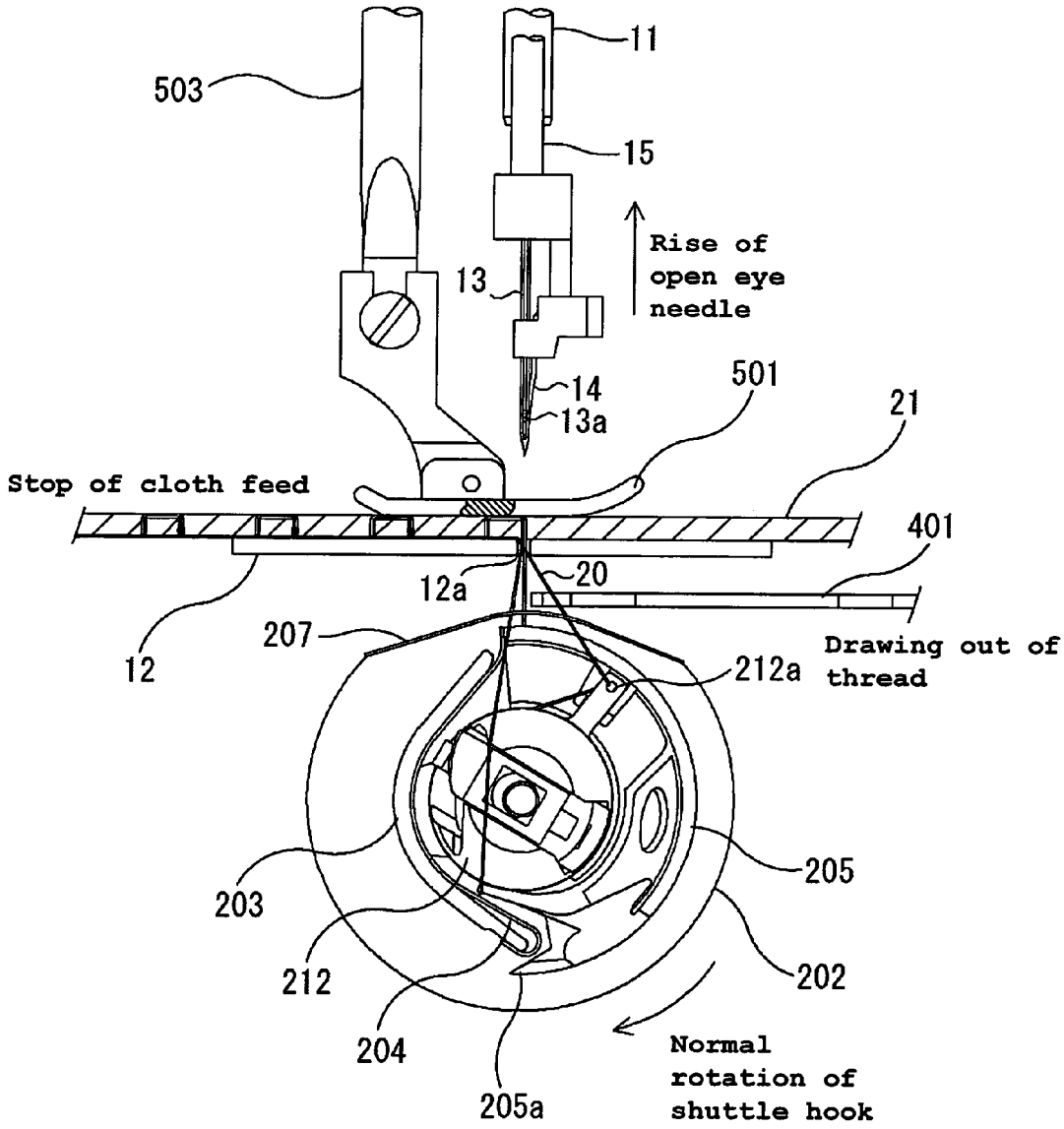
Figure 18V:
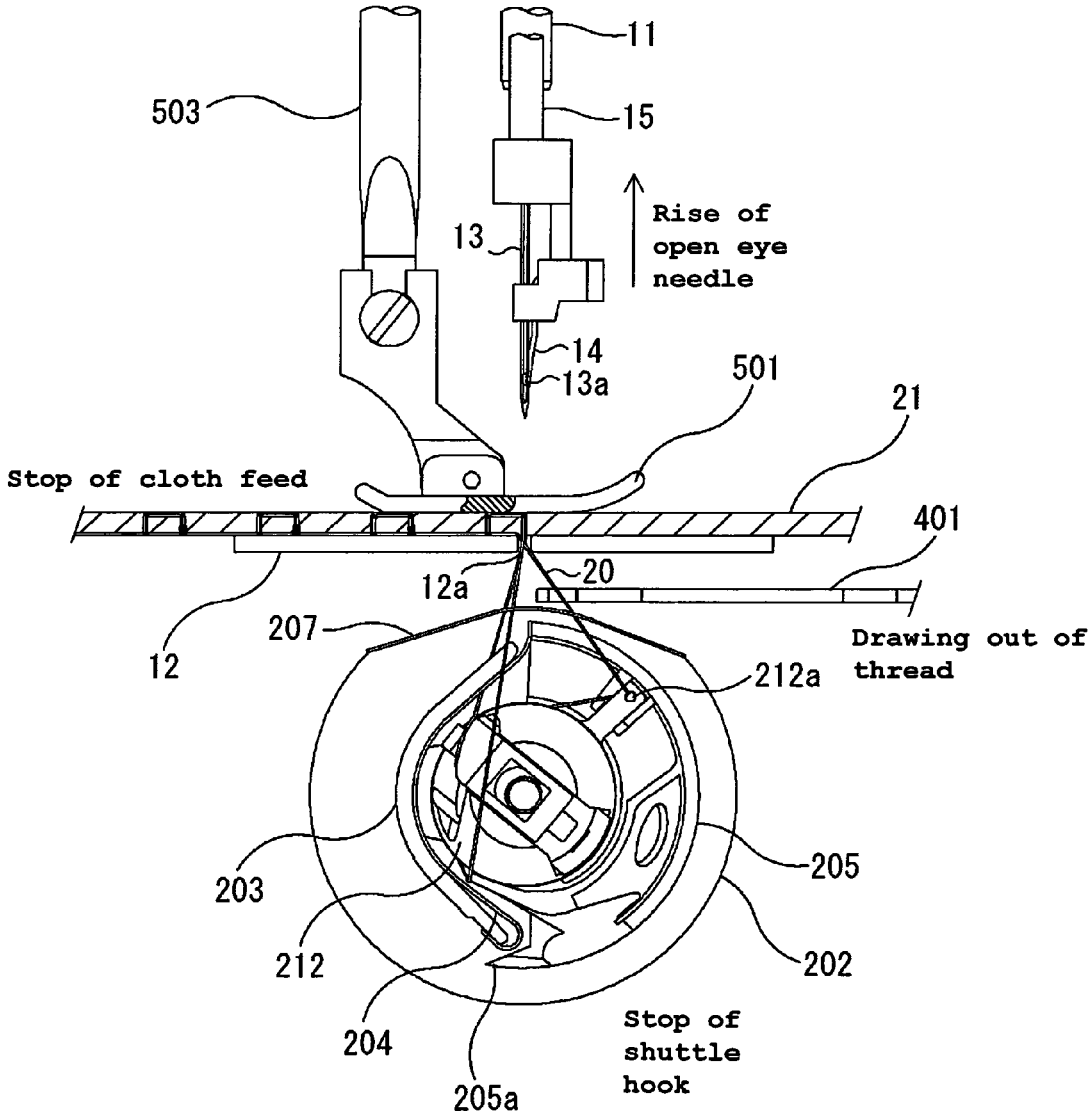
Figure 18W:
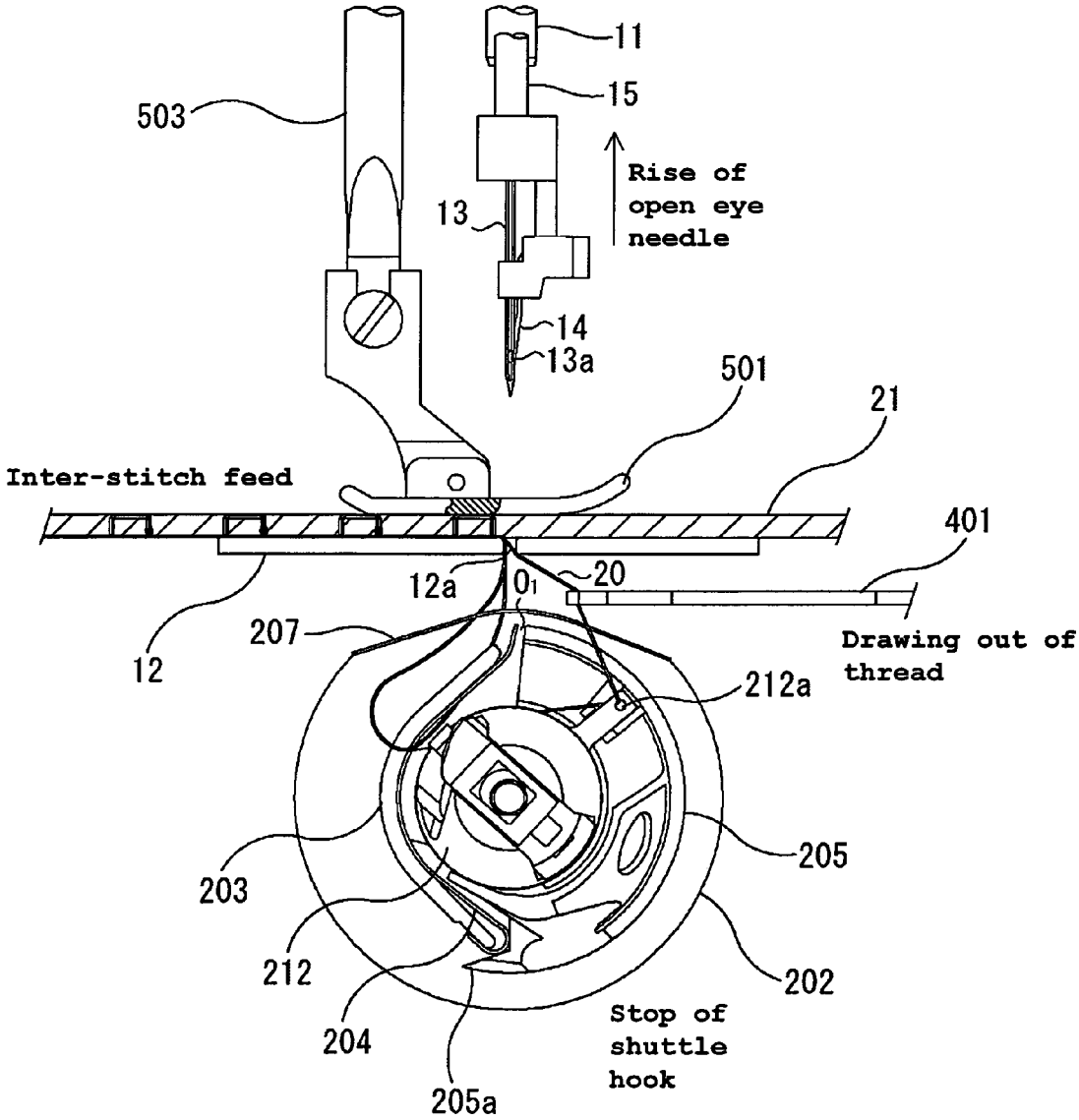

As shown in FIG. 16 and FIG. 17, such the thread draw out drive mechanism 400 is equipped with a screw gear 410 which converts the rotational motion in the horizontal direction of the intermediate shaft 8 into the rotational motion in the vertical direction, a thread draw out actuator drive cam shaft 408 which transmits the rotational motion which is converted from the horizontal direction into the vertical direction by the screw gear 410, and a thread draw out actuator drive cam 407 which gives the rotational motion of the thread draw out actuator drive cam shaft 408 to the above-mentioned function of the thread draw out actuator 401.

Concretely, a first gear 410A of the screw gear 410 is fixed to the intermediate shaft 8, and a second gear 410B is fixed to one end (upper end) of the thread draw out actuator drive cam shaft 408. The thread draw out actuator drive cam 407 that a cam groove 407*a* is formed and is a face cam is fixed to another end (lower end) of the thread draw out actuator drive cam shaft 408. This thread draw out actuator drive cam shaft 408 is rotatably set up by a thread draw out actuator drive cam shaft upper bushing 411 and a thread draw out actuator drive cam shaft lower bushing 412 which are equipped to a thread draw out actuator drive cam shaft tube 409 which is fixed to the arm 2. Besides, the thread draw out drive mechanism 400 is equipped with a thread draw out actuator drive rod base 405 that it is arranged horizontally and a cam follower 406 which engages the cam groove 407*a* of the thread draw out actuator drive cam 407 is rotatably provided by a cam follower pin 413, a thread draw out actuator drive rod 404 that it is arranged horizontally and one end is fixed to the thread draw out actuator drive rod base 405 and another end is rotatably fixed to an arm end 403*a* of a thread draw out actuator drive arm 403 by a pin 414, and a thread draw out actuator rocking shaft 402 that it is arranged vertically and one end is fixed to the thread draw out actuator drive arm 403 and another end is fixed to the thread draw out actuator 401. A hollow elongate hole 405*a* is formed in the thread draw out actuator drive rod base 405, and the thread draw out actuator drive cam shaft 408 is inserted into this elongate hole 405*a*. And the thread draw out actuator drive rod base 405 is movably equipped to the thread draw out actuator drive cam shaft 408 under the thread draw out actuator drive cam 407 horizontally by a thrust collar 415.

In the thread draw out drive mechanism 400 of such a composition, because the thread draw out actuator drive cam shaft 408 rotates by the screw gear 410 when the intermediate shaft 8 rotates, in the thread draw out actuator drive rod base 405 and the thread draw out actuator drive rod 404, the cam follower 406 lets the thread draw out actuator 401 rock in accordance with the shape of the cam groove 407*a* of the thread draw out actuator drive cam 407. This rocking motion of the thread draw out actuator 401 is the following movement. That is, when the thread capturing open eye 13*a* of the open eye needle 13 captures the sewing thread 20, the thread draw out actuator 401 gives the tension to the sewing thread 20 which is drawn out from the thread exit 212*a* by rotation of the shuttle hook 200 by abutting circumferentially on the open eye needle 13, and thread draw out actuator 401 tightens the sewing thread 20 which guides out from the shuttle hook 200. And, after the sewing thread 20 which is captured by the thread capturing open eye 13*a* is scooped by the loop-taker point 205*a* of the shuttle hook 200, the thread draw out actuator 401 hooks the sewing thread 20 which is drawn out from the thread exit 212*a* of the shuttle hook 200, and tightens the thread by drawing out the thread from the shuttle hook 200. And after the thread draw out actuator 401 captures the sewing thread 20 by the thread capturing open eye 13*a*, it releases the sewing thread 20 which is hooked.

In the single-thread locked handstitch sewing machine constituted as described above, the handstitch on the front surface and the locked stitch on the back surface of the fabric workpiece 21 are formed as the skip stitch set by cooperation of the open eye needle 13, the shuttle hook 200 and the thread drawing out actuator 401, and the stitch length feed of the fabric workpiece 21 for the handstitch is performed by the feed dog 601 during the first stroke of the open eye needle 13, and the inter-stitch pitch feed of the fabric workpiece 21 for the inter-handstitch is performed by the feed dog 601 during the second stroke of the open eye needle 13. Besides, in the single-thread locked handstitch sewing machine, the stitch length feed quantity of the stitch length feed and the inter-stitch pitch feed quantity of the inter-stitch pitch feed are set up, and each fabric workpiece feed mode corresponding to the stitch length feed and the inter-stitch pitch feed respectively every one skip stitch set is changed over in sequence, and the set stitch length feed quantity and inter-stitch pitch feed quantity are transmitted to the feed drive mechanism 700 in each fabric workpiece feed mode respectively, and thereby, the fabric workpiece 21 is fed by the feed dog 601. In this description, "cooperation" means working in cooperation with other portions.

Figure 19:
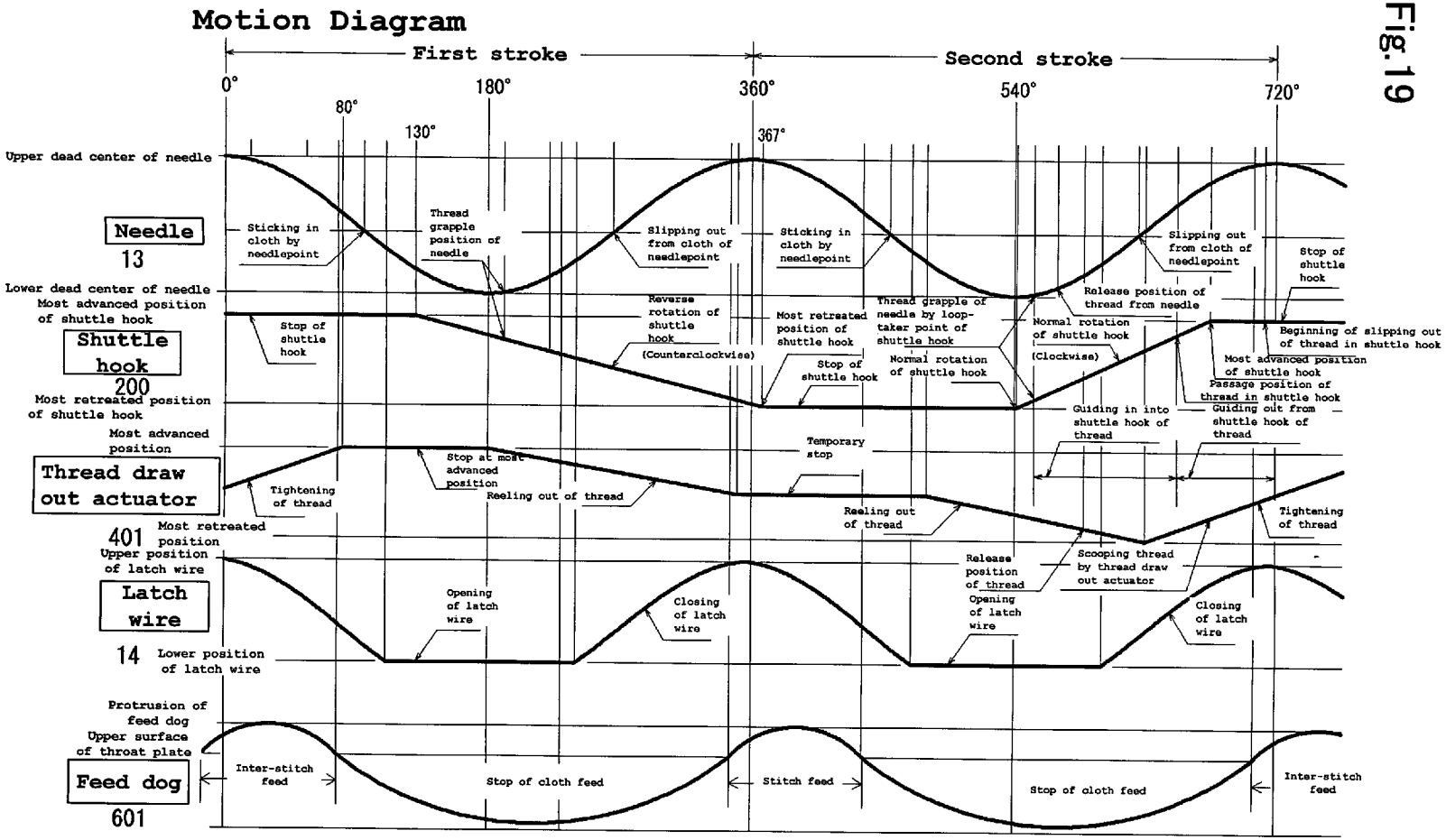
FIG. 19 A movement explanatory view showing the movement state of the open eye needle, the shuttle hook, the thread draw out actuator, the latch wire and the feed dog of the single-thread locked handstitch sewing machine by this invention.
Figure 20:
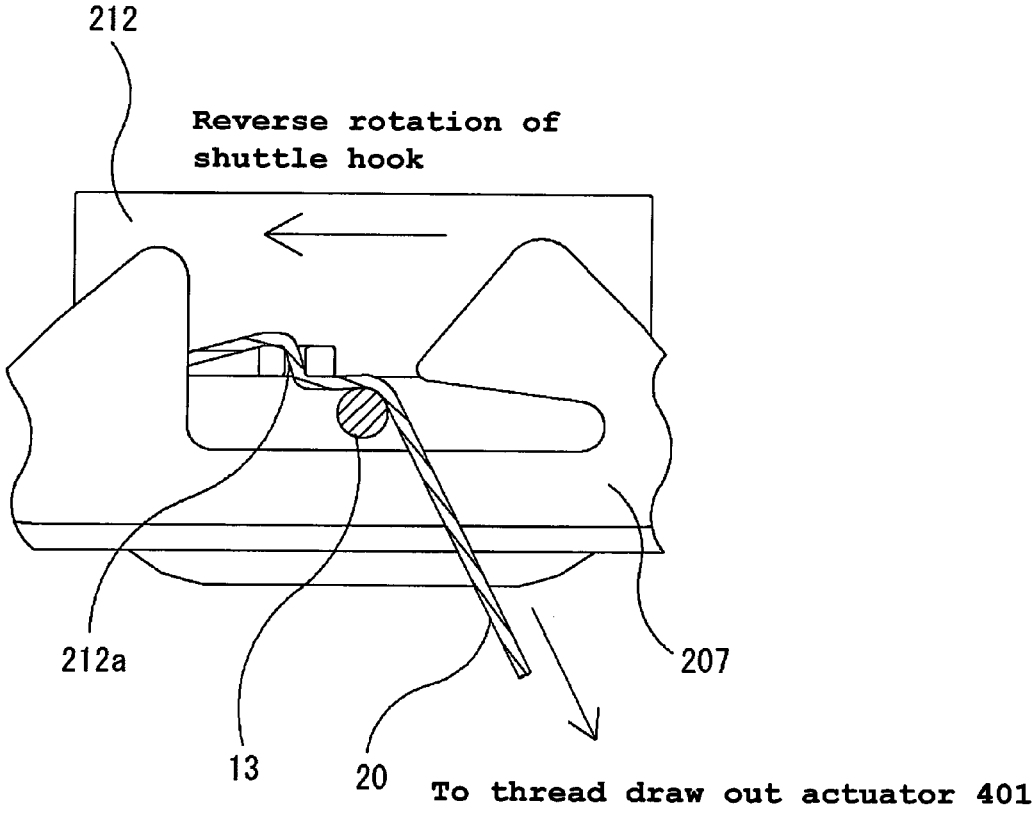
FIG. 20 An explanatory view showing the state that watched only the shuttle hook which is described in FIG. 18 (H) from the upper side.

The movement of such single-thread locked handstitch sewing machine is explained based on FIG. 18 (A)-(W), FIG. 19 and FIG. 20 with a focus on the method for forming single-thread locked handstitches. FIG. 18 (A)-(W) are the movement explanatory view of the open eye needle 13, the shuttle hook 200 and the thread draw out actuator 401, and FIG. 19 is the motion diagram of the open eye needle 13, the shuttle hook 200, the thread draw out actuator 401, the latch wire 14 and the feed dog 601. In this movement explanation, when the direction is indicated, the state that FIG. 18 (A)-(W) are seen from the front is explained. Besides, in FIG. 18 (A)-(W), the drawing of the feed dog 601 is omitted.

In FIG. 18 (A)-(W), caracoling by reverse rotation of the shuttle hook 200 means the counterclockwise rotation of the inner shuttle hook 205, and caracoling by normal rotation of the shuttle hook 200 means the clockwise rotation of the inner shuttle hook 205. Besides, for the sake of convenience, the movement explanation is performed from the state that the open eye needle 13 which does not capture the sewing thread 20 by the thread capturing open eye 13*a* is positioned at the upper dead center and the state that the loop-taker point 205*a* of the inner shuttle hook 205 is positioned under the vertical direction (FIG. 18 (A)). In the state of FIG. 18 (A), the shuttle hook 200 is the state of stopping, the thread draw out actuator 401 is the state which draws out the sewing thread 20 from the bobbin 211 through the thread exit 212*a* of the bobbin case 212, the latch wire 14 is the closed state, and the feed dog 601 is the state of the inter-stitch feed. The feed direction of the fabric workpiece 21 is the left. In addition, in FIG. 19, because the skip stitch set is formed by two rotations of the pulley 4, one cycle of the sewing is shown at 720 degrees in the upper shaft 5, and FIG. 18 (A) is the state that the upper shaft 5 is 0 degrees (720 degrees). The open eye needle 13 becomes the upper dead center at 0 degrees of the upper shaft 5; the open eye needle 13 becomes the lower dead center at 180 degrees; the open eye needle 13 becomes the upper dead center at 360 degrees; and the open eye needle 13 becomes the lower dead center at 540 degrees.

In FIG. 1, when the driven pulley 4 which is driven by the motor M through the drive belt MB rotates clockwise by looking from the side of the open eye needle 13, the open eye needle-latch wire drive mechanism 100, the cloth feed drive mechanism 700, the shuttle hook drive mechanism 220 and the thread draw out drive mechanism 400 drive by the rotation of the upper shaft 5. When the open eye needle-latch wire drive mechanism 100 drives, it lets the open eye needle 13 perform the linear reciprocating motion vertically. When the cloth feed drive mechanism 700 drives, it lets the feed dog 601 perform the four process movements of the feed by the cloth feed mechanism 600. When the shuttle hook drive mechanism 220 drives, it lets the inner shuttle hook 205 of the shuttle hook 200 perform the half-turn normal rotation and the half-turn reverse rotation. When the thread draw out drive mechanism 400 drives, it lets the thread draw out actuator 401 rock. The movement explanation of each mechanism is omitted because the above-mentioned composition explanation was explained in detail.

By following cooperation of the open eye needle 13, the shuttle hook 200, the thread draw out actuator 401 and the feed dog 601 which operate as described above, the handstitch on the front surface and the locked stitch on the back surface of the fabric workpiece 21 are respectively formed by one sewing thread 20.

(a) When the open eye needle 13 which performs the linear reciprocating motion vertically comes down from the upper dead center (upper shaft 5: 0 degrees), and pierces the fabric workpiece 21 which is placed on the throat plate 12 (FIG. 18 (A)-FIG. 18 (F), FIG. 19), and goes up from the lower dead center (upper shaft 5: 180 degrees) during the first stroke, the tightened sewing thread 20 which abuts circumferentially on the open eye needle 13 by being drawn out from the thread exit 212*a* of the shuttle hook 200 which performs the half-turn reverse rotation under the throat plate 12 by the thread draw out actuator 401 is captured by the thread capturing open eye 13*a* (FIG. 18 (G), FIG. 18 (H), FIG. 19). In this case, as shown in FIG. 20, the thread exit 212*a* of the bobbin case 212 that the shuttle hook 200 has is equipped at the direction and the position away from the throat plate 12 by the reverse rotation of the inner shuttle hook 205 of the shuttle hook 200 when the open eye needle 13 goes up from the throat plate 12. Thereby, the sewing thread 20 which is drawn out by the thread draw out actuator 401 can abut circumferentially on the open eye needle 13. Besides, the shuttle hook 200 stops the rotation when the open eye needle 13 substantively moves from the upper dead center (upper shaft 5: 0 degrees) to the lower dead center (upper shaft 5: 180 degrees). As described above, the reason why the shuttle hook 200 stops the rotation is to get the timing that the shuttle hook which performs the half-turn normal rotation performs the half-turn reverse rotation during the second stroke in order to perform the thread guard of the sewing thread 20 to the thread capturing open eye 13*a* of the open eye needle 13 during the first stroke.

The shuttle hook 200 begins the half-turn reverse rotation after the open eye needle 13 sticks into the fabric workpiece 21 (upper shaft 5: 130 degrees), (FIG. 18 (E), FIG. 19). The thread draw out actuator 401 stops at the most advanced position before the open eye needle 13 sticks into the fabric workpiece 21 (upper shaft 5: 80 degrees), (FIG. 18 (D), FIG. 19). The latch wire 14 becomes open state when the open eye needle 13 sticks into the fabric workpiece 21 (FIG. 18 (E), FIG. 19). The feed dog 601 stops the cloth feed of the fabric workpiece 21 before the open eye needle 13 sticks into the fabric workpiece 21 (FIG. 18 (D), FIG. 19).

(b) While the open eye needle 13 slips out from the fabric workpiece 21, and goes up, and passes through the upper dead center (upper shaft 5: 360 degrees) during the first stroke, the fabric workpiece 21 is fed with one stitch length by the feed dog 601. And, the open eye needle 13 which captures the sewing thread 20 goes up and the shuttle hook 200 performs further reverse rotation, thereby, the thread tightness is performed (FIG. 18 (I)-FIG. 18 (M), FIG. 19).

The shuttle hook 200 stops the half-turn reverse rotation (upper shaft 5: 367 degrees) after the open eye needle 13 passes through the upper dead center (upper shaft 5: 360 degrees), (FIG. 18 (M), FIG. 19). The thread draw out actuator 401 begins the rocking which backs away so that the sewing thread 20 can be reeled out when the open eye needle 13 reaches the lower dead center (upper shaft 5: 180 degrees), (FIG. 18 (F), FIG. 19). And the thread draw out actuator 401 stops the backward movement before the open eye needle 13 passes through the upper dead center (upper shaft 5: 360 degrees), (FIG. 18 (L), FIG. 19). When the open eye needle 13 moves from the lower dead center (upper shaft 5: 180 degrees) to the upper dead center (upper shaft 5: 360 degrees), the latch wire 14 makes the thread capturing open eye 13*a* of the open eye needle 13 the closed state after this open eye needle 13 passes through the throat plate 12, and the latch wire 14 passes through the fabric workpiece 21 together with the open eye needle 13 (FIG. 18 (J), FIG. 18 (K), FIG. 19). The feed dog 601 begins one stitch length feed just before the open eye needle 13 passes through the upper dead center (upper shaft 5: 360 degrees), (FIG. 18 (L), FIG. 19).

(c) During the second stroke, when the open eye needle 13 comes down from the upper dead center (upper shaft 5: 360 degrees), and pierces the fabric workpiece 21 (FIG. 18 (N), FIG. 18 (O), FIG. 19), and goes up from the lower dead center (upper shaft 5: 540 degrees), the open eye needle 13 scoops the sewing thread 20 which is captured by the thread capturing open eye 13*a* by the loop-taker point 205*a* of the shuttle hook 200, and the open eye needle 13 releases the captured sewing thread 20 by the rotation of the shuttle hook 200 from the thread capturing open eye 13*a* (FIG. 18 (P), FIG. 19). The shuttle hook 200 stops the rotation when the open eye needle 13 substantively moves from the upper dead center (upper shaft 5: 360 degrees) to the lower dead center (upper shaft 5: 540 degrees). As described above, the reason why the shuttle hook 200 stops the rotation is to get the timing that the shuttle hook which performs the half-turn reverse rotation performs the half-turn normal rotation during the first stroke in order to release the sewing thread 20 which is hooked by the thread capturing open eye 13*a* of the open eye needle 13 from the thread capturing open eye 13*a* by the loop-taker point 205*a* during the second stroke.

The shuttle hook 200 begins the half-turn normal rotation when the open eye needle 13 reaches the lower dead center (upper shaft 5: 540 degrees), (FIG. 18 (P), FIG. 19). The thread draw out actuator 401 backs away after the open eye needle 13 sticks into the fabric workpiece 21, and begins the rocking so as to reel out the sewing thread 20 (FIG. 18 (N), FIG. 19). The latch wire 14 makes the thread capturing open eye 13*a* of the open eye needle 13 the open state when the open eye needle 13 comes down from the upper dead center and passes through the fabric workpiece 21 (FIG. 18 (O), FIG. 19). The feed dog 601 stops one stitch length feed before the open eye needle 13 sticks into the fabric workpiece 21 (FIG. 18 (N), FIG. 19).

(d) The sewing thread 20 which is scooped by the loop-taker point 205*a* of the shuttle hook 200 and is released is guided in the gap $O_2$ which is formed between another end of the inner shuttle hook driver 203 that the inner shuttle hook driver spring 204 of the shuttle hook 200 is fixed and the inner shuttle hook 205 by further rotation of the shuttle hook 200, and is interlaced to the sewing thread 20 which is wound in the shuttle hook 200. And the sewing thread 20 which is guided out from the gap $O_1$ which is formed between one end of the inner shuttle hook driver 203 that the inner shuttle hook driver spring 204 is fixed and the inner shuttle hook 205 is tightened by the thread draw out actuator 401 (FIG. 18 (Q)-FIG. 18 (W), FIG. 19).

The shuttle hook 200 stops the half-turn normal rotation by the time the open eye needle 13 slips out from the fabric workpiece 21 and reaches the upper dead center (upper shaft 5: 720 degrees), (FIG. 18 (V), FIG. 19). The thread draw out actuator 401 begins the rocking so that the sewing thread 20 can be tightened and can be advanced after the open eye needle 13 slips out from the fabric workpiece 21 (FIG. 18 (T), FIG. 19). The latch wire 14 makes the thread capturing open eye 13*a* of the open eye needle 13 the closed state when the open eye needle 13 goes up from the lower dead center and passes through the fabric workpiece 21 (FIG. 18 (T), FIG. 19). The feed dog 601 begins one inter-stitch pitch feed just before the open eye needle 13 passes through the upper dead center (upper shaft 5: 720 degrees), (FIG. 18 (W), FIG. 19).

(e) While the open eye needle 13 slips out from the fabric workpiece 21, and goes up and passes through the upper dead center (upper shaft 5: 720 degrees) during the second stroke, one inter-stitch pitch feed of the fabric workpiece 21 is performed (FIG. 18 (W), FIG. 19).

(f) The handstitch on the front surface and the locked stitch on the back surface of the fabric workpiece 21 are formed respectively by repeating the steps from (a) to (e).

Therefore, the sewing thread 20 is certainly captured to the thread capturing open eye 13*a* of the open eye needle 13, and the formation of single-thread locked stitch is performed in the inner space of the sewing machine bed, and the sewing which is suitable to the quasi-handstitch called pinpoint/saddle stitch is possible. Besides, because the handstitch on the front surface and the locked stitch on the back surface of the fabric workpiece 21 are formed respectively and the sewing-work is performed in the state that the handstitch can be seen on the surface for the worker, it is possible to confirm the position of the handstitch, thereby, the accurate sewing can be performed. In addition, because the handstitch on the front surface and the locked stitch on the back surface of the fabric workpiece 21 are formed respectively, the sewing thread 20 does not come loose easily even if the sewing thread 20 which forms single-thread locked stitch is pulled. Thereby, the firm sewing can be obtained.

In such the single-thread locked handstitch sewing machine, the stitch length and the inter-stitch pitch can be adjusted by the feed quantity setting mechanism 300 and the feed mode changeover mechanism 350. This movement of the feed quantity setting mechanism 300 and the feed mode changeover mechanism 350 are explained based on FIG.

Figure 23A:
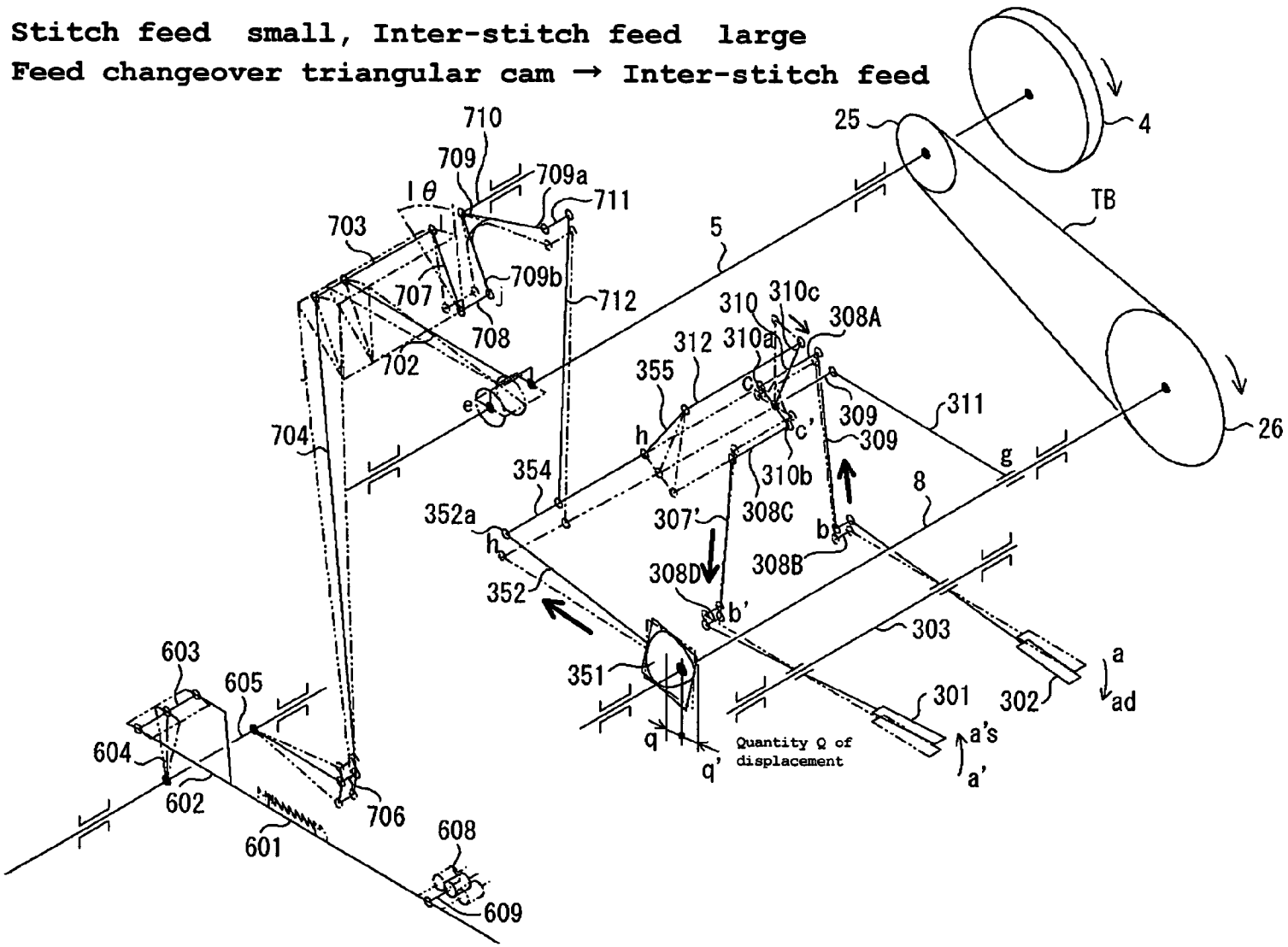
FIG. 23 (A) A view showing the feed quantity setting mechanism, the mode changeover mechanism, the cloth feed mechanism and the cloth feed drive mechanism schematically in the single-thread locked handstitch sewing machine of this invention.
Figure 23B:
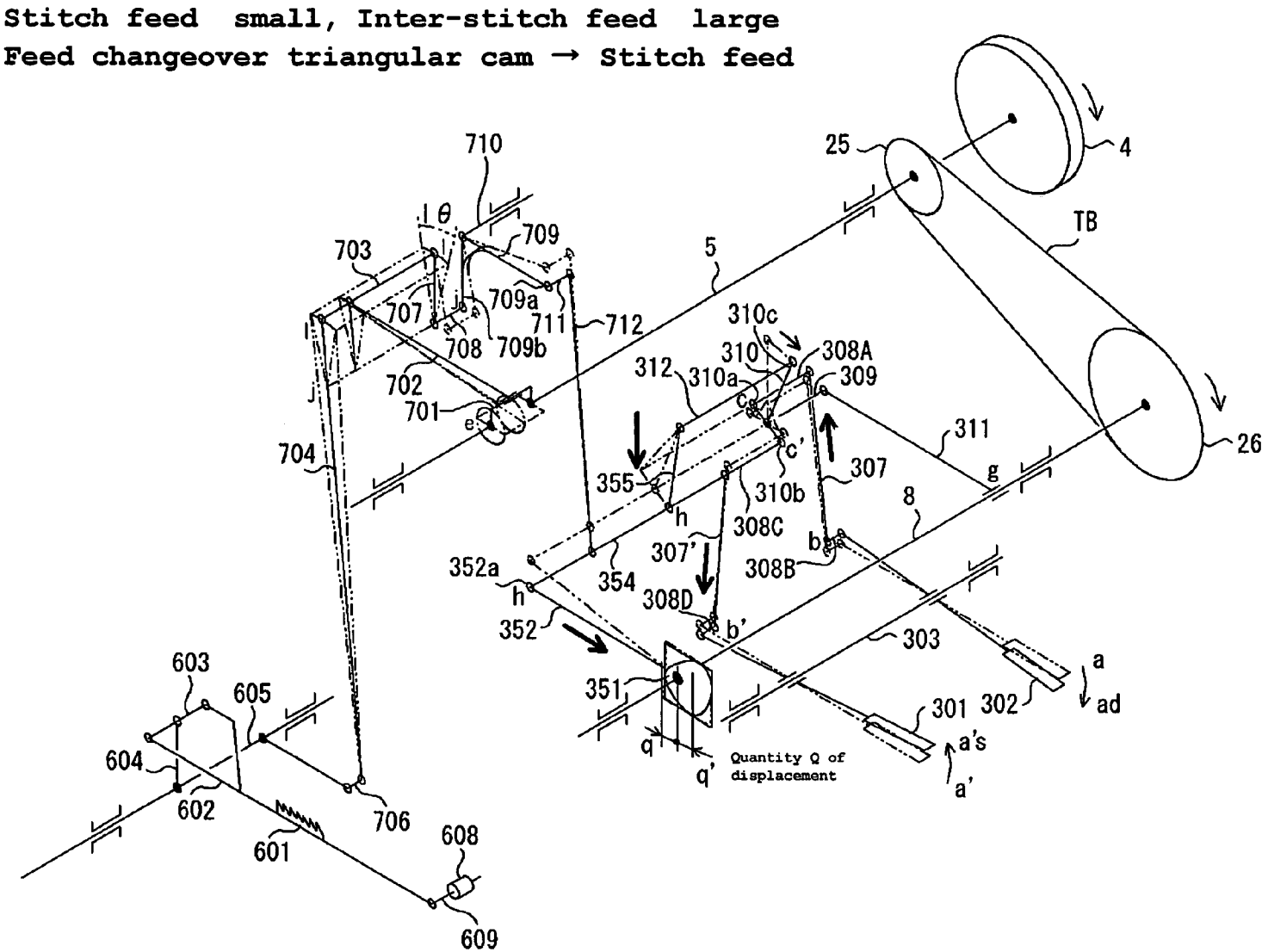
Figure 24A:
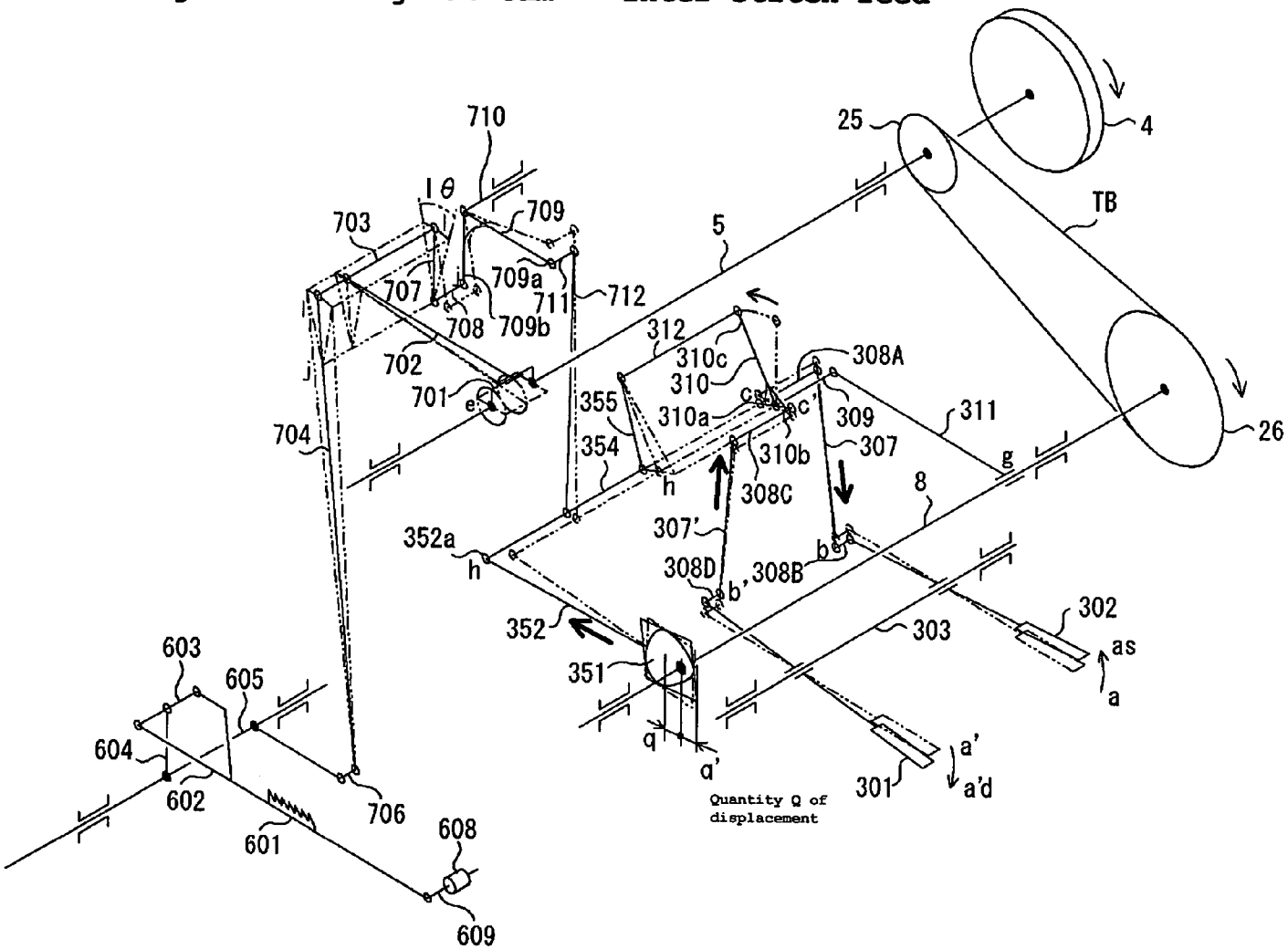
FIG. 24 (A) A view showing the feed quantity setting mechanism, the mode changeover mechanism, the cloth feed mechanism and the cloth feed drive mechanism schematically in the single-thread locked handstitch sewing machine of this invention.
Figure 24B:
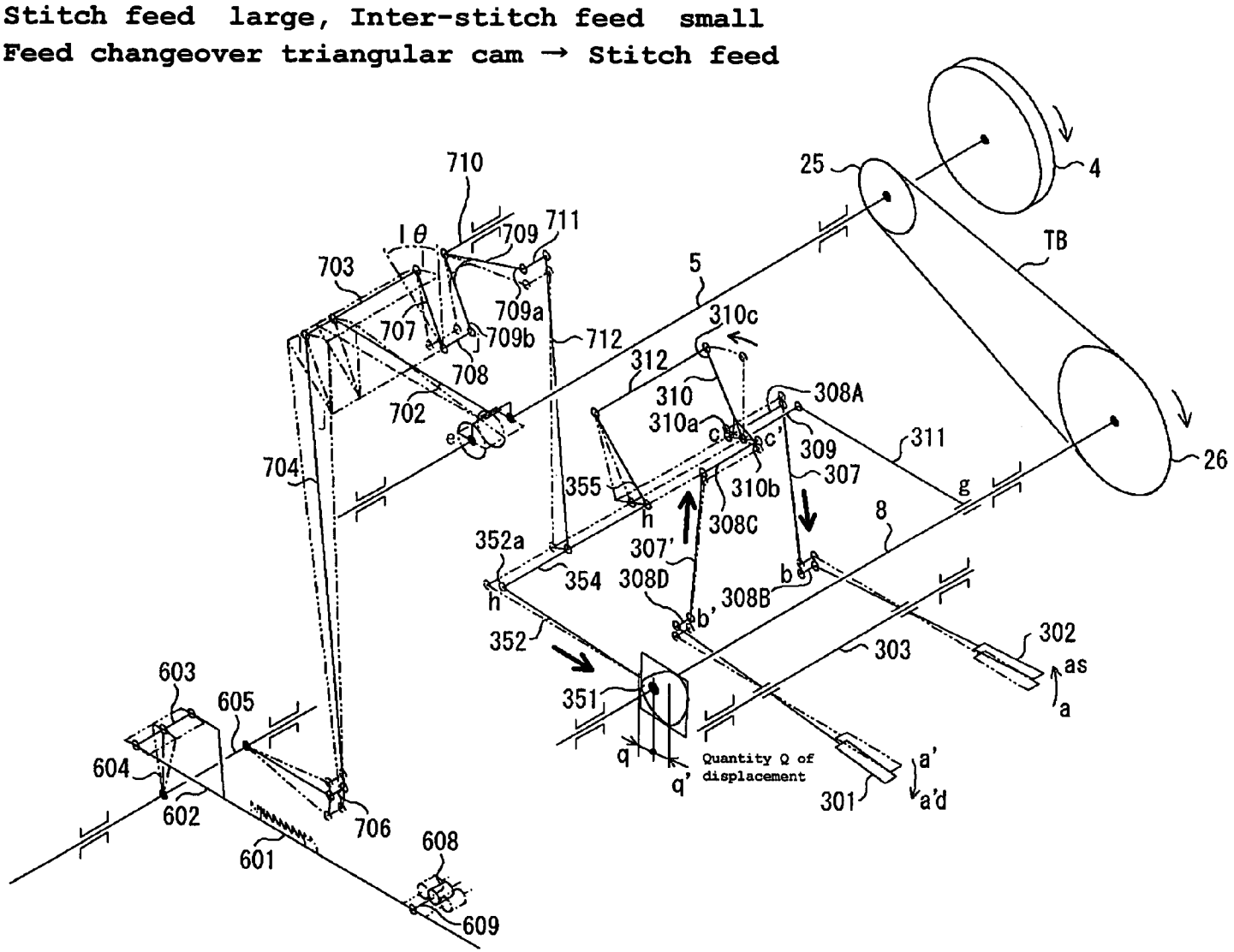

21-FIG. 24. FIG. 21-FIG. 24 are the drawings showing the feed quantity setting mechanism 300, the mode changeover mechanism 350, the cloth feed mechanism 600 and the cloth feed drive mechanism 700 schematically. Besides, in FIG. 21-FIG. 24, the stitch feed adjusting lever 301 and the inter-stitch feed adjusting lever 302 rocks upward and downward respectively. And these are constituted so as to become the minimum feed pitch at the upper end point a's of the stitch feed adjusting lever 301 and the upper end point as of the inter-stitch feed adjusting lever 302, and these are constituted so as to become the maximum feed pitch at the lower end point a'd of the stitch feed adjusting lever 301 and the lower end point ad of the inter-stitch feed adjusting lever 302. In this movement explanation, when the direction is indicated, FIG. 21-FIG. 24 are explained in the state seen toward the right direction from the direction of the feed dog 601.

<Setting Example that the Stitch Feed Pitch and the Inter-Stitch Feed Pitch are the Minimum Feed>

Figure 21:
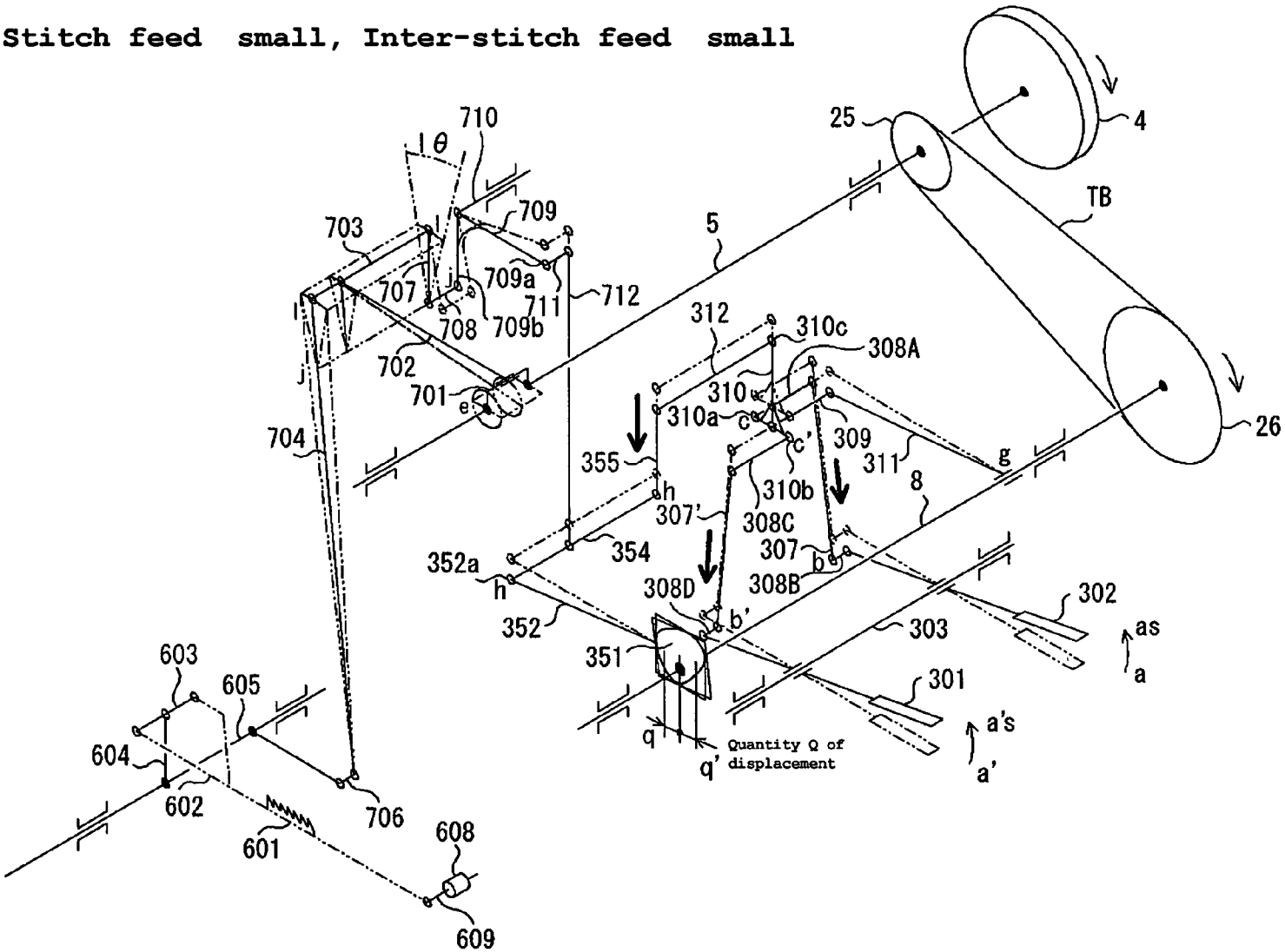
FIG. 21 A view showing the feed quantity setting mechanism, the mode changeover mechanism, the cloth feed mechanism and the cloth feed drive mechanism schematically in the single-thread locked handstitch sewing machine of this invention.

Firstly, the case that one stitch length of the stitch feed and one stitch pitch of the inter-stitch feed are the minimum feed is explained based on FIG. 21.

By operating the stitch feed adjusting lever 301 and the inter-stitch feed adjusting lever 302, when both are set at the upper end point a's, as of the minimum feed pitch, because the portions b', b which become each operating points of the stitch feed adjusting lever 301 and the inter-stitch feed adjusting lever 302 are respectively positioned at the lowermost point, the connecting adjusting lever link 307' and 307 move respectively the reverse T-shaped feed adjuster 310 which is supported by the supporting arm 311 to the lower direction in the vertical state. This moved position becomes the lowermost position of the feed adjuster 310.

When the reverse T-shaped feed adjuster 310 is positioned at the lowermost position in the vertical state, the connecting end 352*a* of the feed changeover rod 352 and the horizontal feed connection link 712 are respectively downed to the lower direction through the stitch length changeover link 355 which is pivotally attached to the end of the vertical arm of the reverse T-shaped feed adjuster 310. This moved position becomes the lowermost position of the connecting end 352*a* of the feed changeover rod 352 and the horizontal feed connection link 712. In this state, when the intermediate shaft 8 rotates clockwise, because the feed changeover triangular cam 351 performs the eccentric motion, the feed changeover rod 352 performs the reciprocating rocking intermittently between the right-and-left two positions q and q' of the almost horizontal direction in the quantity Q of displacement. The shape of the feed changeover triangular cam 351 is formed so that the feed changeover rod 352 can stop intermittently in the moved position q and q'. The time which stops intermittently in the moved position q and q' is decided by the feed changeover triangular cam 351. And, because the intermediate shaft 8 rotates one time while the upper shaft 5 rotates two times, the feed changeover rod 352 moves to the moved position of q direction by the one rotation of the upper shaft, and moves to the moved position of q' direction by the further one rotation of the upper shaft.

When the feed changeover rod 352 stops intermittently by moving to the position q' of the right direction, the point h which is one end of the stitch length changeover link 355 corresponds to the point c' which is another horizontal arm end 310*b* of the reverse T-shaped feed adjuster 310 which moved to the lowermost position. And, when the feed changeover rod 352 stops intermittently by moving to the position q of the left direction, the point h which is one end of the stitch length changeover link 355 corresponds to the point c which is one horizontal arm end 310*a* of the reverse T-shaped feed adjuster 310 which moved to the lower most position. Therefore, because the position of the point h which is one end of the horizontal feed connection link 712 can be decided to the point c which is one horizontal arm end 310*a* and the point c' which is another horizontal arm end 310*b* of the feed adjuster 310 which are respectively set up by the stitch feed adjusting lever 301 and the inter-stitch feed adjusting lever 302, the setup of each fabric workpiece feed mode can be changed over in sequence. This setup of each fabric workpiece feed mode is performed by the feed changeover rod 352. And the cloth feed is performed every this fabric workpiece feed mode.

As described above, when the stitch feed adjusting lever 301 and the inter-stitch feed adjusting lever 302 are respectively set up in the minimum feed pitch, the first arm 709*a* of the horizontal feed connection crank 709 is downed to the horizontal feed connection link 712 and rotates clockwise. Therefore, the point j which is the lower end of the second arm 709*b* of the horizontal feed connection crank 709 rocks to the left direction and is stopping. In this state, when the upper shaft 5 rotates clockwise, because the horizontal feed eccentric cam 701 lets the horizontal feed drive rod 702 performs the reciprocating motion with the quantity e of eccentricity in the almost horizontal direction, the point j which is one end of the horizontal feed rod link 707 which is connected to the second arm 709*b* of the horizontal feed crank 709 becomes the rocking center, and the horizontal feed vertical rod 704 which is connected to another end l of the horizontal feed rod link 707 rocks to the right-and-left direction. The position that the second arm 709*b* of the horizontal feed crank 709 rocks to the left direction and stops is set up so that the point j which is one end of the horizontal feed rod link 707 corresponds to the rocking center of the horizontal feed vertical rod 704. And because the rocking center of the horizontal feed rod link 707 and the rocking center of the horizontal feed vertical rod 704 overlap, even if the quantity e of eccentricity of the horizontal feed eccentric cam 701 is transmitted, the up-and-down motion which is transmitted to the horizontal feed vertical rod 704 becomes extremely few. Therefore, in each fabric workpiece feed modes, the horizontal feed quantity of the feed dog 601 does not occur, and the fabric workpiece 21 becomes minimum feed.

<Setting Example that the Stitch Feed Pitch and the Inter-Stitch Feed Pitch are the Maximum Feed>

Figure 22:
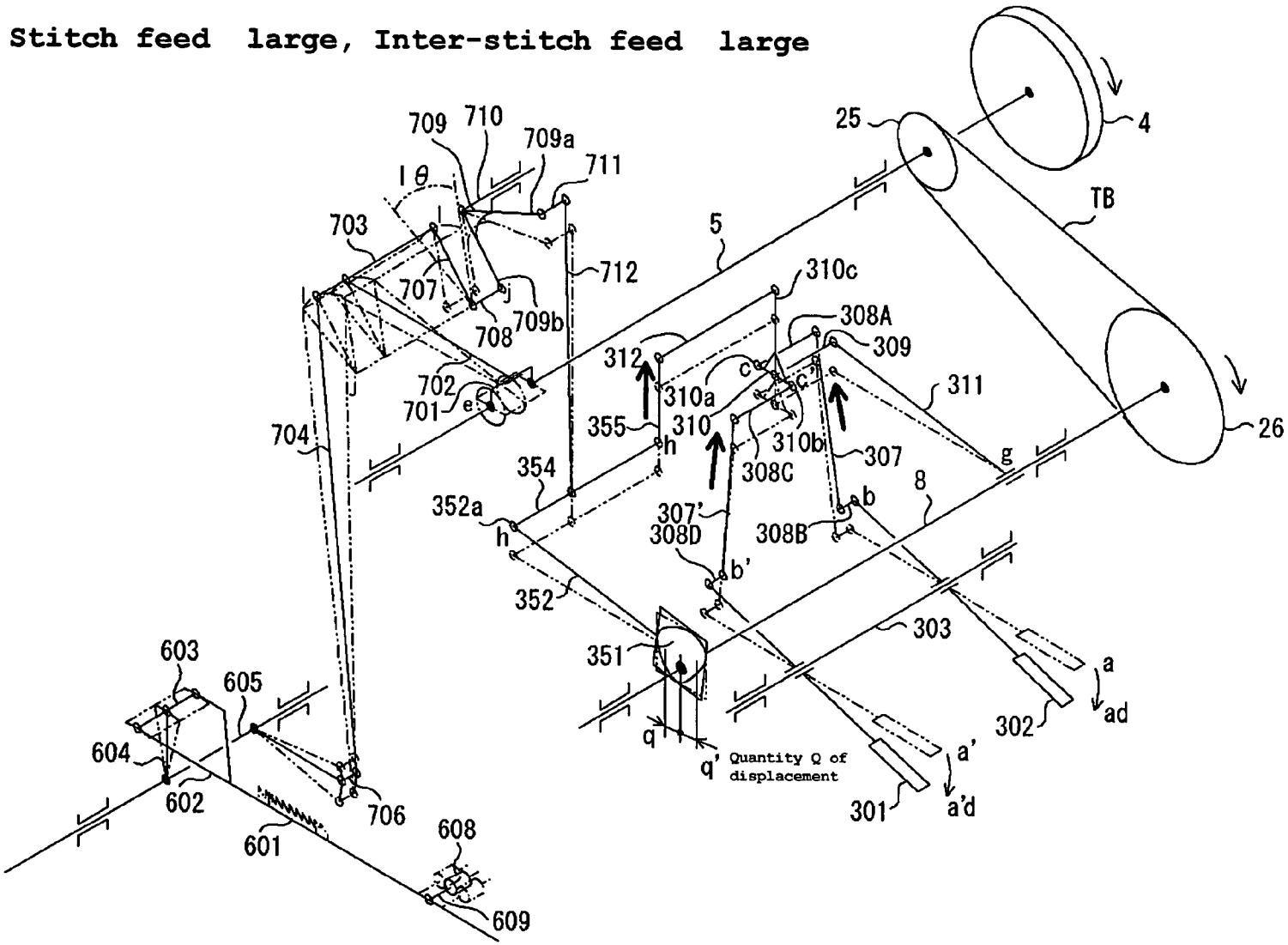
FIG. 22 A view showing the feed quantity setting mechanism, the mode changeover mechanism, the cloth feed mechanism and the cloth feed drive mechanism schematically in the single-thread locked handstitch sewing machine of this invention.

Next, the case that one stitch length of the stitch feed and one stitch pitch of the inter-stitch feed are the maximum feed is explained based on FIG. 22.

When both of the stitch feed adjusting lever 301 and the inter-stitch feed adjusting lever 302 are set up at the lower end points a'd, ad of the maximum feed pitch by operating the stitch feed adjusting lever 301 and the inter-stitch feed adjusting lever 302, because the portions b', b which become each operating points of the stitch feed adjusting lever 301 and the inter-stitch feed adjusting lever 302 respectively are positioned at the uppermost positions, the connecting adjusting lever link 307', 307 respectively move upward the reverse T-shaped feed adjuster 310 which is supported by the supporting arm 311 in the vertical state. This moved position becomes the uppermost position of the feed adjuster 310.

When the reverse T-shaped feed adjuster 310 is positioned at the uppermost position in the vertical state, the connecting end 352*a* of the feed changeover rod 352 and the horizontal feed connection link 712 are respectively pushed up through the stitch length changeover link 355 which is pivotally attached to the vertical arm end 310*c* of the reverse T-shaped feed adjuster 310. This moved position becomes the uppermost position of the connecting end 352*a* of the feed changeover rod 352 and the horizontal feed connection link 712. In this state, when the intermediate shaft 8 rotates clockwise, as with the above-mentioned setting example of the minimum feed, because the feed changeover triangular cam 351 performs the eccentric motion, the feed changeover rod 352 performs the reciprocating rocking intermittently between the right-and-left two positions q and q' of the almost horizontal direction in the quantity Q of displacement. The shape of the feed changeover triangular cam 351 is formed so that the feed changeover rod 352 can stop intermittently in the moved position q and q'. The time which stops intermittently in the moved position q and q' is decided by the feed changeover triangular cam 351. And, because the intermediate shaft 8 rotates one time while the upper shaft 5 rotates two times, the feed changeover rod 352 moves to the moved position of q direction by the one rotation of the upper shaft, and moves to the moved position of q' direction by the further one rotation of the upper shaft.

When the feed changeover rod 352 stops intermittently by moving to the position q' of the right direction, the point h which is one end of the stitch length changeover link 355 corresponds to the point c' which is another horizontal arm end 310*b* of the reverse T-shaped feed adjuster 310 which moved to the uppermost position. And, when the feed changeover rod 352 stops intermittently by moving to the position q of the left direction, the point h which is one end of the stitch length changeover link 355 corresponds to the point c which is one horizontal arm end 310*a* of the reverse T-shaped feed adjuster 310 which moved to the upper most position. Therefore, because the position of the point h which is one end of the horizontal feed connection link 712 can be decided to the point c which is one horizontal arm end 310*a* and the point c' which is another horizontal arm end 310*b* of the feed adjuster 310 which are respectively set up by the stitch feed adjusting lever 301 and the inter-stitch feed adjusting lever 302, the setup of each fabric workpiece feed mode can be changed over in sequence. This setup of each fabric workpiece feed mode is performed by the feed change over rod 352. And the cloth feed is performed every this fabric workpiece feed mode.

As described above, when the stitch feed adjusting lever 301 and the inter-stitch feed adjusting lever 302 are respectively set up in the maximum feed pitch, the first arm 709*a* of the horizontal feed connection crank 709 is pushed up to the horizontal feed connection link 712 and rotates clockwise. Therefore, the point j which is the lower end of the second arm 709*b* of the horizontal feed connection crank 709 rocks to the right direction and is stopping. In this state, when the upper shaft 5 rotates clockwise, the horizontal feed eccentric cam 701 lets the horizontal feed drive rod 702 performs the reciprocating motion with the quantity e of the eccentricity in the almost horizontal direction. Thereby, when the horizontal feed eccentric cam 701 performs eccentricity and rotates and moves to the left direction, by the horizontal feed drive rod 702, another end l of the horizontal feed rod link 707 rocks to the lower left direction. And when the horizontal feed eccentric cam 701 performs eccentricity, rotates and moves to the right direction, by the horizontal feed drive rod 702, another end l of the horizontal feed rod link 707 rocks to the upper right direction. Consequently, the reciprocating rocking motion by the horizontal feed drive rod 702 is transmitted to the horizontal feed vertical rod 704 by being transferred to the maximum up-and-down reciprocating motion. Therefore, in each fabric workpiece feed mode, the horizontal feed quantity of the feed dog 602 becomes maximum pitch, and the cloth feed of the fabric workpiece 21 is performed with maximum pitch.

<Setting Example that the Stitch Feed Pitch is Minimum and the Inter-Stitch Feed Pitch is Maximum>

Next, as shown in FIG. 8 (B), the case that one stitch length P1 of the stitch feed is the minimum feed and one stitch pitch P2 of the inter-stitch feed is the maximum feed is explained based on FIGS. 23 (A) and (B).

As shown in FIG. 23 (A), when setting the stitch feed adjusting lever 301 at the uppermost position a's of the minimum feed pitch and when setting the inter-stitch feed adjusting lever 302 at the lowermost position ad of the maximum feed pitch by operating respectively, the portion b' which becomes the operating point of the stitch feed adjusting lever 301 is positioned at the lowermost position and the portion b which becomes the operating point of the inter-stitch feed adjusting lever 302 is positioned at the uppermost position. The adjusting lever link 307' which is connected to the stitch feed adjusting lever 301 pulls down another horizontal arm end 310*b* of the reverse T-shaped feed adjuster 310, and the adjusting lever link 307 which is connected to the inter-stitch feed adjusting lever 302 pushes up one horizontal arm end 310*a* of the reverse T-shaped feed adjuster 310. Consequently, the reverse T-shaped feed adjuster 310 rotates clockwise on a pivotally supporting point d which is pivotally supported by the supporting arm 311.

In such state, the vertical arm end 310*c* of the reverse T-shaped feed adjuster 310 inclines to the right direction. In the stitch length changeover link 355 which is connected to the vertical arm end 310*c*, the intermediate shaft 8 rotates clockwise and the feed changeover triangular cam 351 performs the eccentric motion. Thereby, when the feed changeover rod 352 moves to the position q of the left direction and stops intermittently, the point h which is one end of the stitch length changeover link 355 corresponds to the point c which is one horizontal arm end 310*a* of the clockwise rotated reverse T-shaped feed adjuster 310. That is, the point h which is one end of the stitch length changeover link 355 moves to the upper left direction by rotating clockwise on the linking pin 312. Therefore, the horizontal feed connection link 712 which is connected to another end of the stitch length changeover link 355 is pushed up to the upper direction, and the first arm 709*a* of the horizontal feed connection crank 709 which is connected to this horizontal feed connection link 712 is pushed up and rotates counterclockwise. Therefore, the point j which is the lower end of the second arm 709*b* of the horizontal feed connection crank 709 rocks to the right direction and is stopping. In this state, when the upper shaft 5 rotates clockwise, the horizontal feed eccentric cam 701 lets the horizontal feed drive rod 702 perform the reciprocating motion with the quantity e of eccentricity in the almost horizontal direction. Thereby, when the horizontal feed eccentric cam 701 performs eccentricity and rotates and moves to the left direction, by the horizontal feed drive rod 702, another end 1 of the horizontal feed rod link 707 rocks to the lower left direction. And when the horizontal feed eccentric cam 701 performs eccentricity and rotates and moves to the right direction, by the horizontal feed drive rod 702, another end l of the horizontal feed rod link 707 rocks to the upper right direction and is stopping. Consequently, the reciprocating rocking motion by the horizontal feed drive rod 702 is transmitted to the horizontal feed vertical rod 704 by being transferred to the maximum up-and-down reciprocating motion. Therefore, the inter-stitch feed which is set by the inter-stitch feed adjusting lever 302 becomes the feed quantity of the maximum feed pitch.

Meanwhile, as shown in FIG. 23 (B), the vertical arm end 310*c* of the reverse T-shaped feed adjuster 310 inclines to the right direction. In the stitch length changeover link 355 which is connected to the vertical arm end 310*c*, the intermediate shaft 8 rotates clockwise and the feed changeover triangular cam 351 performs the eccentric motion. Thereby, when the feed changeover rod 352 moves to the position q' of the right direction and stops intermittently, the point h which is one end of the stitch length changeover link 355 corresponds to the point c' which is another horizontal arm end 310*b* of the clockwise rotated reverse T-shaped feed adjuster 310. That is, the point h which is one end of the stitch length changeover link 355 moves to the lower right direction by rotating counterclockwise on the linking pin 312. Therefore, the horizontal feed connection link 712 which is connected to another end of the stitch length changeover link 355 is pulled down to the lower direction, and the first arm 709*a* of the horizontal feed connection crank 709 which is connected to this horizontal feed connection link 712 is pulled down and rotates clockwise. Therefore, the point j which is the lower end of the second arm 709*b* of the horizontal feed connection crank 709 rocks to the left direction and is stopping. In this state, when the upper shaft 5 rotates clockwise, the horizontal feed eccentric cam 701 lets the horizontal feed drive rod 702 perform the reciprocating motion with the quantity e of eccentricity in the almost horizontal direction. Thereby, the point j which is one end of the horizontal feed rod link 707 which is connected to the second arm 709*b* of the horizontal feed crank 709 becomes the rocking center, and the horizontal feed vertical rod 704 which is connected to another end l of the horizontal feed rod link 707 rocks to the right-and-left direction. The position that the second arm 709*b* of the horizontal feed crank 709 rocks to the left direction and stops is set up so that the point j which is one end of the horizontal feed rod link 707 corresponds to the rocking center of the horizontal feed vertical rod 704. And because the rocking center of the horizontal feed rod link 707 and the rocking center of the horizontal feed vertical rod 704 overlap, even if the quantity e of eccentricity of the horizontal feed eccentric cam 701 is transmitted, the up-and-down motion which is transmitted to the horizontal feed vertical rod 704 becomes extremely few. Therefore, because the horizontal feed quantity of the feed dog 602 also becomes extremely few, the cloth feed of the fabric workpiece 21 is few. That is, it becomes the feed quantity of the minimum feed pitch which is set up by the stitch feed adjusting lever 301.

As described above, each setup of each fabric workpiece feed mode can be changed over in sequence.

<Setting Example that the Stitch Feed Pitch is Maximum and the Inter-Stitch Feed Pitch is Minimum>

Next, as shown in FIG. 8 (C), the case that one stitch length P1 of the stitch feed is the maximum feed and one stitch pitch P2 of the inter-stitch feed is the minimum feed is explained based on FIGS. 24 (A) and (B).

As shown in FIG. 24 (A), when setting the stitch feed adjusting lever 301 at the lowermost position a'd of the maximum feed pitch and when setting the inter-stitch feed adjusting lever 302 at the uppermost position ad of the minimum feed pitch by operating respectively, the portion b' which becomes the operating point of the stitch feed adjusting lever 301 is positioned at the uppermost position and the portion b which becomes the operating point of the inter-stitch feed adjusting lever 302 is positioned at the lowermost position. The adjusting lever link 307' which is connected to the stitch feed adjusting lever 301 pushes up another horizontal arm end 310*b* of the reverse T-shaped feed adjuster 310, and the adjusting lever link 307 which is connected to the inter-stitch feed adjusting lever 302 pulls down one horizontal arm end 310*a* of the reverse T-shaped feed adjuster 310. Consequently, the reverse T-shaped feed adjuster 310 rotates counterclockwise on a pivotally supporting point d which is pivotally supported by the supporting arm 311.

In such state, the vertical arm end 310*c* of the reverse T-shaped feed adjuster 310 inclines to the left direction. In the stitch length changeover link 355 which is connected to the vertical arm end 310*c*, the intermediate shaft 8 rotates clockwise and the feed changeover triangular cam 351 performs the eccentric motion. Thereby, when the feed changeover rod 352 moves to the position q of the left direction and stops intermittently, the point h which is one end of the stitch length changeover link 355 corresponds to the point c which is one horizontal arm end 310*a* of the counterclockwise rotated reverse T-shaped feed adjuster 310. That is, the point h which is one end of the stitch length changeover link 355 moves to the lower left direction by rotating clockwise on the linking pin 312. Therefore, the horizontal feed connection link 712 which is connected to another end of the stitch length changeover link 355 is pulled down to the lower direction, and the first arm 709*a* of the horizontal feed connection crank 709 which is connected to this horizontal feed connection link 712 is pulled down and rotates clockwise. Therefore, the point j which is the lower end of the second arm 709*b* of the horizontal feed connection crank 709 rocks to the left direction and is stopping. In this state, when the upper shaft 5 rotates clockwise, the horizontal feed eccentric cam 701 lets the horizontal feed drive rod 702 perform the reciprocating motion with the quantity e of eccentricity in the almost horizontal direction. Thereby, the point j which is one end of the horizontal feed rod link 707 which is connected to the second arm 709*b* of the horizontal feed crank 709 becomes the rocking center, and the horizontal feed vertical rod 704 which is connected to another end l of the horizontal feed rod link 707 rocks to the right-and-left direction. The position that the second arm 709*b* of the horizontal feed crank 709 rocks to the left direction and stops is setup so that the point j which is one end of the horizontal feed rod link 707 corresponds to the rocking center of the horizontal feed vertical rod 704. And because the rocking center of the horizontal feed rod link 707 and the rocking center of the horizontal feed vertical rod 704 overlap, even if the quantity e of eccentricity of the horizontal feed eccentric cam 701 is transmitted, the up-and-down motion which is transmitted to the horizontal feed vertical rod 704 becomes extremely few. Therefore, because the horizontal feed quantity of the feed dog 602 also becomes extremely few, the cloth feed of the fabric workpiece 21 is few. That is, it becomes the feed quantity of the minimum feed pitch which is set up by the inter-stitch feed adjusting lever 302.

Meanwhile, as shown in FIG. 24 (B), the vertical arm end 310*c* of the reverse T-shaped feed adjuster 310 inclines to the left direction. In the stitch length changeover link 355 which is connected to the vertical arm end 310*c*, the intermediate shaft 8 rotates clockwise and the feed changeover triangular cam 351 performs the eccentric motion. Thereby, when the feed changeover rod 352 moves to the position q' of the right direction and stops intermittently, the point h which is one end of the stitch length changeover link 355 corresponds to the point c' which is another horizontal arm end 310*b* of the counterclockwise rotated reverse T-shaped feed adjuster 310. That is, the point h which is one end of the stitch length changeover link 355 moves to the upper right direction by rotating counterclockwise on the linking pin 312. Therefore, the horizontal feed connection link 712 which is connected to another end of the stitch length changeover link 355 is pushed up to the upper direction, and the first arm 709*a* of the horizontal feed connection crank 709 which is connected to this horizontal feed connection link 712 is pushed up and rotates counterclockwise. Therefore, the point j which is the lower end of the second arm 709*b* of the horizontal feed connection crank 709 rocks to the right direction and is stopping. In this state, when the upper shaft 5 rotates clockwise, the horizontal feed eccentric cam 701 lets the horizontal feed drive rod 702 perform the reciprocating motion with the quantity e of eccentricity in the almost horizontal direction. Thereby, when the horizontal feed eccentric cam 701 performs eccentricity, rotates and moves to the left direction, by the horizontal feed drive rod 702, another end l of the horizontal feed rod link 707 rocks to the lower left direction. And when the horizontal feed eccentric cam 701 performs eccentricity, rotates and moves to the right direction, by the horizontal feed drive rod 702, another end l of the horizontal feed rod link 707 rocks to the upper right direction and is stopping. Consequently, the reciprocating rocking motion by the horizontal feed drive rod 702 is transmitted to the horizontal feed vertical rod 704 by being transferred to the maximum up-and-down reciprocating motion. Therefore, the inter-stitch feed which is set by the stitch feed adjusting lever 301 becomes the feed quantity of the maximum feed pitch.

As described above, each setup of each fabric workpiece feed mode can be changed over in sequence.

As described above, in each feed quantity of one stitch length feed and one inter-stitch pitch feed by the feed quantity setting mechanism 300 and the feed mode changeover mechanism 350, the cloth feed of the fabric workpiece 21 which is respectively set up by the position setting of each adjusting lever 301 and 302 can be performed. And, because the single-thread locked handstitches is formed by the cooperation of the open eye needle 13, the shuttle hook 200 and the thread draw out actuator 401, the stitch length and the inter-stitch pitch can be set up freely.

Figure 25A:
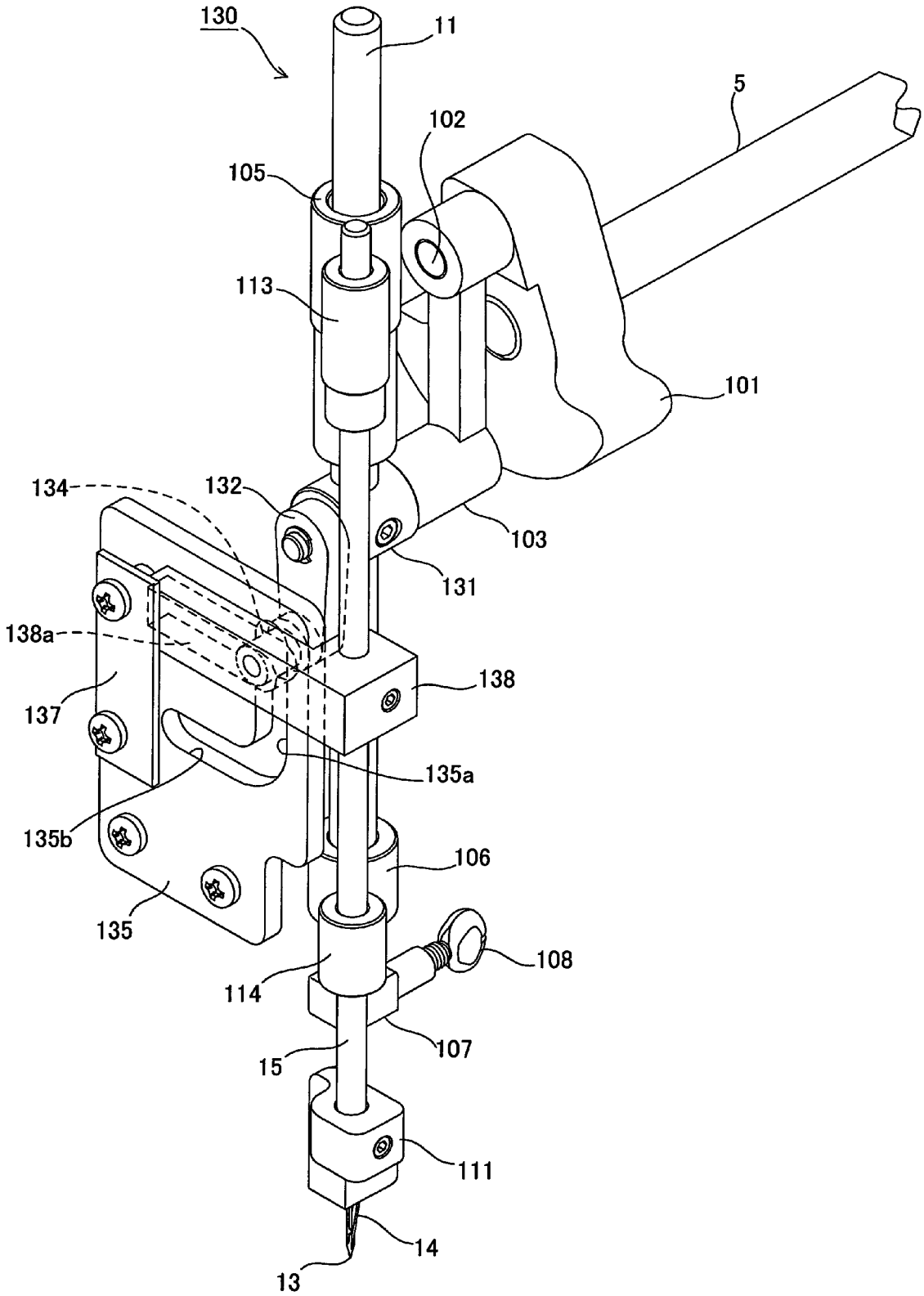
FIG. 25 (A) A perspective view showing the open eye needle-latch wire drive mechanism of another mode of embodiment in the single-thread locked handstitch sewing machine of this invention, wherein (A) is the view that the open eye needle is in the upper dead center.
Figure 25B:
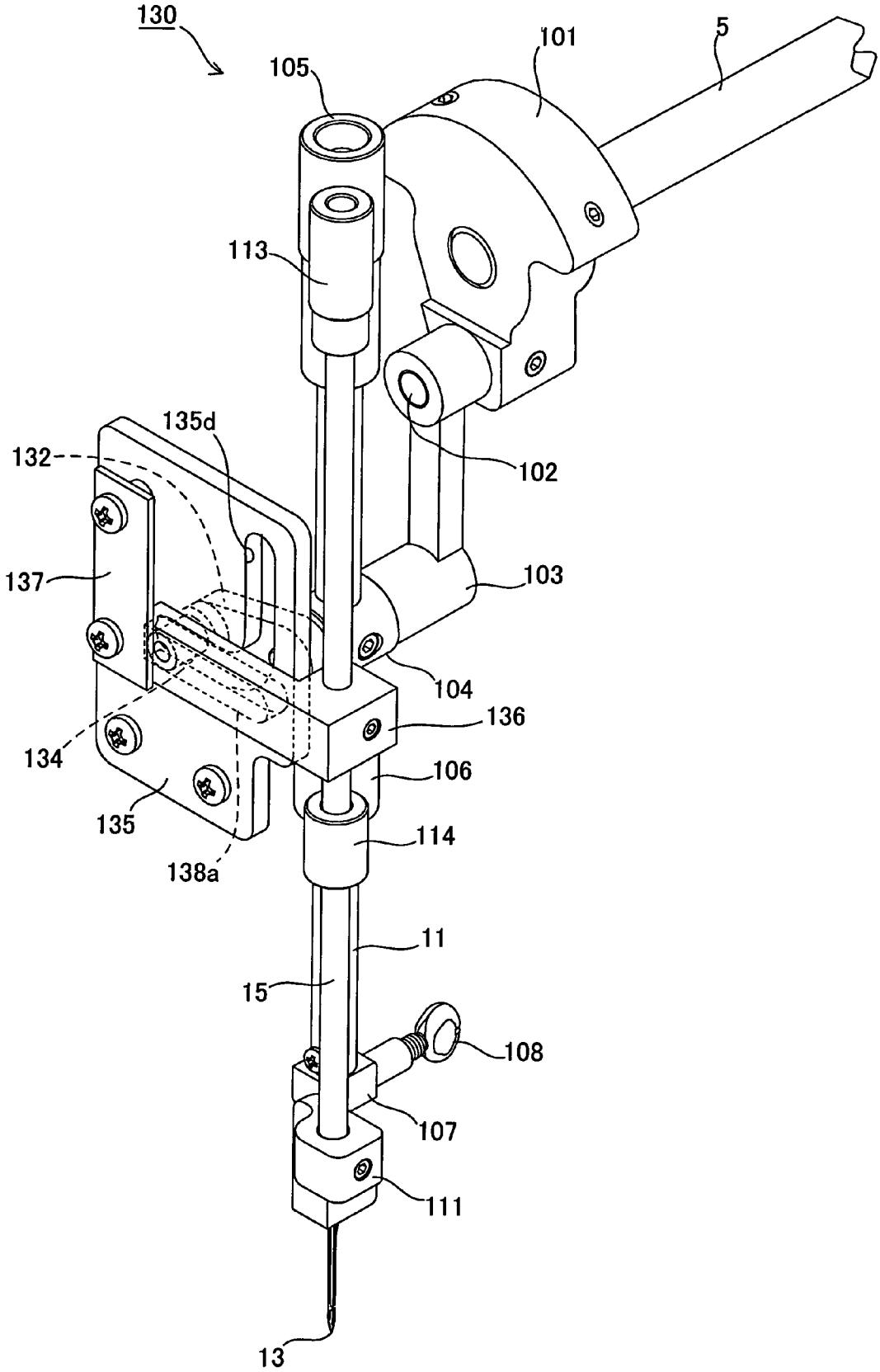
Figure 26:
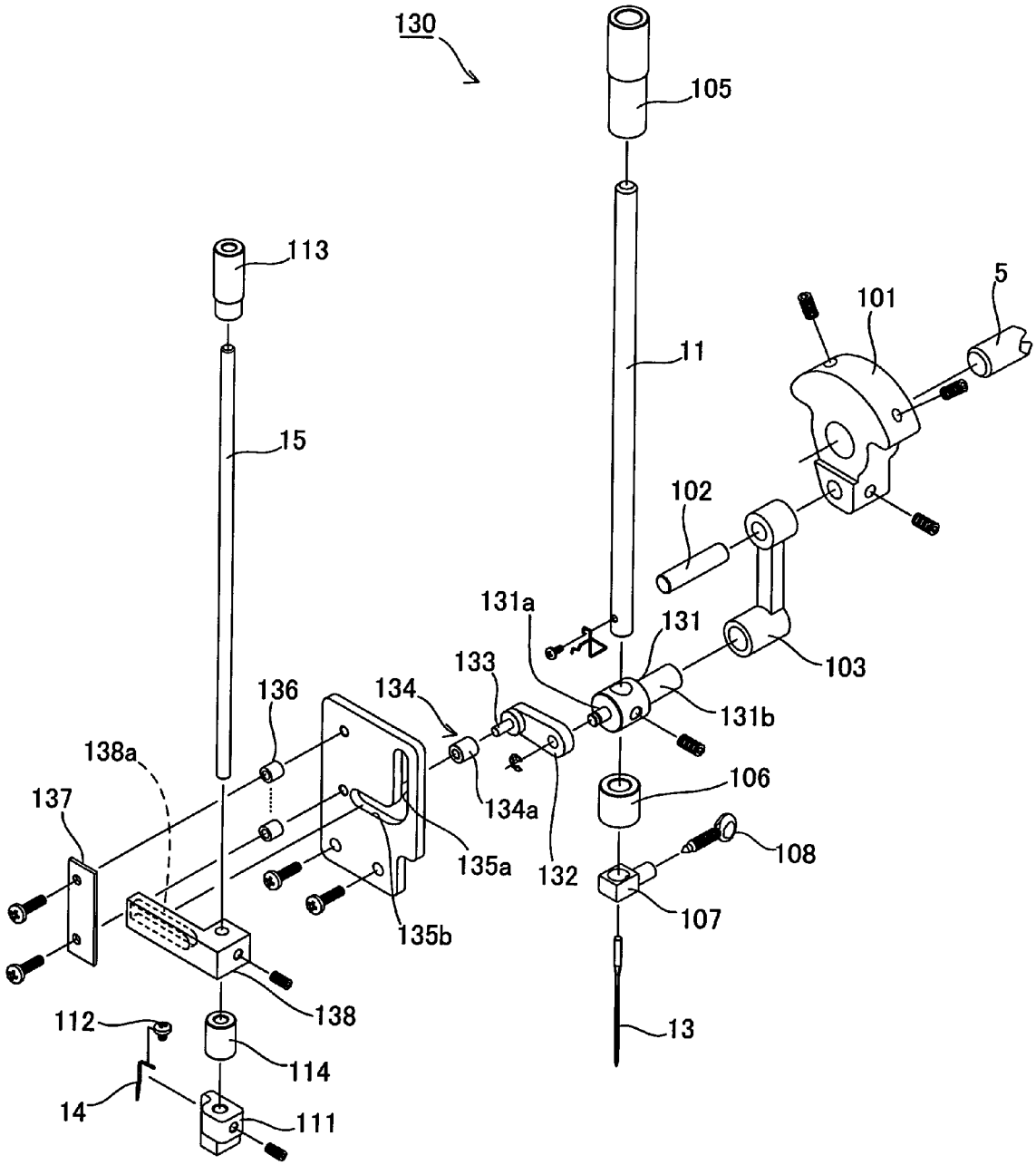
FIG. 26 An exploded perspective view showing the open eye needle-latch wire drive mechanism of FIGS. 25 (A) and (B).

In above-mentioned single-thread locked handstitch sewing machine, after capturing the sewing thread 20 by the thread capturing open eye 13*a* of the open eye needle 13, the latch wire 14 not to let the sewing thread 20 slip out from the thread capturing open eye 13*a* is equipped in the open eye needle-latch wire drive mechanism 100 which covers the thread capturing open eye 13*a* in the period that the open eye needle 13 passes through the throat plate 12 and reaches the upper dead center of the open eye needle 13, and in the period that the open eye needle 13 sticks in the fabric workpiece 21 from the upper dead center of the open eye needle 13. However, not only this, it is possible to drive the latch wire 14 by the open eye needle-latch wire drive mechanism 130 shown in FIG. 25 (A), (B) and FIG. 26. In FIG. 25 (A), (B) and FIG. 26, the same reference number is given to the portion which is the same component with the open eye needle-latch wire drive mechanism 100 shown in FIG. 3 (A), (B) and FIG. 4, and the explanation is omitted.

This open eye needle-latch wire drive mechanism 130 is equipped with a latch wire drive link 132, a latch wire bar drive arm 138 and a plate groove cam 135. One end of the latch wire drive link 132 is pivotally attached to the needle bar 11 and another end has a roller follower 134. The latch wire bar drive arm 138 has a groove 138*a* in which the roller follower 134 which is fastened to the latch wire bar 15 fits horizontally and movably. In the plate groove cam 135, a vertical groove 135*a* and a horizontal groove 135*b* are formed. And the roller follower 134 is fitted into the vertical groove 135*a* and the horizontal groove 135*b*. The vertical groove 135*a* lets the roller follower 134 move to the vertical direction toward the lower dead center from the upper dead center of the open eye needle 13. And, the horizontal groove 135*b* lets the roller follower 134 which moves toward the lower dead center move horizontally at the predetermined position. And, the plate groove cam 135 is fixed to the arm 2.

One end of the latch wire drive link 132 is rotatably held by the pin 131*a* which is formed at one end of the needle bar holder 131. The crank rod pin 131*b* is formed at another end of the needle bar holder 131, and one end of the needle bar crank rod 103 is rotatably connected to this crank rod pin 131*b*. This needle bar holder 131 is fixed to the needle bar 11 between the needle bar upper bushing 105 and the needle bar lower bushing 106. And, a roller shaft 133 is formed at another end of the latch wire drive link 132, and the roller follower 134 is composed by holding a roller 134*a* rotatably.

The latch wire bar drive arm 138 is fixed to the latch wire bar 15 between the latch wire bar upper bushing 113 and the latch wire bar lower bushing 114. And, the vertical groove 135*a* and the horizontal groove 135*b* are connected by the curved groove, and thereby, the plate groove cam 135 is formed in the shape of L.

In the open eye needle-latch wire drive mechanism 130 constituted as described above, in the period that the thread capturing open eye 13*a* of the open eye needle 13 comes down from the upper dead center and pierces the fabric workpiece and passes through the throat plate 12, and in the period that the thread capturing open eye 13*a* of the open eye needle 13 goes up from the lower dead center and passes through the throat plate 12 and slips out from the fabric workpiece and reaches the upper dead center, the latch wire 14 which covers the thread capturing open eye 13*a* can be driven.

Concretely, as shown in FIG. 25 (A), when the needle bar 11 goes up by the rotation of the upper shaft 5, the roller follower 134 of the latch wire drive link 132 goes up along the vertical groove 135*a* of the plate groove cam 135, and the latch wire bar drive arm 138 goes up. In this case, as shown in FIG. 5 (A) and FIG. 6 (A), because the latch wire 14 also goes up through the needle bar 15 that the latch wire bar drive arm 138 is fixed along with the rise of open eye needle 13, the thread capturing open eye 13*a* of the open eye needle 13 becomes closed state by the latch wire 14. That is, in the period that the thread capturing open eye 13*a* of the open eye needle 13 comes down from the upper dead center and pierces the fabric workpiece and passes through the throat plate 12, and in the period that the thread capturing open eye 13*a* of the open eye needle 13 goes up from the lower dead center and passes through the throat plate 12 and slips out from the fabric workpiece and reaches the upper dead center, the thread capturing open eye 13*a* is closed by the latch wire 14. Besides, as shown in FIG. 25 (B), when the needle bar 11 comes down by the rotation of the upper shaft 5, after the roller follower 134 of the latch wire drive link 132 comes down along the vertical groove 135*a* of the plate groove cam 135, it moves horizontally along the horizontal groove 135*b*. In this case, as shown in FIG. 5 (B) and FIG. 6 (B), although the open eye needle 13 comes down, the latch wire bar drive arm 138 stops. Thereby, the thread capturing open eye 13*a* of the open eye needle 13 becomes open state. That is, after the thread capturing open eye 13*a* of the open eye needle 13 comes down from the upper dead center, and pierces the fabric workpiece, and passes through the throat plate 12, the aforementioned thread capturing open eye 13*a* is released from the latch wire 14.

As described above, the reason to drive the latch wire 14 by the open eye needle-latch wire drive mechanism 130 is as follows. When the open eye needle 13 pierces the fabric workpiece, the occurrence of the thread breakage by hooking the thread of the fabric workpiece by the thread capturing open eye 13*a* is prevented. And, it is prevented that the captured thread slips out from the thread capturing open eye 13*a*.

Besides, in the above-mentioned single-thread locked handstitch sewing machine, as shown in FIGS. 18 (M) and (N), when the open eye needle 13 comes down in the second stroke, the sewing thread 20 which is captured by the thread capturing open eye 13*a* of the open eye needle 13 between the needlepoint of the open eye needle 13 and the fabric workpiece 21 becomes the slack state from the tight state, and the thread slack occurs. Thereby, there is the fear that the sewing thread 20 of the slack state is pierced by the descending needlepoint of the open eye needle 13. Therefore, as shown in FIG. 27 (A), (B), FIGS. 28 (A) and (B), when the open eye needle 13 comes down from the upper dead center in the second stroke, it is preferable to provide the thread shifting mechanism 800A and 800B which shift the sewing thread captured by the thread capturing open eye 13*a* between the needlepoint of the open eye needle 13 and the fabric workpiece.

Figure 27A:
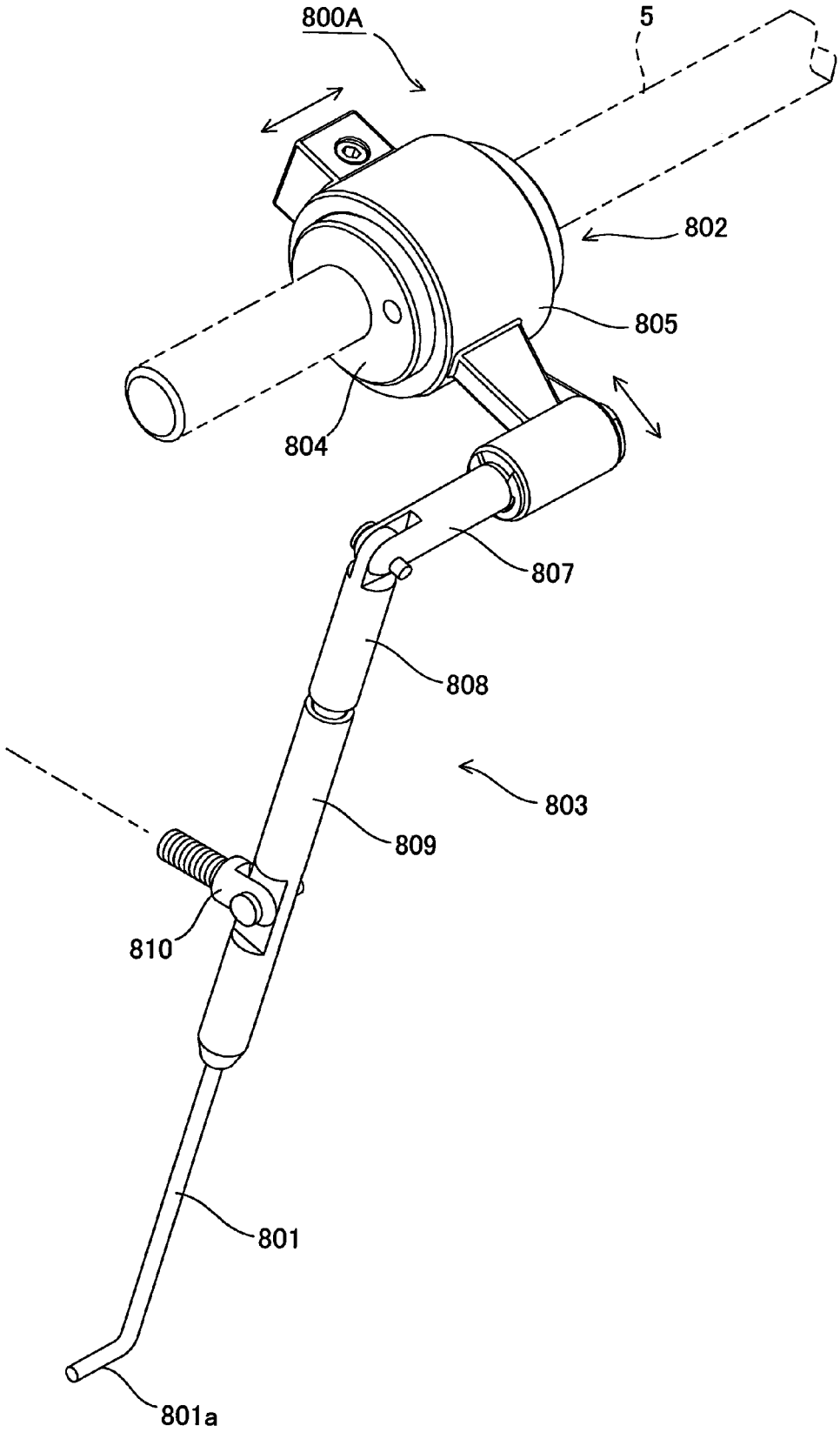
FIG. 27 (A) A perspective view showing the thread shifting mechanism in the single-thread locked handstitch sewing machine of this invention.
Figure 27B:
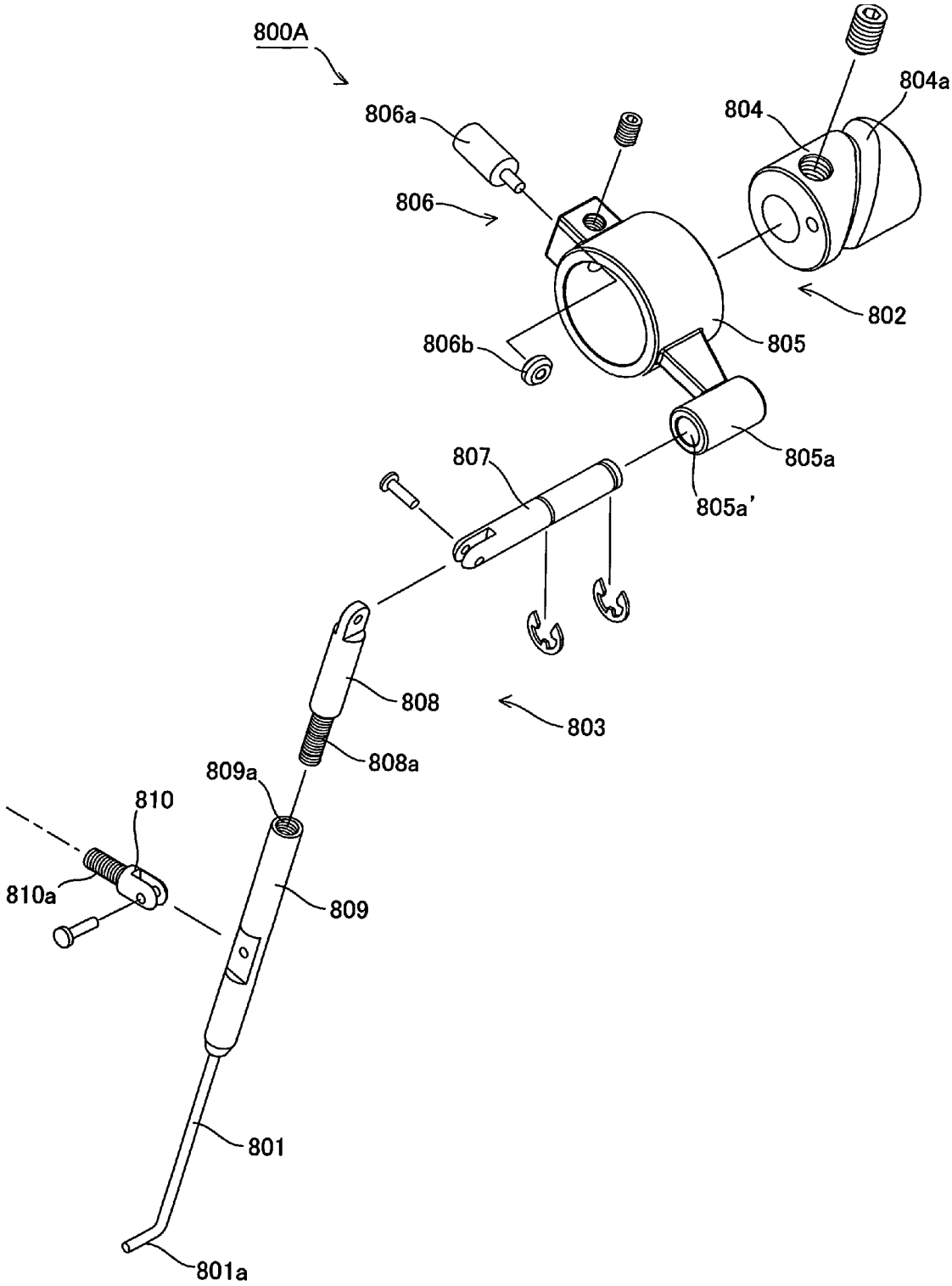

As shown in FIGS. 27 (A) and (B), the thread shifting mechanism 800A is equipped with a thread shifter 801 which is formed in the L-shape to hook the thread slack which occurs between the needlepoint of the open eye needle 13 and the fabric workpiece 21, an elliptical drive mechanism 802 which is attached to the upper shaft 5 and has the elliptical motion trace in the horizontal plain surface and a link mechanism 803 which transmits the elliptical motion by the elliptical drive mechanism 802 to the thread shifter 801.

The elliptical drive mechanism 802 consists of a column-shaped thread shifting drive cam 804 that a cam groove 804*a* is fixed to the upper shaft 5 in the eccentric state and is formed around the circumference, a cylindrical thread shifting drive member 805 which is fitted into so as to cover the thread shifting drive cam 804 and that a thread shifting drive arm 805*a* that the link mechanism 803 is connected is formed, and a cam follower 806 which is mounted on the cylindrical thread shifting drive member 805 and is fitted into the cam groove 804*a* of the thread shifting drive cam 804. The cam groove 804*a* of the thread shifting drive cam 804 is formed so that the thread shifting drive member 805 is able to perform the linear reciprocating motion in the same direction of the axial direction of the upper shaft 5. Besides, the cam follower 806 consists of a roller shaft 806*a* which is fixed to the aforementioned thread shifting drive member 805 so as to protrude partly from the inner wall of the thread shifting drive member 805 and a roller 806*b* which is rotatably held at the tip of the roller shaft 806*a* and fits into the cam groove 804*a* of the thread shifting drive cam 804.

The link mechanism 803 consists of a thread shifting drive arm shaft 807 which is rotatably held in a shaft hole 805*a*' which is equipped at the thread shifting drive arm 805*a* of the thread shifting drive member 805, a thread shifting adjusting shaft 808 whose one end is connected so as to bend freely to the tip of the thread shifting drive arm shaft 807, a thread shifting attachment shaft 809 that a female screw 809*a* into which a male screw 808*a* which is equipped to another end of the thread shifting adjusting shaft 808 is screwed is equipped to one end and the thread shifter 801 is fixed to another end, and a thread shifting attachment shaft holder 810 that a male screw 810*a* which is screwed into a female screw (not shown in the drawing) which is equipped to the predetermined position of the arm 2 is equipped and rotatably supports the thread shifting attachment shaft 809. Because the male screw 808*a* of the thread shifting adjusting shaft 808 and the female screw 809*a* of the thread shifting attachment shaft 809 are screwed without being tightened completely, the thread shifting adjusting shaft 808 and the thread shifting attachment shaft 809 become rotatable. And, because the female screw which is equipped to the predetermined position of the arm 2 and the male screw 810*a* of the thread shifting attachment shaft holder 810 are screwed without being tightened completely, the thread shifting attachment shaft holder 810 becomes rotatable for the arm 2.

In the thread shifting mechanism 800A constituted as described above, as shown in FIG. 29, the tip portion 801*a* of the thread shifter 801 turns around one time on the presser foot 501 by the elliptical motion of the motion trace 830 while the upper shaft 5 turns around one time. Therefore, the tip portion 801*a* of the thread shifter 801 can perform the elliptical motion without interference to the open eye needle 13 which performs the linear motion in the up-and-down direction. Concretely, when the upper shaft 5 rotates, because the thread shifting drive cam 804 which is fixed in the eccentric state to the aforementioned upper shaft 5 also rotates, the thread shifting drive member 805 having the cam follower 806 which engages to the cam groove 804*a* of the thread shifting drive cam 804 performs the linear reciprocating motion in the same direction as the axial direction of the upper shaft 5, and performs the reciprocating motion in the eccentric direction (hereinafter called "eccentric reciprocating motion") of the thread shifting drive cam 804.

When the linear reciprocating motion of the thread shifting drive member 805 is transmitted to the link mechanism 803, the thread shifting drive arm shaft 807 and the thread shifting adjusting shaft 808 of the link mechanism 803 bend. By this bending motion, because the connecting position of the thread shifting drive arm shaft 807 of the thread shifting adjusting shaft 808 becomes the point of force and the tip portion 801*a* of the thread shifter 801 which is fixed to the thread shifting attachment shaft 809 becomes the operating point by making the thread shifting attachment shaft holder 810 the fulcrum, the tip portion 801*a* of the thread shifter 801 rocks to the opposing direction for the linear reciprocating motion of the thread shifting drive member 805. Besides, when the eccentric reciprocating motion of the thread shifting drive member 805 is transmitted to the link mechanism 803, because the thread shifting drive arm shaft 807 of the link mechanism 803 and the thread shifting adjusting shaft 808 are not the bending direction, that state is maintained. However, because the thread shifting drive arm shaft 807 which is rotatably held to the thread shifting drive arm 805*a* of the thread shifting drive member 805 becomes the point of force and the tip portion 801*a* of the thread shifter 801 which is fixed to the thread shifting attachment shaft 809 becomes the operation point by making the connecting position of the thread shifting attachment shaft holder 810 and the thread shifting attachment shaft 809 the fulcrum, the tip portion 801*a* of the thread shifter 801 rocks to the opposing direction for the eccentric reciprocating motion of the thread shifting drive member 805.

Figure 29:
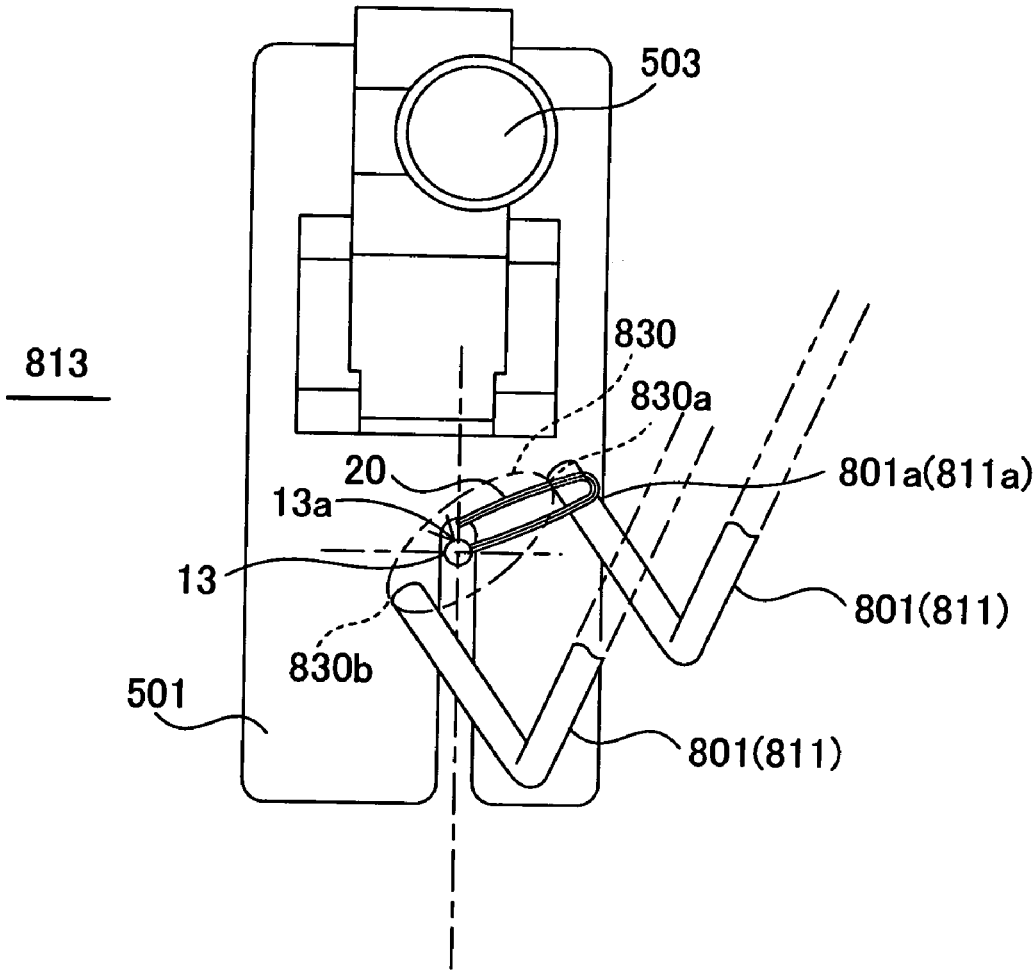
FIG. 29 An explanatory view showing the motion trace of the thread shifter of the thread shifting mechanism of FIGS. 27 (A) and (B), and FIGS. 28(A) and (B) in the single-thread locked handstitch sewing machine of this invention.

Therefore, when two reciprocating motions that the directions of the motion are perpendicular by the thread shifting drive member 805 are combined, the tip portion 801*a* of the thread shifter 801 can perform the elliptical motion of the motion trace 830 as shown in FIG. 29 in the horizontal plain surface. Thereby, when the open eye needle 13 comes down from the upper dead center in the second stroke, it is possible to shift the thread by scooping the sewing thread which is captured by the thread capturing open eye 13*a* by the tip portion 801*a* of the thread shifter 801 between the needle point of the open eye needle 13 and the fabric workpiece.

Figure 28A:
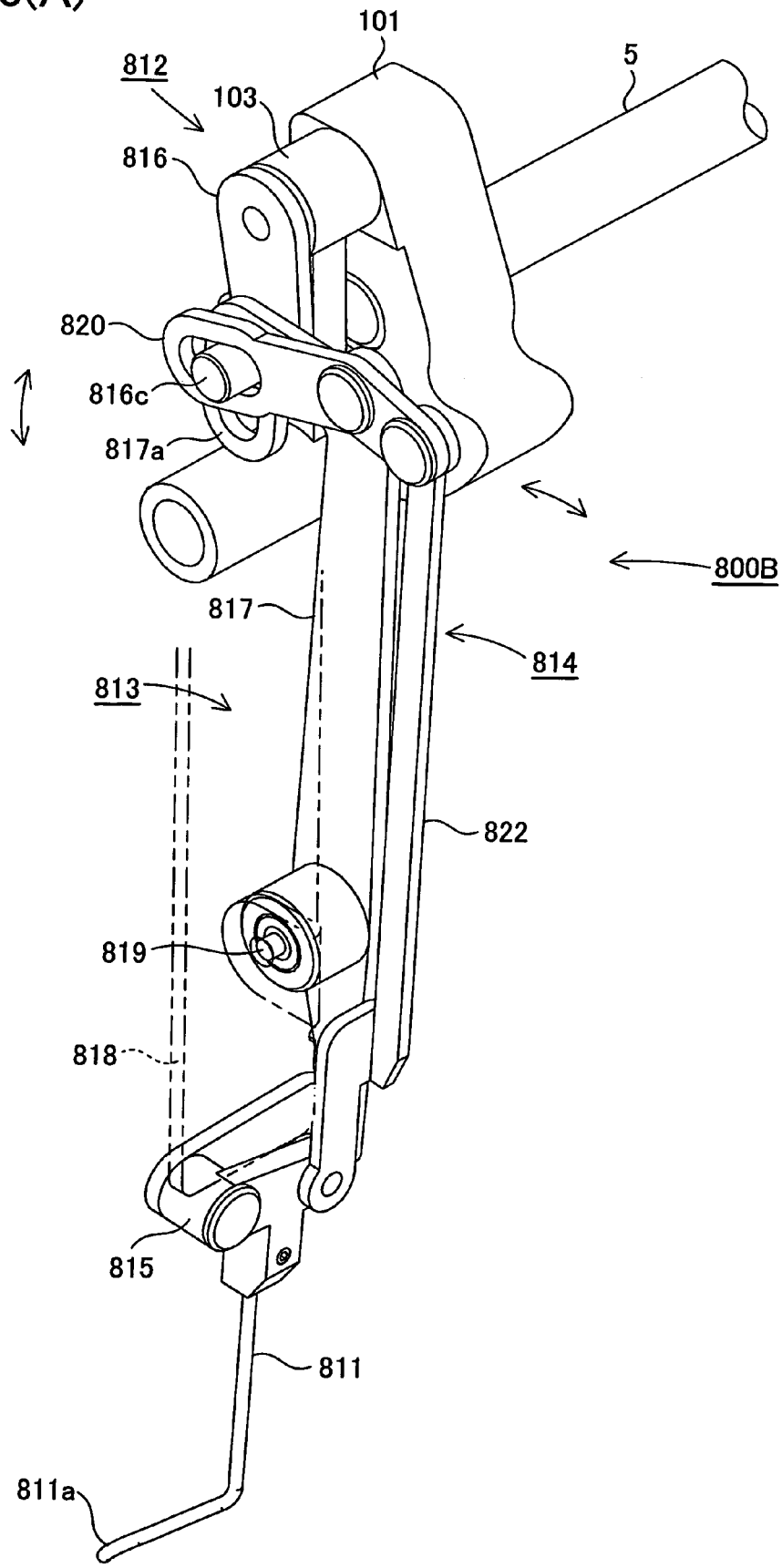
FIG. 28 (A) A perspective view showing the thread shifting mechanism of another mode of embodiment in the single-thread locked handstitch sewing machine of this invention.
Figure 28B:
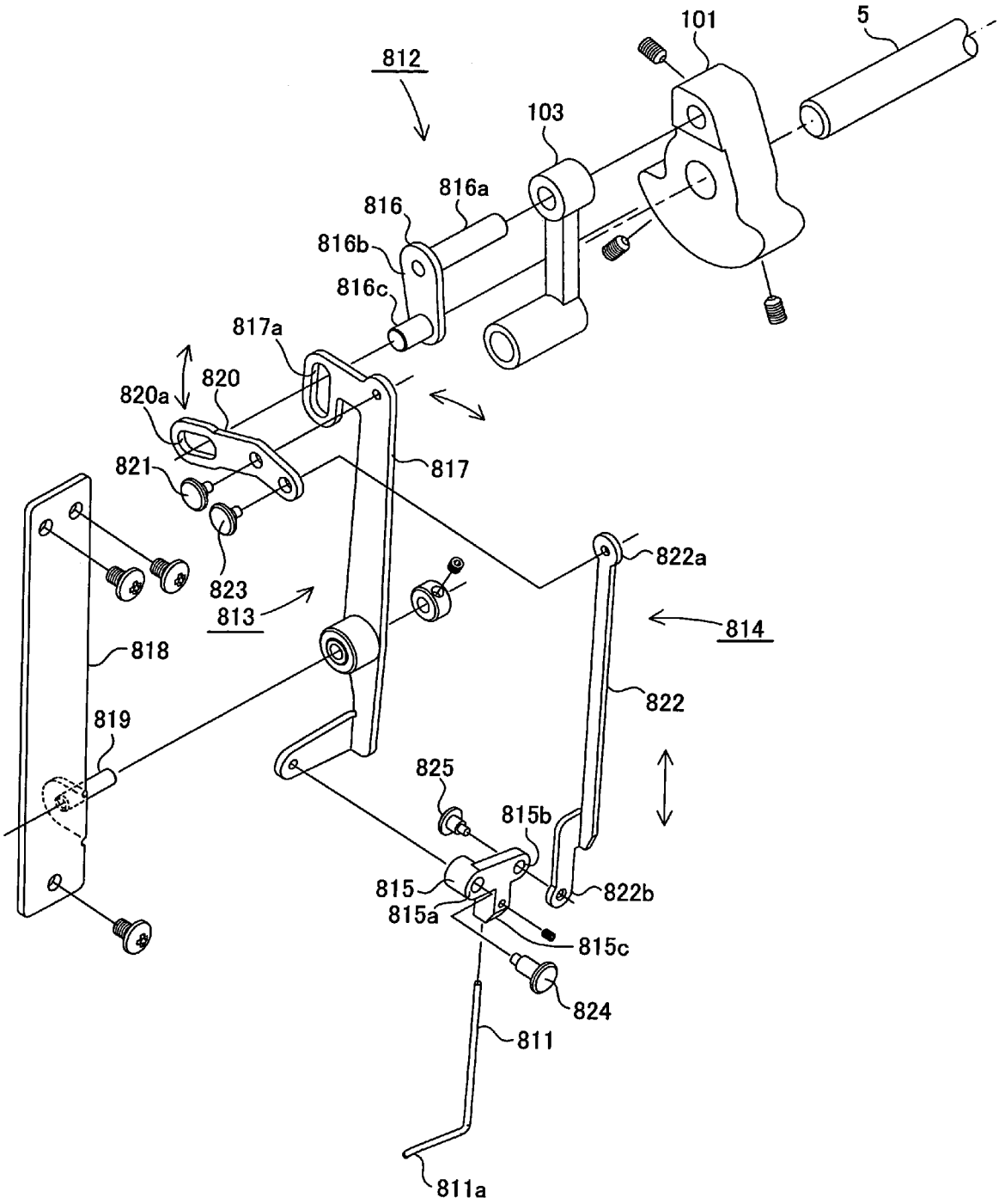

Besides, as shown in FIGS. 28 (A) and (B), the thread shifting mechanism 800B is equipped with a thread shifter 811 which is formed in the L-shape to hook the thread slack which occurs between the needlepoint of the open eye needle 13 and the fabric workpiece 21, an eccentric mechanism 812 which converts the rotational motion of the upper shaft 5 to the eccentric motion, a first link mechanism 813 which is connected to the eccentric mechanism 812 and converts the eccentric motion of the aforementioned eccentric mechanism to the horizontal motion, a second link mechanism 814 which is connected to the eccentric mechanism 812 and converts the eccentric motion of the aforementioned eccentric mechanism to the up-and-down motion and a thread shifting attachment arm 815 which is connected to the first link mechanism 813 and the second link mechanism 814 and converts the motion trace to the elliptical motion in the horizontal direction by combining the horizontal motion of the first link mechanism 813 and the up-and-down motion of the second link mechanism 814 and transmits the elliptical motion to the thread shifter 801.

The eccentric mechanism 812 uses a thread shifting drive eccentric shaft 816 instead of a crank rod pin 102 which connects the needle bar crank rod 103 of the open eye needle-latch wire drive mechanism 100 which is shown in above-mentioned FIG. 3 (A), (B) and FIG. 4 to the needle bar crank 101. The thread shifting drive eccentric shaft 816 consists of a crank rod pin 816*a* which connects the needle bar crank rod 103 to the needle bar crank 101 and an arm portion 816*b* that the crank rod pin 816*a* is fixed to one end and an eccentric shaft 816*c* is fixed to another end.

The first link mechanism 813 is equipped with a thread shifting horizontal rocking arm 817 that an elongate hole 817*a* which engages to the eccentric shaft 816*c* of the thread shifting drive eccentric shaft 816 is formed in one end. The elongate hole 817*a* is formed in the thread shifting horizontal rocking arm 817 so that the longer direction becomes up-and-down direction. This thread shifting horizontal rocking arm 817 is constituted so that the elongate hole 817*a* which is one end becomes the point of force, and so that another end becomes the operating point, and so that the portion between one end and another end becomes the fulcrum. A thread shifting mechanism attachment board 818 which supports the fulcrum of the thread shifting horizontal rocking arm 817 is fixed to the arm 2. The portion which becomes the fulcrum of the thread shifting horizontal rocking arm 817 is rotatably supported to a thread shifting spindle 819 which is equipped to the predetermined position of the thread shifting mechanism attachment board 818. Therefore, another end of the thread shifting horizontal rocking arm 817 can perform the reciprocating rocking in the horizontal direction whose direction is same as the direction of motion of the feed of the feed dog 601 by making the thread shifting spindle 819 the fulcrum.

The second link mechanism 814 is equipped with a thread shifting up-and-down drive arm 820 that an elongate hole 820*a* which engages to the eccentric shaft 816*c* of the thread shifting drive eccentric shaft 816 is formed in one end. The elongate hole 820*a* is formed in the thread shifting up-and-down drive arm 820 so that the longer direction becomes almost horizontal direction. This thread shifting up-and-down drive arm 820 is constituted so that the elongate hole 820*a* which is one end becomes the point of force, and so that another end becomes the operating point, and so that the portion between one end and another end becomes the fulcrum. The fulcrum of the thread shifting up-and-down drive arm 820 is rotatably connected to one end of the thread shifting horizontal rocking arm 817 by a connecting member 821 such as the linking pin. And, an upper end 822*a* of a thread shifting up-and-down rocking arm 822 which is arranged in the up-and-down direction is rotatably connected to the operating point of the thread shifting up-and-down drive arm 820 by a connecting member 823 such as the linking pin. Therefore, because another end of the thread shifting up-and-down drive arm 820 can perform the reciprocating rocking in the up-and-down direction by making the connecting member 821 the fulcrum, the thread shifting up-and-down rocking arm 822 which is connected to another end of the thread shifting up-and-down drive arm 820 can perform the reciprocating motion in the up-and-down direction.

In the thread shifting attachment arm 815, the arrangement direction of the T-shaped horizontal arm is perpendicular to the direction of motion of the feed of the feed dog 601. And, one horizontal arm end 815*a* is rotatably connected to another end of the thread shifting horizontal rocking arm 817 by a connecting member 824 such as the linking pin, and a lower end 822*b* of the thread shifting up-and-down rocking arm 822 is rotatably connected to another horizontal arm end 815*b* by a connecting member 825 such as the linking pin. And, the arrangement direction of the vertical arm of the thread shifting attachment arm 815 is the vertical direction, and the thread shifter 811 is fixed to a tip 815*c*.

In the thread shifting mechanism 800B constituted as described above, it is similar to the thread shifting mechanism 800A. As shown in FIG. 29, a tip portion 811*a* of the thread shifter 811 turns around one time on the presser foot 501 by the elliptical motion of the motion trace 830 while the upper shaft 5 turns around one time. Therefore, the tip portion 811*a* of the thread shifter 811 can perform the elliptical motion without interference to the open eye needle 13 which moves linearly in the up-and-down direction. Concretely, when the needle bar crank 101 rotates by the upper shaft 5, because the distance between the shaft center of a crank rod pin 816*a* of the thread shifting drive eccentric shaft 816 and the shaft center of the eccentric shaft 816*c* is shorter than the distance between the rotational center by the upper shaft 5 of the needle bar crank 101 and the center of the hole which fits in the crank rod pin 816*a* of the thread shifting drive eccentric shaft 816, the eccentric shaft 816*c* of the thread shifting drive eccentric shaft 816 performs the circular motion.

When the eccentric shaft 816*c* of the thread shifting drive eccentric shaft 816 performs the circular motion, because another end of the thread shifting horizontal rocking arm 817 can perform the reciprocating rocking by the elongate hole 817*a* in the horizontal direction whose direction is same as the direction of motion of the feed of the feed dog 601 by making the thread shifting spindle 819 the fulcrum, a vertical arm end 815*c* of the thread shifting attachment arm 815 which is connected to another end of the aforementioned thread shifting horizontal rocking arm 817 also performs the reciprocating rocking in the horizontal direction whose direction is same as the direction of motion of the feed of the feed dog 601. And, when the eccentric shaft 816*c* of the thread shifting drive eccentric shaft 816 performs the circular motion, because another end of the thread shifting up-and-down drive arm 820 performs the reciprocating rocking by the elongate hole 820*a* in the up-and-down direction by making the linking pin 821 the fulcrum, the thread shifting up-and-down rocking arm 822 which is connected to another end of the thread shifting up-and-down drive arm 820 performs the reciprocating motion in the up-and-down direction. When the thread shifting up-and-down rocking arm 822 performs the reciprocating motion in the up-and-down direction, because another end 815*b* of the thread shifting attachment arm 815 which is connected to the lower end 822*b* of the aforementioned thread shifting up-and-down rocking arm 822 performs the reciprocating rocking in the up-and-down direction, the vertical arm end 815*c* of the aforementioned thread shifting attachment arm 815 performs the reciprocating rocking in the horizontal direction whose direction is perpendicular to the direction of motion of the feed of the feed dog 601.

Therefore, when two reciprocating rocking motions by the first link mechanism 813 and the second link mechanism 814 are combined, the tip portion 811*a* of the thread shifter 811 can perform the elliptical motion of the motion trace 830 as shown in FIG. 29 in the horizontal direction. Thereby, when the open eye needle 13 comes down from the upper dead center in the second stroke, it is possible to shift the thread by scooping the sewing thread which is captured by the thread capturing open eye 13*a* by the tip portion 811*a* of the thread shifter 811 between the needle point of the open eye needle 13 and the fabric workpiece.

Figure 30:
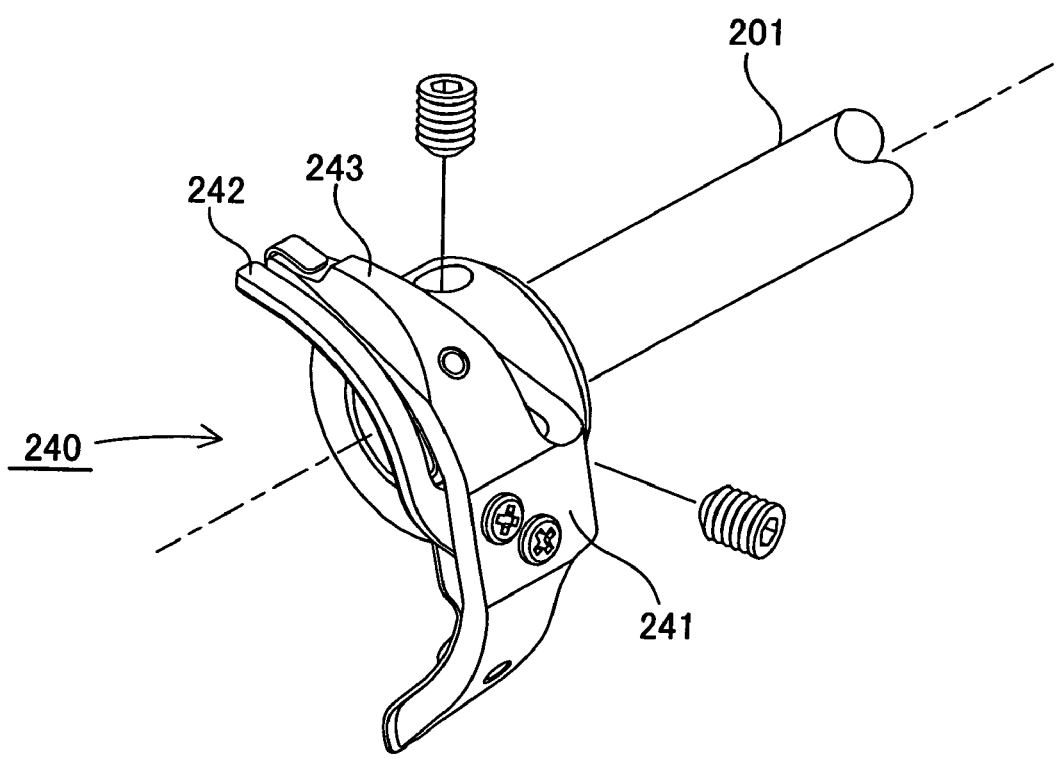
FIG. 30 A perspective view showing the inner shuttle hook driver which equips the needle guard which is used in the shuttle hook in the single-thread locked handstitch sewing machine of this invention.
Figure 31:
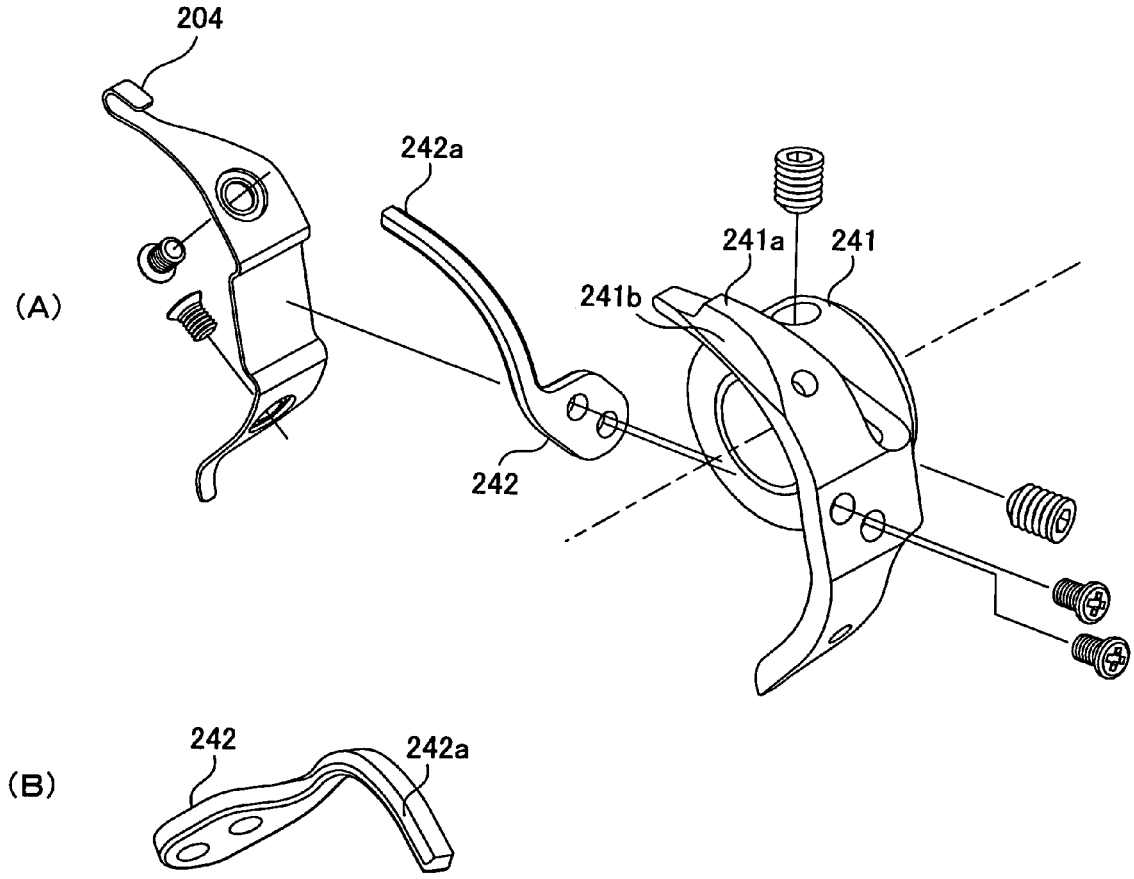
FIGS. 31 (A) is an exploded perspective view showing the inner shuttle hook driver of FIG. 30, and (B) is a perspective view which viewed the needle guard equipped in the inner shuttle hook driver from the direction different from (A).

Besides, in the above mentioned single-thread locked handstitch sewing machine, because there is a fear that the open eye needle 13 bends when it pierces the inhomogeneous fabric workpiece or the extremely-thick fabric workpiece, when scooping the sewing thread 20 which is captured by the thread capturing open eye 13*a* by the loop-taker point 205*a* of the shuttle hook 200 which performs the half-turn normal rotation, there is a possibility that the phenomenon that the open eye needle 13 drops to the direction away from the loop-taker point 205*a* of the shuttle hook 200 occurs. Therefore, as shown in FIG. 30, FIGS. 31 (A) and (B), it is preferable to arrange a needle guard 242 in order to correct the irregular motion which occurs by piercing the fabric workpiece by the open eye needle 13 to the needle dropping position in an inner shuttle hook driver 241 to drive the inner shuttle hook 205 by the half-turn normal rotation and the half-turn reverse rotation after the open eye needle 13 pierced the fabric workpiece. This inner shuttle hook driver 241 and the needle guard 242 can be used by being exchanged from the inner shuttle hook driver 203 in the above-mentioned shuttle hook 200.

Generally, in case of sewing the fabric workpiece by commonly-used sewing-machine needle and the shuttle hook, when scooping the needle thread which is pierced to the needle eye of the needle by the loop-taker point of the shuttle hook, a loop occurs in the needle thread, and the loop is scooped by the loop-taker point of the shuttle hook. Therefore, even if the open eye needle became the mismatched position from the needle dropping position somewhat, the stitch skip did not occur. However, for preventing the collision to the loop-taker point when the needle bends to the direction of the loop-taker point of the shuttle hook, the chamfering is given at the side of the needle dropping position of the needle guard arm that the inner shuttle hook driver has.

Therefore, the inner shuttle hook driver 241 that the needle guard 242 is provided is equipped with a curved needle guard arm 241*a* which is positioned at the needle dropping position of the open eye needle 13 when the open eye needle 13 pierces the fabric workpiece in the second stroke. And, for preventing the collision to the loop-taker point 205*a* when the open eye needle 13 bends to the direction of the loop-taker point of the shuttle hook 200, the chamfering 241*b* is given at the side of the needle dropping position of the aforementioned needle guard arm 241*a*.

However, in the above-mentioned method for forming single-thread locked handstitches, when scooping the sewing thread 20 which is captured by the thread capturing open eye 13*a* in the second stroke of the open eye needle 13 by the loop-taker point 205*a* of the shuttle hook 200 which performs the half-turn normal rotation (FIG. 18 (P)), because it is performed by the timing that the loop does not arise to the sewing thread 20, there is the fear that the stitch skip occurs by the bending of the open eye needle 13. Therefore, the needle guard 242 is formed in the curved state, and is fixed to the predetermined position of the inner shuttle hook driver 241 so as to become almost parallel with the needle guard arm 241*a*. Thereby, because it is possible to lead the open eye needle 13 to the needle dropping position, the stitch skip can be prevented. The chamfering 241*a* is given to also the needle guard 242 at the side of the needle dropping position of the open eye needle 13, and the generating of the stitch skip by the bend of the open eye needle 13 to the direction away from the loop-taker point of the shuttle hook 200 is prevented.

Figure 32:
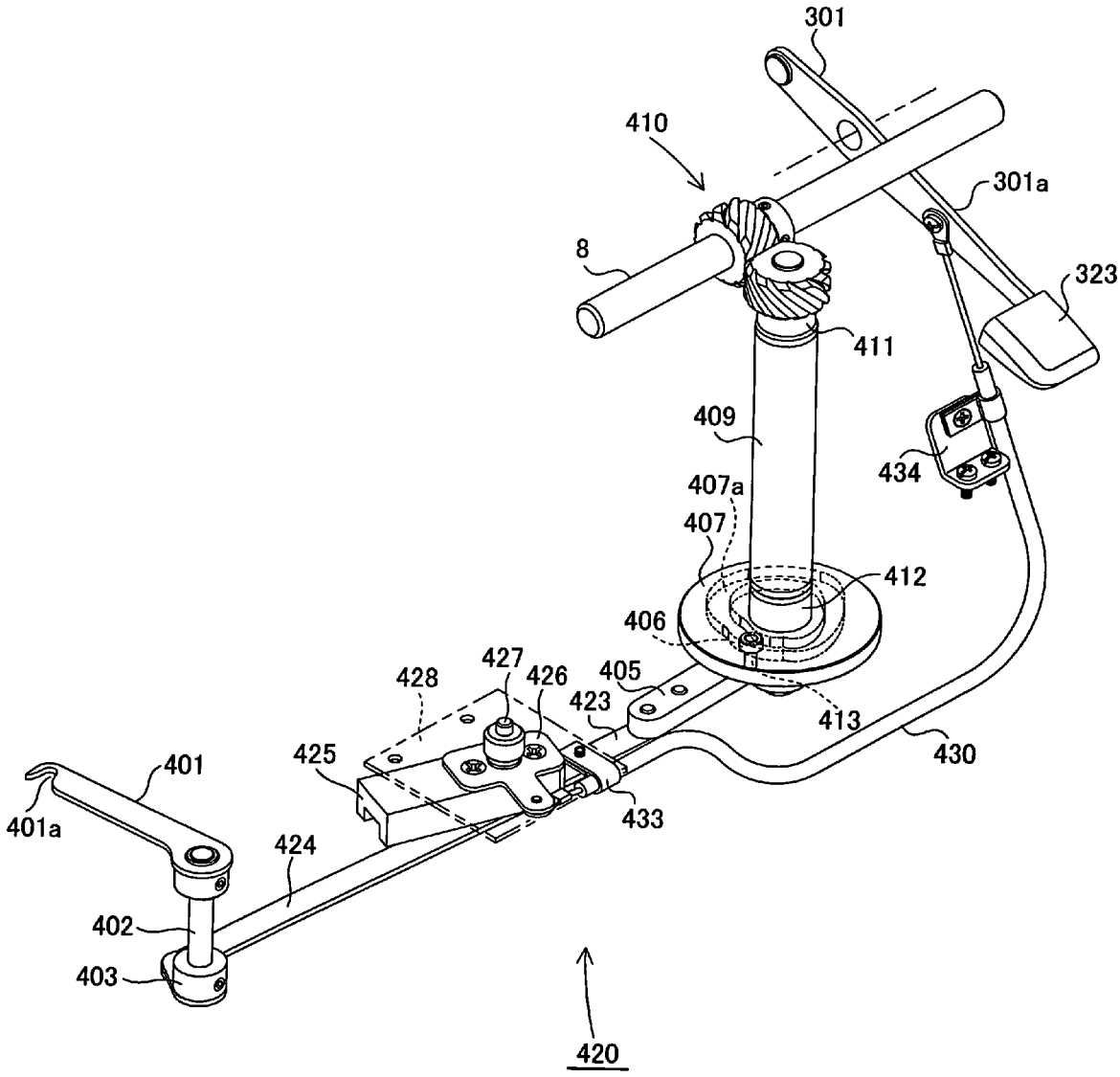
FIG. 32 A perspective view showing the thread tightness adjusting mechanism in the single-thread locked handstitch sewing machine of this invention.
Figure 33:
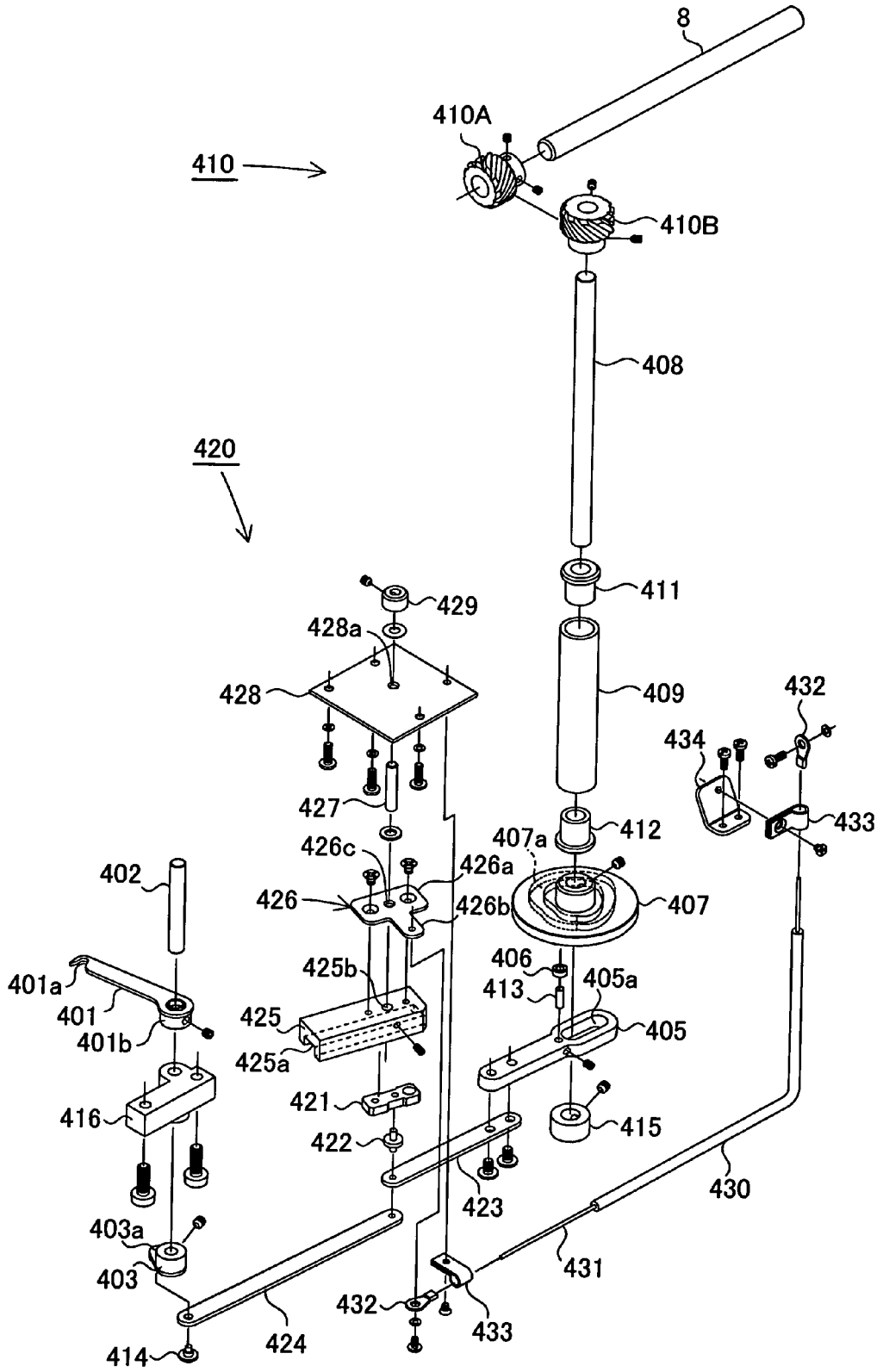
FIG. 33 A exploded perspective view showing the thread tightness adjusting mechanism in the single-thread locked handstitch sewing machine of this invention.

Besides, in the above-mentioned method for forming single-thread locked handstitches, the thread draw out actuator 401 which gives the slack to the sewing thread 20 or tightens the stitches by performing the reciprocating motion like the thread take-up lever is equipped. And, even if the stitch length is changed by the feed quantity setting mechanism 300, a thread tightness quantity by the thread draw out actuator 401 becomes constant anytime. Therefore, as shown in FIG. 32 and FIG. 33, it is preferable to provide the thread tightness adjusting mechanism 420 which adjusts the thread tightness quantity depending on the stitch length which is set by the feed quantity setting mechanism 300.

In the thread tightness adjusting mechanism 420, instead of the thread draw out actuator drive rod 404 which is the component of the thread draw out drive mechanism 400, one end of a thread draw out actuator drive rod 423 is fixed to the thread draw out actuator drive rod base 405, and another end of this thread draw out actuator drive rod 423 is connected to the arm end 403*a* of the thread draw out actuator drive arm 403 by a thread draw out actuator adjusting rod 424. Concretely, another end of the thread draw out actuator drive rod 423 and one end of the thread draw out actuator adjusting rod 424 are rotatably connected by a connecting square piece shaft 422, and another end of the thread draw out actuator adjusting rod 424 and the arm end 403*a* of the thread draw out actuator drive arm 403 are rotatably connected by the pin 414. And, a square piece 421 which is formed in the almost rectangular solid that the longer direction becomes horizontal direction is rotatably fitted into the connecting square piece shaft 422, and the square piece 421 is positioned at the upper direction of the thread draw out actuator drive rod 423. The connecting square piece shaft 422 is formed so that the shaft protrudes from both sides by making the flange the center, and thereby, the square piece 421 and the thread draw out actuator drive rod 423 can be separated. The square piece 421 is slidably fitted into a groove 425*a* which is formed at the lower surface of a thread draw out actuator adjusting grooved block 425 which is formed in the almost rectangular solid that the longer direction becomes horizontal direction. This groove 425*a* is also formed along the longer direction. And, a horizontal arm 426*a* of a T-shaped thread draw out actuator adjusting plate 426 is fixed to the upper surface of the thread draw out actuator adjusting grooved block 425.

The thread draw out actuator adjusting grooved block 425 to which the thread draw out actuator adjusting plate 426 is fixed is rotatably fitted into a thread draw out actuator adjusting grooved block shaft 427 which is arranged and fixed by a thrust collar 429 in the up-and-down direction to a thread draw out actuator adjusting board plate 428 which is fixed to the predetermined position of the bed 3. Besides, the thread draw out actuator adjusting grooved block shaft 427 is inserted in a hole 425*b* of the thread draw out actuator adjusting grooved block 425 by piercing a hole 426*c* of the thread draw out actuator adjusting plate 426 and fixed, and is rotatably fitted into the thread draw out actuator adjusting board plate 428 without jolting in the up-and-down direction. Because the thread draw out actuator adjusting grooved block 425 is in the state put on the square piece 421, it does not secede from the thread draw out actuator adjusting grooved block shaft 427.

Further, a vertical arm end 426*b* of the thread draw out actuator adjusting plate 426 and the stitch feed adjusting lever 301 are connected by an adjusting wire 431. For example, this adjusting wire 431 is inserted into a wire guard 430, and a wire terminal 432 is fixed to the both ends of the adjusting wire 431. One wire terminal 432 is fixed to the vertical arm end 426*b* of the thread draw out actuator adjusting plate 426, and another wire terminal 432 is fixed between the portion which becomes the point of force and the portion which becomes the fulcrum of the stitch feed adjusting lever 301. And, one side of the wire terminal 432 of the adjusting wire 431 is movably fixed to the thread draw out actuator adjusting board plate 428 by a wire guide stopper 433, and in another side of the wire terminal 432, the wire guide stopper 433 is movably fixed to the arm 2 by a mounting plate 434. A feed adjusting lever knob 323 is fixed to the portion which becomes the point of force of the stitch feed adjusting lever 301.

Figure 34A:
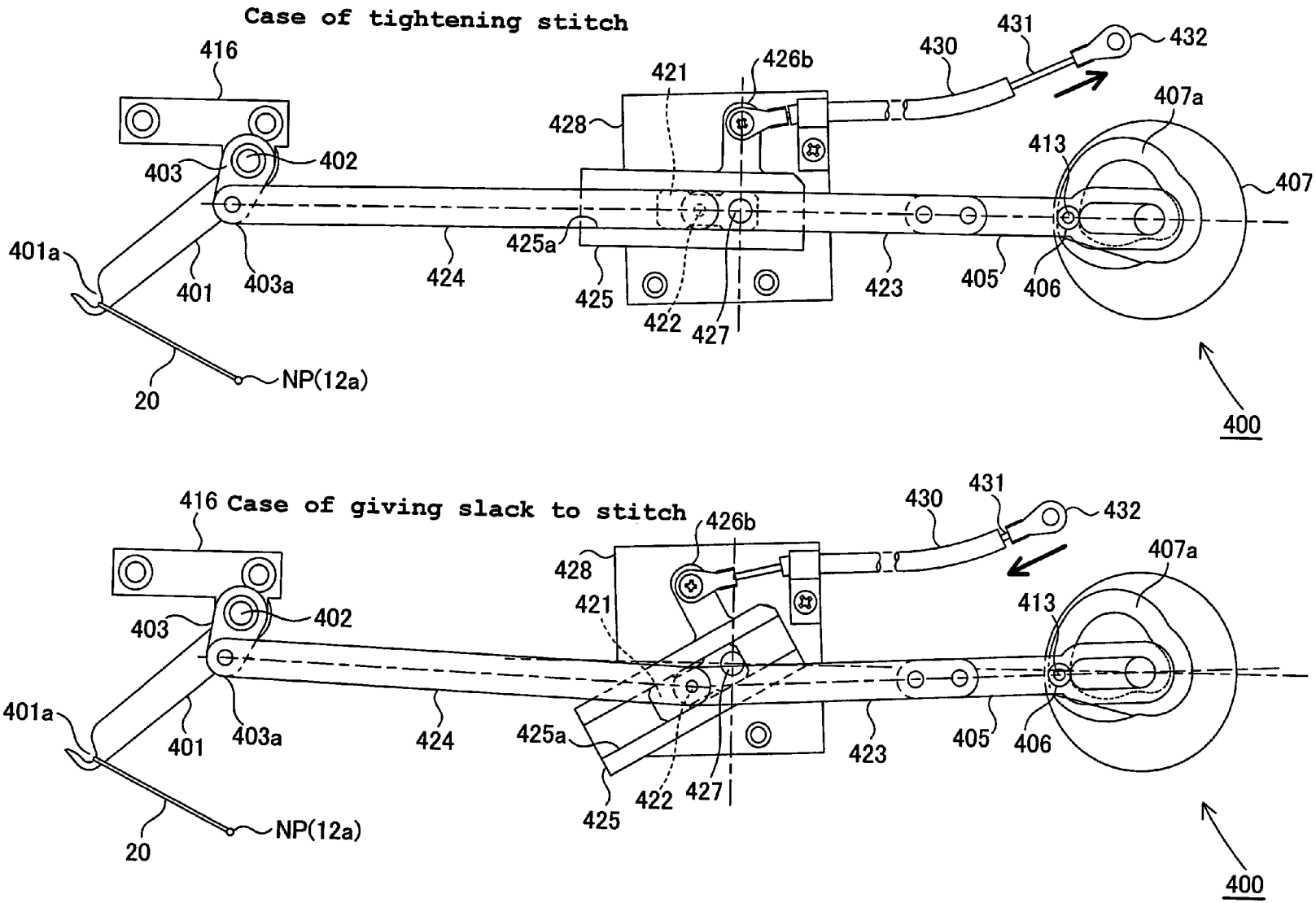
FIG. 34 (A) A plan view showing the movement state when viewing the thread tightness adjusting mechanism of FIG. 32 and FIG. 33 from the lower side of the sewing machine.
Figure 34B:
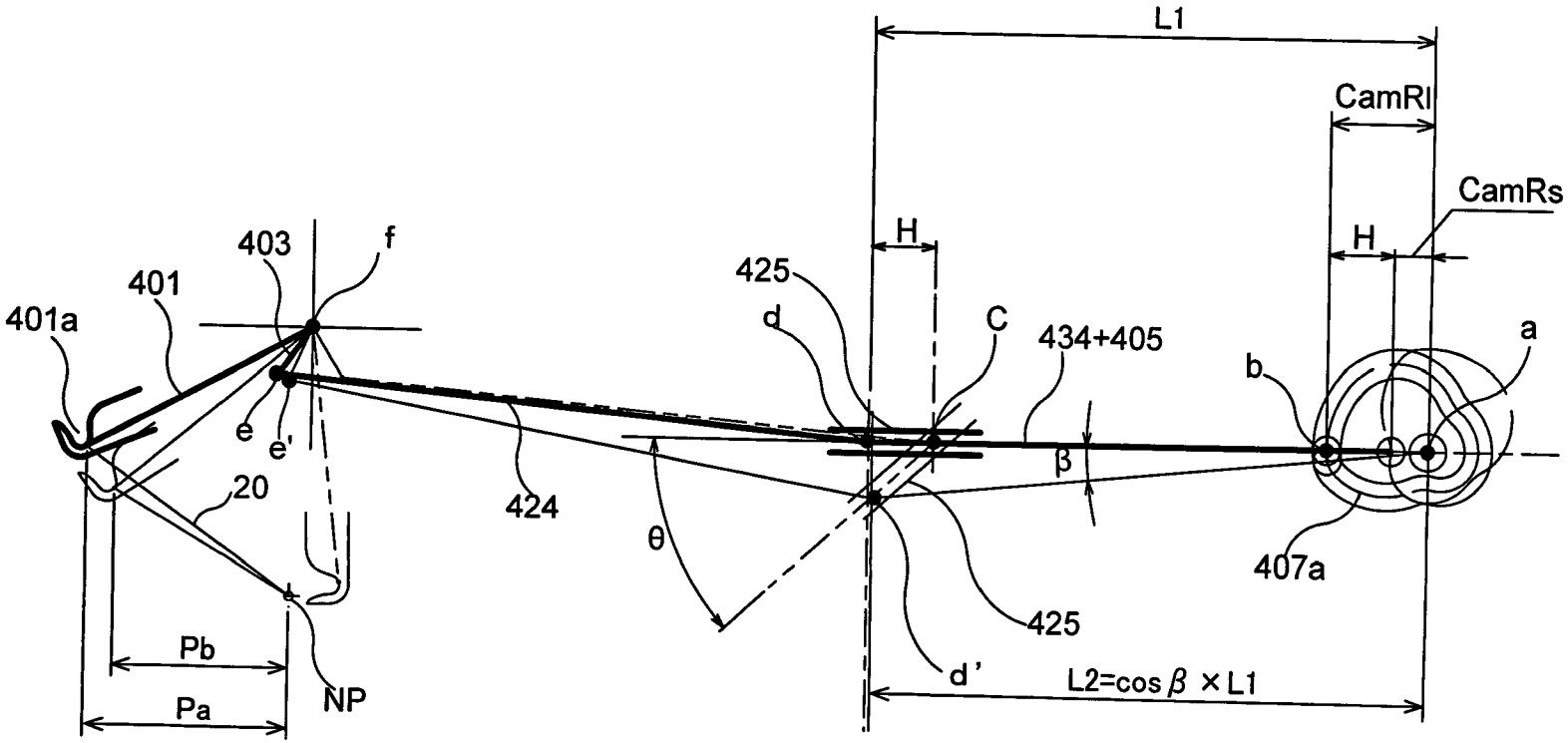

A thread tightness adjusting operation by the thread tightness adjusting mechanism 420 constituted as described above is explained based on FIGS. 34 (A) and (B). FIG. 34 (A) is the drawing which is looking from the underneath of the sewing machine. And, the drawing which is positioned at upper side shows the case that tightens the stitch by the thread tightness adjusting mechanism 420, and the drawing which is positioned at lower side shows the case that gives the slack to the stitch respectively. FIG. 34 (B) is the drawing which is looking from the underneath of the sewing machine. And, the point a is the rotational center of the thread draw out actuator drive cam 407, the point b is the rotational center of the cam follower 406, the point c is the rotational center of the thread draw out actuator adjusting grooved block 425, the point d is the center point of the connecting square piece shaft 422 which connects the thread draw out actuator drive rod 423 and the thread draw out actuator adjusting rod 424, the point e is the connecting center point which connects the thread draw out actuator adjusting rod 424 and the thread draw out actuator drive arm 403 and the point f is the rotational center point of the thread draw out actuator drive arm 403. Besides, the L1 which is shown in FIG. 34 (B) is the length till the point d from the point a. And, this length is the length that the length till the fixing from the cam follower 406 of the thread draw out actuator drive rod base 405 from the maximum diameter CamR1 of the cam groove 407*a*, the length from the fixing of the thread draw out actuator drive rod 423 and the length of the thread draw out actuator adjusting rod 424 are added. And, the L2 is the length till the point d' from the point a when the L1 rotates with the angle β by making the point a the center, $L2=\cos\beta\times L1$.

In the thread tightness adjusting mechanism 420, because the vertical arm end 426*b* of the thread draw out actuator adjusting plate 426 is pulled when the adjusting wire 431 is pulled, the thread draw out actuator adjusting grooved block 425 rotates clockwise by making the thread draw out actuator adjusting grooved block shaft 427 the rotational center, in FIGS. 34 (A) and (B), and it is possible to adjust the longer direction to the same direction of the longer direction of the thread draw out actuator drive rod 423. In this state, when the intermediate shaft 8 (FIG. 32, FIG. 33) rotates, because the cam follower 406 lets the thread draw out actuator adjusting rod 424 perform linear reciprocating motion depending on the shape of the cam groove 407*a* of the thread draw out actuator drive cam 407, the thread draw out actuator drive rod base 405 can let the thread draw out actuator 401 rock. In this case, because the longer direction of the thread draw out actuator adjusting grooved block 425 and the longer direction of the thread draw out actuator drive rod 423 are arranged in the same direction, the thread draw out actuator drive rod 423 and the square piece 421 which is equipped to the thread draw out actuator adjusting rod 424 by the connecting square piece shaft 422 perform the linear reciprocating motion with the maximum movement distance in the inside of the groove 425*a* of the thread draw out actuator adjusting grooved block 425.

Concretely, as shown in FIG. 34 (B), because the quantity H of displacement by the cam groove 407*a* of the thread draw out actuator drive cam 407 becomes the value that subtracted the minimum diameter CamRs from the maximum diameter CamR1 of the aforementioned cam groove 407*a* (H=CamR1−CamRs), when the thread draw out actuator adjusting grooved block 425 is arranged in the same direction as the longer direction of the thread draw out actuator drive rod 423, the quantity H of displacement by the cam groove 407*a* is directly transmitted to the thread draw out actuator adjusting rod 424, and the thread draw out actuator drive arm 403 which is connected to the thread draw out actuator adjusting rod 424 can be rocked. Therefore, because the arm end 403*a* of the thread draw out actuator drive arm 403 can be rocked with the length L1, when the reference position of the rocking of a thread grapple portion 401*a* of the thread draw out actuator 401 which is fixed to the thread draw out actuator rocking shaft 402 to which this thread draw out actuator drive arm 403 is fixed is set to Np, the rocking width becomes the maximum Pa, and the stitch can be tightened.

Besides, in this thread tightness adjusting mechanism 420, because the vertical arm end 426*b* of the thread draw out actuator adjusting plate 426 is pushed when the adjusting wire 431 is pushed, the thread draw out actuator adjusting grooved block 425 rotates counterclockwise by making the thread draw out actuator adjusting grooved block shaft 427 the rotational center, in the drawing, and it is possible to incline the longer direction for the longer direction of the thread draw out actuator drive rod 423 in angle θ. In this state, when the intermediate shaft 8 rotates, because the cam follower 406 lets the thread draw out actuator adjusting rod 424 perform linear reciprocating motion depending on the shape of the cam groove 407*a* of the thread draw out actuator drive cam 407, the thread draw out actuator 401 can be rocked. In this case, because the longer direction of the thread draw out actuator adjusting grooved block 425 is arranged by the inclination of the angle θ for the longer direction of the thread draw out actuator drive rod 423, the thread draw out actuator drive rod 423 and the square piece 421 which is equipped to the thread draw out actuator adjusting rod 424 by the connecting square piece shaft 422 perform the linear reciprocating motion in the inclined direction in the inside of the groove 425*a* of the thread draw out actuator adjusting grooved block 425.

Concretely, as shown in FIG. 34 (B), when the thread draw out actuator adjusting grooved block 425 is arranged at the inclined position of the angle θ, because the center point d of the connecting square piece shaft 422 which connects the thread draw out actuator drive rod 423 and the thread draw out actuator adjusting rod 424 slides in the inside of the groove 425*a* of the thread draw out actuator adjusting grooved block 425 of the square piece 421, the point d which is the center point of the connecting square piece shaft 422 moves to the point d'. As described above, when the point d which is the center point of the connecting square piece shaft 422 moves to the point d', also the connected thread draw out actuator adjusting rod 424 moves, and the quantity H of displacement which rocks the thread draw out actuator drive arm 403 which is connected to the thread draw out actuator adjusting rod 424 decreases. Thereby, the point e which is the connecting center point that the thread draw out actuator adjusting rod 424 and the arm end 403*a* of the thread draw out actuator drive arm 403 are connected moves only to the point e'. Therefore, because the rocking quantity of the thread draw out actuator 401 which is fixed to the thread draw out actuator rocking shaft 402 that the thread draw out actuator drive arm 403 is fixed decreases, the rocking width Pa till the thread grapple portion 401*a* of the thread draw out actuator 401 from the reference position of the rocking Np becomes Pb, and the slack to the stitch can be given.

In FIGS. 34 (A) and (B), the inclined direction of the thread draw out actuator adjusting grooved block 425 becomes the upper direction. However, not only this, it is possible to give the slack to the stitch by inclining it to the lower direction by the setting of the thread tightness adjusting mechanism 420.

Besides, as shown in FIG. 34 (B), the center point of the connecting square piece shaft 422 and the rotational center of the thread draw out actuator adjusting grooved block 425 become the same point in the timing position by the minimum diameter CamRs of the cam groove 407*a*. However, not only this, even if the center point of the connecting square piece shaft 422 which connects the thread draw out actuator drive rod 423 and the thread draw out actuator adjusting rod 424 is not the same point as the rotational center of the thread draw out actuator adjusting grooved block 425 in the timing position by the minimum diameter CamRs of the cam groove 407*a*, the normal operation is possible.

Figure 35A:
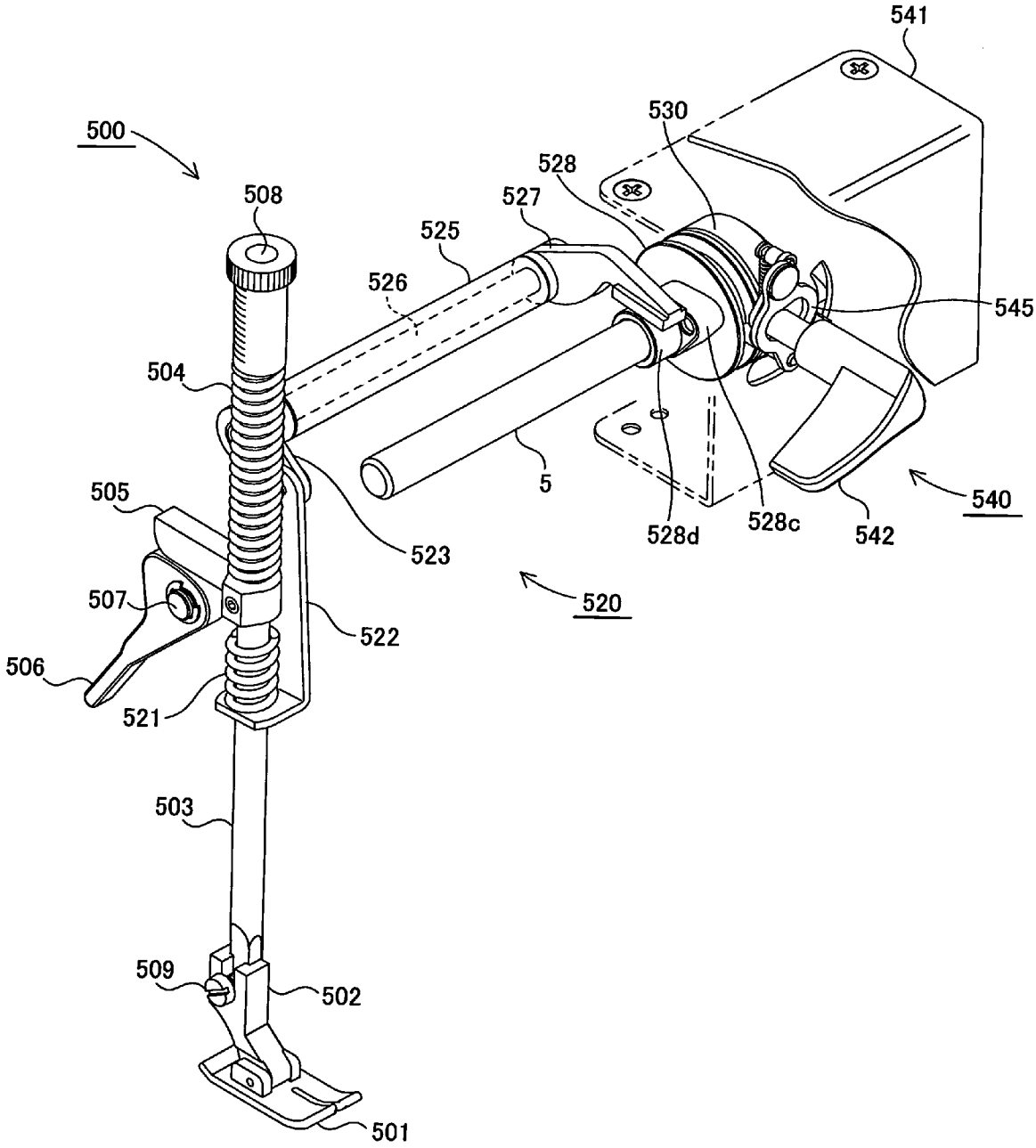
FIG. 35 (A) A rotating operation/linear feed changeover mechanism in the single-thread locked handstitch sewing machine of this invention is shown; wherein this view is a perspective view showing the state that the changeover lever is changed over to the linear feed.
Figure 35B:
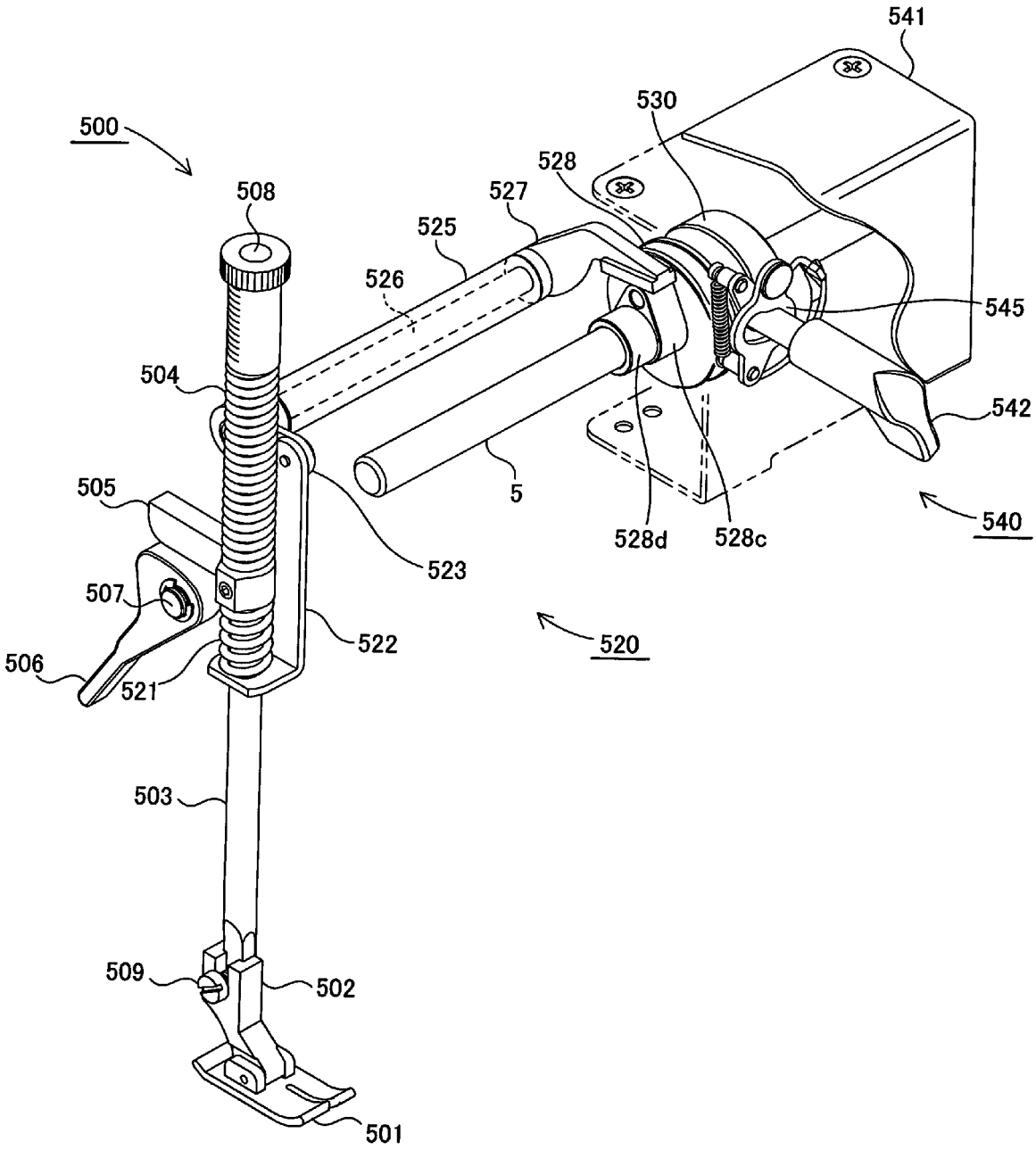

Further, in the above-mentioned single-thread locked handstitch sewing machine, only a linear feed of the fabric workpiece can be performed. Therefore, as shown in FIGS. 35 (A) and (B), it is preferable to be equipped with a rotating operation/linear feed changeover mechanism 540 to perform the following operation. That is, it is preferable to be equipped with the rotating operation/linear feed changeover mechanism 540 to release the pressing force of the presser foot 501 which performs the pressing force of the fabric workpiece on the throat plate 12 and to perform the rotating operation of the feed direction of the fabric workpiece by hand by making the open eye needle 13 the rotating shaft before the open eye needle 13 comes down from the upper dead center, pierces the fabric workpiece, goes up from the lower dead center and slips out from the fabric workpiece. And, these rotating operation feed is called "free curve sewing". In the free curve sewing, because the sewing worker can operate the feed direction of the fabric workpiece in any direction, the small turned curve sewing of the constant stitch length and the constant inter-stitch pitch can be performed easily.

Figure 36:
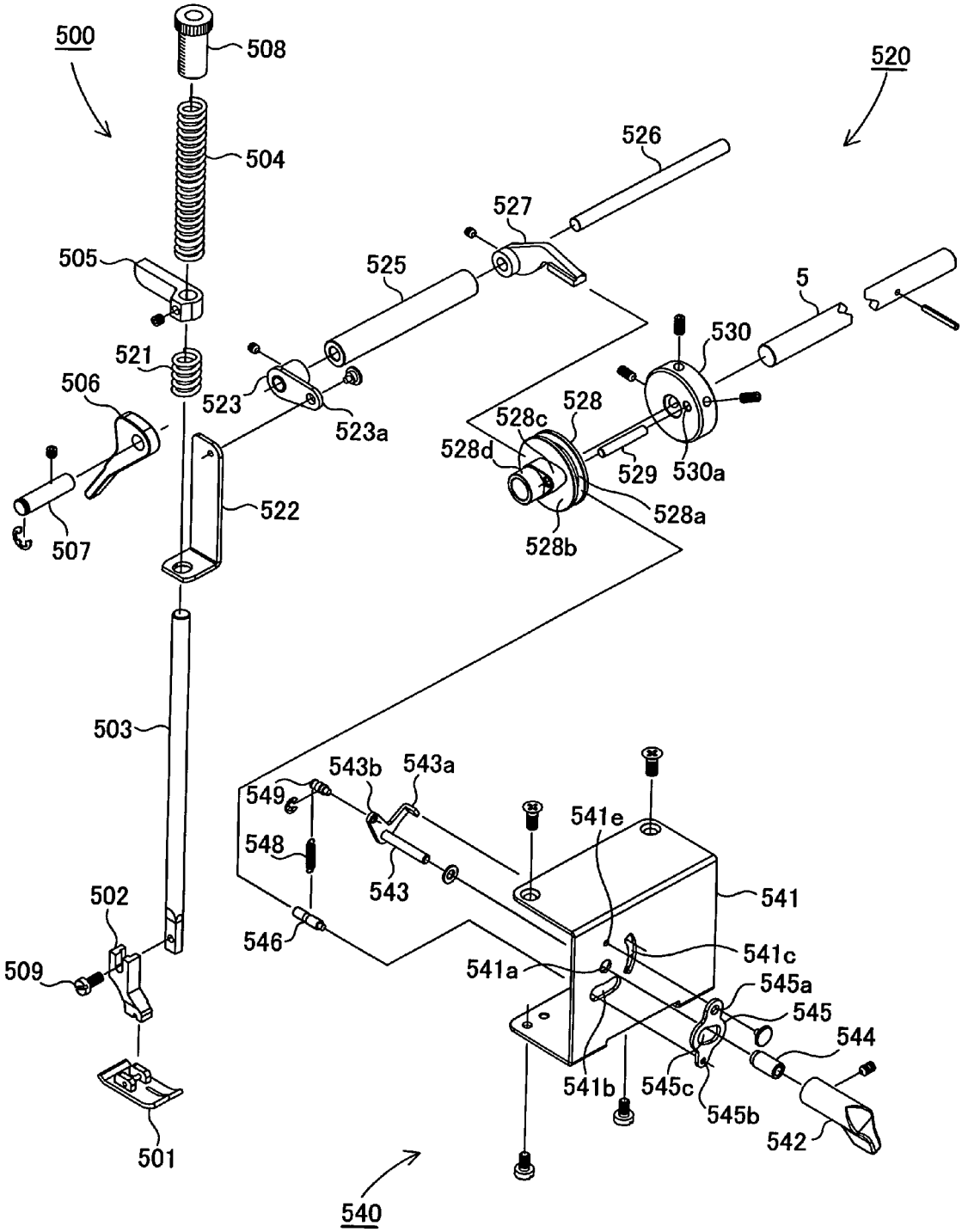
FIG. 36 A exploded perspective view showing the rotating operation/linear feed changeover mechanism of FIGS. 35 (A) and (B).

As shown in FIG. 35 (A), (B) and FIG. 36, the rotating operation/linear feed changeover mechanism 540 has a pressing force release mechanism 520 which transmits the rotational motion of the upper shaft 5 to the presser mechanism 500. And, before the open eye needle 13 comes down from the upper dead center, pierces the fabric workpiece, goes up from the lower dead center and slips out from the fabric workpiece, the pressing force release mechanism 520 can release the pressing force of the presser foot 501 which performs the pressing force of the fabric workpiece on the throat plate 12, and can perform the rotating operation by hand by making the open eye needle 13 the rotating shaft.

In the pressing force release mechanism 520, a pressing force release cam drive board 530 is fixed to another end of the upper shaft 5, and a pressing force release cam 528 is fitted into the upper shaft 5 so that it can slide on the upper shaft 5 in the side surface (left side in the drawing) of the pressing force release cam drive board 530. The pressing force release cam 528 is the plane cam. And the pressing force release cam 528 consists of a main body 528*b* comprising a pulley-like shape that concave portion 528*a* is formed on the circumference of circle, a circular arc cam portion 528*c* which is formed in the oval form like the Polydyne curve in one side surface (left side in the drawing) of the main body 528*b* and a cylindrical portion 528*d* which is equipped to the side surface (left side in the drawing) of the circular arc cam portion 528*c* and becomes the same concentricity with the rotational center of the main body 528*b*. Because the radius of the circular arm of the minimum diameter of the circular arc cam portion 528*c* and the radius of the cylindrical portion 528*d* are same, it becomes same plane in that portion. A pin hole 528*e* which can transmit the rotational motion of the upper shaft 5 by slidably fitting in a pin 529 which is fixed in the protruded state to the side surface (left side in the drawing) of the pressing force release cam drive board 530 which is fixed to the upper shaft 5 is formed so that this pressing force release cam 528 does not rotate on the upper shaft 5.

Besides, in the pressing force release mechanism 520, a pressing force release plate 522 is movably fitted into the presser bar 503 between the presser bar holder 505 of the presser mechanism 500 and the presser foot leg 502. A pressing force release spring 521 is fitted into the presser bar 503 between the pressing force release plate 522 and the presser bar holder 505, and the elastic force can be given so as to let the pressing force release plate 522 move to the lower direction. And, a release shaft 526 for transmitting the rotational motion of the upper shaft 5 to the presser mechanism 500 is arranged to the arm 2 so that the shaft direction becomes horizontal. This release shaft 526 is rotatably arranged to the arm 2 by a shaft bushing 525. The arm for pressing force release cam 527 which contacts to the circular arc cam portion 528*c* and the cylindrical portion 528*d* of the pressing force release cam 528 respectively is fixed to one end of the release shaft 526 and a pressing force release arm 523 is fixed to another end. An arm end 523*a* of the pressing force release arm 523 is swingably connected to the pressing force release plate 522 by the connecting member such as a shoulder screw.

For changing over the linear feed and the rotating operation feed by hand by operating the pressing force release mechanism 520 like this, the rotating operation/linear feed changeover mechanism 540 is equipped with a changeover lever 542 to change over the linear feed and the rotating operation feed by hand, a changeover pin 546 which fits into the concave portion 528*a* of the pressing force release cam 528 and interlocks with the changeover operation of the changeover lever 542, and a changeover base 541 that the changeover lever 542 and the changeover pin 546 are arranged and which is fixed to the arm 2.

For example, the changeover base 541 is formed with the inverted-U-shape. Two face-to-face plate surfaces are fixed to the arm 2, and a hole 541*a* and two circular arced elongate holes 541*b*, 541*c* which are arranged around the hole 541*a* are equipped at a plate surface which is positioned vertically. And, a switching lever 545 is swingably connected by the connecting member such as the shoulder screw at one end 545*a* in the upper portion of the hole 541*a* of the plate surface which becomes the opposite side in regard to the side that the upper shaft 5 is arranged. The changeover pin 546 is fixed to another end 545*b* of the switching lever 545 and it is constituted so that it is inserted to the elongate hole 541*b*. In the changeover pin 546, the range of rocking is limited to the length of the longer direction of the elongate hole 541*b* by rocking of the switching lever 545. An elongate hole 545*c* is equipped between one end 545*a* and another end 545*b* of this switching lever 545, and a changeover shaft bushing 544 which is fixed to the changeover base 541 is inserted to this elongate hole 545*c* in the state that it is inserted to the hole 541*a*. A changeover shaft 543 that the changeover lever 542 is fixed to one end and that two arms 543*a*, 543*b* are formed at another ends is rotatably inserted to the changeover shaft bushing 544. The changeover lever 542 is arranged to the direction that the switching lever 545 of the changeover base 541 is equipped.

One arm 543*a* of the changeover shaft 543 is swingably inserted to the elongate hole 541*c* of the changeover base 541. In this one arm 543*a*, the range of rocking is limited to the length of the longer direction of the elongate hole 541*c* by rotation of the changeover shaft 543. Further, a spring stud 549 is fixed to another arm 543*b* of the changeover shaft 543. One end of a changeover spring 548 is hooked and stopped to the spring stud 549, and another end of the changeover spring 548 is hooked and stopped to the changeover pin 546. This changeover spring 548 always gives the elastic force so that the spring stud 549 and the changeover pin 546 come close.

In the rotating operation/linear feed changeover mechanism 540 constituted as described above, when the changeover lever 542 is stopping at the position (left direction in the drawing) of FIG. 35 (A), because the changeover pin 546 of the switching lever 545 lets the pressing force release cam 528 move to the right direction in the drawing by the elastic force of the changeover spring 548 which is hooked and stopped to the spring stud 549 of another arm 543*b* of the changeover shaft 543 which inclines to the right side, the pressing force release cam 528 and the pressing force release cam drive board 530 are contiguous. And, when the changeover lever 542 is stopping at the position of FIG. 35 (B), because the changeover pin 546 of the switching lever 545 lets the pressing force release cam 528 move to the left direction in the drawing by the elastic force of the changeover spring 548 which is hooked and stopped to the spring stud 549 of another arm 543*b* of the changeover shaft 543 which inclines to the left side, the pressing force release cam 528 and the pressing force release cam drive board 530 are distant.

When the free curve sewing is performed by this rotating operation/linear feed changeover mechanism 540, the changeover is performed by letting the changeover lever 542 rotate counterclockwise (left rotational direction) to the position of FIG. 35 (B) from the position of FIG. 35 (A).

At this time, in the case that the other than place which becomes the same surface as the cylindrical portion 528*d* of the circular arc cam portion 528*c* of the pressing force release cam 528 is positioned at upper direction, when the aforementioned circular arc cam portion 528*c* moves in parallel to the arm portion of the arm for pressing force release cam 527, because the circular arc cam portion 528*c* abuts on the aforementioned arm portion, the pressing force release cam 528 cannot move. However, when the changeover lever 542 rotates counterclockwise, another arm 543*b* of the changeover shaft 543 can rock counterclockwise. In this state, when the upper shaft 5 rotates, because the place which becomes the same surface as the cylindrical portion 528*d* of the circular arc cam portion 528*c* of the pressing force release cam 528 moves with rotation to the arm portion of the arm for pressing force release cam 527, the circular arc cam portion 528*c* can move in parallel to the arm portion of the arm for pressing force release cam 527. And, the changeover pin 546 of the switching lever 545 which is connected to the spring stud 549 of another arm 543*b* by the changeover spring 548 rocks clockwise (right rotational direction) by the elastic force of the changeover spring 548.

Figure 37:
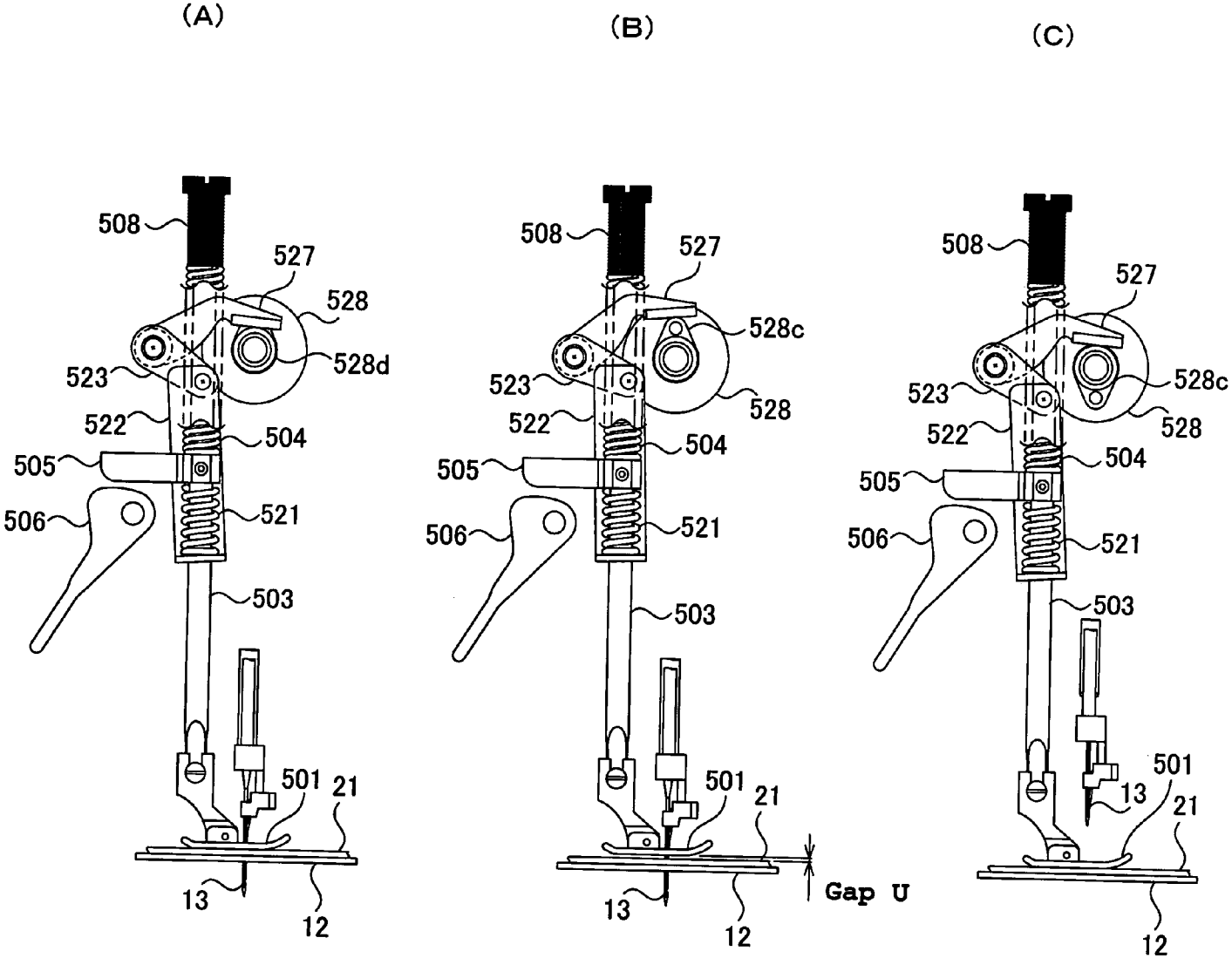
FIG. 37 A movement state of the pressing force release mechanism that the rotating operation/linear feed changeover mechanism has is shown; wherein (A) is the explanatory view showing the relation between the pressing force release cam and the arm for pressing force release cam in the state that the changeover lever is changed over to the linear feed, and, (B) and (C) are the explanatory views showing the relation between the pressing force release cam and the arm for pressing force release cam in the state that the changeover lever is changed over to the rotating operation.

Concretely, when another arm 543*b* of the changeover shaft 543 rocks counterclockwise by making the aforementioned changeover shaft 543 the rotational center, because aforementioned another arm 543*b* moves to the left direction from the rotational center of the changeover shaft 543, the changeover pin 546 is pulled by the elastic force of the changeover spring 548, and rocks clockwise by making the connecting point for the changeover base 541 of the switching lever 545 the rocking center. When the changeover pin 546 rocks clockwise, the pressing force release cam 528 that the aforementioned changeover pin 546 engages moves to the position of FIG. 35 (B) which becomes the left direction from the position of FIG. 35 (A). When the pressing force release cam 528 moves to the left direction, because the arm portion of the arm for pressing force release cam 527 abuts on the circular arc cam portion 528*c*, the arm portion of the arm for pressing force release cam 527 performs the reciprocating rocking in the up-and-down direction by making the release shaft 526 the rocking center based on the shape of the cam of the circular arc cam portion 528*c*. When the arm portion of the arm for pressing force release cam 527 performs the reciprocating rocking in the up-and-down direction, because also the arm end 523*a* of the pressing force release arm 523 performs the reciprocating rocking in the up-and-down direction, the pressing force release plate 522 which is connected to the arm end 523*a* can let the presser foot 501 perform the up-and-down motion by the elastic force of the pressing force release spring 521 (FIGS. 37 (B) and (C)). Therefore, before the open eye needle 13 comes down from the upper dead center, pierces the fabric workpiece, goes up from the lower dead center and slips out from the fabric workpiece, the pressing force of the presser foot 501 which performs the pressing force of the fabric workpiece on the throat plate 12 can be released. When the pressing force release plate 522 goes up based on the shape of the cam of the circular arc cam portion 528*c*, because the elastic force of the pressing force release spring 521 is stronger than the elastic force of the presser bar pressure regulating spring 504, the presser bar holder 505 goes up and can release the pressing force of the presser foot 501 which is fixed to the presser bar 503. Therefore, when the presser bar pressure regulating screw 508 is slacked, because the elastic force of the presser bar pressure regulating spring 504 weakens, the rising height of the presser foot 501 can be made high.

Besides, when changing over the changeover lever 542 which is set as the free curve sewing to the position of FIG. 35 (A) from the position of FIG. 35 (B) by making the rotation clockwise, the linear feed can be performed. When the changeover lever 542 rotates clockwise, because another arm 543*b* of the changeover shaft 543 rocks clockwise, the changeover pin 546 of the switching lever 545 which is connected to the spring stud 549 of this another arm 543*b* by the changeover spring 548 rocks counterclockwise by the elastic force of the changeover spring 548. Concretely, when another arm 543*b* of the changeover shaft 543 rocks clockwise by making the aforementioned changeover shaft 543 the rotational center, because aforementioned another arm 543*b* moves to the right direction from the rotational center of the changeover shaft 543, the changeover pin 546 is pulled by the elastic force of the changeover spring 548, and rocks counterclockwise by making the connecting point for the changeover base 541 of the switching lever 545 the rocking center. When the changeover pin 546 rocks counterclockwise, the pressing force release cam 528 that the aforementioned changeover pin 546 engages moves to the position of FIG. 35 (A) which becomes the right direction from the position of FIG. 35 (B). When the pressing force release cam 528 moves to the right direction, because the arm portion of the arm for pressing force release cam 527 disengages from the circular arc cam portion 528*c* and abuts on the cylindrical portion 528*d*, the arm portion of the arm for pressing force release cam 527 is stopping at that position. Therefore, the presser foot 501 can keep the state of the pressing force (FIG. 37 (A)).

Figure 38:
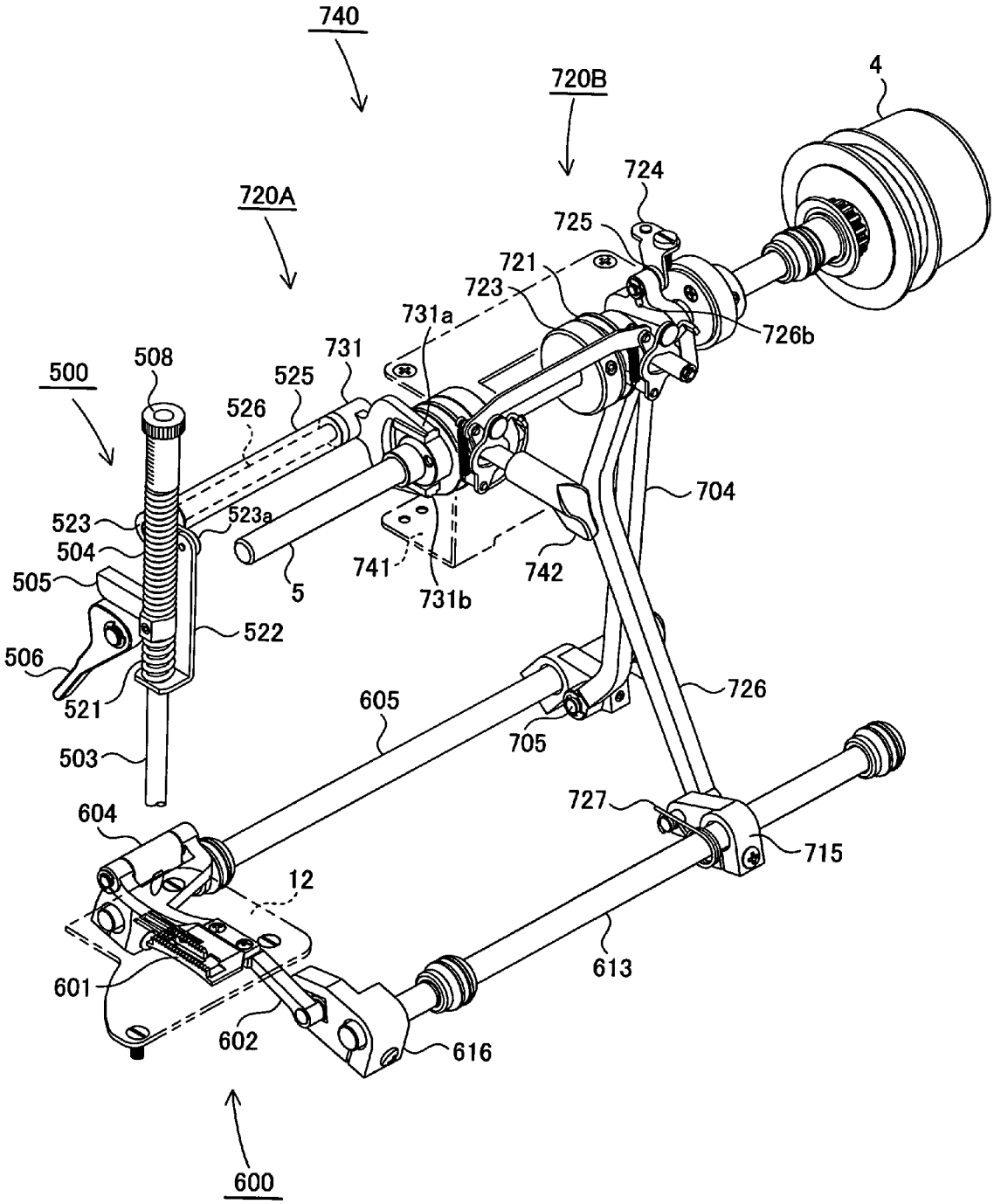
FIG. 38 A perspective view showing the hand feed/linear feed changeover mechanism in the single-thread locked handstitch sewing machine of this invention.
Figure 41:
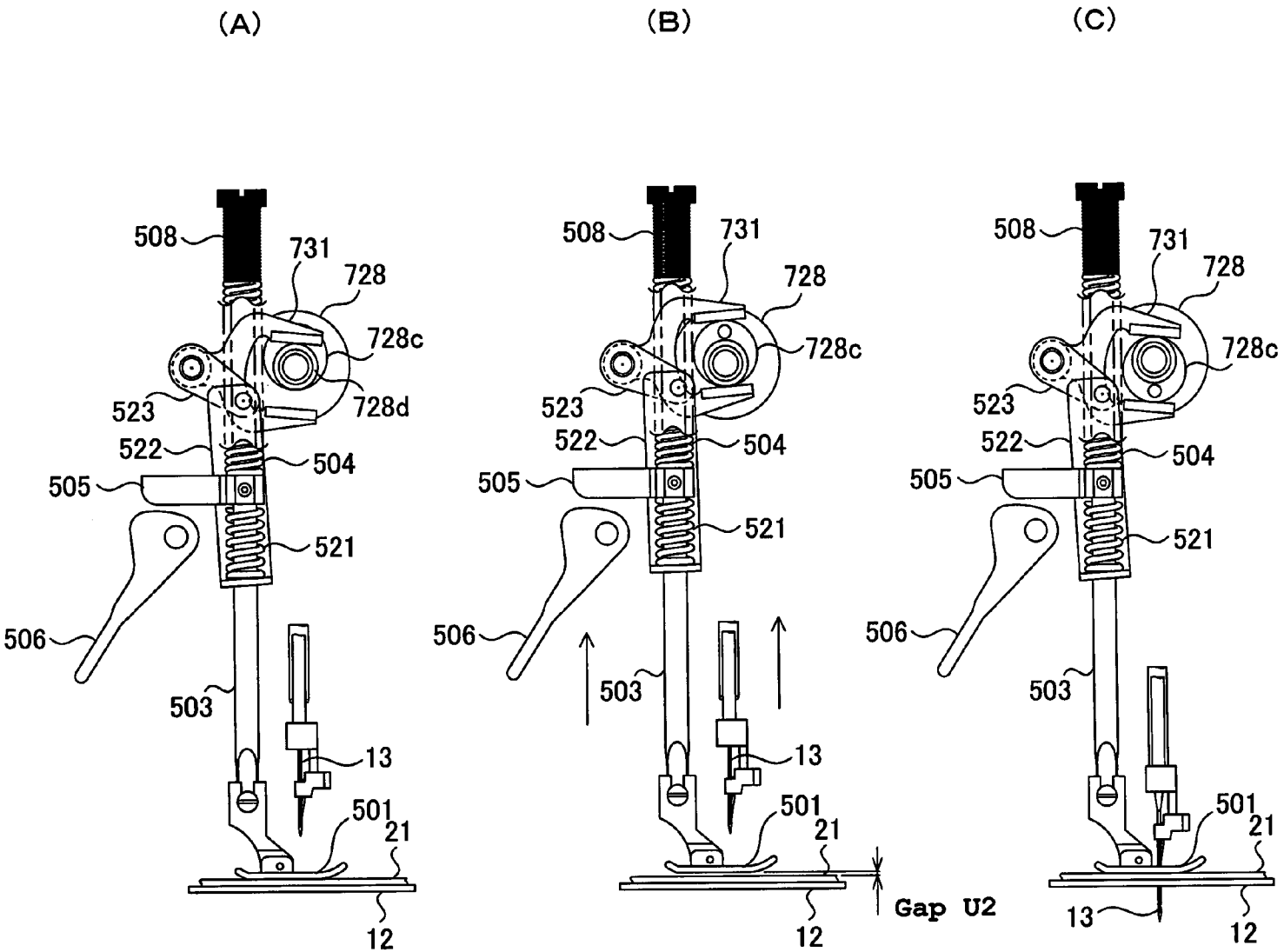
FIG. 41 A movement state of the pressing force release mechanism that the hand feed/linear feed changeover mechanism of FIG. 38 and FIG. 39 has is shown; wherein (A) is the explanatory view showing the relation between the pressing force release cam and the arm for pressing force release cam in the state that the changeover lever is changed over to the linear feed, and, (B) and (C) are the explanatory views showing the relation between the pressing force release cam and the arm for pressing force release cam in the state that the changeover lever is changed over to the hand feed.

Further, in the above-mentioned single-thread locked handstitch sewing machine, the stitch length feed for the handstitch of the fabric workpiece is performed by the feed dog 601 and the presser foot 501 in the first stroke of the open eye needle 13, and the inter-stitch pitch feed for the inter-handstitch of the fabric workpiece is performed by the feed dog 601 and the presser foot 501 in the second stroke of the open eye needle 13. Thereby, the stitch length feed quantity and the inter-stitch pitch feed quantity was not able to be changed arbitrarily. Therefore, as shown in FIG. 38 and FIG. 41, when the open eye needle 13 is slipping out from the fabric workpiece, it is preferable to equip a hand feed/linear feed changeover mechanism 740 to perform the hand feed of the fabric workpiece while giving the stitch length feed quantity and the inter-stitch pitch feed quantity arbitrarily by releasing the pressing force of the presser foot 501 and by evacuating the feed dog 601 which feeds the fabric workpiece. The hand feed like this is called "free motion sewing". In the free motion sewing, because the sewing worker can operate the feed direction of the fabric workpiece to the arbitrary direction, the small turned curve sewing can be performed easily while changing the stitch length and the inter-stitch pitch arbitrarily.

Figure 39:
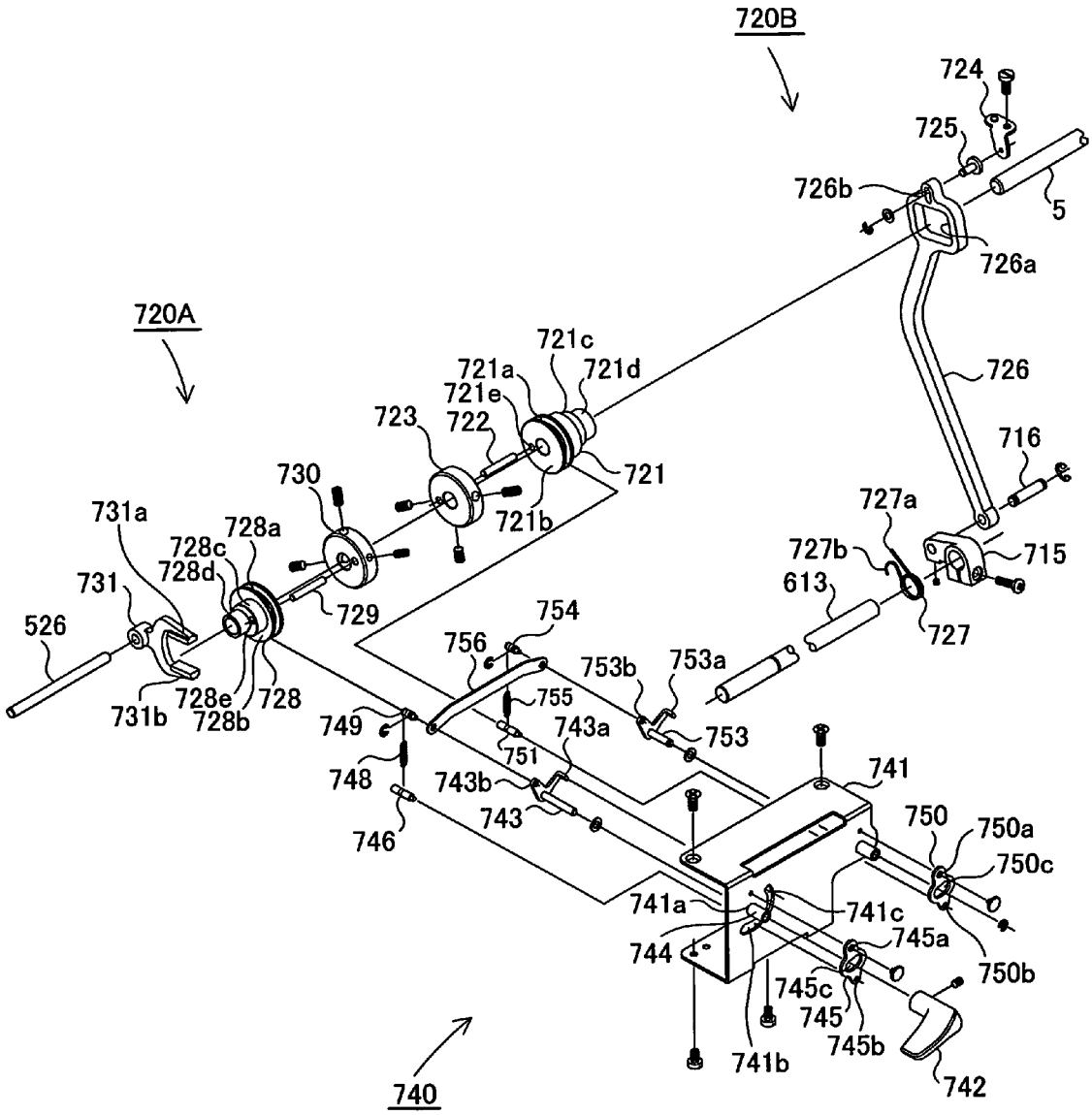
FIG. 39 An exploded perspective view showing the hand feed/linear feed changeover mechanism in the single-thread locked handstitch sewing machine of this invention.

As shown in FIG. 38 and FIG. 39, the hand feed/linear feed changeover mechanism 740 is equipped with a pressing force release mechanism 720A to perform the hand feed of the fabric workpiece while giving the stitch length feed quantity and the inter-stitch pitch feed quantity arbitrarily by releasing the pressing force of the presser foot 501 when the rotational motion of the upper shaft 5 transmits to the presser mechanism 500 and the cloth feed mechanism 600 and when the open eye needle 13 is slipping out from the fabric workpiece. And, the hand feed-linear feed changeover mechanism 740 is equipped with a feed dog evacuate mechanism 720B to perform the hand feed of the fabric workpiece while giving the stitch length feed quantity and the inter-stitch pitch feed quantity arbitrarily by evacuating the feed dog 601 which feeds the fabric workpiece when the open eye needle 13 is slipping out from the fabric workpiece.

In the pressing force release mechanism 720A, a pressing force release cam drive board 730 is fixed to another end of the upper shaft 5, and a pressing force release cam 728 is fitted into the upper shaft 5 slidably on the upper shaft 5 in the side surface of the pressing force release cam drive board 730. The pressing force release cam 728 is the eccentric cam. And the pressing force release cam 728 consists of a main body 728*b* comprising a pulley-like shape that concave portion 728*a* is formed in the inside of the circumferential plane, a cylindrical cam portion 728*c* which is equipped to one side surface (left side in the drawing) of the main body 728*b* and which has the rotational center which is positioned at the eccentric position from the rotational center of the main body 728*b*, and a cylindrical portion 728*d* which is equipped to the side surface (left side in the drawing) of the cam portion 728*c* and which has the same concentricity with the rotational center of the main body 728*b* and has the small diameter than the cam portion 728*c*. The cam portion 728*c* and the cylindrical portion 728*d* have a place becoming the same plane. A pin hole 728*e* which can slidably fit in a pin 729 which is fixed in the protruded state to the side surface (left side in the drawing) of the pressing force release cam drive board 730 is formed so that this pressing force release cam 728 does not rotate on the upper shaft 5.

Besides, in the pressing force release mechanism 720A, as with the pressing force release mechanism 520, a pressing force release plate 522 is movably fitted into the presser bar 503 between the presser bar holder 505 of the presser mechanism 500 and the presser foot leg 502. A pressing force release spring 521 is fitted into the presser bar 503 between the pressing force release plate 522 and the presser bar holder 505, and the elastic force can be given so as to let the pressing force release plate 522 move to the lower direction. And, a release shaft 526 for transmitting the rotational motion of the upper shaft 5 to the presser mechanism 500 is arranged to the arm 2 so that the shaft direction becomes horizontal. This release shaft 526 is rotatably arranged to the arm 2 by a shaft bushing 525. A fork for pressing force release 731 which contacts to the cam portion 728*c* and the cylindrical portion 728*d* of the pressing force release cam 728 respectively is fixed to one end of the release shaft 526 and a pressing force release arm 523 is fixed to another end. In the fork for pressing force release 731, an upper arm 731*a* and a lower arm 731*b* are movably fitted into the cam portion 728*c* in the state almost abutted, and the fork for pressing force release 731 is formed so that the space is made between the fork for pressing force release 731 and the cylindrical portion 728*d*. And, an arm end 523*a* of the pressing force release arm 523 is swingably connected to the pressing force release plate 522 by the connecting member such as a screw.

For changing over the linear feed and the hand feed by operating the pressing force release mechanism 720A like this, the hand feed/linear feed changeover mechanism 740 is equipped with a changeover lever 742 to change over the linear feed and the hand feed, a changeover pin 746 which fits into the concave portion 728*a* of the pressing force release cam 728 and interlocks with the changeover operation of the changeover lever 742, and a changeover base 741 that the changeover lever 742 and the changeover pin 746 are arranged and which is fixed to the arm 2.

For example, the changeover base 741 is formed with the inverted-U-shape. Two face-to-face plate surfaces are fixed to the arm 2, and a hole 741*a* and two circular arced elongate holes 741*b*, 741*c* which are arranged around the hole 741*a* are equipped to a left side of a plate surface which is positioned vertically. And, a switching lever 745 is swingably connected by the connecting member such as the shoulder screw at one end 745*a* in the upper portion of the hole 741*a* of the plate surface which becomes the front face of the sewing machine. The changeover pin 746 is fixed to another end 745*b* of the switching lever 745 and it is constituted so that it is inserted to the elongate hole 741*b*. In the changeover pin 746, the range of rocking is limited to the length of the longer direction of the elongate hole 741*b* by rocking of the switching lever 745. An elongate hole 745*c* is equipped between one end 745*a* and another end 745*b* of this switching lever 545, and a changeover shaft bushing 744 which is fixed to the changeover base 741 is inserted to this elongate hole 745*c* in the state that it is inserted to the hole 741*a*. A changeover shaft 743 that the changeover lever 742 is fixed to one end and that two arms 743*a*, 743*b* are formed at another ends is rotatably inserted to the changeover shaft bushing 744. The changeover lever 742 is arranged to the front face side of the sewing machine that the switching lever 745 of the changeover base 741 is equipped.

One arm 743*a* of the changeover shaft 743 is swingably inserted to the elongate hole 741*c* of the changeover base 741. In this one arm 743*a*, the range of rocking is limited to the length of the longer direction of the elongate hole 741*c* by rotation of the changeover shaft 743. Further, a spring stud 749 is fixed to another arm 743*b* of the changeover shaft 743. One end of a changeover spring 748 is hooked and stopped to the spring stud 749, and another end of the changeover spring 748 is hooked and stopped to the changeover pin 746. This changeover spring 748 always gives the elastic force so that the spring stud 749 and the changeover pin 746 come close.

In the feed dog evacuate mechanism 720B, a feed dog evacuate cam drive board 723 is fixed to the upper shaft 5 that the only predetermined length is away from a pressing force release cam drive board 730, and a feed dog evacuate cam 721 is fitted into the upper shaft 5 slidably on the upper shaft 5 in the side surface (right side in the drawing) of the feed dog evacuate cam drive board 723. The feed dog evacuate cam 721 is the eccentric cam. And the feed dog evacuate cam 721 consists of a main body 721*b* comprising a pulley-like shape that concave portion 721*a* is formed on the circumferential plane, a cylindrical cam portion 721*c* which is equipped to one side surface (right side in the drawing) of the main body 721*b* and which has the rotational center which is positioned at the eccentric position from the rotational center of the main body 721*b*, and a cylindrical portion 721*d* which is equipped to the side surface (right side in the drawing) of the cam portion 721*c* and which has the same concentricity with the rotational center of the main body 721*b* and has the small diameter than the cam portion 721*c*. Because the radius of the cylindrical portion 721*d* is the same as the minimum radius of the cam portion 721*c*, the cam portion 721*c* and the cylindrical portion 721*d* have a place becoming the same plane. A pin hole 721*e* which can slidably fit in a pin 722 which is fixed in the protruded state to the side surface (right side in the drawing) of the feed dog evacuate cam drive board 723 is formed so that this feed dog evacuate cam 721 rotates with the upper shaft 5 integrally to the shaft direction of the upper shaft 5 slidably.

Besides, in the feed dog evacuate mechanism 720B, a feed dog up and down drive vertical rod 726 is used instead of the feed dog up and down drive vertical rod 714 of the cloth feed drive mechanism 700. A rectangular hole 726*a* is formed at one end of this feed dog up and down drive vertical rod 726, and the cam portion 721*c* of the feed dog evacuate cam 721 is movably fitted into the one end of this feed dog up and down drive vertical rod 726 in the state almost abutted for the narrow side. And, a elongate hole 726*b* is formed at the upper portion, and a vertical rod guide holder 724 which is fixed to the arm 2 is connected by a vertical rod guide pin 725. When the cam portion 721*c* fits in the hole 726*a*, because the direction of the long side of the aforementioned hole 726*a* becomes the horizontal direction, the large space occurs in this horizontal direction. Therefore, when the cam portion 721*c* performs the eccentric motion by rotation of the feed dog evacuate cam 721, although the feed dog up and down drive vertical rod 726 does not move to the horizontal direction, it moves to the vertical direction. And, when the vertical rod guide pin 725 is inserted to the elongate hole 726*b*, because the longer direction of the aforementioned elongate hole 726*b* becomes the vertical direction, and because the large space occurs in this vertical direction, in the case that the hole 726*a* of the feed dog up and down drive vertical rod 726 moves to the cylindrical portion 721*d* from the cam portion 721*c* of the feed dog evacuate cam 721, it is possible to lower the feed dog up and down drive vertical rod 726.

Another end of this feed dog up and down drive vertical rod 726 is rotatably connected to the feed dog up and down shaft drive arm 715 which is fixed to another end of the upper and lower feed shaft 613 by the linking pin 716. Therefore, when the upper shaft 5 rotates, because the cam portion 721*c* of the feed dog evacuate cam 721 lets one end of the feed dog up and down drive vertical rod 726 perform the up-and-down motion, the feed dog up and down shaft drive arm 715 can let the upper and lower feed shaft 613 perform the reciprocating rotation.

Besides, a feed dog evacuate spring 727 which is the helical torsion spring is fitted into the upper and lower feed shaft 613. And, one arm 727*a* is fixed to the bed 3 and another arm 727*b* is hooked to the linking pin 716 which connects another end of the feed dog up and down drive vertical rod 726 and the feed dog up and down shaft drive arm 715, and the elastic force is given so as to push the linking pin 716 always to the lower direction. Therefore, when the hole 726*a* of the feed dog up and down drive vertical rod 726 moves to the cylindrical portion 721*d* from the cam portion 721*c* of the feed dog evacuate cam 721, because the feed dog evacuate spring 727 lowers the connecting end of the linking pin 716 of the feed dog up and down shaft drive arm 715 always to the lower direction, the feed dog up and down drive vertical rod 726 stops in the state of lowering and the feed dog 601 can be stopped at the position that it evacuates.

Further, as the feed dog evacuate mechanism 720B, one hole 741*d* is equipped to the right side of the plate surface which is positioned at the vertical direction of a changeover base 741. And, in the upper portion of the hole 741*d* of the plate surface which becomes the front face of the sewing machine, a switching lever 750 is swingably connected by the connecting member such as the shoulder screw in an one end 750*a*. A changeover pin 751 which fits into a concave portion 721*a* of the feed dog evacuate cam 721 is fixed to another end 750*b* of the switching lever 750, and the switching lever 750 is constituted so that this changeover pin 751 can rock at the outside of the changeover base 741. An elongate hole 750*c* is equipped between the one end 750*a* and the another end 750*b* of the switching lever 750, and a changeover shaft bushing 752 which is fixed to the changeover base 741 in the state inserted in a hole 741*d* is inserted to this elongate hole 750*c*. A changeover shaft 753 that two arms 753*a* and 753*b* are formed at one end is rotatably inserted in the changeover shaft bushing 752. Two arms 753*a* and 753*b* of the changeover shaft 753 are arranged to the same direction as the direction of the changeover shaft 743 of the hand feed/linear feed changeover mechanism 740.

One arm 753*a* of the changeover shaft 753 is arranged at the changeover base 741 so that it can rock at the outside of the changeover base 741. And, a spring stud 754 is fixed to another arm 753*b* of the changeover shaft 753. One end of a changeover spring 755 is hooked and stopped to the spring stud 754, and another end of the changeover spring 755 is hooked and stopped to the changeover pin 751. This changeover spring 755 always gives the elastic force so that the spring stud 754 and the changeover pin 751 come close. Besides, the spring stud 754 which is fixed to another arm 753*b* of the changeover shaft 753 and the spring stud 749 which is fixed to another arm 743*b* of the changeover shaft 743 are connected by a connecting link 756.

The shape of the cam portion 728*c* of the pressing force release cam 728 in the pressing force release mechanism 720A and the shape of the circular arc cam portion 528*c* of the pressing force release cam 528 in the pressing force release mechanism 520 are different. That reason is as follows. The pressing force release mechanism 720A releases the pressing force of the presser foot 501 while the open eye needle 13 is slipping out from the fabric workpiece 21, however, the pressing force release mechanism 520 releases the pressing force of the presser foot 501 before the open eye needle 13 comes down from the upper dead center, pierces the fabric workpiece 21, goes up from the lower dead center and slips out from the fabric workpiece 21.

Figure 40A:
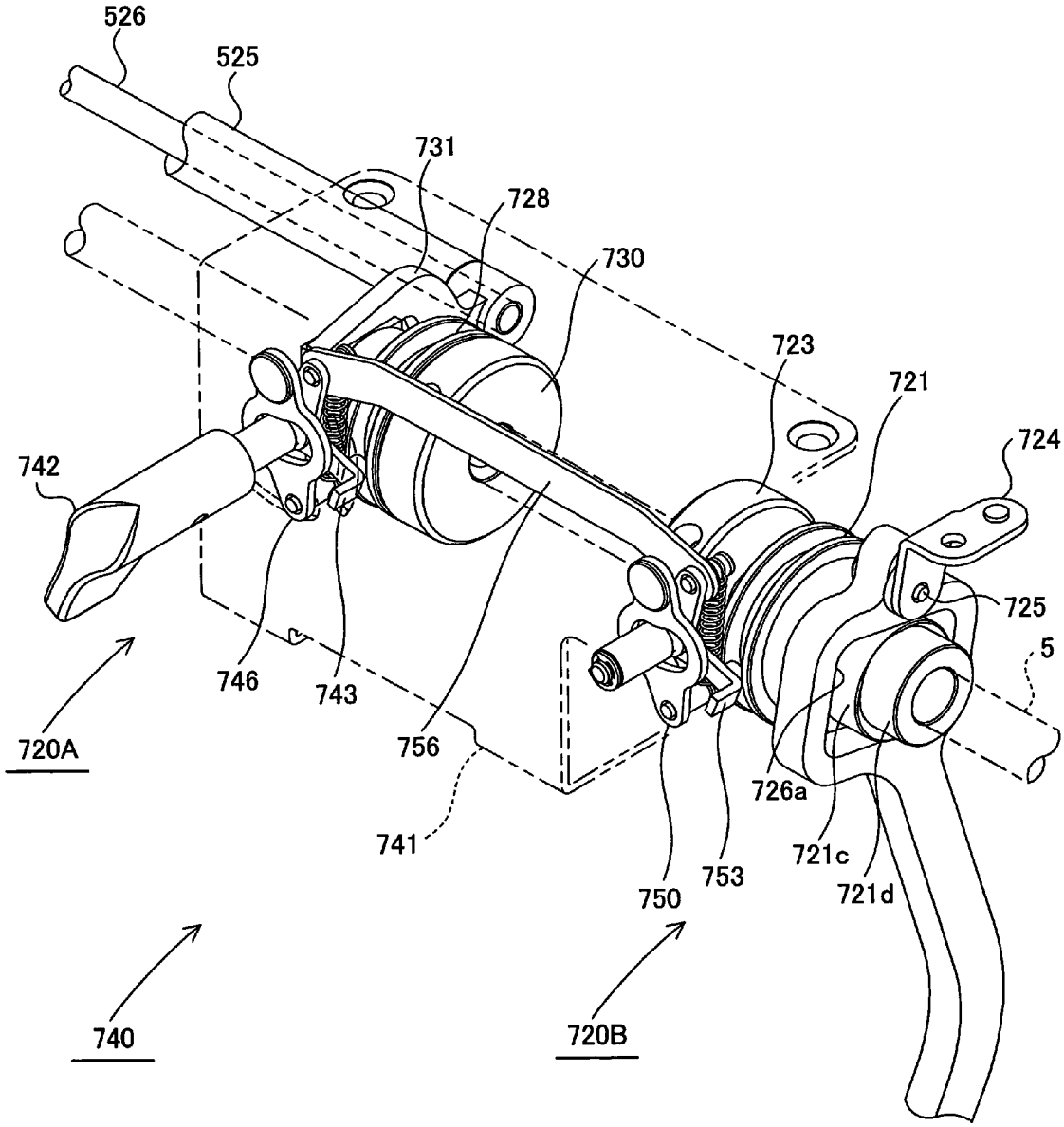
FIG. 40 (A) A hand feed/linear feed changeover mechanism in the single-thread locked handstitch sewing machine of this invention is shown; wherein this view is a perspective view showing the state that the changeover lever is changed over to the linear feed.
Figure 40B:
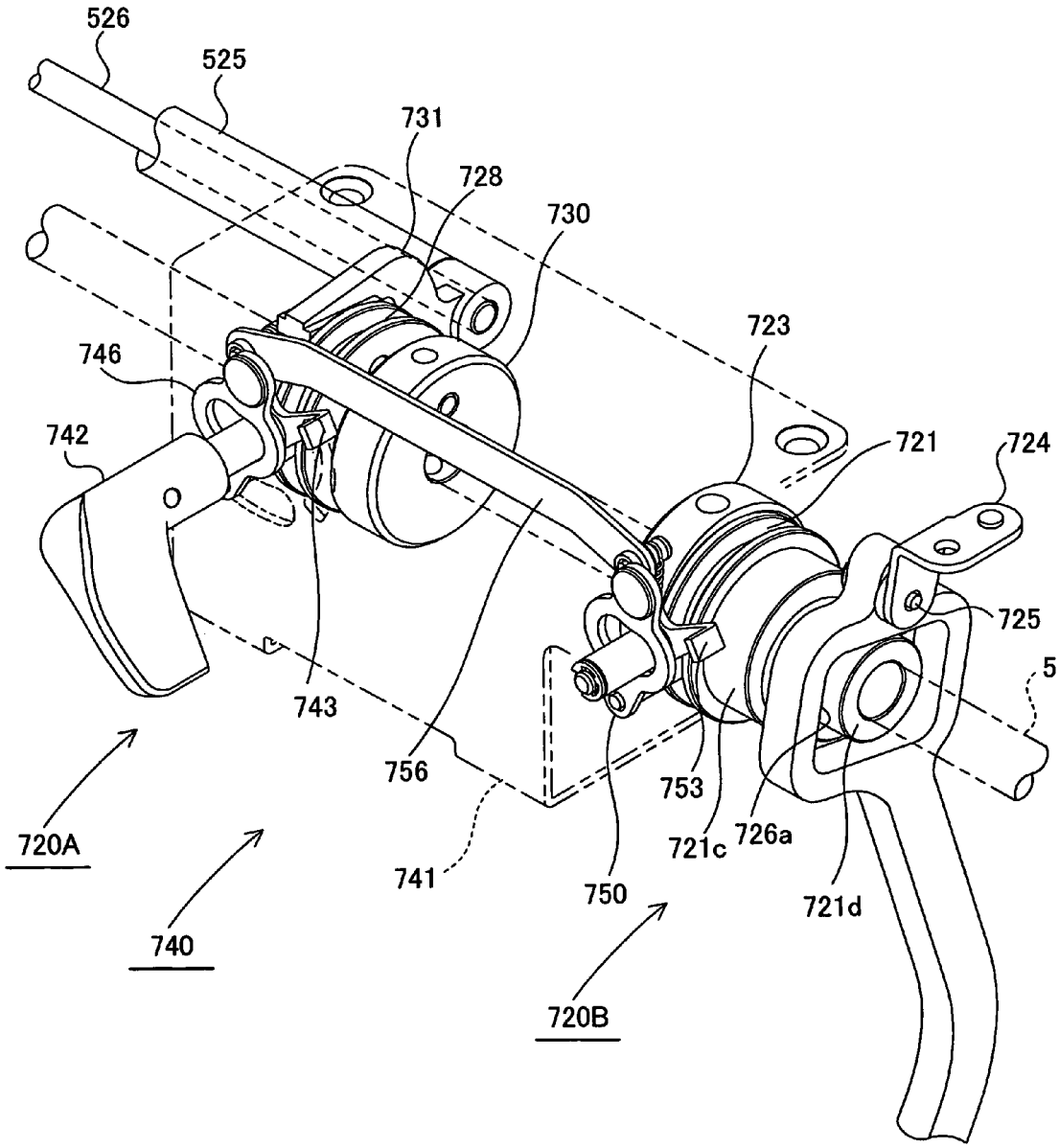

In the hand feed/linear feed changeover mechanism 740 constituted as described above, when the changeover lever 742 is stopping at the position of FIG. 40 (A), the pressing force release cam 728 and the pressing force release cam drive board 730 are contiguous, and the feed dog evacuate cam drive board 723 and the feed dog evacuate cam 721 are distant. And, when the changeover lever 742 is stopping at the position of FIG. 40 (B), the pressing force release cam 728 and the pressing force release cam drive board 730 are distant, and the feed dog evacuate cam drive board 723 and the feed dog evacuate cam 721 are contiguous.

When the free motion sewing is performed by this hand feed/linear feed change over mechanism 740, the change over is performed by letting the changeover lever 742 rotate counterclockwise (left rotational direction) to the position of FIG. 40 (B) from the position of FIG. 40 (A). At this time, in the case that the other than place which becomes the same surface as the cylindrical portion 728*d* of the cam portion 728*c* of the pressing force release cam 728 is positioned at upper direction, when the aforementioned cam portion 728*c* moves in parallel to the arm 731*a* of the upper portion of the fork for pressing force release 731, because the cam portion 728*c* hooks the aforementioned arm 731*a* of the upper portion, the pressing force release cam 728 cannot move. However, when the changeover lever 742 rotates counterclockwise, another arm 743*b* of the changeover shaft 743 can rock counterclockwise. In this state, when the upper shaft 5 rotates, because the place which becomes the same surface as the cylindrical portion 728*d* of the cam portion 728*c* of the pressing force release cam 728 moves with rotation to the arm 731*a* of the upper portion of the fork for pressing force release 731, the cam portion 728*c* can move in parallel to the arm 731*a* of the upper portion of the fork for pressing force release 731. And, the changeover pin 746 of the switching lever 745 which is connected to the spring stud 749 of another arm 743*b* by the changeover spring 748 rocks clockwise (right rotational direction) by the elastic force of the changeover spring 748.

Concretely, when another arm 743*b* of the changeover shaft 743 rocks counterclockwise by making the aforementioned changeover shaft 743 the rotational center, because aforementioned another arm 743*b* moves to the left direction from the rotational center of the changeover shaft 743, the changeover pin 746 is pulled by the elastic force of the changeover spring 748, and rocks clockwise by making the connecting point for the changeover base 741 of the switching lever 745 the rocking center. When the changeover pin 746 rocks clockwise, the pressing force release cam 728 that the aforementioned changeover pin 746 engages moves to the position of FIG. 40 (B) which becomes the left direction from the position of FIG. 40 (A).

When the pressing force release cam 728 moves to the left direction, because the pressing force release cam 728 slides on the upper shaft 5 and the fork for pressing force release 731 engages to the cam portion 728*c* in the same radial point of the cylindrical portion 728*d* of the pressing force release cam 728 and the cam portion 728*c*, the arm 731*a* of the upper portion of the fork for pressing force release 731 performs the reciprocating rocking in the up-and-down direction by making the release shaft 526 the rocking center based on the eccentric shape of the cam portion 728*c*. When the arm 731*a* of the upper portion of the fork for pressing force release 731 performs the reciprocating rocking in the up-and-down direction, because also the arm end 523*a* of the pressing force release arm 523 performs the reciprocating rocking in the up-and-down direction, the pressing force release plate 522 which is connected to the arm end 523*a* can let the presser foot 501 perform the up-and-down motion by the elastic force of the pressing force release spring 521 (FIGS. 41 (B) and (C)).

Besides, when the changeover is performed by letting the changeover lever 742 rotate counterclockwise (left rotational direction) to the position of FIG. 40 (B) from the position of FIG. 40 (A), because the connecting link 756 whose one end is connected to the spring stud 749 is also pulled and moves to the left direction, the spring stud 754 which is connected to another end of this connecting link 756 lets the another arm 753*b* of the changeover shaft 753 rock counterclockwise by making the aforementioned changeover shaft 753 the rotational center. When another arm 753*b* of the changeover shaft 753 rocks counterclockwise by making the aforementioned changeover shaft 753 the rotational center, because aforementioned another arm 753*b* moves to the left direction from the rotational center of the changeover shaft 753, the changeover pin 754 is pulled by the elastic force of the changeover spring 755, and rocks clockwise by making the connecting point for the changeover base 741 of the switching lever 750 the rocking center. When the changeover pin 754 rocks clockwise, the feed dog evacuate cam 721 that the aforementioned changeover pin 754 engages moves to the position of FIG. 40 (B) which becomes the left direction from the position of FIG. 40 (A). When the feed dog evacuate cam 721 moves to the left direction, because the portion which is positioned at the hole 726*a* of the feed dog up and down drive vertical rod 726 of the aforementioned feed dog evacuate cam 721 moves to the cylindrical portion 721*d* from the cam portion 721*c*, the feed dog up and down drive vertical rod 726 stops in the lower state than the feed dog evacuate spring 727, and the feed dog 601 stops always at the evacuated position.

Therefore, in the case that the changeover lever 742 is changed over to the free motion sewing, when the open eye needle 13 is slipping out from the fabric workpiece, the pressing force of the presser foot 501 is released, and it is possible to perform the hand feed of the fabric workpiece while giving the stitch length feed quantity and the inter-stitch pitch feed quantity arbitrarily by evacuating the feed dog 601 which feeds the fabric workpiece.

Besides, when changing over the changeover lever 742 which is set as the free motion sewing to the position of FIG. 40 (A) from the position of FIG. 40 (B) by making the rotation clockwise, the linear feed can be performed. When the changeover lever 742 rotates clockwise, because another arm 743*b* of the changeover shaft 743 rocks clockwise, the changeover pin 746 of the switching lever 745 which is connected to the spring stud 749 of this another arm 743*b* by the changeover spring 748 rocks counterclockwise by the elastic force of the changeover spring 748. Concretely, when another arm 743*b* of the changeover shaft 743 rocks clockwise by making the aforementioned changeover shaft 743 the rotational center, because aforementioned another arm 743*b* moves to the right direction from the rotational center of the changeover shaft 743, the changeover pin 746 is pulled by the elastic force of the changeover spring 748, and rocks counterclockwise by making the connecting point for the changeover base 741 of the switching lever 745 the rocking center. When the change over pin 746 rocks counterclockwise, the pressing force release cam 728 that the aforementioned changeover pin 746 engages moves to the position of FIG. 40 (A) which becomes the right direction from the position of FIG. 40 (B). When the pressing force release cam 728 moves to the right direction, because the arm 731*a*, 731*b* of the fork for pressing force release 731 disengages from the cam portion 728*c* and abuts on the cylindrical portion 728*d*, the fork for pressing force release 731 is stopping at that position. Therefore, the presser foot 501 can keep the state of the pressing force (FIG. 41 (A)).

Besides, when the changeover is performed by letting the changeover lever 742 rotate clockwise to the position of FIG. 40 (A) from the position of FIG. 40 (B), because the connecting link 756 whose one end is connected to the spring stud 749 is also pushed and moves to the right direction, the spring stud 754 which is connected to another end of this connecting link 756 lets the another arm 753*b* of the changeover shaft 753 rock clockwise by making the aforementioned changeover shaft 753 the rotational center. When another arm 753*b* of the changeover shaft 753 rocks clockwise by making the aforementioned changeover shaft 753 the rotational center, because aforementioned another arm 753*b* moves to the right direction from the rotational center of the changeover shaft 753, the changeover pin 754 is pulled by the elastic force of the changeover spring 755, and rocks counterclockwise by making the connecting point for the changeover base 741 of the switching lever 750 the rocking center.

When the changeover pin 754 rocks counterclockwise, the feed dog evacuate cam 721 that the aforementioned change over pin 754 engages moves to the position of FIG. 40 (A) which becomes the right direction from the position of FIG. 40 (B). At this time, in the case that the other than place which becomes the same surface as the cylindrical portion 721*d* of the cam portion 721*c* of the feed dog evacuate cam 721 is positioned at upper direction, when the aforementioned cam portion 721*c* moves in parallel to the hole 726*a* of the feed dog up and down drive vertical rod 726, because the cam portion 721*c* hooks the circumference of the aforementioned hole 726*a* of the feed dog up and down drive vertical rod 726, the feed dog evacuate cam 721 cannot move. However, when the changeover lever 742 rotates clockwise, another arm 753*b* of the changeover shaft 753 can rock clockwise. In this state, when the upper shaft 5 rotates, because the place which becomes the same surface as the cylindrical portion 721*d* of the cam portion 721*c* of the feed dog evacuate cam 721 moves with rotation to the hole 726*a* of the feed dog up and down drive vertical rod 726, the cam portion 721*c* can move in parallel to the hole 726*a* of the feed dog up and down drive vertical rod 726. And, the changeover pin 751 of the switching lever 750 which is connected to the spring stud 754 of another arm 753*b* by the changeover spring 755 rocks counterclockwise by the elastic force of the changeover spring 755.

Concretely, when another arm 753*b* of the changeover shaft 753 rocks clockwise by making the aforementioned changeover shaft 753 the rotational center, because aforementioned another arm 753*b* moves to the right direction from the rotational center of the changeover shaft 753, the changeover pin 751 is pulled by the elastic force of the changeover spring 755, and rocks counterclockwise by making the connecting point for the change over base 741 of the switching lever 750 the rocking center. When the changeover pin 751 rocks counterclockwise, the feed dog evacuate cam 721 that the aforementioned changeover pin 751 engages moves to the position of FIG. 40 (A) which becomes the right direction from the position of FIG. 40 (B). When the feed dog evacuate cam 721 moves to the right direction, because the wall surface of the hole 726*a* of the feed dog up and down drive vertical rod 726 abuts on the cam portion 721*c*, the feed dog up and down drive vertical rod 726 performs the reciprocating rocking in the up-and-down direction based on the eccentric shape of the cam portion 721*c*. When the feed dog up and down drive vertical rod 726 performs the reciprocating rocking in the up-and-down direction, the feed dog up and down shaft drive arm 715 can let the upper and lower feed shaft 613 perform the reciprocating rotation. When the upper and lower feed shaft 613 performs the reciprocating rotation, the feed dog up and down drive fork 616 performs the reciprocating rocking. And, the upper and lower feed roller 608 which fits into the feed dog up and down drive fork 616 lets another end of the feed base 602 perform the reciprocating motion in the up-and-down direction.

As described above, by letting another end of the feed base 602 perform the reciprocating motion by the feed dog evacuate mechanism 720B in the up-and-down direction, and by letting the feed base 602 perform the reciprocating motion by the horizontal feed shaft 605 and the horizontal feed arm 604, the feed dog 601 which is fixed to the feed base 602 can perform the four process movements which is rise→advance→descend→retreat. Therefore, when the changeover lever 742 is changed over to the linear feed, the linear stitch can be performed.

Even if the pressing force release mechanism 720A and the feed dog evacuate mechanism 720B are independently used, the free motion sewing is possible. In the case of only the pressing force release mechanism 720A, when the open eye needle 13 is slipping out from the fabric workpiece, the hand feed of the fabric workpiece is performed while giving the stitch length feed quantity and the inter-stitch pitch feed quantity arbitrarily by releasing the pressing force of the presser foot 501. And, in the case of only the feed dog evacuate mechanism 720B, by setting the press force of the presser foot 501 in the weakened adjustment by slacking the presser bar pressure adjusting screw 508, when the open eye needle 13 is slipping out from the fabric workpiece, the hand feed of the fabric workpiece is performed while giving the stitch length feed quantity and the inter-stitch pitch feed quantity arbitrarily by evacuating the feed dog 601 which feeds the fabric workpiece.

Figure 42:
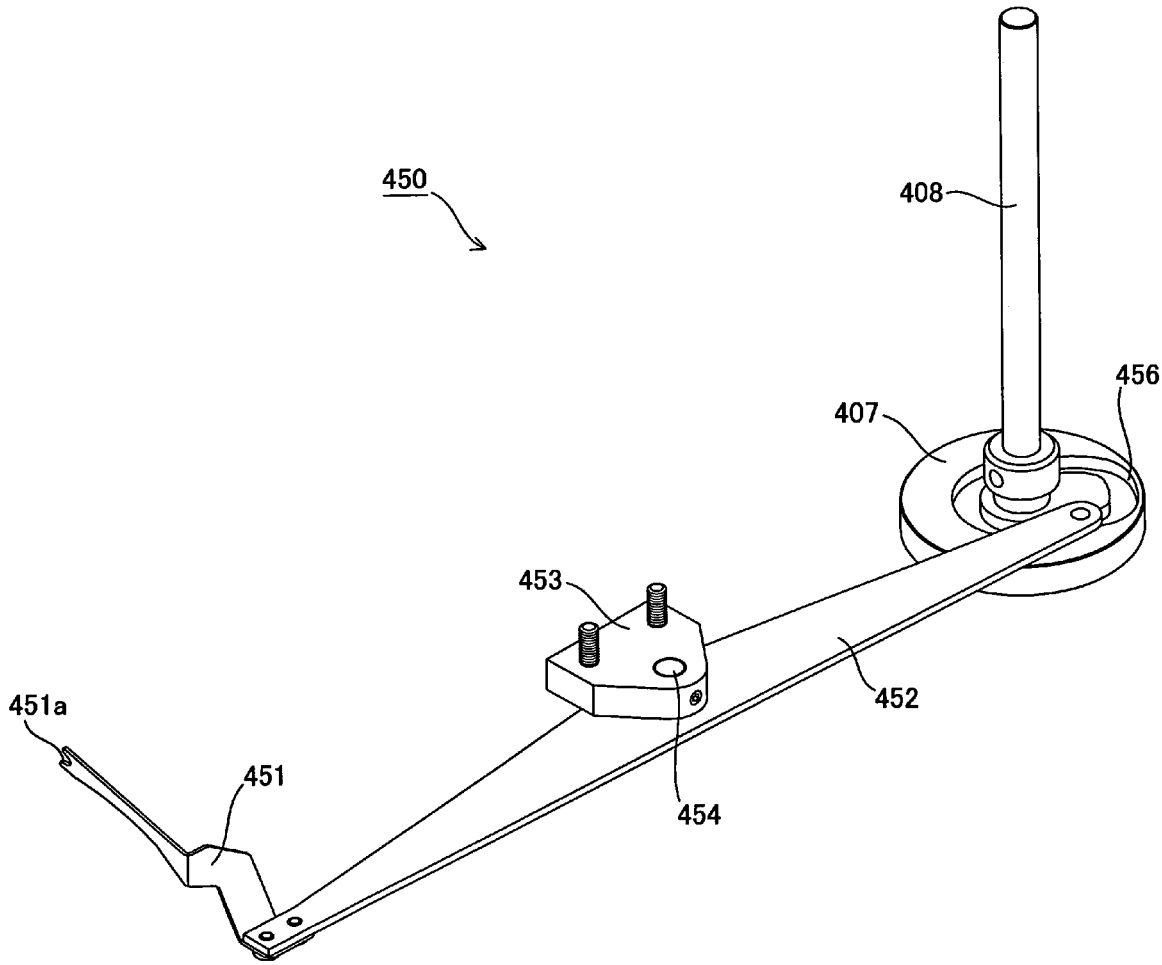
FIG. 42 A perspective view showing the thread insert actuator drive mechanism in the single-thread locked handstitch sewing machine of this invention.
Figure 43:
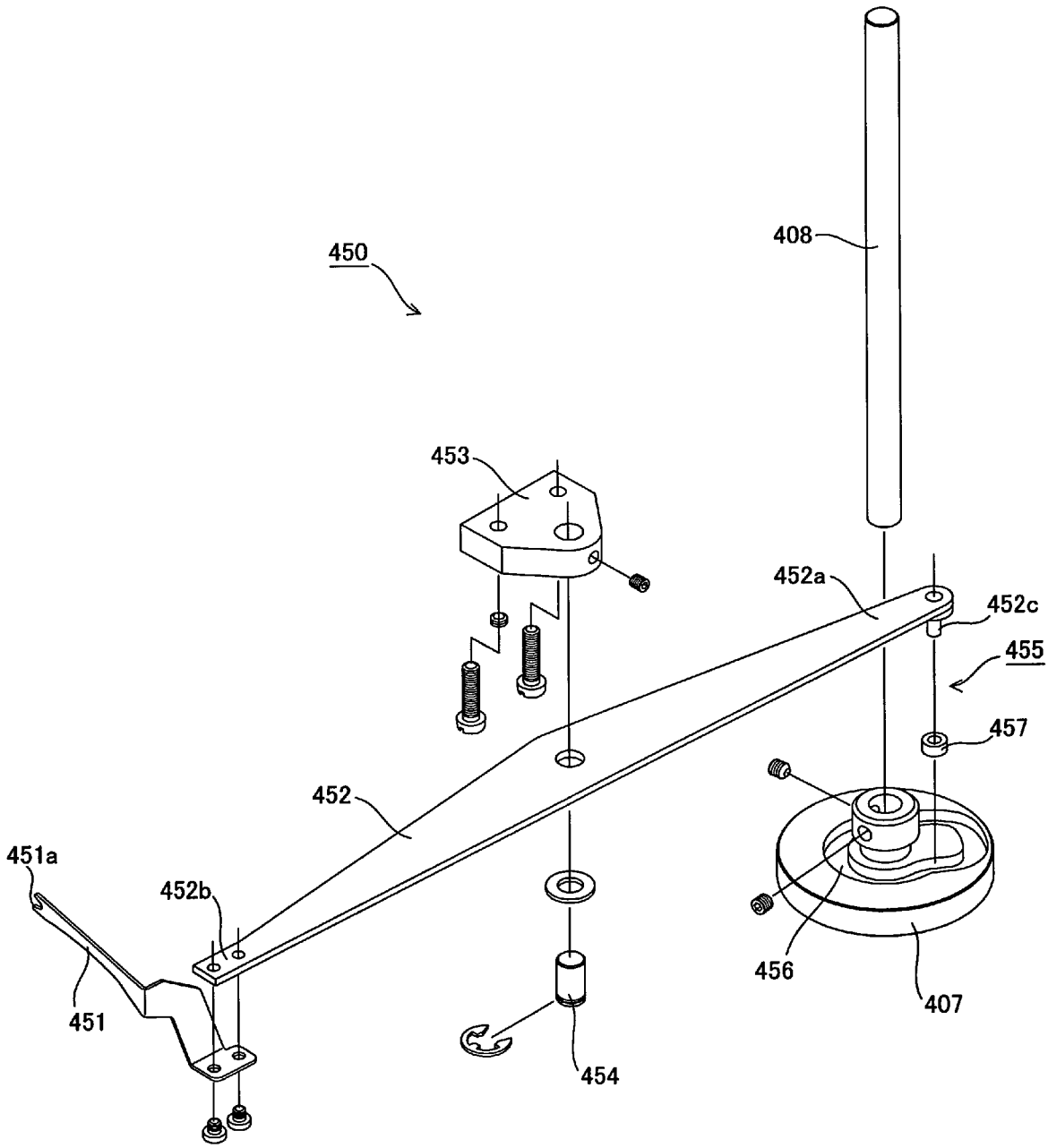
FIG. 43 A exploded perspective view showing the thread insert actuator drive mechanism in the single-thread locked handstitch sewing machine of this invention.

Besides, in the above-mentioned single-thread locked handstitch sewing machine, when sewing by the thick thread or the slightly twisted sewing thread, there is a fear that the sewing thread is not able to be captured by the thread capturing open eye 13*a* of the open eye needle 13. Therefore, as shown in FIG. 42 and FIG. 43, it is preferable to be equipped with a thread insert actuator drive mechanism 450 of a thread insert actuator 451 which inserts forcibly the thread, which is drawn out from the thread exit 212*a* of the shuttle hook 200 and decided the position at the thread capturing open eye 13*a* by the thread draw out actuator 401 and abuts circumferentially on the circumference of the open eye needle 13 and tightened, into the thread capturing open eye 13*a*. A tip 451*a* of the thread insert actuator 451 is formed with the concave shape so as to be able to hook the sewing thread and performs the reciprocating motion at the lower direction of the throat plate 12.

The thread insert actuator drive mechanism 450 uses the thread draw out actuator drive cam 407 of the thread draw out drive mechanism 400, and a thread insert actuator drive cam groove 456 which is the front cam to rock the thread insert actuator 451 is formed at the upper surface of the thread draw out actuator drive cam 407. And, the cam groove 407*a* to let the thread draw out actuator 401 rock is formed at the lower surface of this thread draw out actuator drive cam 407.

And, the thread insert actuator drive mechanism 450 is equipped with a thread insert actuator drive arm 452 and a thread insert actuator drive arm board 453. The thread insert actuator drive arm 452 is arranged in the horizontal direction. In one end 452*a* of the thread insert actuator drive arm 452, a cam follower 455 which engages to the thread insert actuator drive cam groove 456 of the thread draw out actuator drive cam 407 is equipped. In another end 452*b* of the thread insert actuator drive arm 452, the thread insert actuator 451 is fixed. And, the thread insert actuator drive arm board 453 attaches the thread insert actuator drive arm 452 rotatably to the bed 3. The cam follower 455 consists of a roller shaft 452*c* which is equipped to one end 452*a* of the thread insert actuator drive arm 452 and a roller 457 which is rotatably held at the tip of the roller shaft 452*c* and fits into the thread insert actuator drive cam groove 456 of the thread draw out actuator drive cam 407. Besides, a drive arm shaft 454 is fixed to the thread insert actuator drive arm board 453 and the thread insert actuator drive arm 452 is rotatably attached to this drive arm shaft 454.

In the thread insert actuator drive mechanism 450 constituted as described above, the thread insert actuator drive arm 452 makes the drive arm shaft 454 the fulcrum, thereby, the cam follower 455 becomes the operating point and the thread insert actuator 451 becomes the point of force. And, the cam follower 455 lets the thread insert actuator drive arm 452 rotate in accordance with the shape of the thread insert actuator drive cam groove 456 of the thread draw out actuator drive cam 407. Therefore, while the open eye needle 13 pierces the fabric workpiece which is placed on the throat plate 12, and goes up from the lower dead center, the tip 451*a* of the thread insert actuator 451 can perform the reciprocating motion in the side of the shuttle hook 200.

Besides, about the above-mentioned single-thread locked handstitch sewing machine, in the second stroke of the open eye needle 13, there is a case that the sewing thread 20 which is guided into the gap $O_2$ which is formed between another end of the inner shuttle hook driver 203 that the inner shuttle hook driver spring 204 is fixed and the inner shuttle hook 205 moves to the slack state from the tight state by the half-turn normal rotation as shown in FIG. 18 (U). Therefore, in the part of the circumference of the inner shuttle hook 205 of the shuttle hook 200, it is preferable to be equipped with a concave thread accumulating portion 205*f* (FIG. 45) or a convex thread accumulating portion 205*g* (FIG. 46) which accumulates the sewing thread which is guided into the shuttle hook 200 temporarily after interlacing the sewing thread which is scooped by the loop-taker point 205*a* of the inner shuttle hook 205 and released by the thread capturing open eye 13*a* of the open eye needle 13 to the sewing thread which is wound in the shuttle hook 200 by guiding into the shuttle hook 200 by the further rotation of the inner shuttle hook 205, and before tightening the sewing thread which guides out from the shuttle hook 200, and releases the temporary accumulation by tightening the sewing thread which guides out from the shuttle hook 200 by the thread draw out actuator 401.

Figure 45:
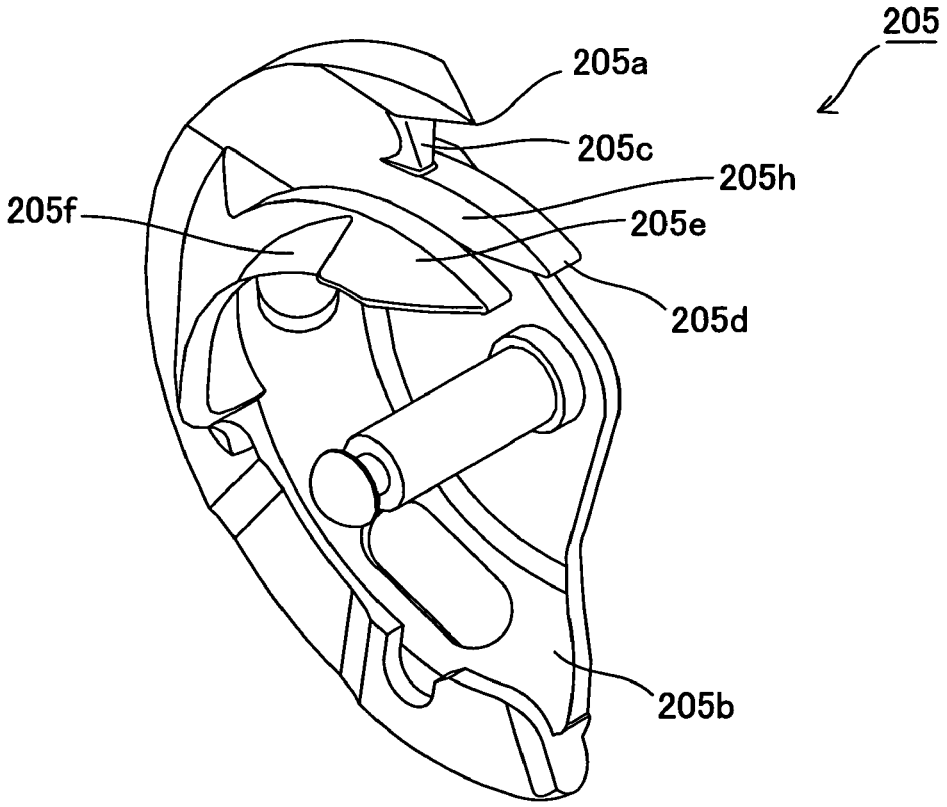
FIG. 45 A perspective view showing the state that the concave thread accumulating portion is equipped in the inner shuttle hook of the shuttle hook in the single-thread locked handstitch sewing machine of this invention.
Figure 46:
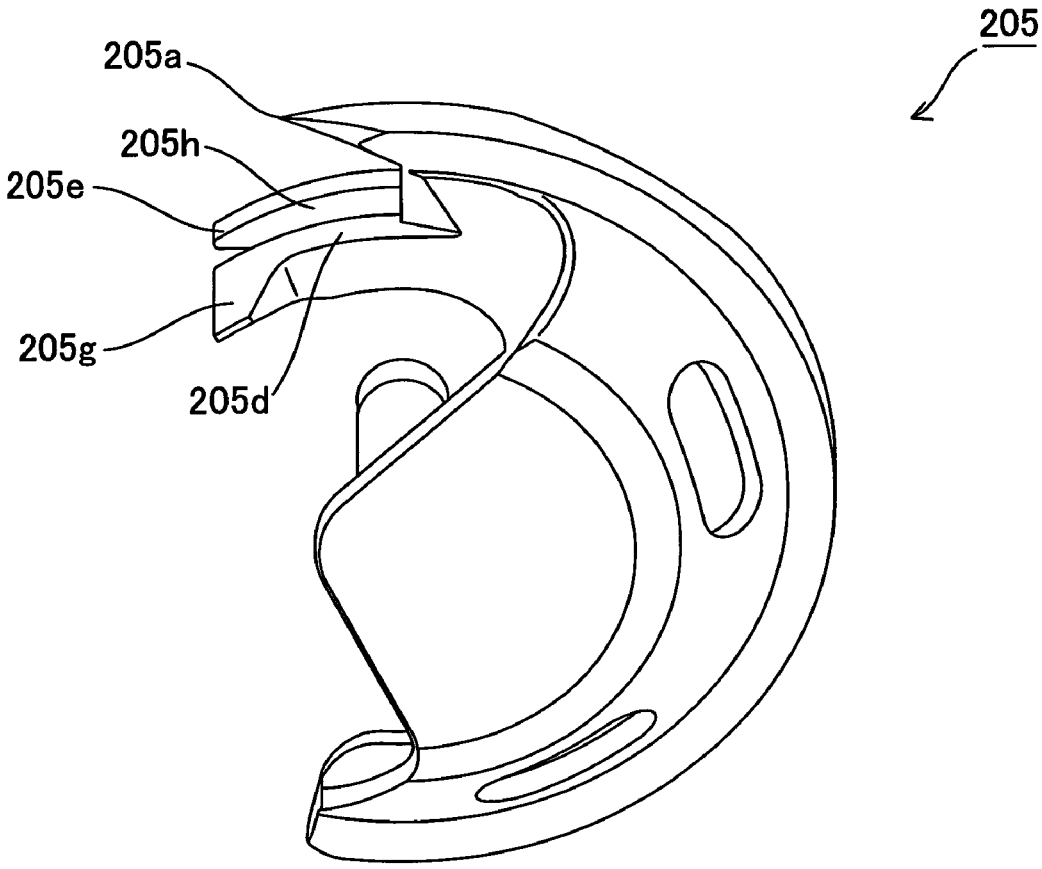
FIG. 46 A exploded perspective view showing the state that the convex thread accumulating portion is equipped in the inner shuttle hook of the shuttle hook in the single-thread locked handstitch sewing machine of this invention.

As shown in FIG. 45 and FIG. 46, the inner shuttle hook 205 which is equipped with the concave thread accumulating portion 205*f* and the convex thread accumulating portion 205*g* is the semicircular shape because of the shuttle hook. And, an upper claw 205*d* or a lower claw 205*e* are formed together with a thread grapple portion 205*c* in the neighborhood of the loop-taker point 205*a* which is formed at one end of the rotational direction, and the gap which is formed by the concave thread accumulating portion 205*f* and the convex thread accumulating portion 205*g* becomes a needle guard groove 205*h*. As shown in FIG. 45, the concave thread accumulating portion 205*f* is formed by notching at the side surface which becomes the opposite side of the needle guard groove 205*h* of the circular arced lower claw 205*e* so as to be able to bring out the above-mentioned the thread accumulating function. And, as shown in FIG. 46, the convex thread accumulating portion 205*g* is formed by protruding at the side surface which becomes the opposite side of the needle guard groove 205*h* of the circular arced upper claw 205*d* so as to be able to bring out the above-mentioned the thread accumulating function.

Figure 47:
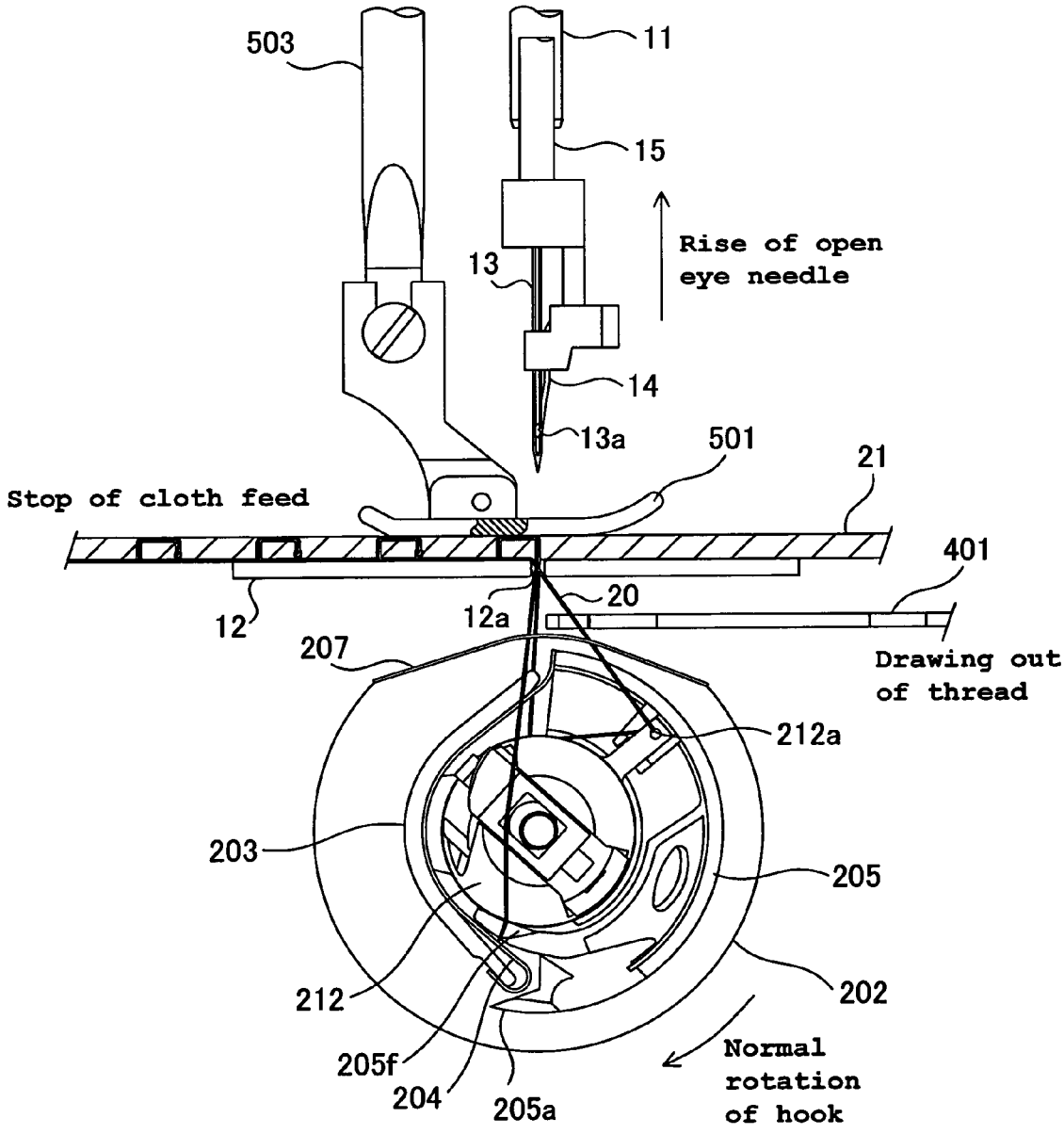
FIG. 47 A movement explanatory view showing the method for forming single-thread locked handstitches of FIG. 18 (U) about the movement of the single-thread locked handstitch sewing machine by this invention that the concave thread accumulating portion is equipped in the inner shuttle hook of the shuttle hook.

In the concave thread accumulating portion 205*f* and the convex thread accumulating portion 205*g* constituted as described above, even if the inner shuttle hook 205 becomes the position which performs the half-turn normal rotation as shown in FIG. 18 (U), as shown in FIG. 47, because the state hooking the sewing thread can be maintained respectively, it is possible to accumulate the sewing thread which is guided into the shuttle hook 200 temporarily, thereafter, it is possible to release the temporary accumulation of the sewing thread by tightening the sewing thread which guides out from the shuttle hook 200 by the thread draw out actuator 401. Therefore, in the second stroke of the open eye needle 13, the tightened state of the sewing thread 20 which is guided into the gap $O_2$ which is formed between another end of the inner shuttle hook driver 203 that the inner shuttle hook driver spring 204 is fixed and the inner shuttle hook 205 can be maintained even if the inner shuttle hook 205 performs the half-turn normal rotation. And, the sewing thread 20 which is guided into the shuttle hook 200 and the sewing thread 20 which is guided out from the thread exit 212*a* can be captured without slacking the sewing thread by the thread grapple portion 401*a* of the thread draw out actuator 401. It is preferable that any one of the concave thread accumulating portion 205*f* or the convex thread accumulating portion 205*g* is provided.

Next, the operation of the single-thread locked handstitch sewing machine, which incorporates the above-mentioned latch wire drive mechanism 130, the thread shifting mechanism 800A and 800B, the needle guard 242, the thread tightness adjusting mechanism 420, the rotating operation/linear feed changeover mechanism 540, the hand feed/linear feed changeover mechanism 740, the thread insert actuator drive mechanism 450, and the inner shuttle hook 205 which is equipped with the concave thread accumulating portion 205*f* or the convex thread accumulating portion 205*g* by selecting arbitrarily, is explained based on the method for forming single-thread locked handstitches.

Figure 48:
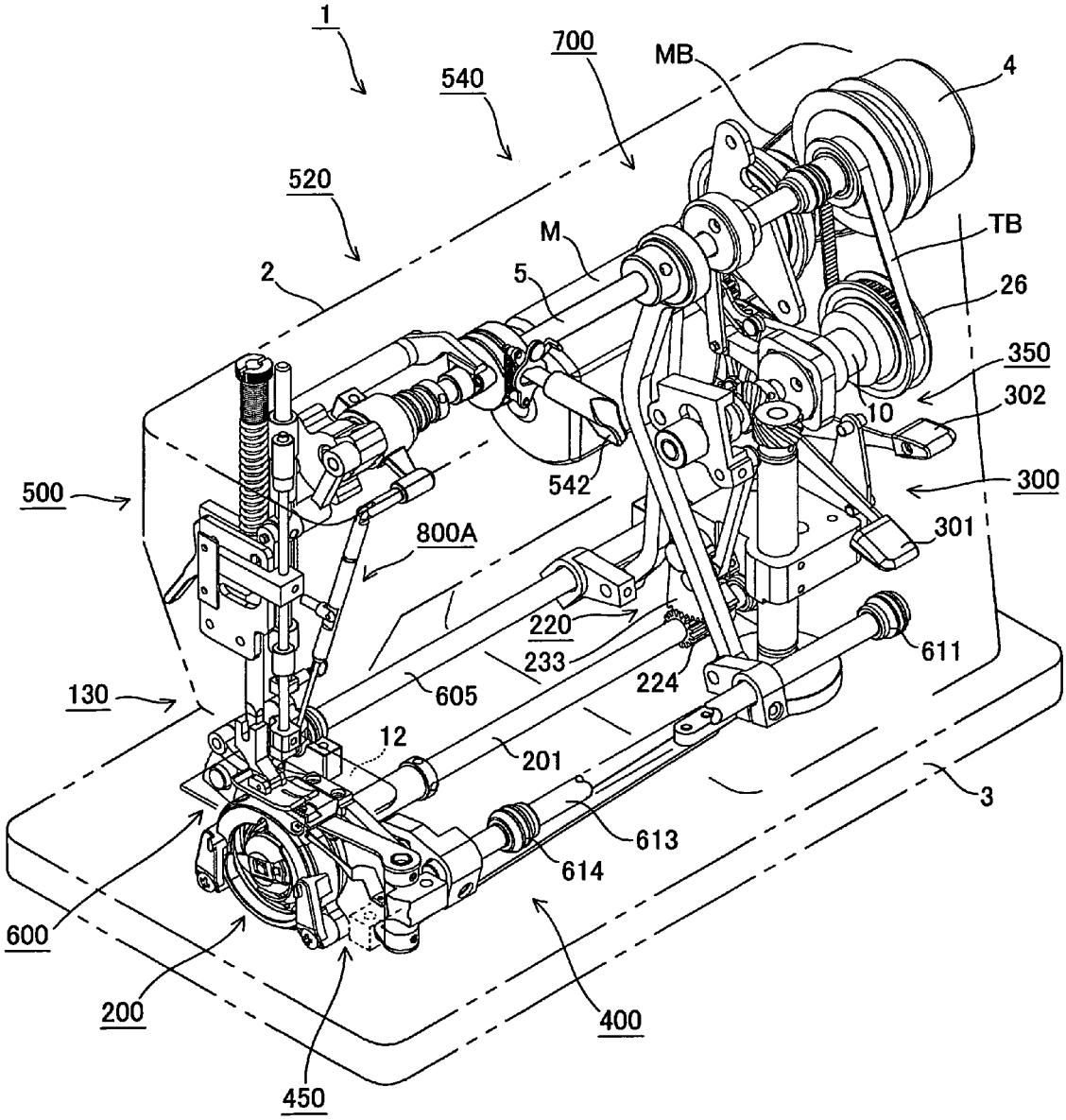
FIG. 48 An overall perspective view showing another preferable example of the mode of embodiment by the single-thread locked handstitch sewing machine of this invention.
Figure 49:
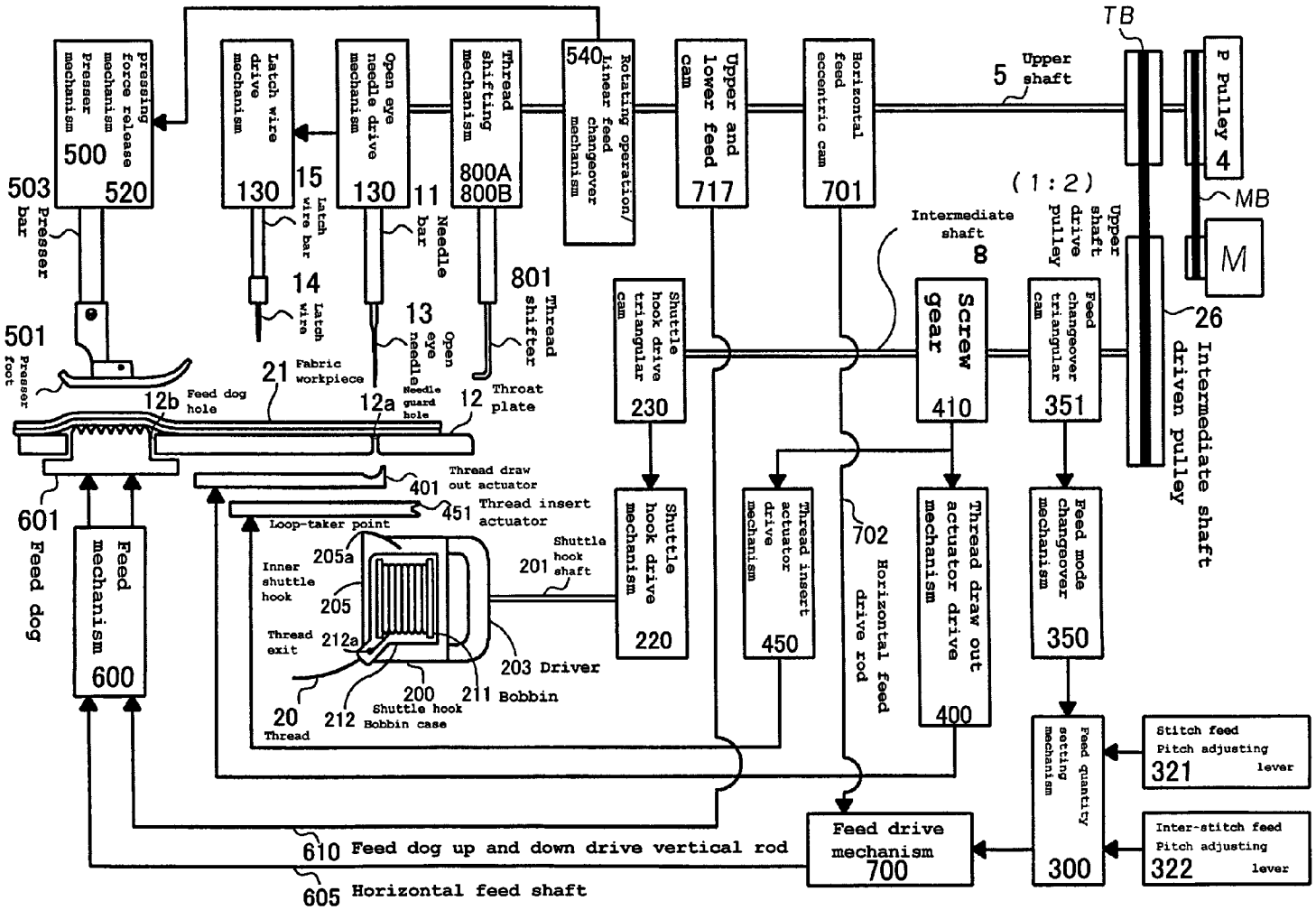
FIG. 49 A block diagram showing the drive system of the single-thread locked handstitch sewing machine of FIG. 48.
Figure 52A:
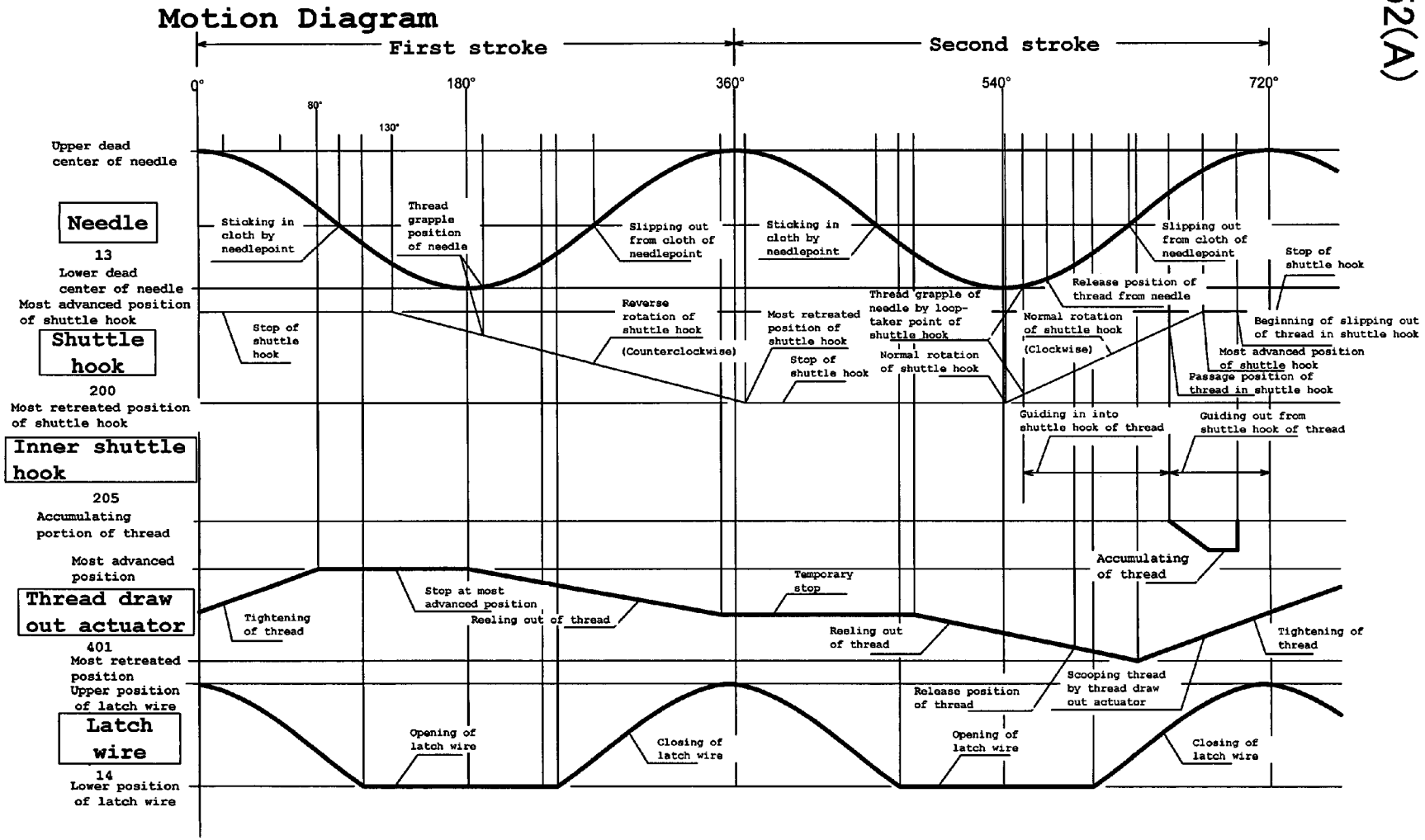
FIG. 52 (A) A movement explanatory view showing the movement state of the open eye needle, the shuttle hook, the thread draw out actuator, the latch wire and the thread accumulating portion of the single-thread locked handstitch sewing machine of FIG. 48, FIG. 49, FIG. 53 and FIG. 54.
Figure 52B:
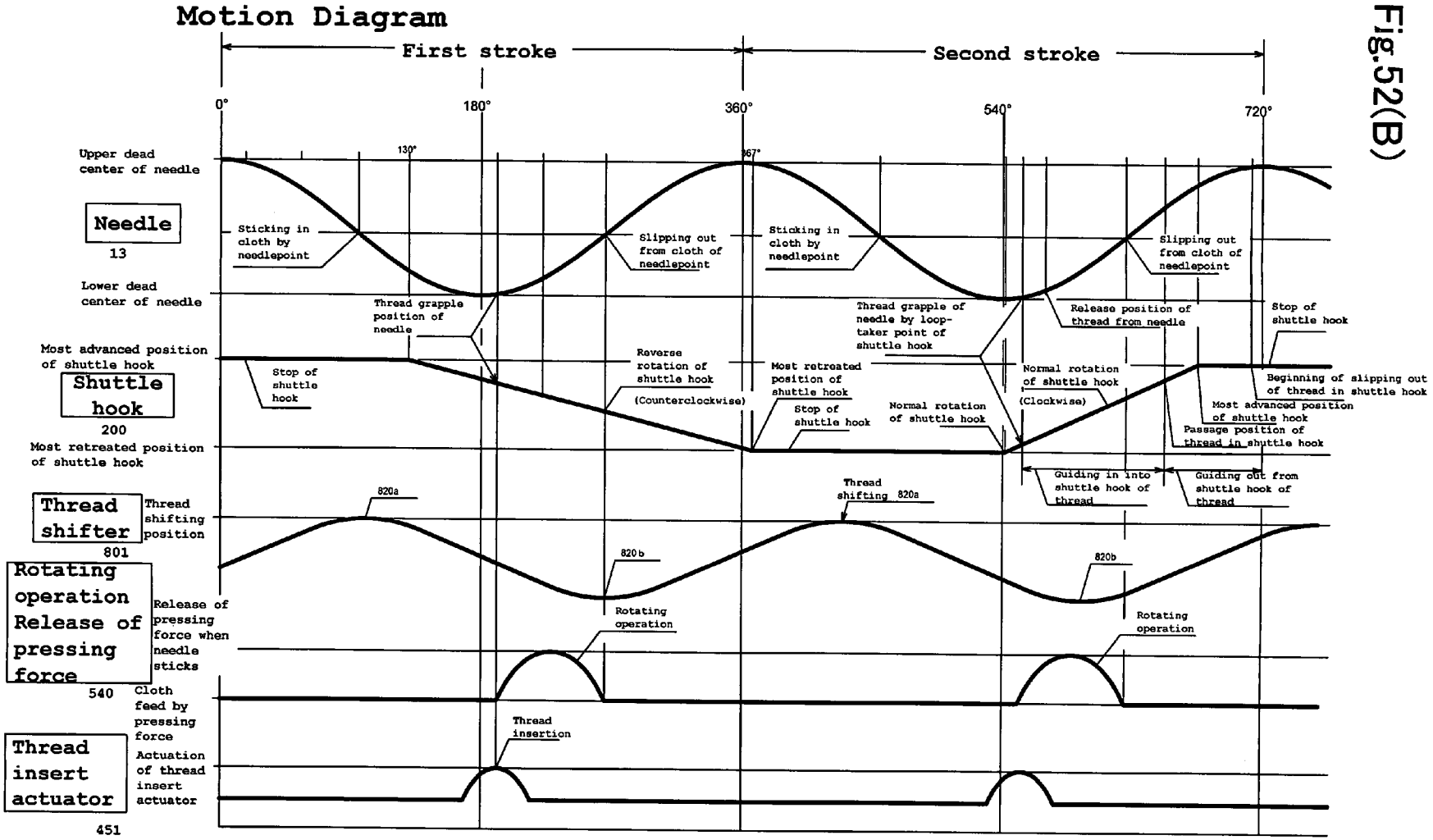
Figure 52C:
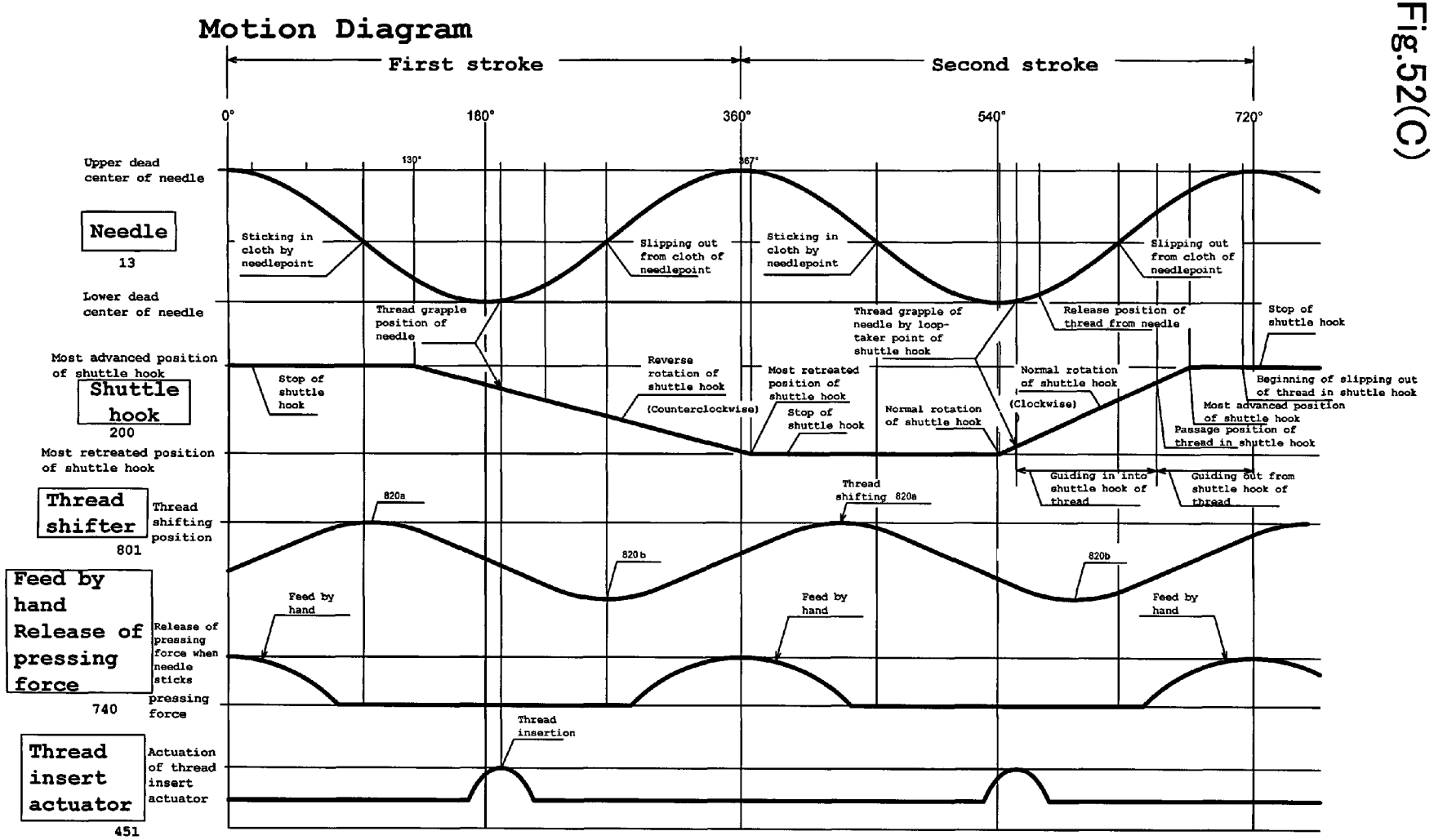

For example, the single-thread locked handstitch sewing machine for the free curve sewing which can perform the changeover of the rotating operation/linear feed is explained based on mainly FIG. 48, FIG. 49, FIG. 18 (A)-(W), FIG. 52 (A), (B). FIG. 48 is the overall perspective view of the single-thread locked handstitch sewing machine for the free curve sewing. FIG. 49 is the block diagram showing the drive system of the single-thread locked handstitch sewing machine for the free curve sewing. FIG. 52 (A) is the motion diagram of the open eye needle 13, the shuttle hook 200, the thread draw out actuator 401, the latch wire 14 and the inner shuttle hook 205. FIG. 52 (B) is the motion diagram of the open eye needle 13, the shuttle hook 200, the thread shifter 801 and the thread insert actuator 451. Because FIG. 18 (A)-(W) are same as the above-mentioned single-thread locked handstitch sewing machine, the explanation is omitted. And, in the overall perspective view shown in FIG. 48, although the shape of the parts used in the feed drive mechanism 700, the feed quantity setting mechanism 300 and the feed mode changeover mechanism 350 is different from the above-mentioned overall perspective view shown in FIG. 1, the shape is just improved on the commercial production, and the constitution and the operation are same. Besides, the shuttle hook 200 except the inner shuttle hook 205, the presser mechanism 500, the cloth feed mechanism 600 and the thread draw out drive mechanism 400 have the same constitution and the operation. Therefore, the explanation is omitted by giving the same numerals. Further, in this single-thread locked handstitch sewing machine for the free curve sewing, the thread shifting mechanism 800A and the rotating operation/linear feed changeover mechanism 540 having the pressing force release mechanism 520 are used.

Figure 50:
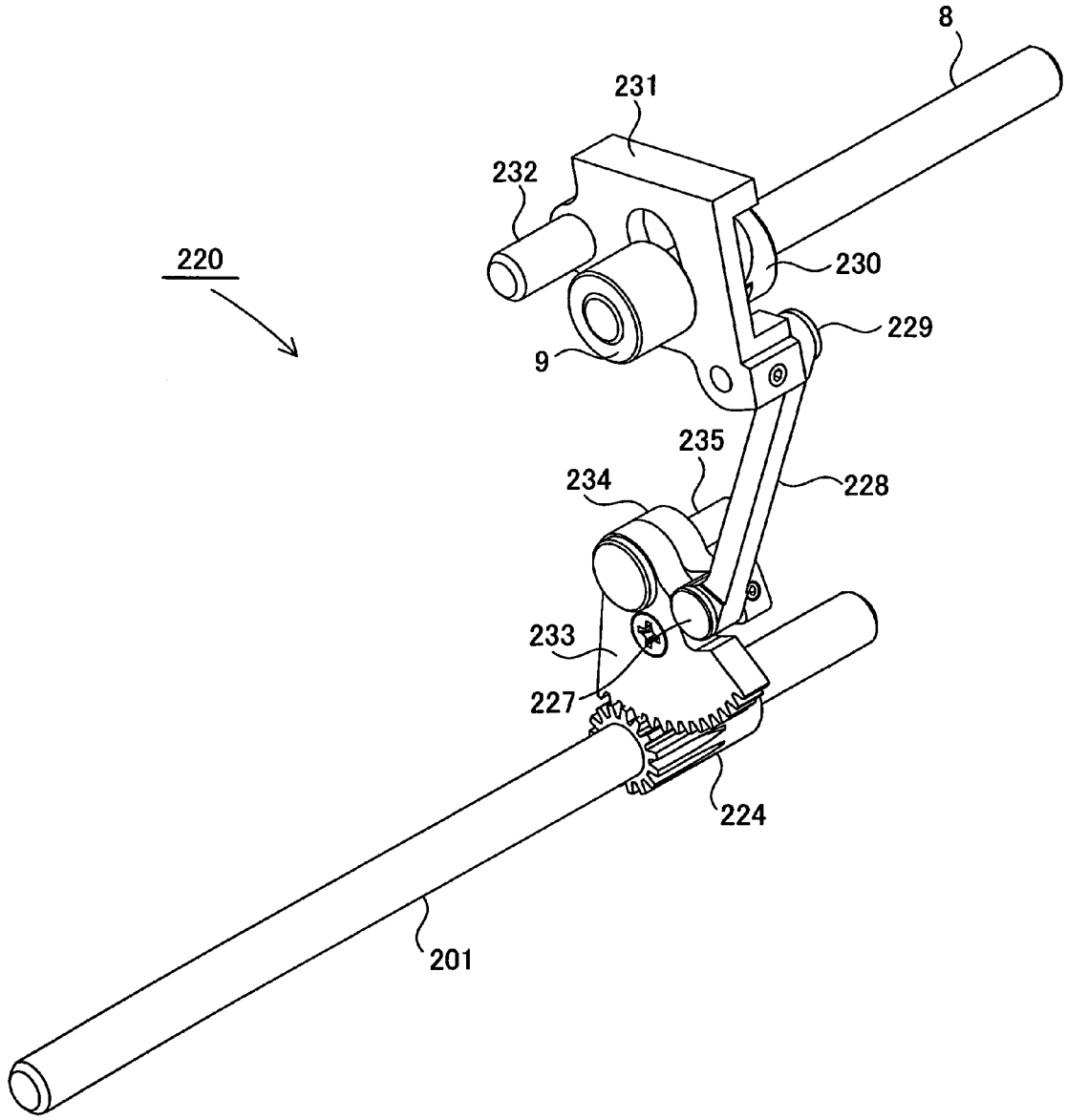
FIG. 50 A perspective view showing the shuttle hook drive mechanism which is another mode of embodiment in the single-thread locked handstitch sewing machine of this invention.
Figure 51:
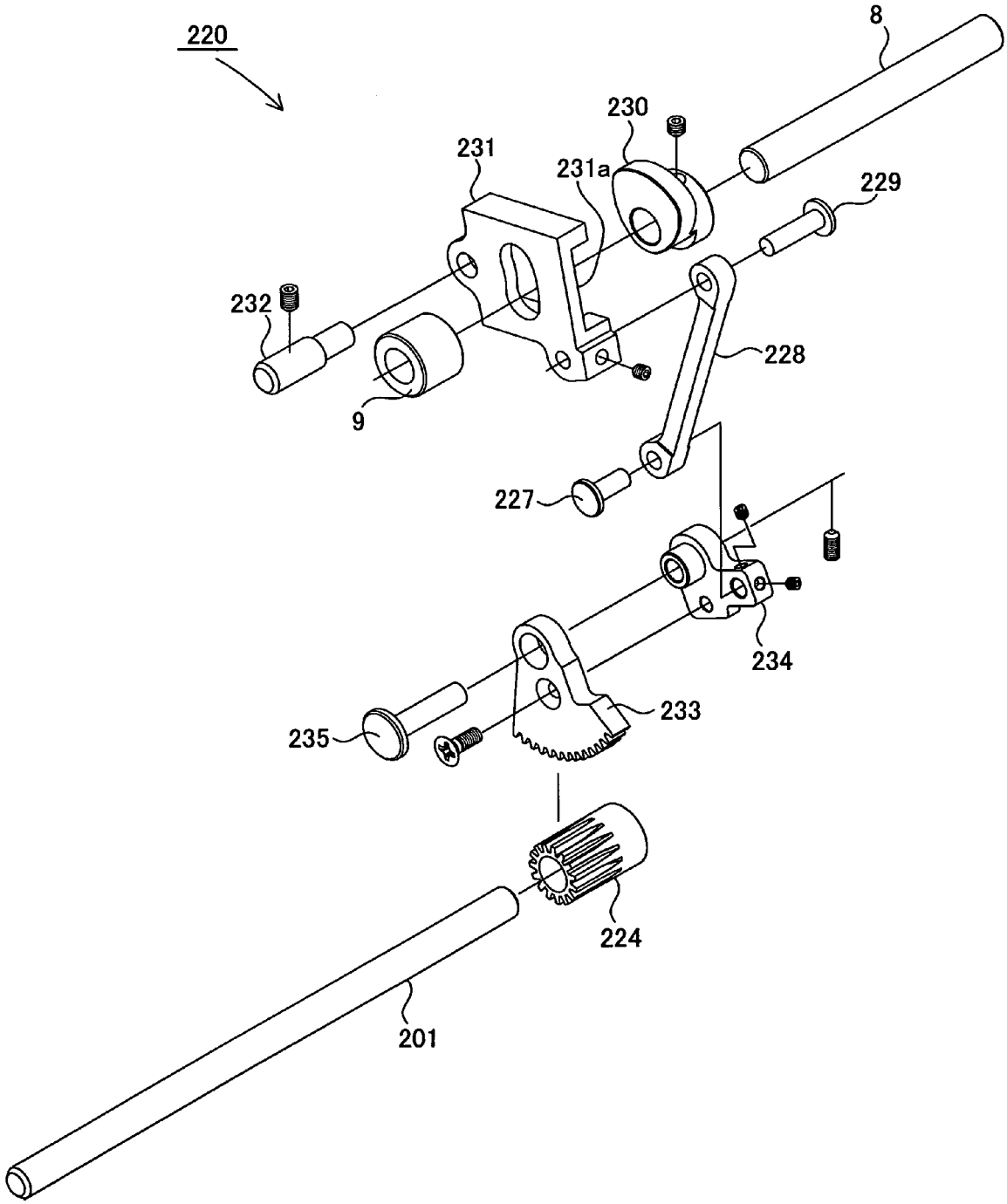
FIG. 51 An exploded perspective view showing the shuttle hook drive mechanism of FIG. 50.

Besides, in the overall perspective view shown in FIG. 1, although the shuttle hook drive fan-shaped gear 233 engages at the lower direction of the shuttle hook shaft gear 224 in the shuttle hook drive mechanism 220, in the overall perspective view shown in FIG. 48, the shuttle hook drive mechanism 220 is constituted so that the shuttle hook drive fan-shaped gear 233 engages at the upper direction of the shuttle hook shaft gear 224. In such the shuttle hook drive mechanism 220, as shown in FIG. 50 and FIG. 51, instead of the fan-shaped gear shaft 221 of the shuttle hook drive mechanism 220 shown in FIG. 14 and FIG. 15, a fan-shaped gear shaft 235 which is arranged at the position of the bed 3 that the shuttle hook drive fan-shaped gear 233 engages at the lower direction of the shuttle hook shaft gear 224 is used. Therefore, the shuttle hook drive vertical rod 228 shown in FIG. 50 and FIG. 51 becomes short than the shuttle hook drive vertical rod 228 shown in FIG. 14 and FIG. 15.

Further, the feed adjusting lever knob 323 is equipped to the portion which becomes the point of force of the stitch feed adjusting lever 301 and the inter-stitch feed adjusting lever 302.

In FIG. 48 and FIG. 49, when the driven pulley 4 which is driven by the motor M through the drive belt MB rotates clockwise by looking from the side of the open eye needle 13, the open eye needle-latch wire drive mechanism 130, the cloth feed drive mechanism 700, the shuttle hook drive mechanism 220, the thread draw out drive mechanism 400, the rotating operation/linear feed changeover mechanism 540, the thread shifting mechanism 800A and the thread insert actuator drive mechanism 450 drive by the rotation of the upper shaft 5. When the open eye needle-latch wire drive mechanism 130 drives, it lets the open eye needle 13 perform the linear reciprocating motion vertically. When the cloth feed drive mechanism 700 drives, it lets the feed dog 601 perform the four process movements of the feed by the cloth feed mechanism 600. When the shuttle hook drive mechanism 220 drives, it lets the inner shuttle hook 205 of the shuttle hook 200 perform the half-turn normal rotation and the half-turn reverse rotation. When the thread draw out drive mechanism 400 drives, it lets the thread draw out actuator 401 rock. When the rotating operation/linear feed changeover mechanism 540 drives, it lets the pressing force of the presser foot 501 release only for the predetermined time every first stroke and second stroke of the open eye needle 13. When the thread shifting mechanism 800A drives, it lets the thread shifter 801 perform the elliptical motion in the neighborhood of the open eye needle 13 every first stroke and second stroke of the open eye needle 13. When the thread insert actuator drive mechanism 450 drives, it lets the thread insert actuator 451 perform the reciprocating motion every first stroke and second stroke of the open eye needle 13. The movement explanation of each mechanism is omitted because the above-mentioned composition explanation was performed in detail.

By following cooperation of the open eye needle 13, the shuttle hook 200, the thread draw out actuator 401, the feed dog 601, the presser foot 501 and the thread insert actuator 451 which operate as described above, the handstitch on the front surface and the locked stitch on the back surface of the fabric workpiece 21 are respectively formed by one sewing thread 20. In the case of the linear feed, the explanation is omitted because the sewing operation is the same as the above-mentioned single-thread locked handstitch sewing machine (FIG. 1 and FIG. 2).

Figure 44:
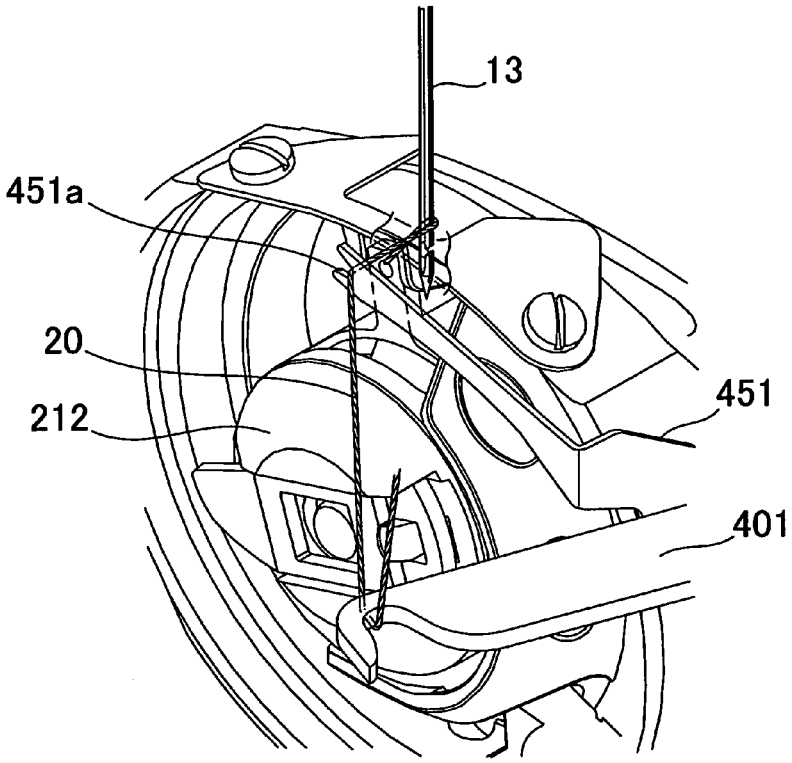
FIG. 44 A view showing the relation between the shuttle hook described in FIG. 18 (H), the thread draw out actuator and the thread insert actuator, wherein (A) is a explanatory view showing the state that the thread insert actuator of the thread insert actuator drive mechanism of FIG. 42 and FIG. 43 inserts the sewing thread forcibly to the thread capturing open eye of the open eye needle, (B) is an explanatory view showing the state that the shuttle hook, the thread draw out actuator and the thread insert actuator are watched from the upper side.
Figure 44:
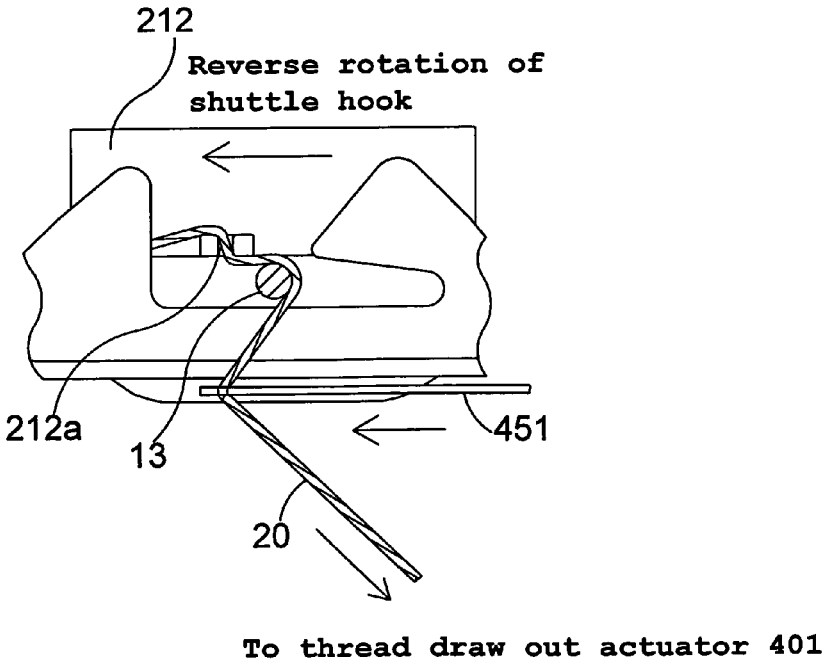

When driving the sewing machine by changing over the changeover lever 542 to the rotating operation feed (free curve sewing), (a) When the open eye needle 13 which performs the linear reciprocating motion vertically comes down from the upper dead center (upper shaft 5: 0 degrees), and pierces the fabric workpiece 21 which is placed on the throat plate 12 (FIG. 18 (A)-(F), FIG. 52 (A)), and goes up from the lower dead center (upper shaft 5: 180 degrees) during the first stroke, the tightened sewing thread 20 which abuts circumferentially on the open eye needle 13 by being drawn out from the thread exit 212*a* of the shuttle hook 200 which performs the half-turn reverse rotation under the throat plate 12 by the thread draw out actuator 401 is captured by the thread capturing open eye 13*a* (FIG. 18 (G), FIG. 18 (H), FIG. 52 (A)). In this case, as shown in FIG. 44 (B), the thread exit 212*a* of the bobbin case 212 that the shuttle hook 200 has is equipped at the direction and the position away from the throat plate 12 by the reverse rotation of the inner shuttle hook 205 of the shuttle hook 200 when the open eye needle 13 goes up from the throat plate 12. Thereby, the sewing thread 20 which is drawn out by the thread draw out actuator 401 can abut circumferentially on the open eye needle 13. And, the sewing thread 20 which is drawn out from the thread exit 212*a* of the bobbin case 212 by the thread draw out actuator 401 and tightened by abutting circumferentially on the open eye needle 13 by deciding the position of the thread capturing open eye 13*a* of the open eye needle 13 is forcibly inserted to the thread capturing open eye 13*a* of the open eye needle 13 by letting the thread insert actuator 451 rock (FIG. 18 (F)-FIG. 18 (K), FIG. 44, FIG. 52 (B)). Besides, the shuttle hook 200 stops the rotation when the open eye needle 13 substantively moves from the upper dead center (upper shaft 5: 0 degrees) to the lower dead center (upper shaft 5: 180 degrees). As described above, the reason why the shuttle hook 200 stops the rotation is to get the timing that the shuttle hook which performs the half-turn normal rotation performs the half-turn reverse rotation during the second stroke in order to perform the thread guard of the sewing thread 20 to the thread capturing open eye 13*a* of the open eye needle 13 during the first stroke. Further, in the first stroke of the open eye needle 13, before the open eye needle 13 comes down from the upper dead center, pierces the fabric workpiece 21, goes up from the lower dead center, and slips out from the fabric workpiece 21, the pressing force of the presser foot 501 which performs the pressing force of the fabric workpiece 21 on the throat plate 12 is released (FIG. 18 (H)-FIG. 18 (K), FIG. 52 (B)). Thereby, it is possible to perform the rotating operation by hand about the feed direction of the fabric workpiece 21 by making the open eye needle 13 the rotating shaft in the first stroke of the open eye needle 13.

The shuttle hook 200 begins the half-turn reverse rotation after the open eye needle 13 sticks into the fabric workpiece 21 (upper shaft 5: 130 degrees), (FIG. 18 (E), FIG. 52 (A)). The thread draw out actuator 401 stops at the most advanced position before the open eye needle 13 sticks into the fabric workpiece 21 (upper shaft 5: 80 degrees), (FIG. 18 (D), FIG. 52 (A)). The latch wire 14 becomes open state when the open eye needle 13 sticks into the fabric workpiece 21 (FIG. 18 (E), FIG. 52 (A)). The feed dog 601 stops the cloth feed of the fabric workpiece 21 before the open eye needle 13 sticks into the fabric workpiece 21 (FIG. 18 (D), FIG. 52 (A)).

(b) While the open eye needle 13 slips out from the fabric workpiece 21, and goes up, and passes through the upper dead center (upper shaft 5: 360 degrees) during the first stroke, the fabric workpiece 21 is fed with one stitch length by the feed dog 601. And, the open eye needle 13 which captures the sewing thread 20 goes up and the shuttle hook 200 performs further reverse rotation, thereby, the thread tightness is performed (FIG. 18 (I)-FIG. 18 (M), FIG. 52 (A)).

The shuttle hook 200 stops the half-turn reverse rotation (upper shaft 5: 367 degrees) after the open eye needle 13 passes through the upper dead center (upper shaft 5: 360 degrees), (FIG. 18 (M), FIG. 52 (A)). The thread draw out actuator 401 begins the rocking which backs away so that the sewing thread 20 can be reeled out when the open eye needle 13 reaches the lower dead center (upper shaft 5: 180 degrees), (FIG. 18 (F), FIG. 52 (A)). And the thread draw out actuator 401 stops the backward movement before the open eye needle 13 passes through the upper dead center (upper shaft 5: 360 degrees), (FIG. 18 (L), FIG. 52 (A)). When the open eye needle 13 moves from the lower dead center (upper shaft 5: 180 degrees) to the upper dead center (upper shaft 5: 360 degrees), the latch wire 14 makes the thread capturing open eye 13*a* of the open eye needle 13 the closed state after this open eye needle 13 passes through the throat plate 12, and the latch wire 14 passes through the fabric workpiece 21 together with the open eye needle 13 (FIG. 18 (J), FIG. 18 (K), FIG. 52 (A)). The feed dog 601 begins one stitch length feed just before the open eye needle 13 passes through the upper dead center (upper shaft 5: 360 degrees), (FIG. 18 (L), FIG. 52 (A)). And, also in the first stroke of the open eye needle 13, as shown in FIG. 29, although the thread shifter 801 performs the elliptical motion of the motion trace 830 of only one rotation in the horizontal direction in the tip 801*a* (FIG. 18 (A)-FIG. 18 (M), FIG. 52 (B)), at this time, the sewing thread 20 is not captured by the thread capturing open eye 13*a* even if the open eye needle 13 comes down.

(c) During the second stroke, when the open eye needle 13 comes down from the upper dead center (upper shaft 5: 360 degrees), and pierces the fabric workpiece 21 (FIG. 18 (N), FIG. 18 (O), FIG. 52 (A)), and goes up from the lower dead center (upper shaft 5: 540 degrees), the open eye needle 13 scoops the sewing thread 20 which is captured by the thread capturing open eye 13*a* by the loop-taker point 205*a* of the shuttle hook 200 which performs the half-turn normal rotation, and the open eye needle 13 releases the captured sewing thread 20 by the rotation of the shuttle hook 200 from the thread capturing open eye 13*a* (FIG. 18 (P), FIG. 52 (A)). The shuttle hook 200 stops the rotation when the open eye needle 13 substantively moves from the upper dead center (upper shaft 5: 360 degrees) to the lower dead center (upper shaft 5: 540 degrees). As described above, the reason why the shuttle hook 200 stops the rotation is to get the timing that the shuttle hook which performs the half-turn reverse rotation performs the half-turn normal rotation during the first stroke in order to release the sewing thread 20 which is hooked by the thread capturing open eye 13*a* of the open eye needle 13 from the thread capturing open eye 13*a* by the loop-taker point 205*a* during the second stroke.

The shuttle hook 200 begins the half-turn normal rotation when the open eye needle 13 reaches the lower dead center (upper shaft 5: 540 degrees), (FIG. 18 (P), FIG. 52 (A)). The thread draw out actuator 401 stops just before the open eye needle 13 sticks into the fabric workpiece 21 (FIG. 18 (N), FIG. 52(A)). Thereafter, the latch wire 14 makes the thread capturing open eye 13*a* of the open eye needle 13 the open state when the open eye needle 13 comes down from the upper dead center and passes through the fabric workpiece 21 (FIG. 18 (O), FIG. 52(A)). The feed dog 601 stops one stitch length feed before the open eye needle 13 sticks into the fabric workpiece 21 (FIG. 18 (N), FIG. 52(A)).

Besides, in the second stroke of the open eye needle 13, as shown in FIG. 29, the thread shifter 801 performs the elliptical motion of the motion trace 830 of only one rotation in the horizontal direction in the tip 801*a* (FIG. 18 (M)-FIG. 18 (W), FIG. 52 (B)). In this case, when the open eye needle 13 comes down, because the sewing thread 20 which is captured by the thread capturing open eye 13*a* of the open eye needle 13 between the needlepoint of the open eye needle 13 and the fabric workpiece 21 becomes the slack state from the tight state and the thread slack occurs, the shifting of the sewing thread of this thread slack is performed to the unopened direction of the open eye needle 13 between the needlepoint of the open eye needle 13 and the fabric workpiece 21 (FIG. 18 (M), (N), FIG. 52 (B)). Concretely, as shown in FIG. 29, the elliptical motion of the motion trace 830 of the tip 801*a* of the thread shifter 801 becomes clockwise by looking from the upper side of the presser foot 501, and it is possible to hook the loop of the sewing thread 20 in the neighborhood of the position 830*a* which becomes the shifting point of the sewing thread of the motion trace 830 by shifting the sewing thread by the tip 801*a* of the thread shifter 801 to the unopened direction of the thread capturing open eye 13*a*. The position 830*b* of the motion trace 830 shown in FIG. 52 (B) is the position shown in FIG. 29.

Further, in the second stroke of the open eye needle 13, before the open eye needle 13 comes down from the upper dead center, pierces the fabric workpiece 21, goes up from the lower dead center, and slips out from the fabric workpiece 21, the pressing force of the presser foot 501 which performs the pressing force of the fabric workpiece 21 on the throat plate 12 is released (FIG. 18 (P)-FIG. 18 (T), FIG. 52 (B)). Thereby, it is possible to perform the rotating operation by hand about the feed direction of the fabric workpiece 21 by making the open eye needle 13 the rotating shaft in the second stroke of the open eye needle 13.

Besides, for example, in the case that the convex thread accumulating portion 205*g* is equipped at the inner shuttle hook 205 in the shuttle hook 200, even if the inner shuttle hook 205 becomes the position which performs the half-turn normal rotation as shown in FIG. 18 (U), as shown in FIG. 47, because the state that the convex thread accumulating portion 205*g* hooks the sewing thread 20 can be maintained, it is possible to accumulate the sewing thread which is guided into the shuttle hook 200 temporarily, thereafter, it is possible to release the temporary accumulation of the sewing thread by tightening the sewing thread which guides out from the shuttle hook 200 by the thread draw out actuator 401. Therefore, in the second stroke of the open eye needle 13, the tightened state of the sewing thread 20 which is guided into the gap $O_2$ which is formed between another end of the inner shuttle hook driver 203 that the inner shuttle hook driver spring 204 is fixed and the inner shuttle hook 205 can be maintained even if the inner shuttle hook 205 performs the half-turn normal rotation.

Also in the second stroke of the open eye needle 13, although the thread insert actuator 451 rocks (FIG. 18 (O)-FIG. 18 (S), FIG. 52 (B)), at this time, the position of the sewing thread 20 is not decided at the thread capturing open eye 13*a* of the open eye needle 13.

(d) The sewing thread 20 which is scooped by the loop-taker point 205*a* of the shuttle hook 200 and is released is guided in the gap $O_2$ which is formed between another end of the inner shuttle hook driver 203 that the inner shuttle hook driver spring 204 of the shuttle hook 200 is fixed and the inner shuttle hook 205 by further rotation of the shuttle hook 200, and is interlaced to the sewing thread 20 which is wound in the shuttle hook 200. And the sewing thread 20 which is guided out from the gap $O_1$ which is formed between one end of the inner shuttle hook driver 203 that the inner shuttle hook driver spring 204 is fixed and the inner shuttle hook 205 is tightened by the thread draw out actuator 401 (FIG. 18 (Q)-FIG. 18 (W), FIG. 52 (A)).

The shuttle hook 200 stops the half-turn normal rotation by the time the open eye needle 13 slips out from the fabric workpiece 21 and reaches the upper dead center (upper shaft 5: 720 degrees), (FIG. 18 (V), FIG. 52 (A)). The thread draw out actuator 401 begins the rocking so that the sewing thread 20 can be tightened and can be advanced after the open eye needle 13 slips out from the fabric workpiece 21 (FIG. 18 (T), FIG. 52 (A)). The latch wire 14 makes the thread capturing open eye 13*a* of the open eye needle 13 the closed state when the open eye needle 13 goes up from the lower dead center and passes through the fabric workpiece 21 (FIG. 18 (T), FIG. 52 (A)). The feed dog 601 begins one inter-stitch pitch feed just before the open eye needle 13 passes through the upper dead center (upper shaft 5: 720 degrees), (FIG. 18 (W), FIG. 52 (A)).

(e) While the open eye needle 13 slips out from the fabric workpiece 21, and goes up and passes through the upper dead center (upper shaft 5: 720 degrees) during the second stroke, one inter-stitch pitch feed of the fabric workpiece 21 is performed (FIG. 18 (W), FIG. 52 (A)).

(f) The handstitch on the front surface and the locked stitch on the back surface of the fabric workpiece 21 are formed respectively by repeating the steps from (a) to (e).

Therefore, the sewing thread 20 is certainly captured to the thread capturing open eye 13*a* of the open eye needle 13, and the formation of single-thread locked stitch is performed in the inner space of the sewing machine bed, and the sewing which is suitable to the quasi-handstitch called pinpoint/saddle stitch is possible. And, because it is possible to vary the feed direction of the fabric workpiece 21 every one skip stitch set, the sewing which are suitable to the quilt, the quilting or the patchwork can be performed. Besides, because the handstitch on the front surface and the locked stitch on the back surface of the fabric workpiece 21 are formed respectively and the sewing-work is performed in the state that the handstitch can be seen on the surface for the worker, it is possible to confirm the position of the handstitch, thereby, the accurate sewing can be performed. In addition, because the handstitch on the front surface and the locked stitch on the back surface of the fabric workpiece 21 are formed respectively, the sewing thread 20 does not come loose easily even if the sewing thread 20 which forms single-thread locked stitch is hooked. Thereby, the firm sewing can be obtained.

Because the feed quantity setting mechanism 300 and the feed mode changeover mechanism 350 have the same constitution as the above-mentioned single-thread locked handstitch sewing machine, the explanation regarding the adjusting of the stitch length and the inter-stitch pitch is omitted.

Figure 53:
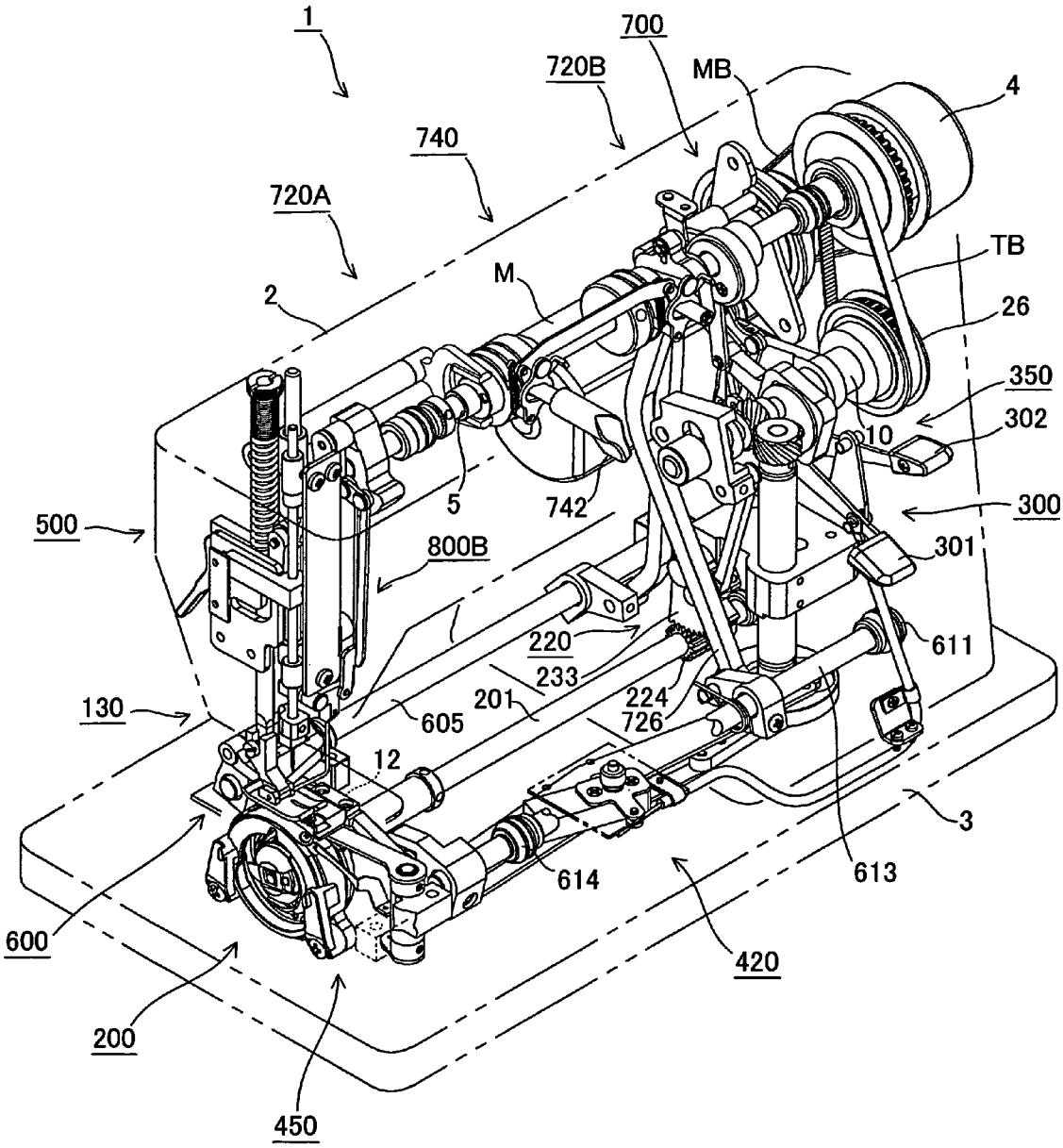
FIG. 53 An overall perspective view showing another preferable example of the mode of embodiment by the single-thread locked handstitch sewing machine of this invention.
Figure 54:
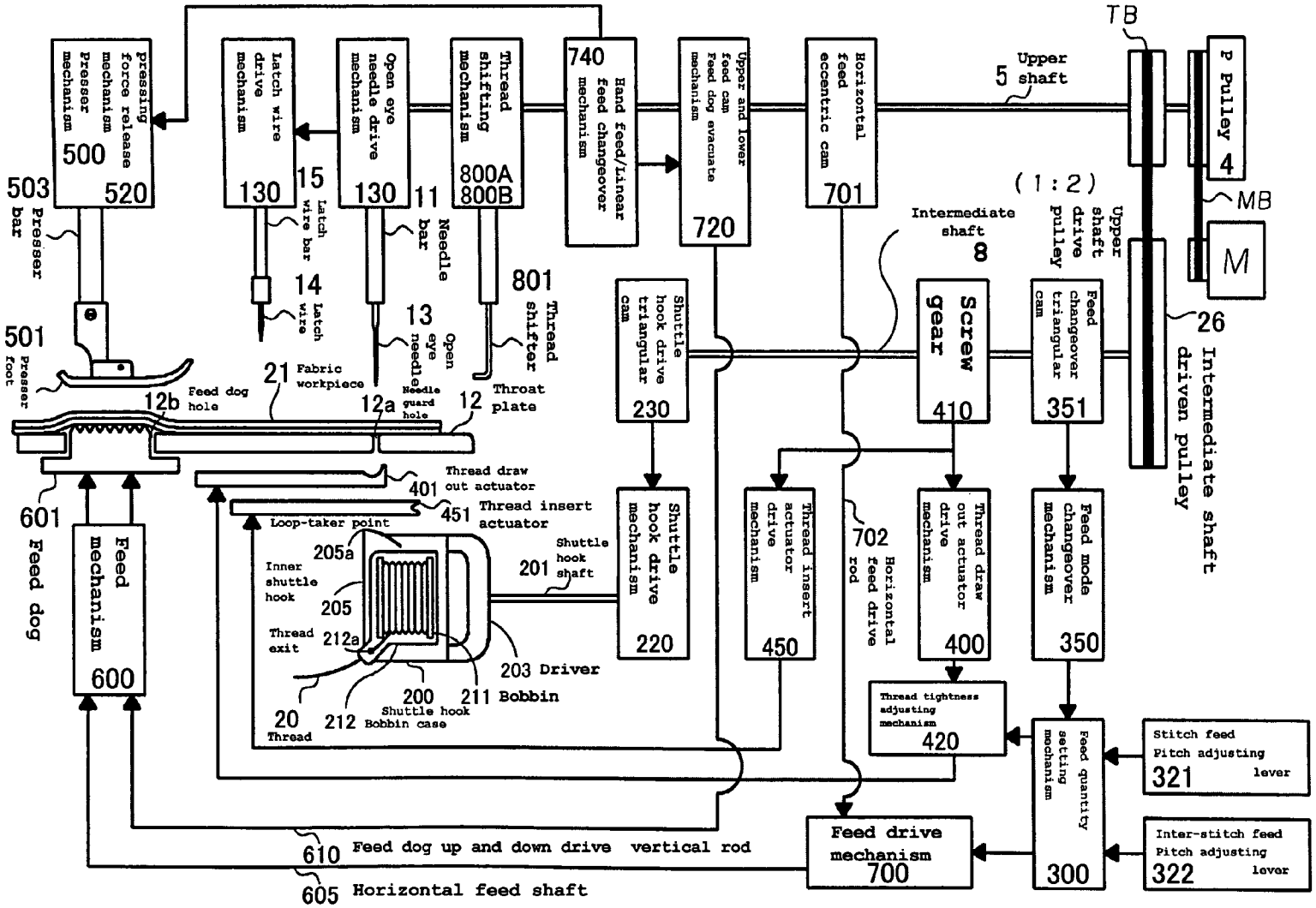
FIG. 54 A block diagram showing the drive system of the single-thread locked handstitch sewing machine of FIG. 53.

Next, the single-thread locked handstitch sewing machine for the free motion sewing which can perform the changeover of the hand feed/linear feed is explained based on mainly FIG. 53, FIG. 54, FIG. 18 (A)-(W), FIG. 52 (A), (C). FIG. 53 is the overall perspective view of the single-thread locked handstitch sewing machine for the free motion sewing. FIG. 54 is the block diagram showing the drive system of the single-thread locked handstitch sewing machine for the free motion sewing. FIG. 52 (C) is the motion diagram of the open eye needle 13, the shuttle hook 200, thread shifter 811 and the presser foot 501. FIG. 18 (A)-(W), FIG. 52 (A) are the same contents as the single-thread locked handstitch sewing machine for the free curve sewing. In the overall perspective view shown in FIG. 53, although the shape of the parts used in the feed drive mechanism 700, the feed quantity setting mechanism 300 and the feed mode changeover mechanism 350 is different from the above-mentioned overall perspective view shown in FIG. 1, the shape is just improved on the commercial production, and the constitution and the operation are same. Besides, the shuttle hook 200 except the inner shuttle hook 205, the presser mechanism 500, the cloth feed mechanism 600 and the thread draw out drive mechanism 400 have the same constitution and the operation. Therefore, the explanation is omitted by giving the same numerals. And, in this single-thread locked handstitch sewing machine for the free motion sewing, the thread shifting mechanism 800B and the hand feed/linear feed changeover mechanism 740 having the pressing force release mechanism 720A and the feed dog evacuate mechanism 720B are used.

Besides, as well as the single-thread locked handstitch sewing machine for the free curve sewing, the shuttle hook drive mechanism 220 is constituted so that the shuttle hook drive fan-shaped gear 233 shown in FIG. 50 and FIG. 51 engages at the lower direction of the shuttle hook shaft gear 224. And, because the shuttle hook drive fan-shaped gear 233 is fixed to the fan-shaped gear shaft 235, the shuttle hook drive vertical rod 228 shown in FIG. 50 and FIG. 51 becomes short than the shuttle hook drive vertical rod 228 shown in FIG. 14 and FIG. 15.

Further, as well as the single-thread locked handstitch sewing machine for the free curve sewing, the feed adjusting lever knob 323 is equipped to the portion which becomes the point of force of the stitch feed adjusting lever 301 and the inter-stitch feed adjusting lever 302.

In FIG. 53 and FIG. 54, when the driven pulley 4 which is driven by the motor M through the drive belt MB rotates clockwise by looking from the side of the open eye needle 13, the open eye needle-latch wire drive mechanism 130, the cloth feed drive mechanism 700, the shuttle hook drive mechanism 220, the thread draw out drive mechanism 400, the hand feed/linear feed changeover mechanism 740, the thread shifting mechanism 800B and the thread insert actuator drive mechanism 450 drive by the rotation of the upper shaft 5. When the open eye needle-latch wire drive mechanism 130 drives, it lets the open eye needle 13 perform the linear reciprocating motion vertically. When the shuttle hook drive mechanism 220 drives, it lets the inner shuttle hook 205 of the shuttle hook 200 perform the half-turn normal rotation and the half-turn reverse rotation. When the thread draw out drive mechanism 400 drives, it lets the thread draw out actuator 401 rock. When the hand feed/linear feed changeover mechanism 740 drives, it lets the pressing force of the presser foot 501 release only for the predetermined time every first stroke and second stroke of the open eye needle 13 and it lets the feed dog 601 evacuate always by letting the cloth feed drive mechanism 700 stop. When the thread shifting mechanism 800B drives, it lets the thread shifter 811 perform the elliptical motion in the neighborhood of the open eye needle 13 every first stroke and second stroke of the open eye needle 13. When the thread insert actuator drive mechanism 450 drives, it lets the thread insert actuator 451 perform the reciprocating motion every first stroke and second stroke of the open eye needle 13. The movement explanation of each mechanism is omitted because the above-mentioned composition explanation was performed in detail.

By following cooperation of the open eye needle 13, the shuttle hook 200, the thread draw out actuator 401, the feed dog 601, the presser foot 501, and the thread insert actuator 451 which operate as described above, the handstitch on the front surface and the locked stitch on the back surface of the fabric workpiece 21 are respectively formed by one sewing thread 20. In the case of the linear feed, the explanation is omitted because the sewing operation is the same as the above-mentioned single-thread locked handstitch sewing machine (FIG. 1 and FIG. 2).

When driving the sewing machine by changing over the changeover lever 542 to the rotating operation feed (free curve sewing), (a) When the open eye needle 13 which performs the linear reciprocating motion vertically comes down from the upper dead center (upper shaft 5: 0 degrees), and pierces the fabric workpiece 21 which is placed on the throat plate 12 (FIG. 18 (A)-(F), FIG. 52 (A)), and goes up from the lower dead center (upper shaft 5: 180 degrees) during the first stroke, the tightened sewing thread 20 which abuts circumferentially on the open eye needle 13 by being drawn out from the thread exit 212*a* of the shuttle hook 200 which performs the half-turn reverse rotation under the throat plate 12 by the thread draw out actuator 401 is captured by the thread capturing open eye 13*a* (FIG. 18 (G), FIG. 18 (H), FIG. 52 (A)). In this case, as shown in FIG. 20 (B), the thread exit 212*a* of the bobbin case 212 that the shuttle hook 200 has is equipped at the direction and the position away from the throat plate 12 by the reverse rotation of the inner shuttle hook 205 of the shuttle hook 200 when the open eye needle 13 goes up from the throat plate 12. Thereby, the sewing thread 20 which is drawn out by the thread draw out actuator 401 can abut circumferentially on the open eye needle 13. And, the sewing thread 20 which is drawn out from the thread exit 212*a* of the bobbin case 212 by the thread draw out actuator 401 and tightened by abutting circumferentially on the open eye needle 13 by deciding the position of the thread capturing open eye 13*a* of the open eye needle 13 is forcibly inserted to the thread capturing open eye 13*a* of the open eye needle 13 by letting the thread insert actuator 451 rock (FIG. 18 (F)-FIG. 18 (K), FIG. 44, FIG. 52 (C)). Besides, the shuttle hook 200 stops the rotation when the open eye needle 13 substantively moves from the upper dead center (upper shaft 5: 0 degrees) to the lower dead center (upper shaft 5: 180 degrees). As described above, the reason why the shuttle hook 200 stops the rotation is to get the timing that the shuttle hook which performs the half-turn normal rotation performs the half-turn reverse rotation during the second stroke in order to perform the thread guard of the sewing thread 20 to the thread capturing open eye 13*a* of the open eye needle 13 during the first stroke. Further, in the first stroke of the open eye needle 13, when the open eye needle 13 is slipping out from the fabric workpiece 21, the pressing force of the presser foot 501 is released and the feed dog 601 which feeds the fabric workpiece 21 is evacuated (FIG. 18 (J)-FIG. 18 (N), FIG. 52 (C)). Thereby, it is possible to perform the hand feed of the fabric workpiece 21 while giving the stitch length feed quantity and the inter-stitch pitch feed quantity arbitrarily in the first stroke of the open eye needle 13. The feed dog 601 lets the feed dog evacuate mechanism 720B evacuate always during the hand feed.

Besides, the shuttle hook 200 begins the half-turn reverse rotation after the open eye needle 13 sticks into the fabric workpiece 21 (upper shaft 5: 130 degrees), (FIG. 18 (E), FIG. 52 (A)). The thread draw out actuator 401 stops at the most advanced position before the open eye needle 13 sticks into the fabric workpiece 21 (upper shaft 5: 80 degrees), (FIG. 18 (D), FIG. 52 (A)). The latch wire 14 becomes open state when the open eye needle 13 sticks into the fabric workpiece 21 (FIG. 18 (E), FIG. 52 (A)).

(b) While the open eye needle 13 slips out from the fabric workpiece 21, and goes up, and passes through the upper dead center (upper shaft 5: 360 degrees) during the first stroke, the fabric workpiece 21 is fed with one stitch length by the feed dog 601. And, the open eye needle 13 which captures the sewing thread 20 goes up and the shuttle hook 200 performs further reverse rotation, thereby, the thread tightness is performed (FIG. 18 (I)-FIG. 18 (M), FIG. 52 (A)).

The shuttle hook 200 stops the half-turn reverse rotation (upper shaft 5: 367 degrees) after the open eye needle 13 passes through the upper dead center (upper shaft 5: 360 degrees), (FIG. 18 (M), FIG. 52 (A)). The thread draw out actuator 401 begins the rocking which backs away so that the sewing thread 20 can be reeled out when the open eye needle 13 reaches the lower dead center (upper shaft 5: 180 degrees), (FIG. 18 (F), FIG. 52 (A)). And the thread draw out actuator 401 stops the backward movement before the open eye needle 13 passes through the upper dead center (upper shaft 5: 360 degrees), (FIG. 18 (L), FIG. 52 (A)). When the open eye needle 13 moves from the lower dead center (upper shaft 5: 180 degrees) to the upper dead center (upper shaft 5: 360 degrees), the latch wire 14 makes the thread capturing open eye 13*a* of the open eye needle 13 the closed state after this open eye needle 13 passes through the throat plate 12, and the latch wire 14 passes through the fabric workpiece 21 together with the open eye needle 13 (FIG. 18 (J), FIG. 18 (K), FIG. 52 (A)). And, also in the first stroke of the open eye needle 13, as shown in FIG. 29, although the thread shifter 811 performs the elliptical motion of the motion trace 830 of only one rotation in the horizontal direction in the tip 811*a* (FIG. 18 (A)-FIG. 18 (M), FIG. 52 (C)), at this time, the sewing thread 20 is not captured by the thread capturing open eye 13*a* even if the open eye needle 13 comes down.

(c) During the second stroke, when the open eye needle 13 comes down from the upper dead center (upper shaft 5: 360 degrees), and pierces the fabric workpiece 21 (FIG. 18 (N), FIG. 18 (O), FIG. 52 (A)), and goes up from the lower dead center (upper shaft 5: 540 degrees), the open eye needle 13 scoops the sewing thread 20 which is captured by the thread capturing open eye 13*a* by the loop-taker point 205*a* of the shuttle hook 200, and the open eye needle 13 releases the captured sewing thread 20 by the rotation of the shuttle hook 200 from the thread capturing open eye 13*a* (FIG. 18 (P), FIG. 52 (A)). The rotation of the shuttle hook 200 stops when the open eye needle 13 substantively moves from the upper dead center (upper shaft 5: 360 degrees) to the lower dead center (upper shaft 5: 540 degrees). As described above, the reason why the shuttle hook 200 stops the rotation is to get the timing that the shuttle hook which performs the half-turn reverse rotation performs the half-turn normal rotation during the first stroke in order to release the sewing thread 20 which is hooked by the thread capturing open eye 13*a* of the open eye needle 13 from the thread capturing open eye 13*a* by the loop-taker point 205*a* during the second stroke.

The shuttle hook 200 begins the half-turn normal rotation when the open eye needle 13 reaches the lower dead center (upper shaft 5: 540 degrees), (FIG. 18 (P), FIG. 52 (A)). The thread draw out actuator 401 backs away after the open eye needle 13 sticks into the fabric workpiece 21, and begins the rocking so as to reel out the sewing thread 20 (FIG. 18 (N), FIG. 52 (A)). The latch wire 14 makes the thread capturing open eye 13*a* of the open eye needle 13 the open state when the open eye needle 13 comes down from the upper dead center and passes through the fabric workpiece 21 (FIG. 18 (O), FIG. 52 (A)).

Besides, in the second stroke of the open eye needle 13, as shown in FIG. 29, the thread shifter 811 performs the elliptical motion of the motion trace 830 of only one rotation in the horizontal direction in the tip 811*a* (FIG. 18 (M)-FIG. 18 (W), FIG. 52 (C)). In this case, when the open eye needle 13 comes down, because the sewing thread 20 which is captured by the thread capturing open eye 13*a* of the open eye needle 13 between the needlepoint of the open eye needle 13 and the fabric workpiece 21 becomes the slack state from the tight state and the thread slack occurs, the shifting of the sewing thread of this thread slack is performed to the unopened direction of the open eye needle 13 between the needlepoint of the open eye needle 13 and the fabric workpiece 21 (FIG. 18 (M), (N), FIG. 52 (C)). Concretely, as shown in FIG. 29, the elliptical motion of the motion trace 830 of the tip 811*a* of the thread shifter 811 becomes clockwise by looking from the upper side of the presser foot 501, and it is possible to hook the loop of the sewing thread 20 in the neighborhood of the position 830*a* which becomes the shifting point of the sewing thread of the motion trace 830 by shifting the sewing thread by the tip 811*a* of the thread shifter 811 to the unopened direction of the thread capturing open eye 13*a*. The position 830*b* of the motion trace 830 shown in FIG. 52 (C) is the position shown in FIG. 29.

Besides, in the second stroke of the open eye needle 13, when the open eye needle 13 is slipping out from the fabric workpiece 21, if the pressing force of the presser foot 501 is released, because the feed dog 601 which feeds the fabric workpiece 21 is evacuated (FIG. 18 (T)-FIG. 18 (E), FIG. 52 (C)), it is possible to perform the hand feed of the fabric workpiece 21 while giving the stitch length feed quantity and the inter-stitch pitch feed quantity arbitrarily in the second stroke of the open eye needle 13.

Besides, for example, in the case that the convex thread accumulating portion 205*g* is equipped at the inner shuttle hook 205 in the shuttle hook 200, even if the inner shuttle hook 205 becomes the position which performs the half-turn normal rotation as shown in FIG. 18 (U), as shown in FIG. 47, because the state that the convex thread accumulating portion 205*g* hooks the sewing thread 20 can be maintained, it is possible to accumulate the sewing thread which is guided into the shuttle hook 200 temporarily, thereafter, it is possible to release the temporary accumulation of the sewing thread by tightening the sewing thread which guides out from the shuttle hook 200 by the thread draw out actuator 401. Therefore, in the second stroke of the open eye needle 13, the tightened state of the sewing thread 20 which is guided into the gap $O_2$ which is formed between another end of the inner shuttle hook driver 203 that the inner shuttle hook driver spring 204 is fixed and the inner shuttle hook 205 can be maintained even if the inner shuttle hook 205 performs the half-turn normal rotation. And, the sewing thread 20 which is guided into the shuttle hook 200 and the sewing thread 20 which is guided out from the thread exit 212*a* can be captured without slacking the sewing thread by the tip grappling portion 401*a* of the thread draw out actuator 401.

Also in the second stroke of the open eye needle 13, although the thread insert actuator 451 rocks (FIG. 18 (O)-FIG. 18 (S), FIG. 52 (C)), at this time, the position of the sewing thread 20 is not decided at the thread capturing open eye 13*a* of the open eye needle 13.

(d) The sewing thread 20 which is scooped by the loop-taker point 205*a* of the shuttle hook 200 and is released is guided in the gap $O_2$ which is formed between another end of the inner shuttle hook driver 203 that the inner shuttle hook driver spring 204 of the shuttle hook 200 is fixed and the inner shuttle hook 205 by further rotation of the shuttle hook 200, and is interlaced to the sewing thread 20 which is wound in the shuttle hook 200. And the sewing thread 20 which is guided out from the gap $O_1$ which is formed between one end of the inner shuttle hook driver 203 that the inner shuttle hook driver spring 204 is fixed and the inner shuttle hook 205 is tightened by the thread draw out actuator 401 (FIG. 18 (Q)-FIG. 18 (W), FIG. 52 (A)).

The shuttle hook 200 stops the half-turn normal rotation by the time the open eye needle 13 slips out from the fabric workpiece 21 and reaches the upper dead center (upper shaft 5: 720 degrees), (FIG. 18 (V), FIG. 52 (A)). The thread draw out actuator 401 begins the rocking so that the sewing thread 20 can be tightened and can be advanced after the open eye needle 13 slips out from the fabric workpiece 21 (FIG. 18 (T), FIG. 52 (A)). The latch wire 14 makes the thread capturing open eye 13*a* of the open eye needle 13 the closed state when the open eye needle 13 goes up from the lower dead center and passes through the fabric workpiece 21 (FIG. 18 (T), FIG. 52 (A)).

(e) While the open eye needle 13 slips out from the fabric workpiece 21, and goes up and passes through the upper dead center (upper shaft 5: 720 degrees) during the second stroke, one inter-stitch pitch feed of the fabric workpiece 21 is performed (FIG. 18 (W), FIG. 52 (A)).

(f) The handstitch on the front surface and the locked stitch on the back surface of the fabric workpiece 21 are formed respectively by repeating the steps from (a) to (e).

Therefore, the sewing thread 20 is certainly captured to the thread capturing open eye 13*a* of the open eye needle 13, and the formation of single-thread locked stitch is performed in the inner space of the sewing machine bed, and the sewing which is suitable to the quasi-handstitch called pinpoint/saddle stitch is possible. And, because it is possible to vary the feed direction of the fabric workpiece 21 every one skip stitch set, the sewing which are suitable to the quilt, the quilting or the patchwork can be performed. Besides, because the handstitch on the front surface and the locked stitch on the back surface of the fabric workpiece 21 are formed respectively and the sewing-work is performed in the state that the handstitch can be seen on the surface for the worker, it is possible to confirm the position of the handstitch, thereby, the accurate sewing can be performed. In addition, because the handstitch on the front surface and the locked stitch on the back surface of the fabric workpiece 21 are formed respectively, the sewing thread 20 does not come loose easily even if the sewing thread 20 which forms single-thread locked stitch is hooked. Thereby, the firm sewing can be obtained.

Because the feed quantity setting mechanism 300 and the feed mode changeover mechanism 350 have the same constitution as the above-mentioned single-thread locked handstitch sewing machine, the explanation regarding the adjusting of the stitch length and the inter-stitch pitch is omitted.

Heretofore, the explanation was performed by the particular mode of embodiment shown in the drawing about this invention. However, this invention is not limited to the mode of embodiment shown in the drawing. And, any constitution which is known heretofore can be adopted obviously insofar as the effect of this invention is achieved.

The invention claimed is:

1. A method for forming single-thread locked handstitches, comprising the steps of (a) capturing a thread which is drawn out from a thread exit of a shuttle hook positioned under a throat plate, winding the thread and performing a half-turn reverse rotation, and which abuts circumferentially on an open eye needle and is tightened by a thread capturing open eye when the open eye needle which equips the thread capturing open eye laterally and performs a linear reciprocating motion vertically comes down from an upper dead center, pierces a fabric workpiece which is placed on the throat plate, and goes up from a lower dead center during a first stroke, (b) feeding one stitch length of said fabric workpiece, and tightening a thread by a rise of said open eye needle which captures said thread, and by performing a further reverse rotation of said shuttle hook while the open eye needle slips out from the fabric workpiece, goes up, and passes through the upper dead center during the first stroke, (c) scooping the thread which is captured by said thread capturing open eye by a loop-taker point of said shuttle hook which performs the half-turn normal rotation, and releasing the captured thread by the rotation of said shuttle hook from said thread capturing open eye when said open eye needle comes down from the upper dead center, pierces said fabric workpiece, and goes up from the lower dead center during a second stroke, (d) guiding in the thread which is scooped by the loop-taker point of said shuttle hook and released by the further rotation of said shuttle hook into said shuttle hook, interlacing the thread to the thread which is wound in said shuttle hook, and tightening the thread which guides out from said shuttle hook, (e) feeding one inter-stitch pitch of said fabric workpiece while the open eye needle slips out from the fabric workpiece, goes up, and passes through the upper dead center during the second stroke, and (f) forming a handstitch on a front surface and a locked stitch on a back surface of said fabric workpiece by repeating the steps from said (a) to said (e).

2. The method for forming single-thread locked handstitches according to claim 1, wherein said shuttle hook incorporates a bobbin case which houses a bobbin that the thread is wound in an inner shuttle hook, said bobbin case is rotatably loaded together with the inner shuttle hook in an shuttle race body, and said thread exit is equipped in said bobbin case in the direction and the position which depart from said throat plate by reverse rotation of said shuttle hook when said open eye needle goes up from said throat plate.

3. The method for forming single-thread locked handstitches according to claim 1, wherein said shuttle hook stops the rotation when said open eye needle moves from the upper dead center to the lower dead center.

4. The method for forming single-thread locked handstitches according to claim 1, wherein the thread which is drawn out from the thread exit of said shuttle hook is hooked, and is tightened by being drawn out from said shuttle hook after the thread captured by said thread capturing open eye is scooped by the look-taker point of said shuttle hook, and the thread which is hooked is released after said thread is captured by said thread capturing open eye.

5. The method for forming single-thread locked handstitches according to claim 1, wherein the thread captured by said thread capturing open eye is shifted to the unopened direction of said thread capturing open eye between the tip of said open eye needle and said fabric workpiece when said open eye needle comes down from said upper dead center during the second stroke.

6. The method for forming single-thread locked handstitches according to claim 1, wherein the thread tightness quantity is adjusted depending on said stitch length when tightening the thread which guides out from said shuttle hook.

7. The method for forming single-thread locked handstitches according to claim 1, wherein before said open eye needle comes down from said upper dead center, pierces said fabric workpiece, goes up from the lower dead center and slips out from said fabric workpiece, a pressing force which performs the pressing force of said fabric workpiece on the throat plate is released, and a rotating operation by hand of the feed direction of the fabric workpiece is performed by making said open eye needle the rotating shaft.

8. The method for forming single-thread locked handstitches according to claim 1, wherein the thread which is scooped by the loop-taker point of said shuttle hook and released interlaces to the thread which is wound in the shuttle hook by guiding in said shuttle hook by the further rotation of said shuttle hook, and the thread which is guided in said shuttle hook is accumulated temporarily in the circumference of said shuttle hook after interlacing and before the thread which guides out from said shuttle hook is tightened, and the temporary accumulation is released by tightening the thread which guides out from said shuttle hook.

9. A method for forming single-thread locked handstitches, comprising the steps of:

forming a handstitch on a front surface and a locked stitch on a back surface of a fabric workpiece as a skip stitch set by cooperation of an open eye needle, a shuttle hook and a thread draw out actuator, setting up a stitch length feed quantity of a stitch length feed and an inter-stitch pitch feed quantity of an inter-stitch pitch feed respectively, when the stitch length feed of said fabric workpiece for said handstitch is performed by a feed dog during a first stroke of said open eye needle, and the inter-stitch pitch feed of said fabric workpiece for the inter-handstitch is performed by the feed dog during a second stroke of said open eye needle, changing over to each fabric workpiece feed mode corresponding to said stitch length feed and said inter-stitch pitch feed respectively every one skip stitch set in sequence, transmitting said set stitch length feed quantity and inter-stitch pitch feed quantity to a feed drive mechanism in each fabric workpiece feed mode respectively, and feeding said fabric workpiece by said feed dog.

10. The method for forming single-thread locked handstitches according to claim 9, wherein a hand feed of said fabric workpiece is performed while giving said stitch length feed quantity and said inter-stitch pitch feed quantity arbitrarily by releasing a pressing force that the pressing force of said fabric workpiece is kept on the throat plate when said open eye needle is slipping out from said fabric workpiece.

11. The method for forming single-thread locked handstitches according to claim 9, wherein a hand feed of said fabric workpiece is performed while giving said stitch length feed quantity and said inter-stitch pitch feed quantity arbitrarily by evacuating said feed dog which feeds said fabric workpiece when said open eye needle is slipping out from said fabric workpiece.

12. A single-thread locked handstitch sewing machine, comprising:

an open eye needle, which captures a thread when coming down from an upper dead center, piercing a fabric workpiece, and going up from a lower dead center during a first stroke of coming down from the upper dead center, piercing the fabric workpiece which is placed on a throat plate, slipping out from said fabric workpiece from the lower dead center, going up, and performing a linear reciprocating motion vertically, and equips laterally a thread capturing open eye which releases the captured thread when coming down from an upper dead center, piercing a fabric workpiece, and going up from a lower dead center during a second stroke, a shuttle hook, which is a shuttle hook positioned in a lower direction of said throat plate, and that a thread is wound, and said thread is drawn out from a thread exit, and said shuttle hook performs a half-turn reverse rotation when said open eye needle comes down from said upper dead center, piercing said fabric workpiece and going up from said lower dead center during a first stroke, and that said thread is tightened by a further reverse rotation along with a rising of said open eye needle which captured the thread by said thread capturing open eye, and which has a loop-taker point for scooping the thread which is captured by said thread capturing open eye by a half-turn normal rotation of said shuttle hook, and that the captured thread is released from said thread capturing open eye by scooping by the loop-taker point of said shuttle hook by the rotation of said shuttle hook, and the released thread is guided in said shuttle hook by the further rotation of said shuttle hook and is interlaced to the thread which is wound in said shuttle hook when said open eye needle comes down from the upper dead center, pierces said fabric workpiece, and goes up from the lower dead center during the second stroke, a thread draw out actuator, which tightens the thread which is drawn out from said thread exit by abutting circumferentially on said open eye needle by rotation of said shuttle hook when said thread capturing open eye captures said thread, and tightens the thread which guides out from said shuttle hook, and a feed dog, which feeds said fabric workpiece with one stitch length while said open eye needle slips out from said fabric workpiece, goes up, and passes through the upper dead center during said first stroke, and feeds said fabric workpiece with one inter-stitch pitch while said open eye needle slips out from said fabric workpiece, goes up, and passes through the upper dead center during the second stroke, wherein a handstitch on a front surface and a locked stitch on a back surface of said fabric workpiece are formed respectively.

13. The single-thread locked handstitch sewing machine according to claim 12, wherein said shuttle hook incorporates a bobbin case which houses a bobbin that the thread is wound in an inner shuttle hook, said bobbin case is rotatably loaded together with the inner shuttle hook in an shuttle race body, said thread exit is equipped in said bobbin case in the direction and the position which depart from said throat plate by reverse rotation of said shuttle hook when said open eye needle goes up from said throat plate.

14. The single-thread locked handstitch sewing machine according to claim 12, wherein said shuttle hook has a period of a stop of a rotation when said open eye needle moves from the upper dead center to the lower dead center.

15. The single-thread locked handstitch sewing machine according to claim 12, wherein said thread draw out actuator has functions for hooking the thread drawn out from the thread exit of said shuttle hook, tightening the thread by drawing out the thread from said shuttle hook after scooping the thread captured by said capturing open eye by the loop-taker point of said shuttle hook, and releasing the thread which is hooked after capturing the thread by said thread capturing open eye.

16. The single-thread locked handstitch sewing machine according to claim 12, wherein a thread shifting mechanism which shifts the thread captured by said thread capturing open eye between a needlepoint of said open eye needle and said fabric workpiece when said open eye needle comes down from said upper dead center during said second stroke is equipped.

17. The single-thread locked handstitch sewing machine according to claim 12, wherein a thread tightness adjusting mechanism which adjusts a thread tightness quantity of said thread draw out actuator depending on said stitch length which is set by a feed quantity setting mechanism is equipped.

18. The single-thread locked handstitch sewing machine according to claim 12, wherein a presser foot which performs the pressing force of said fabric workpiece on the throat plate is equipped, and a pressing force release mechanism that the hand feed of said fabric workpiece is performed while giving said stitch length feed quantity and said inter-stitch pitch feed quantity arbitrarily by releasing the pressing force of said presser foot when said open eye needle is slipping out from said fabric workpiece is equipped.

19. The single-thread locked handstitch sewing machine according to claim 18, wherein a feed dog evacuate mechanism that the hand feed of said fabric workpiece is performed while giving said stitch length feed quantity and said inter-stitch pitch feed quantity arbitrarily by evacuating said feed dog which feeds said fabric workpiece when said open eye needle is slipping out from said fabric workpiece is equipped.

20. The single-thread locked handstitch sewing machine according to claim 12, wherein before said open eye needle comes down from said upper dead center, pierces said fabric workpiece, goes up from the lower dead center and slips out from said fabric workpiece, a rotating operation/linear feed changeover mechanism for performing a rotating operation by hand of the feed direction of the fabric workpiece by making said open eye needle the rotating shaft by releasing a pressing force which performs the pressing force of said fabric workpiece on the throat plate is equipped.

21. The single-thread locked handstitch sewing machine according to claim 13, wherein a needle guard for correcting an irregular motion which occurs by piercing said fabric workpiece by said open eye needle to the needle dropping position after said open eye needle pierced said fabric workpiece is equipped in a driver which drives the inner shuttle hook so as to perform the half-turn normal rotation and the half-turn reverse rotation.

22. The single-thread locked handstitch sewing machine according to claim 12, wherein a thread insert actuator which inserts forcibly the thread, which is drawn out from said thread exit and decided the position at said thread capturing open eye by said thread draw out actuator and tightened by abutting circumferentially on said open eye needle, into said thread capturing open eye is equipped.

23. The single-thread locked handstitch sewing machine according to claim 12, wherein an open eye needle-latch wire drive mechanism for driving a latch wire which closes said thread capturing open eye is equipped in the period that said thread capturing open eye of said open eye needle comes down from said upper dead center, pierces said fabric workpiece, and passes through said throat plate, and in the period that said thread capturing open eye passes through said throat plate, slips out from said fabric workpiece, and reaches said upper dead center after said thread capturing open eye goes up from said lower dead center and captures said thread.

24. The single-thread locked handstitch sewing machine according to claim 12, wherein the thread which is scooped by the loop-taker point of said shuttle hook and released interlaces to the thread which is wound in the shuttle hook by guiding in said shuttle hook by the further rotation of said shuttle hook, and a thread accumulating portion that the thread which is guided in said shuttle hook is accumulated temporarily after interlacing and before the thread which guides out from said shuttle hook is tightened, and said temporary accumulation is released by tightening the thread which guides out from said shuttle hook is equipped in the part of the circumference of said shuttle hook.

25. A single-thread locked handstitch sewing machine which forms a handstitch on a front surface and a locked stitch on a back surface of a fabric workpiece as a skip stitch set by cooperation of an open eye needle, a shuttle hook and a thread draw out actuator, and performs a stitch length feed of said fabric workpiece for said handstitch by a feed dog during a first stroke of said open eye needle and performs an inter-stitch pitch feed of said fabric workpiece for said inter-handstitch by said feed dog during a second stroke, comprising:

a feed quantity setting mechanism which sets up a stitch length feed quantity of said stitch length feed and an inter-stitch pitch feed quantity of an inter-stitch pitch feed respectively, a feed mode changeover mechanism which changes over to each fabric workpiece feed mode corresponding to said stitch length feed and said inter-stitch pitch feed respectively every one skip stitch set in sequence, and a feed drive mechanism which transmits said set stitch length feed quantity and inter-stitch pitch feed quantity in each fabric workpiece feed mode respectively, and feeds said fabric workpiece by said feed dog.

26. The single-thread locked handstitch sewing machine according to claim 25, wherein said feed quantity setting mechanism consists of a reverse T-shaped feed adjuster which is pivotally attached to a supporting arm which is pivotally supported to an intermediate shaft that one-half is decelerated from an upper shaft which drives said open eye needle, and a stitch length feed quantity operating member and an inter-stitch pitch feed quantity operating member are pivotally attached to both arms of said reverse T-shaped feed adjuster respectively.

27. The single-thread locked handstitch sewing machine according to claim 25, wherein said feed mode changeover mechanism consists of a feed changeover triangular cam which is firmly fixed to said intermediate shaft and has two even-numbered deviating points and a feed changeover rod which contacts to the outside of said feed changeover triangular cam, and a connecting end of said feed changeover rod is pivotally attached to one end of a stitch length changeover link, and another end is pivotally attached to a vertical arm end of said reverse T-shaped feed adjuster.

28. The single-thread locked handstitch sewing machine according to claim 27, wherein said feed drive mechanism consists of a horizontal feed connection link whose one end is pivotally attached to the connecting end of said feed changeover rod, a horizontal feed connection crank whose first arm is pivotally attached to another end of said horizontal feed connection link, a horizontal feed rod link whose one end is pivotally attached to a second arm of said horizontal feed connection crank and another end is pivotally attached to a horizontal feed vertical rod, a horizontal feed eccentric cam which is firmly fixed to said upper shaft, and a horizontal feed drive rod which is pivotally attached to another end of said horizontal feed rod link and contacts to the outside of said horizontal feed eccentric cam.

* * * * *